US008273509B2

(12) United States Patent
Nagao et al.

(10) Patent No.: US 8,273,509 B2
(45) Date of Patent: Sep. 25, 2012

(54) ELECTROPHOTOGRAPHIC PHOTORECEPTOR, AND IMAGE FORMING DEVICE AND ELECTROPHOTOGRAPHIC PHOTORECEPTOR CARTRIDGE USING THE SAME MEMBER CARTRIDGE

(75) Inventors: Yuka Nagao, Yokohama (JP); Tadashi Mizushima, Yokohama (JP); Masami Tsurumori, Yokohama (JP); Tomoko Nakagawa, Yokohama (JP); Hiroaki Takamura, Odawara (JP); Shunichirou Kurihara, Odawara (JP); Tooru Uenaka, Odawara (JP); Masayuki Hiroi, Odawara (JP)

(73) Assignee: Mitsubishi Chemical Corporation, Tokyo (JP)

( * ) Notice: Subject to any disclaimer, the term of this patent is extended or adjusted under 35 U.S.C. 154(b) by 999 days.

(21) Appl. No.: 12/160,052

(22) PCT Filed: Jan. 9, 2007

(86) PCT No.: PCT/JP2007/050075

§ 371 (c)(1),
(2), (4) Date: Sep. 9, 2008

(87) PCT Pub. No.: WO2007/078006

PCT Pub. Date: Jul. 12, 2007

(65) Prior Publication Data

US 2009/0232551 A1 Sep. 17, 2009

(30) Foreign Application Priority Data

| | | |
|---|---|---|
| Jan. 6, 2006 | (JP) | 2006-001041 |
| Jan. 13, 2006 | (JP) | 2006-006647 |
| Jan. 13, 2006 | (JP) | 2006-006686 |
| Jan. 13, 2006 | (JP) | 2006-006687 |
| Jan. 13, 2006 | (JP) | 2006-006688 |
| Jan. 13, 2006 | (JP) | 2006-006689 |
| Jan. 13, 2006 | (JP) | 2006-006690 |

(51) Int. Cl.
*G03G 15/00* (2006.01)

(52) U.S. Cl. ..... 430/56; 430/58.05; 430/58.7; 399/159

(58) Field of Classification Search ..... 430/56, 430/58.05, 58.4, 58.7, 58.75, 58.8, 59.1; 399/159
See application file for complete search history.

(56) References Cited

U.S. PATENT DOCUMENTS 5,378,567 A 1/1995 Nozomi et al.

(Continued)

FOREIGN PATENT DOCUMENTS

EP 0 002 238 B1 6/1979

(Continued)

OTHER PUBLICATIONS

English Translation of JP-2001265022.*

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

To realize an electrophotographic photoreceptor excellent in abrasion resistance, the photosensitive layer of the photoreceptor comprises a polyester resin containing a repeating structural unit represented by the formula (1) and a hydrazone compound.

(1)

(In the formula (1), $Ar^1$ to $Ar^4$ each represents, independently of each other, an arylene group which may have a substituent. $X^1$ represents a bivalent group (including a single bond) and $X^2$ represents a bivalent group (including a single bond) with 3 or less atoms.)

33 Claims, 3 Drawing Sheets

U.S. PATENT DOCUMENTS

| | | | | |
|---|---|---|---|---|
| 2004/0101771 | A1 | 5/2004 | Azuma et al. | |
| 2006/0115760 | A1 | 6/2006 | Mitsuhashi et al. | |
| 2008/0063963 | A1 * | 3/2008 | Tajima et al. | 430/69 |

FOREIGN PATENT DOCUMENTS

| | | | |
|---|---|---|---|
| JP | 50 98332 | | 8/1975 |
| JP | 54-83837 | | 7/1979 |
| JP | 56 135844 | | 10/1981 |
| JP | 57-122444 | | 7/1982 |
| JP | 59 71057 | | 4/1984 |
| JP | 59 184251 | | 10/1984 |
| JP | 3 6567 | | 1/1991 |
| JP | 05107778 | A * | 4/1993 |
| JP | 5 346671 | | 12/1993 |
| JP | 9-22126 | | 1/1997 |
| JP | 9-151245 | | 6/1997 |
| JP | 10 20514 | | 1/1998 |
| JP | 10 20521 | | 1/1998 |
| JP | 10 20533 | | 1/1998 |
| JP | 10 39532 | | 2/1998 |
| JP | 10 288845 | | 10/1998 |
| JP | 2000-112153 | | 4/2000 |
| JP | 2001-166508 | | 6/2001 |
| JP | 2001 265021 | | 9/2001 |
| JP | 2001 265022 | | 9/2001 |
| JP | 2001265022 | A * | 9/2001 |
| JP | 2002-236383 | | 8/2002 |
| JP | 2003 337435 | | 11/2003 |
| JP | 2004 13068 | | 1/2004 |
| JP | 2004-18600 | | 1/2004 |
| JP | 2004 45517 | | 2/2004 |
| JP | 2004 117991 | | 4/2004 |
| JP | 2004 177703 | | 6/2004 |
| JP | 2005 49862 | | 2/2005 |
| JP | 2005 215572 | | 8/2005 |
| JP | 2005-265935 | | 9/2005 |
| JP | 2005-274745 | | 10/2005 |
| JP | 2005-338349 | | 12/2005 |
| JP | 2006-003499 | | 1/2006 |
| JP | 2006-119217 | | 5/2006 |
| JP | 2007-72277 | | 3/2007 |
| JP | 2007-79554 | | 3/2007 |
| JP | 2007-79555 | | 3/2007 |
| JP | 2007-108239 | | 4/2007 |
| JP | 2007-108240 | | 4/2007 |
| JP | 2007-192903 | | 8/2007 |
| JP | 2007-193309 | | 8/2007 |
| JP | 2007-199659 | | 8/2007 |
| JP | 2007-199686 | | 8/2007 |
| JP | 2007-199688 | | 8/2007 |
| JP | 2008-33145 | | 2/2008 |
| WO | WO 2006009126 | A1 * | 1/2006 |

OTHER PUBLICATIONS

English Translation of JP-05107778.*

Office Action issued Oct. 11, 2011, in Japanese Patent Application No. 2007-005432 (with English translation).

Office Action issued Jul. 12, 2011, in Japanese Patent Application No. 2007-005430 with English translation.

Office Action issued Jul. 12, 2011, in Japanese Patent Application No. 2007-005431 with English translation.

Office Action issued Jul. 12, 2011, in Japanese Patent Application No. 2007-005432 with English translation.

Office Action issued Jul. 12, 2011, in Japanese Patent Application No. 2007-005433 with English translation.

U.S. Appl. No. 13/155,660, filed Jun. 8, 2011, Takamura.

Office Action issued May 31, 2011 in Japanese Paten Application No. 2007-005434 (with English translation).

Office Action issued May 31, 2011 in Japanese Paten Application No. 2007-005435 (with English translation).

U.S. Appl. No. 13/149,215, filed May 31, 2011, Takamura.

* cited by examiner

ELECTROPHOTOGRAPHIC PHOTORECEPTOR, AND IMAGE FORMING DEVICE AND ELECTROPHOTOGRAPHIC PHOTORECEPTOR CARTRIDGE USING THE SAME MEMBER CARTRIDGE

TECHNICAL FIELD

The present invention relates to an electrophotographic photoreceptor used for copying machines, printers or the like. Particularly, it relates to an electrophotographic photoreceptor having excellent durability and also relates to an image forming device and an electrophotographic photoreceptor cartridge using the same.

BACKGROUND ART

An electrophotographic technology has been widely used in the field of copying machines and various printers because of its immediacy nature and high quality image.

Regarding an electrophotographic photoreceptor (hereinafter referred to as "photoreceptor", as appropriate) which is the core of the electrophotographic technology, a photoreceptor based on an organic photoconductive material has been used because of its advantages such as no potential for pollution, easy formation of films and easy method of production.

As photoreceptors based on an organic photoconductive material are known a so-called monolayer type photoreceptor, in which a photoconductive fine powder is dispersed in a binder resin, and a lamination type photoreceptor, in which a charge generation layer and a charge transport layer are laminated. Lamination type photoreceptors have predominantly been developed and put to practical use, because high sensitivity photoreceptors can be obtained by combining a high efficiency charge generation material and a high efficiency charge transport material, the material can be selected from a wide range of materials enabling the realization of a safe photoreceptor, and a photosensitive layer can be formed easily by coating resulting in high productivity and low cost.

An electrophotographic photoreceptor is repeatedly used in an electrophotographic process such as charging, exposure, development, transfer, cleaning and charge removal, and therefore subjected to various stresses leading to deterioration. Such chemical and electrical deterioration includes: chemical damage caused to the photosensitive layer by strongly oxidizing ozone or NOx generated by a corona charger used as a charger; disruption of photosensitive layer composition by a carrier which is generated by image-exposing light or charge-removing light and which flows through the photosensitive layer, or by light from outside.

As another kind of deterioration, the following can be cited: mechanical deterioration on the surface of the photosensitive layer such as abrasion, flaw or peeling off of the film caused by rubbing with a cleaning blade or magnetic brush, or contact with a developer agent, transfer part member or paper. Such damage on the surface of the photosensitive layer tends to become apparent on the image, impairing the image quality directly, and this is an important factor in determining the life span of the photosensitive receptor. Therefore, in order to develop a long-life photoreceptor, improvement in mechanical strength as well as electrical and chemical durability is desired.

In the case of a general photoreceptor having no functional layer such as surface protective layer, it is a photosensitive layer which is exposed to such a load. A photosensitive layer usually consists of a binder resin and a photoconductive material. It is the binder resin which substantially determines its strength. However, as the amount of the photoconductive material to be doped is considerably large, sufficient mechanical strength has not been secured by the previously known technique.

As a binder resin of the photosensitive layer, the following can be used: thermoplastic resins and various thermosetting resins including polymethylmethacrylate, polystyrene, vinyl polymer such as polyvinyl chloride, their copolymers, polycarbonate, polyester, polysulfone, phenoxy, epoxy and silicone resins. Of these binder resins, polycarbonate resin is comparatively superior in performance and various kinds of polycarbonate resins have been developed and put to practical use (for example, refer to Patent Documents 1 to 4).

On the other hand, a technology on an electrophotographic photoreceptor has been disclosed in which a polyarylate resin, commercially available under the trade name of "U-polymer", is used as a binder resin, wherein sensitivity has been claimed to be excellent in comparison with a polycarbonate resin (for example, refer to Patent Document 5).

Further, a technology has been disclosed in which a polyarylate resin, based on a bivalent phenol component of specific structure, is used as a binder resin, wherein solution stability at the time of production of the photoreceptor is known to be improved, and its mechanical strength, especially abrasion resistance, is known to be excellent. (For example, refer to Patent Documents 6 and 7).

[Patent Document 1] Japanese Patent Laid-Open Publication No. Sho 50-98332

[Patent Document 2] Japanese Patent Laid-Open Publication No. Sho 59-71057

[Patent Document 3] Japanese Patent Laid-Open Publication No. Sho 59-184251

[Patent Document 4] Japanese Patent Application No. Hei 5-21478

[Patent Document 5] Japanese Patent Laid-Open Publication No. Sho 56-135844

[Patent Document 6] Japanese Patent Laid-Open Publication No. Hei 3-6567

[Patent Document 7] Japanese Patent Laid-Open Publication No. Hei 10-288845

DISCLOSURE OF THE INVENTION

Problem to be Solved by the Invention

However, a photoreceptor based on a previously known technology is liable to undergo abrasion or flaw of its surface during its practical use, which is caused by friction due to the developing using a toner, transfer part member, paper, cleaning member (blade) or the like. Therefore, its print performance has been limited from a practical standpoint.

The present invention was made to solve these problems. Namely, the purpose of the present invention is to provide an electrophotographic photoreceptor excellent in abrasion resistance, and an image forming device and electrophotographic photoreceptor cartridge using the electrophotographic photoreceptor.

Means for Solving the Problem

The present inventors found that superior mechanical durability can be obtained by incorporating a polyester resin containing a specific repeating structure in the photosensitive layer, which led to the completion of the present invention.

Namely, the subject matter of the present invention lies in an electrophotographic photoreceptor comprising at least a photosensitive layer on an electroconductive support, wherein said photosensitive layer has a polyester resin containing a repeating structural unit represented by the formula (1) below and a hydrazone compound (claim 1).

[Chemical Formula 1]

(1)

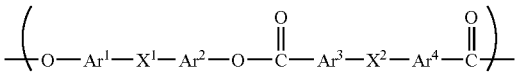

(In the formula (1), $Ar^1$ to $Ar^4$ each represents, independently of each other, an arylene group which may have a substituent. $X^1$ represents a bivalent group (including a single bond) and $X^2$ represents a bivalent group (including a single bond) with 3 or less atoms.)

Another subject matter of the present invention lies in an electrophotographic photoreceptor comprising at least a photosensitive layer on an electroconductive support, wherein said photosensitive layer has a polyester resin containing a repeating structural unit represented by the above formula (1) and a charge transport material, and said charge transport material comprises only a charge transport material containing substantially no unsaturated bond other than aromatic ring (claim 2).

Still another subject matter of the present invention lies in an electrophotographic photoreceptor comprising at least a photosensitive layer on an electroconductive support, wherein said photosensitive layer has a polyester resin containing a repeating structural unit represented by the above formula (1) and a diamine compound represented by the following formula (2) below (claim 3).

[Chemical Formula 2]

(2)

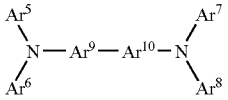

(In the formula (2), $Ar^5$ to $Ar^8$ each represents, independently of each other, an aryl group which may have a substituent with 8 or less carbon atoms. $Ar^9$ and $Ar^{10}$ each represents, independently of each other, an arylene group which may have a substituent.)

Still another subject matter of the present invention lies in an electrophotographic photoreceptor comprising at least a photosensitive layer on an electroconductive support, wherein said photosensitive layer has a polyester resin containing a repeating structural unit represented by the above formula (1) and an antioxidant (claim 4).

In this case, it is preferable that said antioxidant is a phenolic antioxidant (claim 5).

Still another subject matter of the present invention lies in an electrophotographic photoreceptor comprising at least a photosensitive layer on an electroconductive support, wherein said photosensitive layer has a polyester resin (hereinafter referred to as "first resin") containing a repeating structural unit represented by the above formula (1) and at least one another resin (hereinafter referred to as "second resin") selected from the group consisting of polyester resin, having a different structure from said first resin, and polycarbonate resin, and at least either said first resin or said second resin contains a repeating structural unit represented by the formula (3) below (claim 6).

[Chemical Formula 3]

(3)

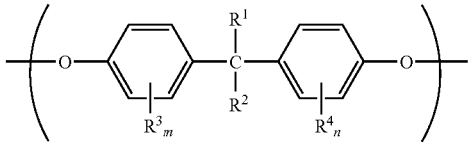

(In the formula (3), $R^1$ and $R^2$ each represents, independently of each other, a hydrogen atom or an alkyl group, $R^3$ and $R^4$ each represents, independently of each other, an alkyl group, and m and n each represents, independently of each other, an integer selected from 1 to 4.)

In this case, it is preferable that said second resin is polycarbonate resin (claims 7 and 10).

Further, it is preferable that the repeating structural unit represented by the formula (3) is a unit represented by the formula (3') below (claim 8).

[Chemical Formula 4]

(3')

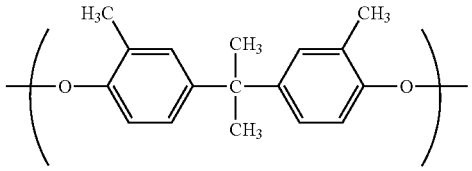

Further, it is preferable that the weight ratio of the repeating structural unit represented by the formula (3') in the total weight of said first resin and said second resin is 1 weight % or more and 45 weight % or less (claim 9).

Further, it is preferable that the weight ratio of the repeating structural unit represented by the formula (3") below, contained in said polycarbonate resin, is 70 weight % or more of said polycarbonate resin (claim 11).

[Chemical Formula 5]

(3")

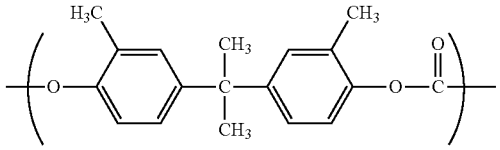

Still another subject matter of the present invention lies in an electrophotographic photoreceptor of positive charge type comprising a monolayer type photosensitive layer on an electroconductive support, wherein said monolayer type photosensitive layer has a polyester resin containing a repeating structural unit represented by the above formula (1) (claim 12).

Still another subject matter of the present invention lies in an electrophotographic photoreceptor cartridge comprising: an above-mentioned electrophotographic photoreceptor and at least one part selected from a charging part for charging said electrophotographic photoreceptor, an exposure part for exposing said charged electrophotographic photoreceptor to form an electrostatic latent image thereon, and a developing part for developing the electrostatic latent image formed on said electrophotographic photoreceptor (claim 13).

Still another subject matter of the present invention lies in an image forming device comprising: an above-mentioned electrophotographic photoreceptor, a charging part for charging said electrophotographic photoreceptor, an exposure part for exposing said charged electrophotographic photoreceptor to form an electrostatic latent image thereon, a developing part for developing the electrostatic latent image with toner, and a transfer part for transferring the toner to a transfer target (claim 14).

Still another subject matter of the present invention lies in an image forming device comprising at least an electrophotographic photoreceptor and a toner, wherein the photosensitive layer of said electrophotographic photoreceptor has a polyester resin containing a repeating structural unit represented by the above formula (1), and the average degree of circularity of said toner, measured by a flow particle image analyzer, is 0.940 or larger and 1.000 or smaller (claim 15).

In this case, it is preferable that said toner is produced in an aqueous medium (claim 16).

Further, it is preferable that said toner has a resin-coating layer (claim 17).

Further, it is preferable that said toner contains polysiloxane wax in said resin-coating layer (claim 18).

Further, it is preferable that said toner contains a paraffin wax (claim 19).

Still another subject matter of the present invention lies in an electrophotographic photoreceptor used in an image forming device of which exposure part for forming an electrostatic latent image emits a monochromatic light having an exposure wavelength of 380 nm to 500 nm, wherein the photosensitive layer has a polyester resin containing a repeating structural unit represented by the above formula (1) (claim 20).

Still another subject matter of the present invention lies in an electrophotographic photoreceptor comprising at least a photosensitive layer having a charge transport layer on an electroconductive support, said photosensitive layer, wherein said charge transport layer has a transmittance of 70% or larger with respect to the wavelength region of 400 nm to 500 nm, and said charge transport layer has a polyester resin (claim 21).

In this case, it is preferable that said polyester resin contains a repeating structural unit represented by the above formula (1) (claim 22).

Still another subject matter of the present invention lies in an image forming device comprising: an above-mentioned electrophotographic photoreceptor, a charging part for charging said electrophotographic photoreceptor, an exposure part for exposing said charged electrophotographic photoreceptor with a monochromatic light having an exposure wavelength of 380 nm to 500 nm to form an electrostatic latent image thereon, and a developing part for developing the electrostatic latent image formed on said electrophotographic photoreceptor (claim 23).

Advantageous Effect of the Invention

According to the present invention, it is possible to provide an electrophotographic photoreceptor excellent in abrasion resistance, and an image forming device and electrophotographic photoreceptor cartridge using the electrophotographic photoreceptor.

EXPLANATION OF LETTERS OR NUMERALS

Figure 1:
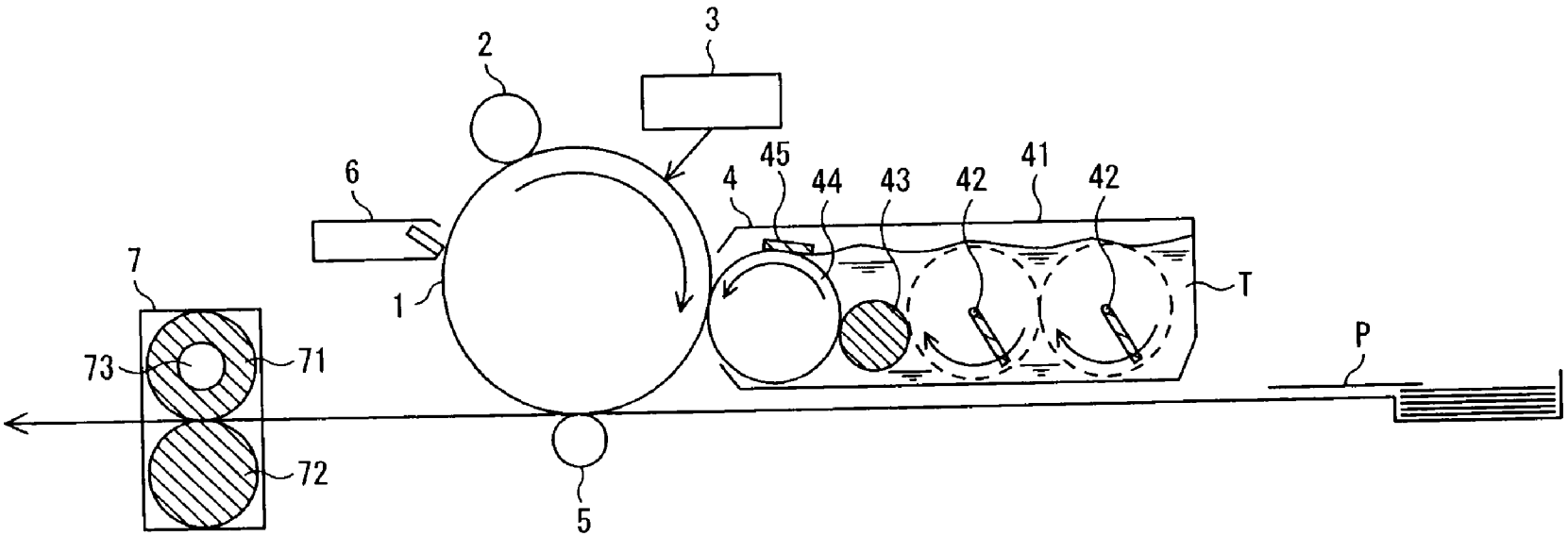
FIG. 1 is a drawing schematically illustrating the essential part of the structure of one embodiment of an image forming device of the present invention.

1 photoreceptor
2 charging apparatus (charging roller)
3 exposure apparatus
4 developing apparatus
5 transfer apparatus
6 cleaning apparatus
7 fixing apparatus
41 developing tank
42 agitator
43 supply roller
44 developing roller
45 control member
71 upper fixing member (pressure roller)
72 lower fixing member (fixing roller)
73 heating apparatus
T toner
P recording paper

BEST MODES FOR CARRYING OUT THE INVENTION

The best mode for carrying out the present invention will be explained in detail below. However, it is to be understood that the present invention is not limited to the following embodiment and any modification can be added thereto insofar as they do not depart from the scope of the present invention.

The photoreceptor and image forming device of the present invention both comprise a polyester resin containing a repeating structural unit, represented by the formula (1) to be described later (hereinafter referred to as "polyester resin of the present invention", as appropriate), as a part of their structural components. They can be classified into the first to eighth subject matter according to each embodiment. In the following, explanation will be given first to the polyester resin of the present invention and each subject matter will be dealt with later.

[I. Polyester Resin of the Present Invention]

The polyester resin of the present invention is a polyester resin containing a repeating structural unit represented by the formula (1) below.

[Chemical Formula 6]

(1)

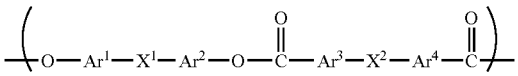

(In the formula (1), $Ar^1$ to $Ar^4$ each represents, independently of each other, an arylene group which may have a substituent. $X^1$ represents a bivalent group (including a single bond) and $X^2$ represents a bivalent group (including a single bond) with 3 or less atoms.)

Detailed explanation of the polyester resin will be given below.

In the above formula (1), $Ar^1$ to $Ar^4$ each represents, independently of each other, an arylene group.

The number of carbon atoms of $Ar^1$ to $Ar^4$ is arbitrary insofar as the advantage of the present invention is not significantly impaired. Usually, the carbon number of $Ar^1$ and $Ar^2$ is 6 or more and 20 or less, preferably 12 or less, more preferably 7. The carbon number of $Ar^3$ and $Ar^4$ is usually 6 or more and usually 20 or less, preferably 12 or less, and particularly preferably it is 6.

The number of rings constituting $Ar^1$ to $Ar^4$ is also arbitrary insofar as the advantage of the present invention is not significantly impaired. Usually, it is 1 or more and 3 or less, preferably 2 or less, and particularly preferably it is 1.

Concrete examples of $Ar^1$ to $Ar^4$ include: phenylene group, naphthylene group, 3-methylphenylene group and 3-phenylphenylene group. Also cited are anthrylene group, phenanthrylene group and pirenylene group. Of these groups, particularly preferable from the standpoint of production cost are phenylene group and naphthylene group. Further, of these two groups, phenylene group is more preferable because of easier synthesis, in addition to the lower production cost.

Each arylene group constituting $Ar^1$ to $Ar^4$ may have a substituent, independently of each other. Concrete examples of the substituent include: alkyl group, aryl group, halogen group, alkoxy group and condensed polycyclic group. In consideration of mechanical characteristics as binder resin for the photosensitive layer and solubility in coating liquid for forming photosensitive layer, phenyl group and naphthyl group are preferable as aryl group, fluorine atom, chlorine atom, bromine atom and iodine atom are preferable as halogen group, and methoxy group, ethoxy group and butoxy group are preferable as alkoxy group. When the substituent is an alkyl group, the carbon number of the alkyl group is usually 1 or more, and usually 10 or less, preferably 8 or less, more preferably 2 or less. Specifically, methyl group is particularly preferable. There is no special limitation on the number of the substituent of $Ar^1$ to $Ar^4$. It is preferably 3 or less, more preferably 2 or less, and particularly preferably 1 or less.

Furthermore, in the formula (1), when $Ar^1$ and $Ar^2$ have a substituent, it is preferable that $Ar^1$ and $Ar^2$ are the same arylene group with the same substituent. It is more preferable that they are both phenylene group having methyl group as substituent.

Further, it is preferable that $Ar^3$ and $Ar^4$ are the same arylene group. It is particularly preferable that they are the same phenylene group without substituent.

In the formula (1) above, $X^1$ represents a bivalent group. The bivalent group here includes a single bond. Preferable examples of $X^1$ include: sulfur atom, oxygen atom, sulfonyl group, cycloalkylene group and $—CR^aR^b—$. $R^a$ and $R^b$ each represents, independently of each other, a hydrogen atom, alkyl group, aryl group, halogen group or alkoxy group. Of the $R^a$ and $R^b$, in consideration of mechanical characteristics as binder resin for the photosensitive layer and solubility in coating liquid for forming photosensitive layer, phenyl group and naphthyl group are preferable as aryl group, fluorine atom, chlorine atom, bromine atom and iodine atom are preferable as halogen group, and methoxy group, ethoxy group and butoxy group are preferable as alkoxy group. When the $R^a$ or $R^b$ is an alkyl group, the carbon number of the alkyl group is usually 1 or more, and usually 10 or less, preferably 8 or less, more preferably 2 or less.

In consideration of ease of production of the bivalent hydroxyl compound used in the production of the polyester resin of the present invention, preferable examples of $X^1$ include: —O—, —S—, —SO—, $—SO_2—$, —CO—, $—CH_2—$, $—CH(CH_3)—$, $—C(CH_3)_2—$ and cyclohexylidene group. Of these, preferable are $—CH_2—$, $—CH(CH_3)—$, $—C(CH_3)_2—$ and cyclohexylidene group. Particularly preferable are $—CH_2—$, $—CH(CH_3)—$ and cyclohexylidene group.

In the above formula (1), $X^2$ represents a bivalent group with 3 or less atoms. The bivalent group here includes a single bond. Preferable examples of $X^2$ include: single bond, —O—, —S—, —SO—, $—SO_2—$, —CO— and $—CH_2—$. In consideration of mechanical characteristics and ease of production of the polyester resin of the present invention, preferable examples of $X^2$ include single bond, —O— and $—CH_2—$. Most preferable from the standpoint of mechanical characteristics is —O—.

The repeating structural unit represented by the formula (1) above consists of a bivalent hydroxyl residue (partial structure represented by the formula (4) below) and a dicarboxylic acid residue (partial structure represented by the formula (5) below). The structure of these bivalent hydroxyl residue and dicarboxylic acid residue affects the polyester resin of the present invention in various ways. Therefore, due attention should be paid to the structure of these bivalent hydroxyl residue and dicarboxylic acid residue.

[Chemical Formula 7]

(4)

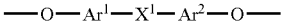

[Chemical Formula 8]

(5)

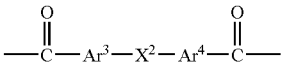

(In the formula (4) and (5), $Ar^1$ to $Ar^4$ each represents, independently of each other, an arylene group which may have a substituent. $X^1$ represents a bivalent group (including a single bond) and $X^2$ represents a bivalent group (including a single bond) with 3 or less atoms.)

In the following, explanation will be given on the preferable structure of the above bivalent hydroxyl residue and dicarboxylic acid residue.

The bivalent hydroxyl residue is represented by the formula (4) above. In the formula (4), $Ar^1$, $Ar^2$ and $X^1$ are the same as explained for the formula (1).

Of the bivalent hydroxyl residue represented by the above formula (4), a bivalent phenol residue represented by the formula (6) below is particularly preferable.

[Chemical Formula 9]

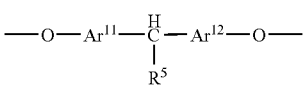

(6)

(In the formula (6), $Ar^{11}$ and $Ar^{12}$ each represents, independently of each other, a phenylene group that may have a substituent and $R^5$ represents a hydrogen atom or a methyl group.)

In the above formula (6), $Ar^{11}$ and $Ar^{12}$ each represents, independently of each other, a phenylene group that may have a substituent. The substituents of $Ar^{11}$ and $Ar^{12}$ are the same as those described for $Ar^1$ to $Ar^4$.

$R^5$ in the above formula (6) represents a hydrogen atom or a methyl group.

As a concrete example of the formula (6) a bivalent phenol residue can be cited in which hydrogen atom is removed from the hydroxyl group of bivalent phenol compounds shown below.

Namely, when $R^5$ is a hydrogen atom, examples of bivalent phenol compounds corresponding to the bivalent phenol residue represented by the formula (6) above include bis(2-hydroxyphenyl)methane, (2-hydroxyphenyl)(3-hydroxyphenyl)methane, (2-hydroxyphenyl)(4-hydroxyphenyl) methane, bis(3-hydroxyphenyl)methane, (3-hydroxyphenyl) (4-hydroxyphenyl)methane, bis(4-hydroxyphenyl)methane, bis(2-hydroxy-3-methylphenyl)methane, bis (2-hydroxy-3-ethylphenyl)methane, (2-hydroxy-3-methylphenyl)(3-hydroxy-4-methylphenyl)methane, (2-hydroxy-3-ethylphenyl) (3-hydroxy-4-ethylphenyl)methane, (2-hydroxy-3-methylphenyl)(4-hydroxy-3-methylphenyl)methane, (2-hydroxy-3-ethylphenyl)(4-hydroxy-3-ethylphenyl)methane, bis(3-hydroxy-4-methylphenyl)methane, bis(3-hydroxy-4-ethylphenyl) methane, (3-hydroxy-4-methylphenyl) (4-hydroxy-3-methylphenyl)methane, (3-hydroxy-4-ethylphenyl) (4-hydroxy-3-ethylphenyl)methane, bis(4-hydroxy-3-methylphenyl)methane, bis(4-hydroxy-3-ethylphenyl)methane, bis(4-hydroxy-3,5-dimethylphenyl) methane, (4-hydroxy-3,5-dimethylphenyl)(3-hydroxy-2,4-dimethylphenyl)methane and bis(3-hydroxyl-2,4-dimethylphenyl)methane.

Further, when $R^5$ is a methyl group, examples of bivalent phenol compounds corresponding to the bivalent phenol residue represented by the formula (6) above include 1,1-bis(2-hydroxylphenyl)ethane, 1-(2-hydroxylphenyl)-1-(3-hydroxylphenyl)ethane, 1-(2-hydroxylphenyl)-1-(4-hydroxylphenyl)ethane, 1,1-bis(3-hydroxylphenyl)ethane, 1-(3-hydroxylphenyl)-1-(4-hydroxylphenyl)ethane, 1,1-bis (4-hydroxylphenyl)ethane, 1,1-bis(2-hydroxyl-3-methylphenyl)ethane, 1,1-bis(2-hydroxyl-3-ethylphenyl)ethane, 1-(2-hydroxyl-3-methylphenyl)-1-(3-hydroxyl-4-methylphenyl)ethane, 1-(2-hydroxyl-3-ethylphenyl)-1-(3-hydroxyl-4-ethylphenyl)ethane, 1-(2-hydroxyl-3-methylphenyl)-1-(4-hydroxyl-3-methylphenyl)ethane, 1-(2-hydroxyl-3-ethylphenyl)-1-(4-hydroxyl-3-ethylphenyl)ethane, 1,1-bis (3-hydroxyl-4-methylphenyl)ethane, 1,1-bis(3-hydroxyl-4-ethylphenyl)ethane, 1-(3-hydroxyl-4-methylphenyl)-1-(4-hydroxyl-3-methylphenyl)ethane, 1-(3-hydroxyl-4-ethylphenyl)-1-(4-hydroxyl-3-ethylphenyl)ethane, 1,1-bis (4-hydroxyl-3-methylphenyl)ethane, 1,1-bis (4-hydroxyl-3-ethylphenyl)ethane, 1,1-bis(4-hydroxyl-3,5-dimethylphenyl)ethane, 1-(4-hydroxyl-3,5-dimethylphenyl)-1-(3-hydroxyl-2,4-dimethylphenyl)ethane and 1,1-bis(3-hydroxyl-2,4-dimethylphenyl)ethane.

From the standpoint of ease of production of the bivalent phenol compound, particularly preferable of these compounds, when $R^5$ is a hydrogen atom, are bis (4-hydroxylphenyl)methane, (2-hydroxylphenyl)(4-hydroxylphenyl)methane, bis(2-hydroxylphenyl)methane, bis(4-hydroxyl-3-methylphenyl)methane, bis (4-hydroxyl-3-ethylphenyl) methane and bis(4-hydroxyl-3,5-dimethylphenyl)methane.

When $R^5$ is a methyl group, preferable are 1,1-bis(4-hydroxylphenyl)ethane, 1-(2-hydroxylphenyl)-1-(4-hydroxylphenyl)ethane, 1,1-bis(2-hydroxylphenyl)ethane, 1,1-bis(4-hydroxyl-3-methylphenyl)ethane, 1,1-bis(4-hydroxyl-3-ethylphenyl)ethane and 1,1-bis(4-hydroxyl-3,5-dimethylphenyl)ethane.

In the formula (4), examples of the bivalent hydroxyl residue not covered by the formula (6) include a bivalent hydroxyl residue in which hydrogen atom is removed from the hydroxyl group of bivalent hydroxyl compounds shown below.

Namely, as bivalent hydroxyl compounds corresponding to the bivalent hydroxyl residue represented by the formula (4) above, the following can be cited: 3,3',5,5'-tetramethyl-4,4'-dihydroxylbiphenyl, 2,4,3',5'-tetramethyl-3,4'-dihydroxylbiphenyl, 2,2',4,4'-tetramethyl-3,3'-dihydroxylbiphenyl, 1,1-bis(4-hydroxylphenyl) propane, 1,1-bis(4-hydroxyl-3-methylphenyl) propane, 1,1-bis(4-hydroxyl-3,5-dimethylphenyl) propane, 2-(4-hydroxyl-3,5-dimethylphenyl)-2-(3-hydroxyl-2,4-dimethylphenyl) propane, 1,1-bis(3-hydroxyl-2,4-dimethylphenyl) propane, 2,2-bis(4-hydroxylphenyl) propane, 2,2-bis (4-hydroxyl-3-methylphenyl) propane, 2,2-bis(4-hydroxyl-3,5-dimethylphenyl) propane, 2-(4-hydroxyl-3,5-dimethylphenyl)-2-(3-hydroxyl-2,4-dimethylphenyl) propane and 2,2-bis(3-hydroxyl-2,4-dimethylphenyl) propane, bis(4-hydroxylphenyl)phenylmethane, 1,1-bis(4-hydroxylphenyl)-1-phenylethane, 1,1-bis(4-hydroxylphenyl)-1-phenylpropane, bis(4-hydroxylphenyl) diphenylmethane, bis(4-hydroxylphenyl) dibenzylmethane, 1,1-bis(4-hydroxylphenyl)cyclohexane, 1,1-bis(4-hydroxyl-3-methylphenyl)cyclohexane, 1,1-bis(4-hydroxyl-3,5-dimethylphenyl)cyclohexane, 1-(4-hydroxyl-3,5-dimethylphenyl)-1-(3-hydroxyl-2,4-dimethylphenyl)cyclohexane, 1,1-bis(3-hydroxyl-2,4-dimethylphenyl)cyclohexane, bis(2-hydroxylphenyl)ether, (2-hydroxylphenyl)(3-hydroxylphenyl)ether, (2-hydroxylphenyl)(4-hydroxylphenyl) ether, bis(3-hydroxylphenyl)ether, (3-hydroxylphenyl)(4-hydroxylphenyl)ether, bis(4-hydroxylphenyl)ether, bis(2-hydroxyl-3-methylphenyl)ether, bis(2-hydroxyl-3-ethylphenyl)ether, (2-hydroxyl-3-methylphenyl)(3-hydroxyl-4-methylphenyl)ether, (2-hydroxyl-3-ethylphenyl) (3-hydroxyl-4-ethylphenyl)ether, (2-hydroxyl-3-methylphenyl)(4-hydroxyl-3-methylphenyl)ether, (2-hydroxyl-3-ethylphenyl)(4-hydroxyl-3-ethylphenyl) ether, bis(3-hydroxyl-4-methylphenyl)ether, bis(3-hydroxyl-4-ethylphenyl)ether, (3-hydroxyl-4-methylphenyl)(4-hydroxyl-3-methylphenyl)ether, (3-hydroxyl-4-ethylphenyl) (4-hydroxyl-3-ethylphenyl)ether, bis(4-hydroxyl-3-methylphenyl)ether, bis(4-hydroxyl-3-ethylphenyl)ether, bis (4-hydroxyl-3,5-dimethylphenyl)ether, (4-hydroxyl-3,5-dimethylphenyl)(3-hydroxyl-2,4-dimethylphenyl)ether, bis (3-hydroxyl-2,4-dimethylphenyl)ether, and bis(4-hydroxylphenyl) ketone.

Of these compounds, preferable from the standpoint of ease of production of bivalent hydroxyl compounds are 3,3',5,5'-tetramethyl-4,4'-dihydroxylbiphenyl, 2,2-bis(4-hydroxyl-3,5-dimethylphenyl) propane, 1,1-bis(4-hydroxyl-3,5-dimethylphenyl)cyclohexane, bis(4-hydroxylphenyl)ether, (2-hydroxylphenyl)(4-hydroxylphenyl)ether, bis(2-hydroxylphenyl)ether, bis(4-hydroxyl-3-methylphenyl)ether, bis(4-hydroxyl-3-ethylphenyl)ether and bis(4-hydroxyl-3,5-dimethylphenyl)ether.

The above-mentioned bivalent hydroxyl compounds and bivalent hydroxyl residues can be used either as a single kind or as a mixture of two or more kinds in any combination and in any ratio.

On the other hand, the dicarboxylic acid residue is represented by the formula (5) mentioned before. In the formula (5), $Ar^3$, $Ar^4$ and $X^2$ are the same as explained before for the formula (1). Of the dicarboxylic acid residue represented by the formula (5), particularly preferable is one in which $X^2$ is —O—, like the formula below.

[Chemical Formula 10]

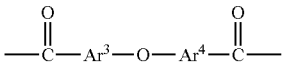

As a concrete example, the dicarboxylic acid residue can be cited in which hydroxyl group is removed from carboxyl group of dicarboxylic acids shown below.

Namely, examples of dicarboxylic acids corresponding to the dicarboxylic acid residue represented by the above formula (5) include diphenylether-2,2'-dicarboxylic acid, diphenylether-2,3'-dicarboxylic acid, diphenylether-2,4'-dicarboxylic acid, diphenylether-3,3'-dicarboxylic acid, diphenylether-3,4'-dicarboxylic acid and diphenylether-4,4'-dicarboxylic acid. Of these, from the standpoint of ease of production of dicarboxylic acid, preferable are diphenylether-2,2'-dicarboxylic acid, diphenylether-2,4'-dicarboxylic acid and diphenylether-4,4'-dicarboxylic acid, and particularly preferable is diphenylether-4,4'-dicarboxylic acid.

The above mentioned dicarboxylic acid compounds and dicarboxylic acid residue can be used either as a single kind or as a mixture of two or more kinds in any combination and in any ratio.

The above $Ar^1$ to $Ar^4$, $X^1$ and $X^2$ should be selected properly so that the structures of the bivalent hydroxyl residue and dicarboxylic acid residue are appropriate.

In view of the above consideration, it is particularly preferable that the above-mentioned polyester resin of the present invention contains a repeating structural unit shown in the formula (7) below.

[Chemical Formula 11]

(7)

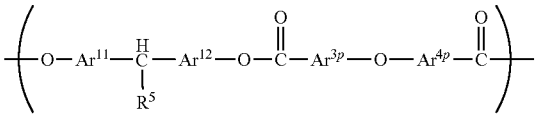

(In the formula (7) $Ar^{3p}$, $Ar^{4p}$, $Ar^{11}$ and $Ar^{12}$ each represents, independently of each other, a phenylene group which may have a substituent and $R^5$ represents a hydrogen atom or a methyl group.)

In the above formula (7), $Ar^{11}$, $Ar^{12}$ and $R^5$ are the same as described before for the formula (6).

In the formula (7), $Ar^{3p}$ and $Ar^{4p}$ each represents, independently of each other, a phenylene group which may have a substituent. In this case, the substituents of $Ar^{3p}$ and $Ar^{4p}$ are the same as described before for the substituents of $Ar^3$ to $Ar^4$.

The repeating structural unit in the formula (1) of the polyester resin of the present invention can be used either as a single kind or as a mixture of two or more kinds in any combination and in any ratio. Therefore, the above-mentioned bivalent hydroxyl residue and dicarboxylic acid residue can also be used either as a single kind or as a mixture of two or more kinds in any combination and in any ratio. Further, each of $Ar^1$ to $Ar^4$, $X^1$ and $X^2$ can be used either as a single kind or as a mixture of two or more kinds in any combination and in any ratio.

Furthermore, the polyester resin of the present invention may contain, as its partial structure, a component other than the bivalent hydroxyl residue represented by the above formula (4) or the dicarboxylic acid residue represented by the above formula (5). For example, it may be a resin which contains a dicarboxylic acid residue other than that represented by the formula (5) and contains a repeating structural unit represented by the formula (1) as a partial structure. Examples of other dicarboxylic acid residue include: adipic acid residue, suberic acid residue, sebacic acid residue, phthalic acid residue, isophthalic acid residue, terephthalic acid residue, toluene-2,5-dicarboxylic acid residue, p-xylene-2,5-dicarboxylic acid residue, pyridine-2,3-dicarboxylic acid residue, pyridine-2,4-dicarboxylic acid residue, pyridine-2,5-dicarboxylic acid residue, pyridine-2,6-dicarboxylic acid residue, pyridine-3,4-dicarboxylic acid residue, pyridine-3,5-dicarboxylic acid residue, naphthalene-1,4-dicarboxylic acid residue, naphthalene-2,3-dicarboxylic acid residue, naphthalene-2,6-dicarboxylic acid residue, biphenyl-2,2'-dicarboxylic acid residue and biphenyl-4,4'-dicarboxylic acid residue. Of these, preferable are adipic acid residue, sebacic acid residue, phthalic acid residue, isophthalic acid residue, terephthalic acid residue, naphthalene-1,4-dicarboxylic acid residue, naphthalene-2,6-dicarboxylic acid residue, biphenyl-2,2'-dicarboxylic acid residue and biphenyl-4,4'-dicarboxylic acid residue. Particularly preferable are isophthalic acid residue and terephthalic acid residue. A repeating structural unit (residue) other than the bivalent hydroxyl residue represented by the formula (4) and dicarboxylic acid residue represented by the formula (5) can also be used either as a single kind or as a mixture of two or more kinds in any combination and in any ratio.

However, in the polyester resin of the present invention, it is preferable that the proportion of a repeating structural unit other than the bivalent hydroxyl residue represented by the formula (4) and the dicarboxylic acid residue represented by the formula (5) is kept small. Therefore, it is also preferable that the amount of the bivalent hydroxyl residue other than that represented by the formula (4) and the amount of the dicarboxylic acid residue other than that represented by the formula (5) are kept small. There is no special limitation on the proportion but the proportion of the dicarboxylic acid residue represented by the formula (5) in the whole dicarboxylic acid residue is, in terms of the number of repeating structural unit, usually 70% or higher, preferably 80% or higher, more preferably 90% or higher, particularly preferably 100%.

The production method of the polyester resin of the present invention will be explained in the following. As production method of the polyester resin of the present invention, known polymerization methods can be used. Examples include such methods as interfacial polymerization, melt polymerization and solution polymerization.

In interfacial polymerization method, for example, an alkaline aqueous solution of the bivalent hydroxyl compound is mixed with a solution of aromatic dicarboxylic acid chloride in halogenated hydrocarbon. It may be possible to add a quaternary ammonium salt or quaternary phosphonium salt as catalyst. It is preferable to maintain the polymerization temperature in the range of 0 to 40° C. and the reaction time in the range of 2 to 20 hours, from the standpoint of productivity. After polymerization, aqueous phase and organic phase are separated, and the polymer in the organic phase is separated and washed in the known manner to obtain the target resin.

As alkaline component used in the interfacial polymerization method, the following can be cited: the hydroxide of alkali metal such as sodium hydroxide and potassium hydroxide. The amount of the alkali component used is preferably in the range of 1.01 to 3 times equivalent of the phenolic hydroxyl group contained in the reaction system.

As halogenated hydrocarbon, the following can be cited: dichloromethane, chloroform, 1,2-dichloroethane, trichloroethane, tetrachloroethane and dichlorobenzene. The halogenated hydrocarbon can be used either as a single kind or as a mixture of two or more kinds in any combination and in any ratio.

As quaternary ammonium salt and quaternary phosphonium salt used as catalyst, the following can be cited: salt such as hydrochloride, hydrobromide or hydroiodide of tertiary alkylamine such as tributylamine and trioctylamine; benzyltriethylammonium chloride, benzyltrimethylammonium chloride, benzyltributylammonium chloride, tetraethylammonium chloride, tetrabutylammonium chloride, tetrabutylammonium bromide, trioctylmethylammonium chloride, tetrabutylphosphonium bromide, triethyloctadecylphosphonium bromide, N-laurylpyridinium chloride and laurylpicolinium chloride. These catalysts can be used either as a single kind or as a mixture of two or more kinds in any combination and in any ratio.

In the interfacial polymerization method, molecular weight-adjusting agent can be used. The following compounds serve as molecular weight-adjusting agent, for example. Alkylphenols such as phenol, o,m,p-cresol, o,m,p-ethylphenol, o,m,p-propylphenol, o,m,p-(tert-butyl)phenol, penthylphenol, hexylphenol, octylphenol, nonylphenol, derivatives of 2,6-dimethylphenol and derivatives of 2-methylphenol; monofunctional phenols such as o,m,p-phenylphenol; monofunctional acid halide such as acetyl chloride, butyroyl chloride, octylic acid chloride, benzoyl chloride, benzenesulfonyl chloride, sulfinyl chloride and benzenephosphonyl chloride, and their derivatives.

Of these molecular weight-adjusting agents, preferable from the standpoint of molecular weight-adjusting capability and stability in solution are o,m,p-(tert-butyl)phenol, derivatives of 2,6-dimethylphenol, and derivatives of 2-methylphenol. Particularly preferable are p-(tert-butyl)phenol, 2,3,6-tetramethylphenol and 2,3,5-tetramethylphenol. Molecular weight-adjusting agent can also be used either as a single kind or as a mixture of two or more kinds in any combination and in any ratio.

The viscosity-average molecular weight of the polyester resin of the present invention is usually 10,000 or higher, preferably 15,000 or higher, more preferably 20,000 or higher, and usually 300,000 or lower, preferably 200,000 or lower, more preferably 100,000 or lower, so that it is suitable for forming the photosensitive layer by coating. When the viscosity-average molecular weight is lower than 10,000, mechanical strength of the resin may be too low for practical use and, when it is higher than 300,000, it may be difficult to be formed by coating the photosensitive layer with the proper thickness of coating.

[II. First Subject Matter]

The electrophotographic photoreceptor according to the first subject matter of the present invention comprises at least a photosensitive layer on an electroconductive support (also referred to as "electroconductive substrate"). The photosensitive layer includes a polyester resin containing a repeating structural unit represented by the above formula (1) (namely, polyester resin of the present invention) and, in addition, a hydrazone compound. The polyester resin contained in the photosensitive layer is used as binder resin and the hydrazone compound is used as charge transport material.

[II-1. Polyester Resin of the Present Invention]

The polyester resin of the present invention is as described in [I. Polyester resin of the present invention].

The polyester resin of the present invention, in the first subject matter of the present invention, can be used with other resin for an electrophotographic photoreceptor. Examples of other resin include: thermoplastic resins and various thermosetting resins including polymethylmethacrylate, polystyrene, vinyl polymer such as polyvinyl chloride, their copolymers, polycarbonate, polyester, polyester polycarbonate, polysulfone, phenoxy, epoxy and silicone resins. Of these resins, preferable are polycarbonate resin and polyester resin. Particularly preferable is polycarbonate resin.

Examples of the polyester resin and polycarbonate resin that can be used with include the examples of the second resin cited in the explanation of the fifth subject matter.

Other resin to be used with can be added either as a single kind or as a mixture of two or more kinds in any combination and in any ratio.

There is no special limitation on the mixing ratio of other resin to be used with. However, other resin to be used with is preferably used in the mixing ratio not exceeding that of the polyester resin of the present invention, and particularly preferably, other resin is omitted.

The polyester resin described above is used in the electrophotographic photoreceptor and serves as binder resin in the photosensitive layer set on the electroconductive support of said photoreceptor.

[II-2. Hydrazone Compound]

Hydrazone compounds to be used will be explained next. In the first subject matter of the present invention, a hydrazone compound contained in the photosensitive layer serves as a charge transport material. There is no special limitation on the kind of hydrazone compound and various hydrazones can be used. One preferable example is a hydrazone compound having a structure shown in the formula (8) below.

[Chemical Formula 12]

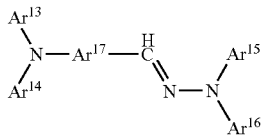

(8)

In the formula (8), $Ar^{13}$ and $Ar^{14}$ each represents an aryl group that may have a substituent. Phenyl group and naphthyl group can be cited as examples of the aryl group. Phenyl group is preferable because, when conjugated system of condensed rings is excessively extended with substituents, molecular interaction becomes strong, resulting in decreased solubility in solvents. Preferable as substituent is a lower alkyl group of 3 or less carbon atoms such as methyl group, ethyl group and 2-propyl group. These substituents may be connected with each other to form an alicyclic structure such as cyclopentane ring or cyclohexane ring, or they may be connected within each of $Ar^{13}$ and $Ar^{14}$ to form a ring structure such as cyclopentyl ring or cyclohexyl ring. From the standpoint of mobility of charge transport material, it is preferable that $Ar^{13}$ and $Ar^{14}$ are 4-methylphenyl group.

$Ar^{15}$ and $Ar^{16}$ each represents an aryl group that may have a substituent. Phenyl group and naphthyl group can be cited as examples of the aryl group. Phenyl group is preferable because a conjugation system, when highly extended, brings about poor solubility in solvent. As possible substituents, the following can be cited: a lower alkyl group of 3 or less carbon atoms such as methyl group, ethyl group and 2-propyl group. When $Ar^{15}$ and $Ar^{16}$ are connected with each other or connected via an alkylene group to form a ring, planarity of the molecule itself increases and interaction among the molecules become strong, leading to lower solubility of hydrazone compounds. This in turn increases the possibility of the compound precipitating out after coating the photosensitive layer. Therefore, it is preferable that $Ar^{15}$ and $Ar^{16}$ are not connected with each other or that $Ar^{15}$ and $Ar^{16}$ are not connected, for example, via an alkylene group to form a ring. Of unsubstituted aryl group and aryl group having a substituent, unsubstituted phenyl group is preferable in overall consideration of availability of the reagent and performance when used in an electrophotographic photoreceptor.

$Ar^{17}$ represents an arylene group that may have a substituent. Arylene group includes: phenylene group, naphthylene group and anthranylene group. Possible substituents include a lower alkyl group of 3 or less carbon atoms such as methyl group, ethyl group, and 2-propyl group. These substituents may be connected with each other to form an alicyclic structure such as cyclopentane ring or cyclohexane ring. As described before, when $Ar^{17}$ has a polycyclic condensed ring structure, its solubility in organic solvent, used as coating solvent, decreases and, therefore, phenylene group is preferable. From the standpoint of mobility as charge transport material, unsubstituted phenylene group is more preferable.

Preferable structures of hydrazone compounds that can be advantageously used for the present invention will be exemplified below. It is to be noted that these examples are presented for better understanding of the intention of the present invention and should not be interpreted as restricting the present invention.

[Chemical Formula 13]

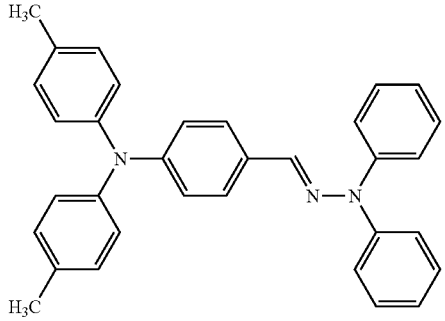

-continued

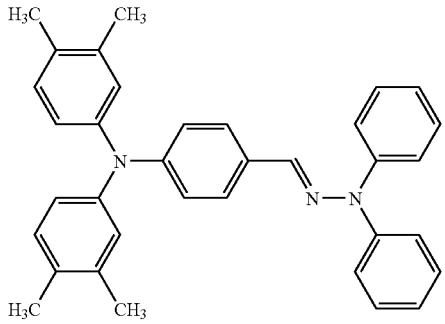

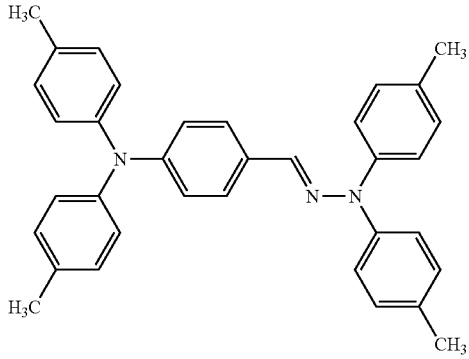

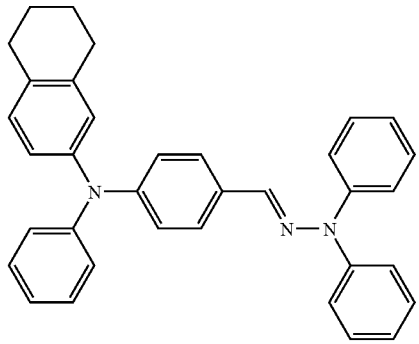

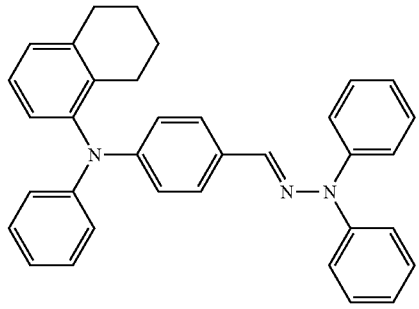

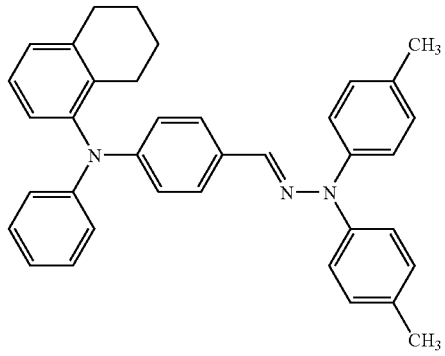

-continued
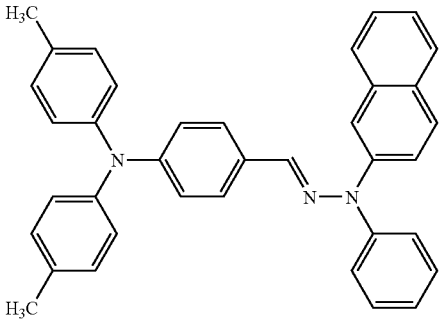
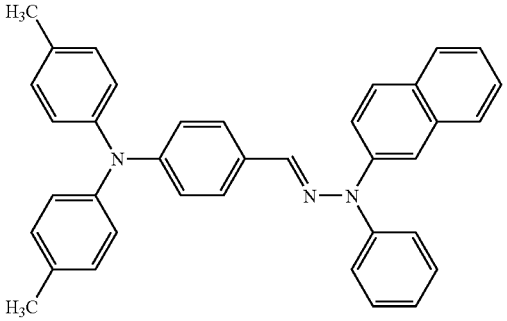
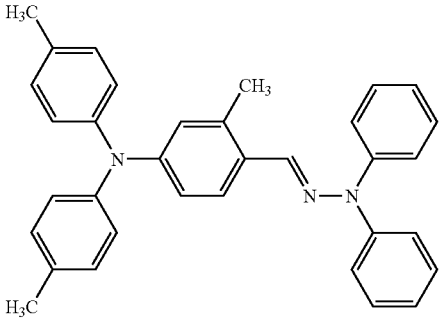
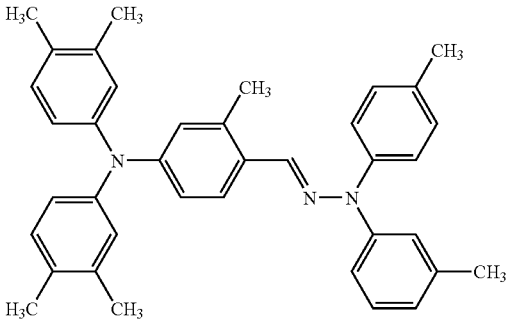
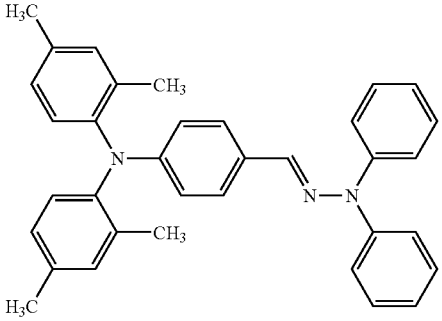
-continued
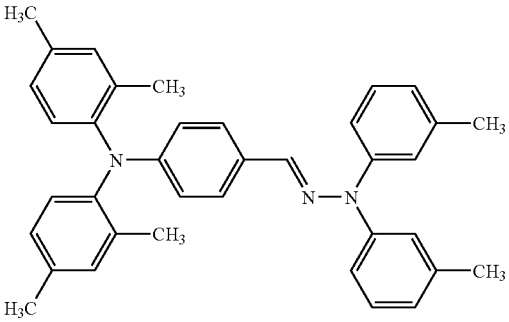
[Chemical Formula 14]
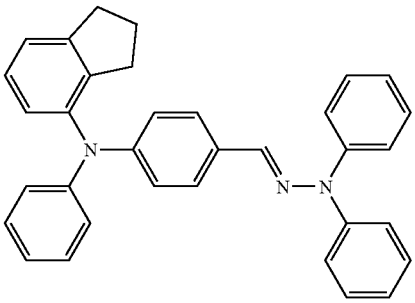
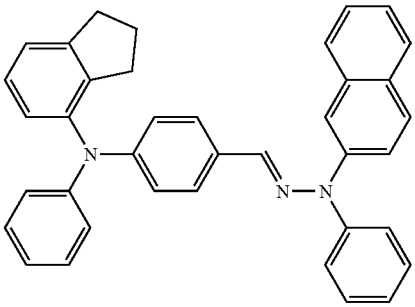
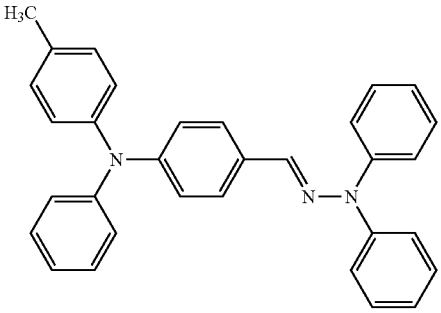
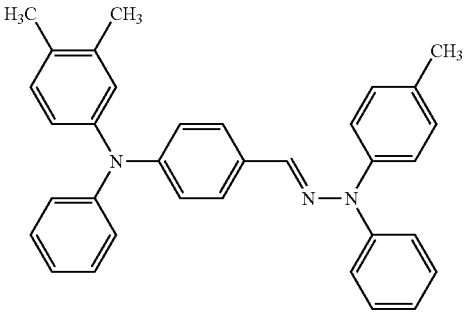

-continued

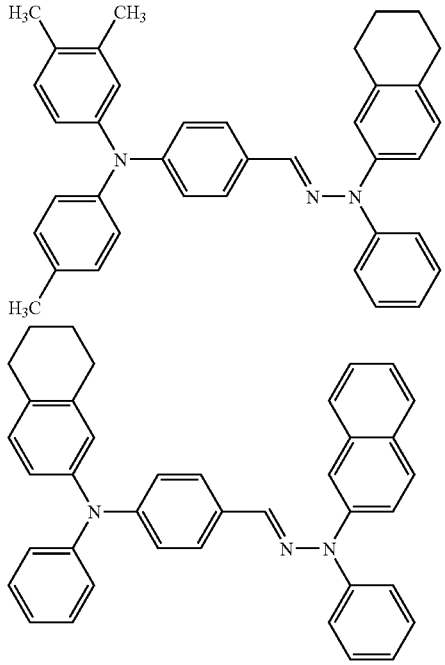

Hydrazone compound, which is used as charge transport material in the first subject matter of the present invention as described above, can be used either as a single kind or as a mixture of two or more kinds in any combination and in any ratio. Further, hydrazone compound can be used as a single kind or in combination with other charge transport material.

Any known type of charge transport material can be used together. The examples are: electron-withdrawing substances including aromatic nitro compounds such as 2,4,7-trinitrofluorenone, cyano compounds such as tetracyanoquinodimethane, and quinone compounds such as diphenoquinone; and electron donating substances including heterocyclic compounds such as carbazole and its derivatives, indole and its derivatives, imidazole and its derivatives, oxazole and its derivatives, pyrazole and its derivatives, thiadiazole and its derivatives and benzofuran and its derivatives, and aniline and its derivatives, hydrazone and its derivatives, aromatic amine and its derivatives, stilbene and its derivatives, butadiene and its derivatives, and enamine and its derivatives, and the ones obtained by combining a plurality of these compounds, and polymers having a group comprising these compounds at its main chain or side chain. These charge transport materials that can be used together can be used either as a single kind, or as a mixture of two or more kinds in any combination and in any ratio.

When the above-mentioned hydrazone compound is used with other charge transport material, the proportion between the hydrazone compound and other charge transport material can be decided arbitrarily. However, the proportion of hydrazone compound is usually 50 weight % or more, and preferably 90 weight % or more. It is particularly preferable that only hydrazone compound is used as charge transport material.

[II-3. Electrophotographic Photoreceptor]

The photoreceptor according to the first subject matter of the present invention comprises at least a photosensitive layer on an electroconductive support.

Concrete types of the photosensitive layer structure can be cited as follows. One is a monolayer type (or dispersion type) in which charge generation material and charge transport material exist in the same layer and are dispersed or dissolved in binder resin. Another is a lamination type (or function separated type) having multilayer structure, which comprises two different-function layers. The one layer is charge generation layer in which charge generation material is dispersed or dissolved in binder resin. The other is charge transport layer in which charge transport material is dispersed or dissolved in binder resin. The photoreceptor having monolayer type photosensitive layer is so-called a monolayer type photoreceptor (or dispersion type photoreceptor), and the photoreceptor having lamination type photosensitive layer is so-called a lamination type photoreceptor (or function separated type photoreceptor). Any type of photosensitive layer structure can be adopted. Furthermore, an overcoat layer (protective layer) can be provided on the photosensitive layer for the purpose of improvement in charging characteristics or abrasion resistance.

Lamination type photosensitive layer can further be divided into forward lamination type photosensitive layer in which charge generation layer and charge transport layer are laminated in this order from the electroconductive support side, and reverse lamination type photosensitive layer in which charge generation and charge transport layers are laminated in the reverse order. Any of these two types can be adopted. Of these, forward lamination type photosensitive layer, which can achieve well-balanced photoconductive characteristics, is preferable.

In the first subject matter of the present invention, at least the polyester resin of the present invention and a hydrazone compound are contained. The polyester resin of the present invention contained in the photosensitive layer functions as binder resin. The hydrazone compound serves as charge transport material. At this point, when the photosensitive layer comprises two or more layers (for example, charge generation layer and charge transport layer), the polyester resin represented by the above formula (1) and the hydrazone compound may be contained in at least one of the layers forming the photosensitive layer. However, they are usually used for the same layer of the photosensitive layer, and preferably used for the charge transport layer of a lamination type photosensitive layer.

[II-3-1. Electroconductive Support]

There is no special limitation on the material used for the electroconductive support, and the examples thereof include metal materials such as aluminum, aluminum alloy, stainless steel, copper and nickel; resin materials in which conductive powder such as metal, carbon, or tin oxide is added for ensuring electrical conductivity; resin, glass, or paper deposited or coated on the surface with conductive materials such as aluminum, nickel or ITO (indium tin oxide). These materials can be used either as a single kind or as a mixture of two or more kinds in any combination and in any ratio.

Further, the electroconductive support can be used in the form of, for example, drum, sheet and belt. Also, an electroconductive support made of metal material with a conductive material having appropriate resistance value on the surface for controlling the conductivity and surface properties, and for a coating breach can be used.

In addition, when metallic material such as aluminum alloy is used for the electroconductive support, the electroconductive support may be subjected to anodization, chemical film formation or the like before it is used. When it is subjected to anodization, it is desirable to perform sealing by a known method.

The support may have a smooth surface or a surface roughened by a particular cutting method or by polishing. It may also have a surface roughened by mixing particles with an appropriate particle size in the material for the electroconductive support.

[II-3-2. Undercoat Layer]

An undercoat layer may be provided between the electroconductive support and the photosensitive layer, to be described later, for improving the adhesiveness, blocking tendency and the like.

Examples of material for the undercoat layer include a resin by itself, and a resin in which organic pigment, particles (usually, inorganic particles) such as metal oxide particles or the like is dispersed.

Examples of the metal oxide particles to be used in the undercoat layer include: metal oxide particles including one metal element such as titanium oxide, aluminum oxide, silicon oxide, zirconium oxide, zinc oxide and iron oxide; and metal oxide particles including a plurality of metal elements such as calcium titanate, strontium titanate and barium titanate. These particles may be used as a single kind, or as a mixture of two or more kinds in any combination and in any ratio.

Of these metal oxide particles, the titanium oxide and the aluminum oxide are preferred, and the titanium oxide is particularly preferred. The titanium oxide particles may be surface-treated by an inorganic substance such as tin oxide, aluminum oxide, antimony oxide, zirconium oxide or silicon oxide, or an organic substance such as stearic acid, polyol or silicone. Any crystalline form of the titanium oxide particles, such as rutile, anatase, brookite or amorphous, may be used. Concerning the crystalline form, a plurality of the crystalline forms may be included therein in any combination and in any ratio.

Further, as metal oxide particles, the ones having various particle sizes can be used. Among them, in view of the characteristics and the solution stability, the average primary particle size thereof is usually 1 nm or larger, preferably 10 nm or larger, and usually 100 nm or smaller, preferably 50 nm or smaller.

It is desirable that the undercoat layer is formed in a manner that the metal oxide particles are dispersed in the binder resin. Examples of the binder resin used for the undercoat layer include phenoxy, epoxy, polyvinylpyrrolidone, polyvinyl alcohol, casein, polyacrylic acid, celluloses, gelatin, starch, polyurethane, polyimide and polyamide. Among them, alcohol-soluble copolymerized polyamide, modified polyamide, or the like is preferred in that it exhibits good dispersibility and coating property. The binder resin of the undercoat layer may be used either as a single kind or as a mixture of two or more kinds in any combination and in any ratio. In addition, the binder resin can be used either by itself or in a cured form with a curing agent.

The mixture ratio of the particles to the binder resin can be arbitrarily selected, but it is preferably in the range from 10 weight % to 500 weight % in view of the stability and coating property of the dispersion liquid.

The film thickness of the undercoat layer can be selected arbitrarily insofar as the advantage of the present invention is not significantly impaired. However, it is preferably 0.1 μm to 25 μm from the standpoint of photoreceptor characteristics and coating property. In addition, additives such as antioxidant may also be added to the undercoat layer.

[II-3-3. Photosensitive Layer]

The photosensitive layer is provided on the electroconductive support (when using an undercoat layer, via the undercoat layer on the electroconductive support). The type of the photosensitive layer includes a lamination type, in which a charge generation layer and a charge transport layer are provided, and a monolayer type, in which both the charge transport material and charge generation material are contained in the same layer. The photosensitive layer here may have any of these structures. It is generally known that charge transport materials show, in both the monolayer type and lamination type, equivalent performances.

[II-3-3-1. Charge Generation Layer]

The charge generation layer is a layer in which charge generation material is contained. As a charge generation material, for example, various photoconductive materials can be used including: inorganic photoconductive materials such as selenium and its alloy, and cadmium sulfide; and organic pigments such as phthalocyanine pigments, azo pigments, quinacridone pigments, indigo pigments, perylene pigments, polycyclic quinone pigments, anthanthrone pigments and benzimidazole pigments. Of these, organic pigments are particularly preferred, and further, phthalocyanine pigments and azo pigments are more preferred.

The example of the phthalocyanine compound that is used as charge generation material include: metal-free phthalocyanine; and phthalocyanines bonded as ligands with metals such as copper, indium, gallium, tin, titanium, zinc, vanadium, silicon and germanium, or oxides thereof, halides thereof, or the like. Examples of ligands to a trivalent or higher valent metal element include hydroxyl group, alkoxy group and the like, in addition to the above mentioned oxygen atom and chlorine atom. Of these, high-sensitivity phthalocyanines such as X-form phthalocyanine, τ-form metal-free phthalocyanine, A-form, B-form, D-form or the like titanyl phthalocyanine, vanadyl phthalocyanine, chloroindium phthalocyanine, chlorogallium phthalocyanine, hydroxygallium phthalocyanine and the like can be preferably used.

Among the crystalline forms of titanyl phthalocyanine, cited above, the A-form and B-form are denoted by I-phase and II-phases respectively, by W. Hellers, et al. (Zeit. Kristallogr. 159 (1982) 173). Of these, the A-form is known to be stable. The D-form is a crystalline form characterized in that its diffraction angle 2θ±0.2° has a distinct peak at 27.3° in a powder X ray diffraction using the CuKα line.

On the other hand, the example of the azo pigments used as charge generation material include: bisazo pigments, trisazo pigments and tetrakisazo pigments. Of these, the ones having more than one azo group are preferable, and particularly, bisazo pigments and trisazo pigments are more preferable. The particularly preferable examples of the azo pigments are shown below.

[Chemical Formula 15]
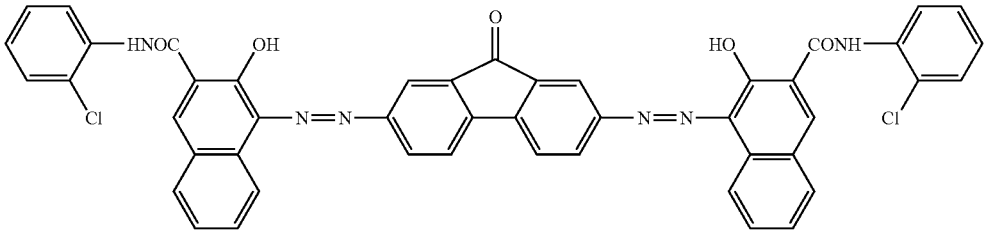
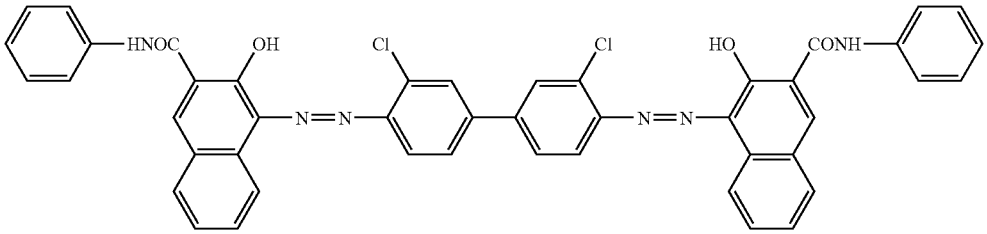
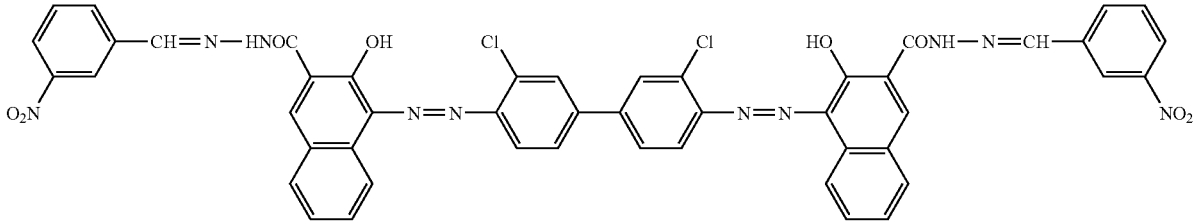
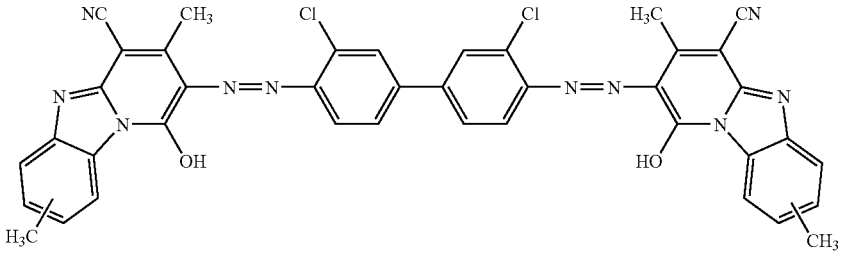
[Chemical Formula 16]
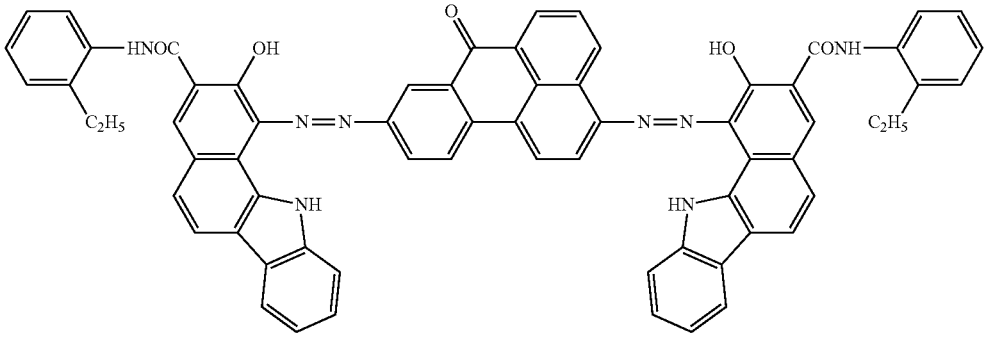

-continued
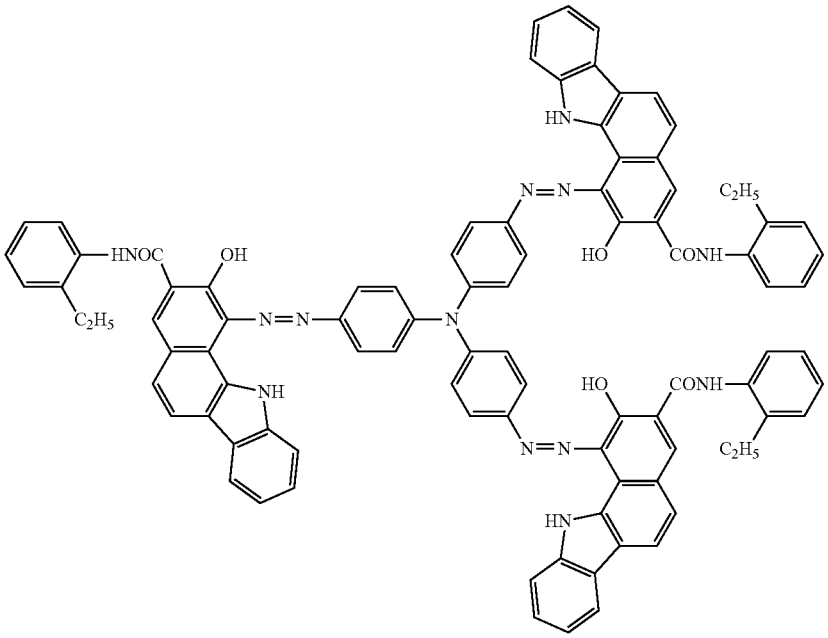
[Chemical Formula 17]
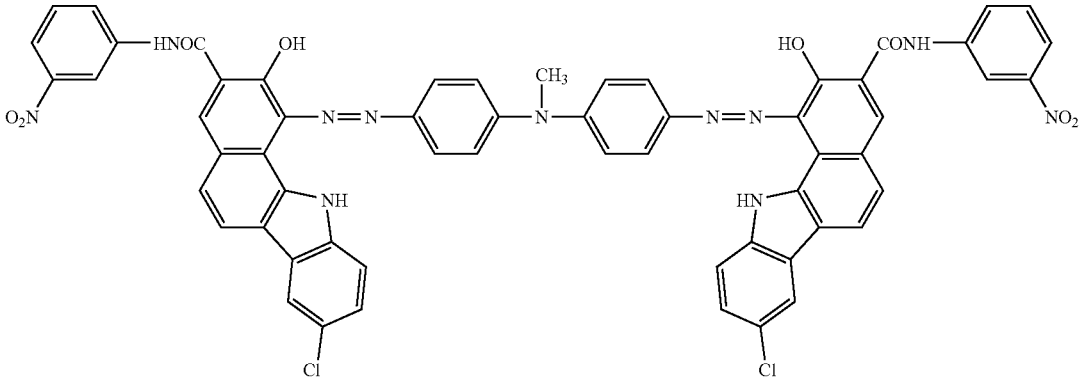
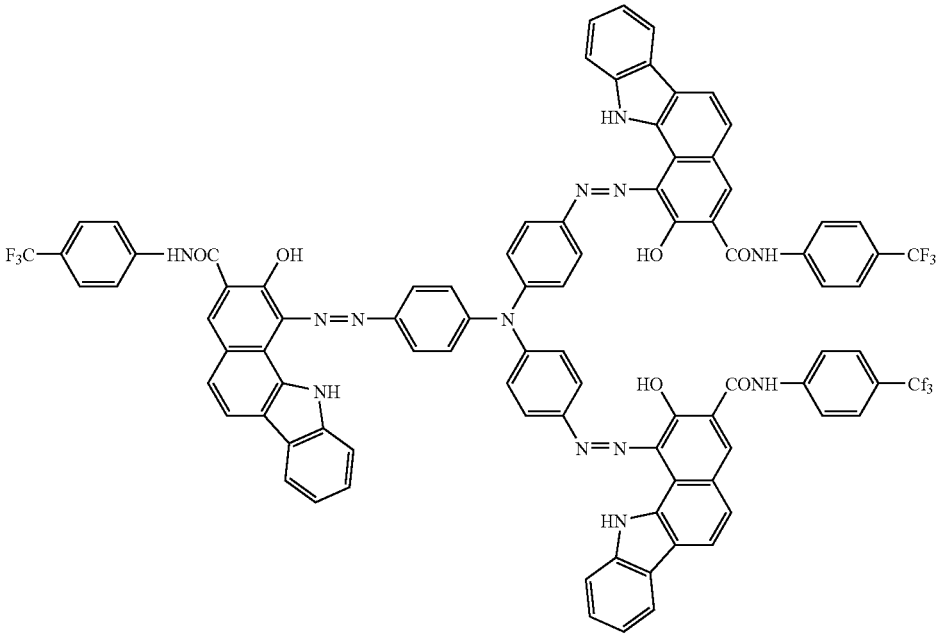

-continued
[Chemical Formula 18]
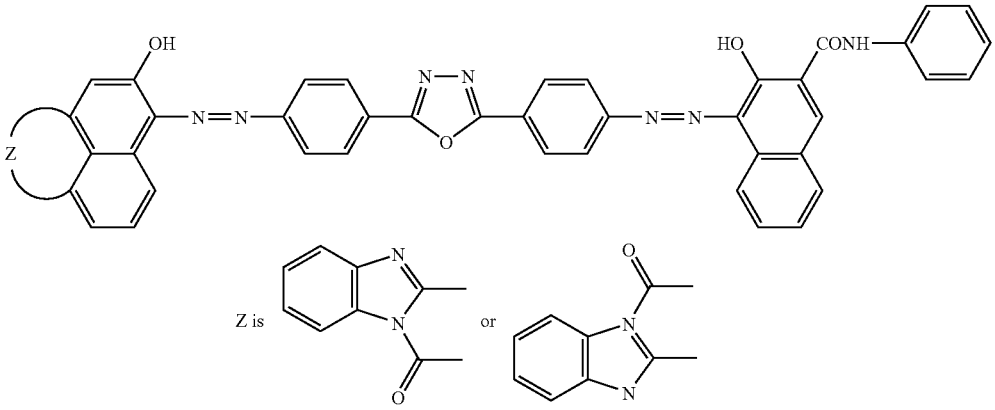
[Chemical Formula 19]
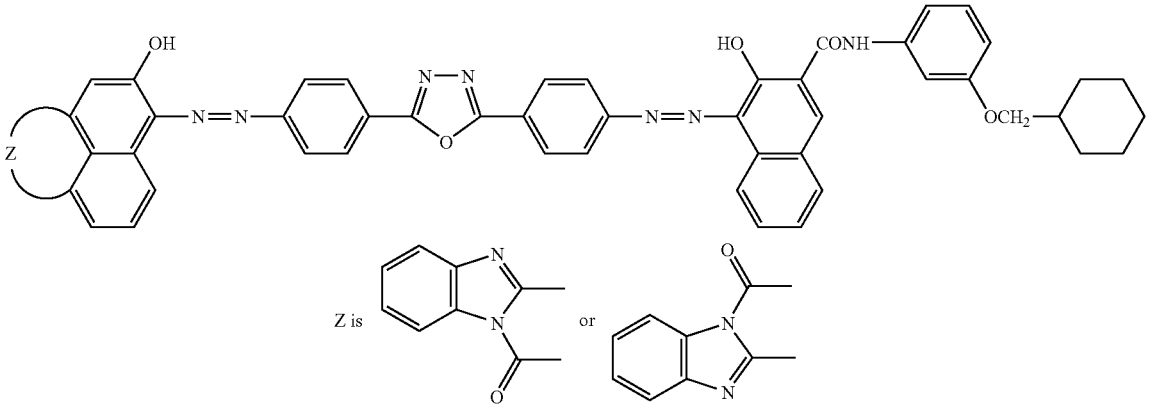
[Chemical Formula 20]
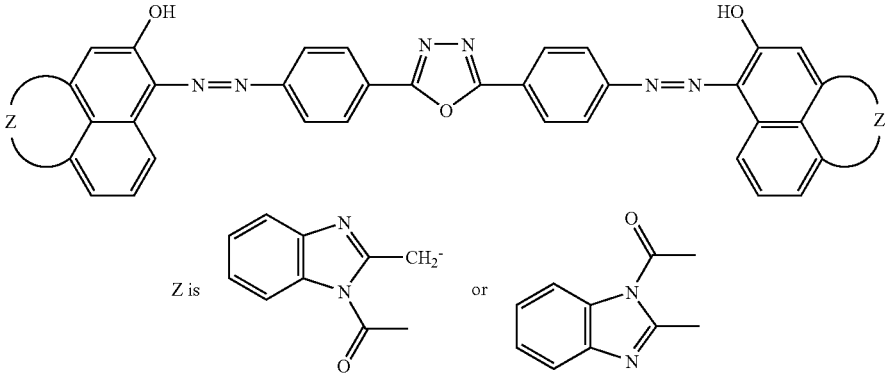
[Chemical Formula 21]
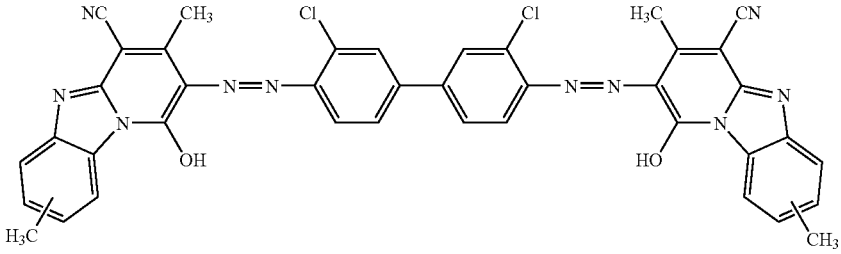

-continued

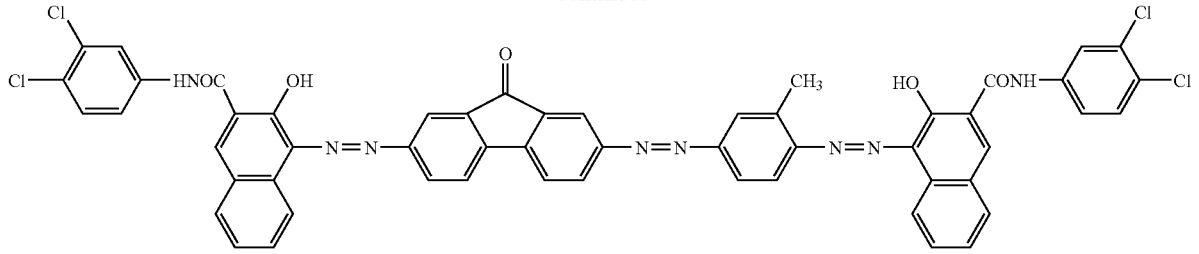

Furthermore, among azo pigments, a compound represented by the formula below is particularly preferable.

[Chemical Formula 22]

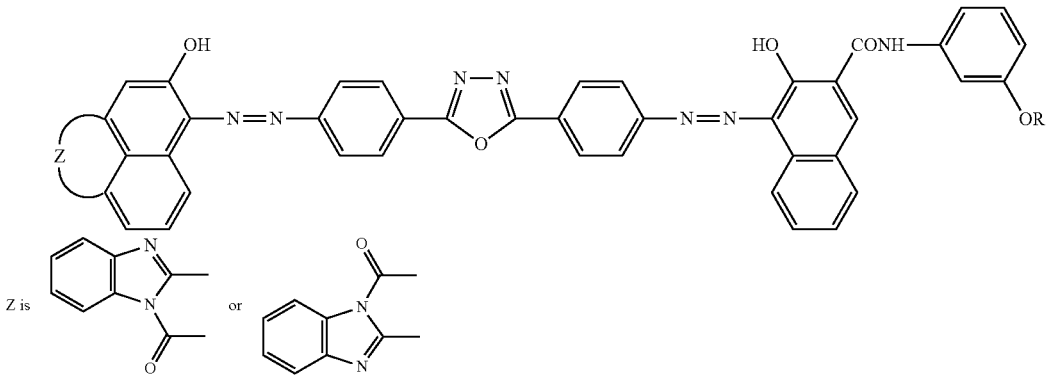

(In the formula, R represents an alkyl group having cycloalkyl group that may have an alkyl substituent and 4 to 20 of total carbon atoms.)

The charge generation materials may be used either as a single kind or as a mixture of two or more kinds in any combination and in any ratio. The mixed state of the charge generation materials in the state of crystalline, when two or more kinds of them are used, may be obtained either by forming it in the process of manufacturing or treatments, of the charge generation materials, such as synthesis, formation into pigments or crystallization, or by mixing the respective constituents afterwards. As such treatments, acid paste treatment, grinding, solvent treatment or the like is known.

The charge generation material forms the charge generation layer in a state of being bound by the binder resin. At this point, as binder resin in the charge generation layer, the polyester resin of the present invention can be used. In such case, other binder resin can be used together with the polyester resin of the present invention, as described before.

When the polyester resin of the present invention is contained in a layer of the photosensitive layer other than the charge generation layer (for example, charge transport layer), only binder resin that is other than the polyester resin of the present invention may be used as binder resin of the charge generation layer. Examples of the binder resin used in this case include polyester resin, polyvinyl acetate, polyacrylic acid ester, polymethacrylic acid ester, polyester, polycarbonate, polyvinyl acetoacetal, polyvinyl propional, polyvinyl butyral, phenoxy resin, epoxy resin, urethane resin, cellulose ester and cellulose ether. The binder resin in the charge generation layer may be used either as a single kind or as a mixture of two or more kinds in any combination and in any ratio.

The amount of the charge generation material used can be decided arbitrarily insofar as the advantage of the present invention is not significantly impaired. However, it is preferable that the amount of the charge generation material is, to 100 weight parts of the binder resin in the charge generation layer, usually 30 weight parts or more, preferably 50 weight parts or more, more preferably 100 weight parts or more, and usually 500 weight parts or less, preferably 300 weight parts or less, more preferably 200 weight parts or less. When the amount of the charge generation material is too small, the sensitivity may be insufficient. When it is too large, the charging characteristics, sensitivity or the like of the photoreceptor may be lowered.

There is no special limitation on the film thickness of the charge generation layer. However, it is preferable that the thickness is usually 0.1 μm or larger, preferably 0.15 μm or larger, and usually 1 μm or smaller, preferably 0.6 μm or smaller.

The charge generation layer may contain additives. The additives are used for improving the film-formation capability, flexibility, coatability, stain resistance, gas resistance, light resistance, mechanical strength and the like of the photosensitive layer. Examples of the additives include plasticizer, antioxidant, UV absorbing agent, electron-withdrawing compound, dye and pigment. Examples of the antioxidant include hindered phenol compound and hindered amine compound. Examples of the dye and pigment include various colorant compounds and azo compounds. Other additives such as residual potential inhibitor for controlling the residual potential, dispersant aid for improving the dispersion stability, leveling agent (for example, silicone oil and fluorine-based oil) for improving the coatability, and surfactant can also be used.

Additives may be used either as a single kind or as a mixture of two or more kinds in any combination and in any ratio.

[II-3-3-2. Charge Transport Layer]

The charge transport layer is a layer in which charge transport material is contained. The polyester resin of the present invention, which is contained within the photosensitive layer in the present invention, is preferably contained in this charge transport layer. Further, in the first subject matter of the present invention, the hydrazone compound of the present invention is also contained in the charge transport layer as charge transport material.

The charge transport material forms the charge transport layer by being bound in the binder resin. At this point, as binder resin in the charge transport layer, the polyester resin of the present invention can be preferably used. In such case, other binder resin can be used together with the polyester resin of the present invention, as described before.

When the polyester resin of the present invention is contained in a layer of the photosensitive layer other than the charge transport layer (for example, charge generation layer), only binder resin that is other than the polyester resin of the present invention may be used as binder resin of the charge transport layer. Examples of the binder resin used in this case include the same ones as cited above as binder resin to be used together with the polyester resin of the present invention.

The binder resin in the charge transport layer may be used either as a single kind or as a mixture of two or more kinds in any combination and in any ratio.

The amount of the charge transport material used can be decided arbitrarily insofar as the advantage of the present invention is not significantly impaired. However, the amount of the charge transport material used is usually 20 weight parts or more to 100 weight parts of the binder resin in the photosensitive layer. Preferably it is 30 weight parts or more from the standpoint of decreasing the residual potential. More preferably, it is 40 weight parts or more in view of the stability after repeated uses and charge mobility. Among them, 50 weight parts or more is particularly preferable. On the other hand, it is usually 200 weight parts or less. Preferably it is 150 weight parts or less from the standpoint of the heat stability of the photosensitive layer. More preferably, it is 110 weight parts or less in view of the compatibility between the charge transport material and binder resin, and still more preferably it is 100 weight parts or less. Furthermore, it is particularly preferably 80 weight parts or less in view of the print resistance, and still more preferably it is 70 weight parts or less in view of the flaw resistance. When the amount of the charge transport material is too small, the electrical properties may be lowered. When it is too large, the coated film may be fragile, leading to worse abrasion resistance.

The film thickness of the charge transport layer has no special limitation. However, from the standpoint of long lifespan and image stability, it is in the range of usually 5 μm or larger, preferably 10 μm or larger, and usually 50 μm or smaller, preferably 45 μm or smaller, more preferably 30 μm or smaller.

The charge transport layer may contain other additives for the purpose of improving the film-formation capability, flexibility, coatability, stain resistance, gas resistance, light resistance and the like. Examples of the additives include the same ones as exemplified as additives which may be contained in the charge generation layer. The additives, also in the charge transport layer, may be used either as a single kind or as a mixture of two or more kinds in any combination and in any ratio.

The charge transport layer may be formed either by a single layer or by plural and laminated layers having different components or different compositions. When the charge transport layer includes more than one layers, it is preferable that at least one of layers contains the hydrazone compound, in addition to the polyester resin of the present invention.

[II-3-3-3. Monolayer Type (Dispersion Type) Photosensitive Layer]

A monolayer type photosensitive layer is constructed in a manner that the above-mentioned charge generation material is dispersed in the charge transport layer having the above-mentioned amount ratio. In the first subject matter of the present invention, a monolayer type photosensitive layer should surely contain the polyester resin of the present invention and hydrazone compound.

In the monolayer type photosensitive layer, the kinds of the charge transport material and binder resin, as well as the amount ratios of them used, are the same as those described for the charge transport layer of the lamination type photosensitive layer which contains the polyester resin of the present invention. Therefore, in the monolayer type photoreceptor, the polyester resin of the present invention and hydrazone compound are contained in the photosensitive layer.

The kind of the charge generation material is the same as described above. However, in this instance, it is preferable that the particle diameter of the charge generation material is sufficiently small. Specifically, it is usually 1 μm or smaller, and preferably 0.5 μm or smaller.

When the amount of the charge generation material dispersed in the photosensitive layer is too small, the sensitivity may be insufficient. When it is too large, the charging characteristics, sensitivity or the like of the photoreceptor may be lowered. Accordingly, the amount of the charge generation material in the monolayer type photosensitive layer is usually 0.5 weight % or more, preferably 1 weight % or more, and usually 50 weight % or more, preferably 20 weight %.

The film thickness of the monolayer type photosensitive layer is arbitrary, but it is usually 5 μm or larger, preferably 10 μm or larger, and usually 50 μm or smaller, preferably 45 μm or smaller.

The monolayer type photosensitive layer may contain additives, as is the case with the charge generation layer.

[II-3-4. Other Layers]

The photoreceptor may have additional layers besides the above-mentioned undercoat layer, charge generation layer, charge transport layer and monolayer type photosensitive layer.

A protective layer may be provided on the photosensitive layer for the purpose of preventing the wear of the photosensitive layer, or preventing or reducing the deterioration of the photosensitive layer due to the discharge product or the like generated from a charger or the like. Further, the top surface layer of the photoreceptor may contain fluorine-based resin, silicone resin and the like for the purpose of reducing the frictional resistance or abrasion on the surface of the photoreceptor. It may also contain particles comprising these resins, or particles of inorganic compounds.

[II-3-5. Formation Method of Each Layer]

There is no limitation on the formation method of each layer such as undercoat layer, photosensitive layer (charge generation layer, charge transport layer, monolayer type photosensitive layer) and protective layer. As an example, a known method can be cited in which a coating liquid, obtained by dissolving or dispersing a substance to be contained in the formed layer in a solvent, is sequentially applied on an electroconductive support directly or via other layer(s).

When a charge generation layer is formed, for example, a coating liquid is prepared in which a charge generation material, binder resin and, as required, solvent and additive are contained. Then the coating liquid prepared is applied on the electroconductive support directly or via other layer(s) (on the electroconductive support in the case of forward lamination type photosensitive layer (on the undercoat layer if an undercoat layer is provided) and on the charge generation layer in the case of reverse lamination type photosensitive layer).Thereafter, the solvent is removed by drying to form a charge generation layer.

When a charge transport layer is formed, for example, a coating liquid is prepared in which a charge transport material, binder resin and, as required, solvent and additive are contained. Then the coating liquid prepared is applied on the electroconductive support directly or via other layer(s) (on the charge generation layer in the case of forward lamination type photosensitive layer and on the electroconductive support in the case of reverse lamination type photosensitive layer (on the undercoat layer if an undercoat layer is provided)). Thereafter, the solvent is removed by drying to form a charge transport layer.

When a monolayer type photosensitive layer is formed, for example, a coating liquid is prepared in which a charge generation material, charge transport material, binder resin and, as required, solvent and additive are contained. The coating liquid is applied on the electroconductive support directly or via other layer(s) (on the undercoat layer if an undercoat layer is provided). Thereafter, the solvent is removed by drying to form a monolayer type photosensitive layer.

The method of coating is arbitrary. For example, such methods as dip coating, spray coating, nozzle coating, bar coating, roll coating and blade coating can be used. Of these methods, dip coating is preferable because of high productivity. These coating methods can be performed either as a single method or as a combination of two or more methods.

No particular limitation is imposed on the solvent, namely solvent medium or dispersion medium, used to prepare the coating liquid. Concrete examples are: alcohols such as methanol, ethanol, propanol and 2-methoxyethanol; ethers such as tetrahydrofuran, 1,4-dioxane and dimethoxyethane; esters such as methyl formate and ethyl acetate; ketones such as acetone, methyl ethyl ketone, cyclohexanone and 4-methoxy-4-methyl-2-pentanone; aromatic hydrocarbons such as benzene, toluene and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane and trichloroethylene; N-containing compounds such as n-butylamine, isopropanolamine, diethylamine, triethanolamine, ethylenediamine and triethylenediamine; non-protonic polar solvent such as acetonitrile, N-methylpyrrolidone, N,N-dimethylformamide and dimethylsulfoxide. These solvents can be used either as a single kind or as a mixture of two or more kinds in any combination and in any ratio.

No particular limitation is imposed on the amount of the solvent used, and depending on the intended use of the layer and the property of the solvent, it is preferable to adjust physicochemical properties of the coating liquid, such as solid component concentration and viscosity, appropriately in the desired range. Concrete examples of the ranges are as follows: When the coating liquid is used for the formation of a photosensitive layer of a monolayer type photoreceptor or a charge transport layer of a lamination type photoreceptor, it is desirable to adjust the amount of the solvent so that the solid component concentration of the coating liquid is usually 10 weight % or higher, preferably 15 weight % or higher, and usually 40 weight % or lower, preferably 35 weight % or lower. Further, in order to maintain the appropriate coating property of the coating liquid, it is desirable to adjust the composition and amount of the solvent so that the viscosity of the coating liquid is usually 50 mPa·s or higher, preferably 100 mPa·s or higher, and usually 1000 mPa·s or lower, preferably 600 mPa·s or lower.

Further, when the coating liquid is used for the formation of a charge generation layer of a lamination type photoreceptor, it is desirable to adjust the amount of the solvent so that the solid component concentration is usually 1 weight % or higher, preferably 2 weight % or higher, and usually 15 weight % or lower, preferably 10 weight % or lower. Further, in order to maintain the appropriate coating property of the coating liquid, it is desirable to adjust the composition and amount of the solvent so that the viscosity of the coating liquid is usually 0.1 mPa·s or higher, preferably 0.5 mPa·s or higher, and usually 10 mPa·s or lower, preferably 8 mPa·s or lower.

The above-mentioned polyester resin used as binder resin of the present invention is preferable because it is excellent in solubility in a solvent used in the coating process and also in stability in the coating liquid after dissolution. For example, the binder resin does not usually precipitates in the coating liquid for forming photosensitive layer, thus prevents white turbidity of the coating liquid advantageously. The reason for this advantage is not clear. It may be due to the chemical structure characteristic of the polyester resin of the present invention.

Further, the coating liquid mentioned above is very useful in that its electrical properties are stable with time. The old coating liquid for which some time has passed after preparation as well as new coating liquid immediately after preparation can both be used for the preparation of a photoreceptor which can usually maintain superior electrical properties, which is desirable. Concretely, the coating liquid mentioned above, with the passage of time, is not liable to cause change in solution state which is derived from formation of precipitate or gel, or change in the viscosity of the liquid, or the like. The liquid state of the coating liquid can be confirmed by visual observation of white turbidity in the liquid caused by the formation of precipitate or the like. No white turbidity formation can be interpreted as indicating that the solution is stable with time. Further, when the viscosity of the liquid is measured and its change is found to be small (for example, less than 10% in viscosity change rate after 3 months), this can be taken as an indication of good stability.

[II-3-6. Advantage of the Photoreceptor]

As described above, by containing the polyester resin of the present invention in the photosensitive layer, as well as containing hydrazone compound as charge transport material, a photosensitive layer excellent in abrasion resistance, electrical properties and mechanical strength can be obtained.

Incidentally, the photoreceptor according to the first subject matter of the present invention is exposed to form an electrostatic latent image by a write-in light from the exposure part while image forming. Any type of the write-in light can be used in that process insofar as an electrostatic latent image can be formed.

[II-4. Image Forming Device]

An embodiment of an image forming device using the electrophotographic photoreceptor according to the first subject matter of the present invention (image forming device according to the first subject matter of the present invention) will be described below with reference to FIG. 1 illustrating the essential part of the structure of the device. It is to be understood that the embodiment is not limited to the one explained below and any modification can be added thereto so long as it does not depart from the scope of the present invention.

As shown in FIG. 1, the image forming device comprises an electrophotographic photoreceptor 1, charging apparatus (charging part) 2, exposure apparatus (exposure part, image-exposing part) 3 and developing apparatus (developing part) 4. As appropriate, it further comprises a transfer apparatus (transfer part) 5, cleaning apparatus (cleaning part) 6 and fixing apparatus (fixing part) 7.

Electrophotographic photoreceptor 1 is not particularly limited insofar as it is the above-described electrophotographic photoreceptor according to the first subject matter of the present invention. In FIG. 1, as one example thereof, a drum-form photoreceptor in which the above-described photosensitive layer is formed on the surface of a cylindrical electroconductive support. Along the outer circumference of electrophotographic photoreceptor 1, charging apparatus 2, exposure apparatus 3, developing apparatus 4, transfer apparatus 5 and cleaning apparatus 6 are disposed respectively.

Charging apparatus 2 charges electrophotographic photoreceptor 1. More specifically, it uniformly charges the surface of electrophotographic photoreceptor 1 to a predetermined potential. A roller-type charging apparatus (charging roller) is shown in FIG. 1, as one example of charging apparatus 2, but as other types thereof, a corona charging apparatus such as corotron or scorotron, a contact charging apparatus such as a brush charger, and the like are popularly used.

Electrophotographic photoreceptor 1 and charging apparatus 2 are often designed to be removable from the main body of the image forming device, in the form of a cartridge (electrophotographic photoreceptor cartridge of the present invention, hereinafter referred to as "photoreceptor cartridge" as appropriate) comprising both of them. At this point, charging apparatus 2 may be provided separately from the cartridge, for example at the main body of the image forming device. When, for example, electrophotographic photoreceptor 1 or charging apparatus 2 is deteriorated, the photoreceptor cartridge can be taken out from the main body of the image forming device and another new photoreceptor cartridge can be attached to the main body of the image forming apparatus. By the way, in many cases, the toner, to be described later, is stored in a toner cartridge and the cartridge is designed to be removable from the main body of the image forming device. And when the toner in the toner cartridge is used up, the toner cartridge can be taken out from the main body of the image forming device, and another new toner cartridge can be attached. Further, a cartridge can be used which comprises all of electrophotographic photoreceptor 1, charging apparatus 2 and toner.

There is no limitation on the type of exposure apparatus 3 insofar as it can expose (image-expose) electrophotographic photoreceptor 1 to form an electrostatic latent image on the photosensitive surface of electrophotographic photoreceptor 1. Concrete examples thereof include a halogen lamp, a fluorescent lamp, laser such as semiconductor laser or He—Ne laser and light-emitting diode (LED). Further, the exposure process may be carried out in a method of photoreceptor-internal image exposure. There is no special limitation on the type of the light used for the exposure, but a monochromatic light is generally preferable. Examples of the wavelength (exposure wavelength) of the preferable monochromatic light include 700 nm to 850 nm, 600 nm to 700 nm (comparatively short wavelength), and 300 nm to 500 nm (short wavelength).

Particularly, in order to expose an electrophotographic photoreceptor using phthalocyanine compound as charge generation material, it is preferable to use a monochromatic light having wavelength of 700 nm to 850 nm. On the other hand, in order to expose an electrophotographic photoreceptor using azo compound, it is preferable to use a white light or a monochromatic light having wavelength of 700 nm or shorter.

There is no limitation on the type of developing apparatus 4 insofar as it can develop the electrostatic latent image formed on exposed electrophotographic photoreceptor 1 into a visible image. Concretely, developing apparatuses utilizing any developing method, such as dry development including cascade development, single component development using conductive toner and two component development using magnetic brush, or a wet development, can be used. In FIG. 1, developing apparatus 4 comprises developing tank 41, agitator 42, supply roller 43, developing roller 44 and control member 45, and toner T is stored in developing tank 41. Further, as appropriate, a supply apparatus (not shown in FIG.) for supplying toner T may be added to developing apparatus 4. The supply apparatus is constructed so that it can supply toner T from a container such as a bottle or cartridge.

Supply roller 43 is formed of conductive sponge or the like. Developing roller 44 is composed of, for example, a metal roll such as iron, stainless steel, aluminum or nickel, or a resin roll in which such metal roll is covered with silicon resin, urethane resin, fluorine resin or the like. The surface of developing roller 44 may be smoothed or roughened as appropriate.

Developing roller 44 is disposed between electrophotographic photoreceptor 1 and supply roller 43, being in contact with each of electrophotographic photoreceptor 1 and supply roller 43. However, developing roller 44 and electrophotographic photoreceptor 1 may not be in contact with, but may be positioned close to each other. Supply roller 43 and developing roller 44 are rotated by a rotation drive mechanism (not shown in FIG.). Supply roller 43 carries stored toner T and supplies it to developing roller 44. Developing roller 44 carries toner T supplied by supply roller 43 and makes it touch to the surface of electrophotographic photoreceptor 1.

Control member 45 is composed of, for example, a resin blade such as silicone resin or urethane resin, a metal blade such as stainless steel, aluminum, copper, brass or phosphor bronze, or a blade in which such metal blade is covered with resin. Control member 45 is usually in contact with developing roller 44, and is pressed under a predetermined force to developing roller 44 by, for example, a spring (general blade linear pressure is 0.05 N/cm to 5 N/cm). As appropriate, this control member 45 may have a function to charge toner T by means of frictional electrification with toner T.

Agitators 42, provided as needed, is each rotated by a rotation drive mechanism, stirs toner T and transports toner T toward supply roller 43. A plurality of agitators 42 with different blade shapes or sizes may be provided.

There is no limitation of the type of the toner. For example, powdery toner, as well as polymerized toner produced by suspension polymerization or emulsion polymerization, may be used. Particularly, when using polymerized toner, one having small particle size about 4 μm to 8 μm is preferable. Further, toners having various particle shapes, such as nearly spherical or far from spherical like potato-shape, can be used. Polymerized toner excels in charge uniformity and transfer properties, and therefore is preferably used to achieve a high quality image.

There is no special restriction on the type of transfer apparatus 5. Transfer apparatus 5 utilizing any transfer method, such as electrostatic transfer including corona transfer, roller transfer and belt transfer; pressure transfer; or adhesive transfer, can be used. In this case, it is assumed that transfer apparatus 5 is constructed so that it comprises a transfer charger, transfer roller, transfer belt and the like which are arranged facing electrophotographic photoreceptor 1. This transfer apparatus 5 applies a predetermined voltage (transfer voltage) at a polarity opposite to the charged potential of toner T and transfers a toner image formed on electrophotographic photoreceptor 1 to a recording paper (paper sheet, medium, or transfer target) P.

There is no special limitation on cleaning apparatus 6, and any type of cleaning apparatus such as a brush cleaner, magnetic brush cleaner, electrostatic brush cleaner, magnetic roller cleaner or a cleaning blade may be used. Cleaning apparatus 6 scrapes away the residual toner attached to photoreceptor 1 with a cleaning member and retrieves the residual toner. However, in the case that just a little or almost no residual toner is attached to the photoreceptor surface, cleaning apparatus 6 may be omitted.

Fixing apparatus 7 comprises upper fixing member (pressure roller) 71 and lower fixing member (fixing roller) 72. Heating apparatus 73 is provided inside the fixing member 71 or 72. FIG. 1 illustrates an example wherein heating apparatus 73 is provided inside the upper fixing member 71. As each of upper and lower fixing members 71 and 72, a known heat fixing member such as a fixing roll in which a metal cylinder, such as of stainless steel or aluminum, is covered with silicon rubber, another type of fixing roll in which the above-mentioned fixing roll is further covered with Teflon (registered trademark), or a fixing sheet may be used. Each of fixing members 71 and 72 may have a structure that can supply a release agent such as silicone oil so as to improve the releasability. They may also have a structure that forcibly applies pressure to each other by a spring or the like.

The toner transferred on recording paper P is heated until it presents a molten state when it passes between upper fixing member 71 and lower fixing member 72, which have been heated to a predetermined temperature, cooled after the passage, and fixed on recording paper P.

There is no special limitation on the type of the fixing apparatus either, and fixing apparatuses utilizing any fixing methods, in addition to the method described above, such as heat roller fixing, flash fixing, oven fixing or pressure fixing, can be used.

In the electrophotographic device constructed as described above, the image recording is performed by a charging process for charging the photoreceptor, exposure process for exposing the charged photoreceptor and forming an electrostatic latent image, development process for developing the electrostatic latent image with toner, and transfer process for transferring the toner to a transfer target. More specifically, first, the surface (photosensitive surface) of photoreceptor 1 is charged to a predetermined potential (−600 V, for example) by charging apparatus 2 (charging process). At this point, it may be charged by a direct voltage only or by a direct voltage superimposed with an alternating voltage.

Then the photoreceptor is exposed to form an electrostatic latent image (exposure process). Namely, the charged photosensitive surface of photoreceptor 1 is exposed by exposure apparatus 3 according to the image to be recorded to form an electrostatic latent image on the photosensitive surface. Then, the electrostatic latent image formed on the photosensitive surface of photoreceptor 1 is developed by developing apparatus 4 (development process).

Developing apparatus 4 charges toner T by means of frictional electrification into a predetermined polarity (in this case, the same polarity as the charged potential of photoreceptor 1, namely, negative polarity), while thinning it with control member (developing blade) 45, and carries it by making it retained on developing roller 44 so as to bring it into contact with the surface of photoreceptor 1.

When the charged toner T retained by developing roller 44 touches the surface of photoreceptor 1, a toner image corresponding to the electrostatic latent image is formed on the photosensitive surface of photoreceptor 1. Then, the toner image is transferred to recording paper P by transfer apparatus 5 (transfer process). Subsequently, the toner remaining on the photosensitive surface of photoreceptor 1 without being transferred is removed by cleaning apparatus 6.

After the toner image is transferred to recording paper P, an image is finally obtained by heat fixing of the toner image on recording paper P when it passes through fixing apparatus 7.

The image forming device may have a structure having additional function of, for example, charge removal process, compared with the above-described structure. In a charge removal process, charge is removed from an electrophotographic photoreceptor by exposing the electrophotographic photoreceptor. As charge removal apparatus, a fluorescent lamp, LED or the like is used. The exposure energy of the light used in a charge removal process often has an intensity more than three times as strong as that of the exposure light.

In addition, the image forming device may have a further modified structure. For example, a structure capable of carrying out a process such as pre-exposure or supplementary charging, a structure capable of performing offset printing, or a full-color, tandem-type structure utilizing plural types of toners.

Photoreceptor 1 may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7. And this electrophotographic photoreceptor cartridge may be designed to be removable from the main body of the electrophotographic device such as copying machine or laser beam printer. For example, the cartridge may be constructed by combining at least one of charging apparatus 2, exposure apparatus 3, developing apparatus 4 and transfer apparatus 5 together with photoreceptor 1. Also in this case, as is the case with the cartridge described in the above embodiment, for example when electrophotographic photoreceptor 1 or some other member is deteriorated, the electrophotographic photoreceptor cartridge can be taken out from the main body of the image forming device and another new electrophotographic photoreceptor cartridge can be attached to the main body of the image forming device, leading to easier maintenance of the image forming device.

[III. Second Subject Matter]

The electrophotographic photoreceptor according to the second subject matter of the present invention comprises at least a photosensitive layer on an electroconductive support. The photosensitive layer includes a polyester resin containing a repeating structural unit represented by the above formula (1) (namely, polyester resin of the present invention) and, as charge transport material, only includes a charge transport material containing substantially no unsaturated bond other than aromatic ring. The polyester resin contained in the photosensitive layer is used as binder resin.

[III-1. Polyester Resin]

The polyester resin of the present invention is the same as described in [I. Polyester resin of the present invention].

The polyester resin of the present invention, in the second subject matter of the present invention, can be used for an electrophotographic photoreceptor in combination with other resin. Other resin that can be used with in this subject matter is the same as described in the first subject matter. Therefore, the concrete examples, mixing ratio or the like of other resin in the second subject matter of the present invention are the same as those in the first subject matter of the present invention.

[III-2. Charge Transport Material Containing no Unsaturated Bond Other than Aromatic Ring]

The charge transport material according to the second subject matter of the present invention is a substance that is contained in the photosensitive layer of a monolayer type photoreceptor or in the charge transport layer of a lamination type photoreceptor, at the time of producing the photosensitive layer. At this point, for the photoreceptor according to the second subject matter of the present invention, as charge transport material, a charge transport material containing substantially no unsaturated bond other than aromatic ring is used. The charge transport material here may comprise aromatic ring or may not. The reason why only charge transport material containing substantially no unsaturated bond other than aromatic ring is used is as follows. Namely, when forming a photoreceptor, layers are formed by coating and drying a coating liquid (for example, coating liquid for forming photosensitive layer, and coating liquid for forming charge transport layer), which is prepared by containing a binder resin and charge transport material. In this process, the charge transport material may be decomposed as time passes if a charge transport material having unsaturated bond other than aromatic ring exists in the coating liquid containing the polyester resin of the present invention, due to high reactivity. As a result, the performance of the electrophotographic photoreceptor, produced in that process, may be lowered.

In this context, "substantially" does not mean that charge transport materials, other than those containing no unsaturated bond except aromatic ring, are utterly eliminated, but it means that charge transport materials, other than those containing no unsaturated bond except aromatic ring, may be contained when the amount is small or when having the unsaturated bond with little reactivity only to the extent that the advantageous effect of the present invention can be achieved. More specifically, for example, various impure charge transport materials, such as a residue in a reaction vessel at the time of charge transport material production, another residue in a dissolution bath when preparing a coating liquid for forming photosensitive layer, or still another residue when replacing a coating liquid in a coating liquid vessel, may be accidentally contained. These small amount of impure charge transport materials, represented by the above examples, are usually 10 weight % or less in the whole charge transport material. However, in the second subject matter of the present invention, it is preferably 5 weight % or less, and particularly preferably 3 weight % or less.

There is no special limitation on the kind of the charge transport material of the present subject matter, insofar as it is a charge transport material containing no unsaturated bond other than aromatic ring. For example, a compound represented by any one of the following formulae (9) to (11) can be cited.

[Chemical Formula 23]

(9)

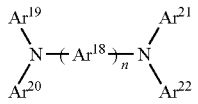

(In the above formula (9), $Ar^{18}$ represents an arylene group, $Ar^{19}$ to $Ar^{22}$ each represents, independently of each other, an aryl group, and n represents a natural number. $Ar^{18}$ to $Ar^{22}$ may have a substituent containing no unsaturated bond other than aromatic ring.)

In the formula (9), $Ar^{18}$ represents an arylene group. No particular limitation is imposed on the number of carbon atoms of $Ar^{18}$, insofar as the advantage of the present invention is not significantly impaired. Usually, it is 6 or more and 14 or less, preferably 12 or less, and particularly preferably it is 6.

No particular limitation is imposed on the number of rings of $Ar^{18}$ either, insofar as the advantage of the present invention is not significantly impaired. Usually, it is 1 or more and 3 or less, preferably 2 or less, and particularly preferably it is 1.

Concrete examples of $Ar^{18}$ include: phenylene group, naphthylene group and anthrylene group.

In the formula (9), $Ar^{19}$ to $Ar^{22}$ each represents, independently of each other, an aryl group. No particular limitation is imposed on the number of carbon atoms of $Ar^{19}$ to $Ar^{22}$, insofar as the advantage of the present invention is not significantly impaired. Usually, it is 6 or more and 14 or less, preferably 12 or less, more preferably 8 or less, and particularly preferably it is 7 or less.

The number of rings constituting $Ar^{19}$ to $Ar^{22}$ is also arbitrary insofar as the advantage of the present invention is not significantly impaired. Usually, it is 3 or less, preferably 2 or less, and more preferably it is 1.

Concrete examples of $Ar^{19}$ to $Ar^{22}$ include: phenyl group, p-methylphenyl group and m-methylphenyl group.

Furthermore, $Ar^{18}$ to $Ar^{22}$ each may have, independently of each other, a substituent containing no unsaturated bond other than aromatic ring. Examples of such substituent having no unsaturated bond include: alkyl group, aryl group, halogen group and alkoxy group. These substituents may be connected with each other to form a ring. The substituent may be present either as a single substituent or as 2 or more substituents in any combination and in any ratio.

In the formula (9), n represents a natural number. Concretely, it is a natural number which is usually 1 or larger and 10 or smaller, and preferably 3 or smaller. When n is too large, production of the charge transport material may be difficult.

When n is 2 or more, $Ar^{18}$ may be the same group or different groups.

[Chemical Formula 24]

(10)

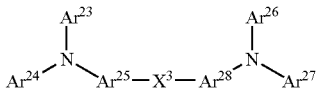

(In the above formula (10), $Ar^{23}$, $Ar^{24}$, $Ar^{26}$ and $Ar^{27}$ each represents, independently of each other, an aryl group, $Ar^{25}$ and $Ar^{28}$ each represents, independently of each other, an arylene group, and $X^3$ represents a bivalent group containing no unsaturated bond other than aromatic ring. At this point, $Ar^{23}$ to $Ar^{28}$ and $X^3$ may have a substituent containing no unsaturated bond other than aromatic ring.)

In the formula (10), $Ar^{23}$, $Ar^{24}$, $Ar^{26}$ and $Ar^{27}$ each represents, independently of each other, an aryl group. There is no special limitation on the number of carbon atoms of $Ar^{23}$, $Ar^{24}$, $Ar^{26}$ and $Ar^{27}$, insofar as the advantage of the present invention is not significantly impaired. However, it is desirable that it is in the same range as that described for $Ar^{19}$ to $Ar^{22}$ in the explanation about formula (9).

There is no special limitation on the number of rings of $Ar^{23}$, $Ar^{24}$, $Ar^{26}$ and $Ar^{27}$, insofar as the advantage of the present invention is not significantly impaired. However, it is desirable that it is in the same range as that described for $Ar^{19}$ to $Ar^{22}$ in the explanation about formula (9).

Concrete examples of $Ar^{23}$ $Ar^{24}$ $Ar^{26}$, and $Ar^{27}$ include the same group as those described for the formula (9) as example of $Ar^{19}$ to $Ar^{22}$.

Further, in the formula (10), $Ar^{25}$ and $Ar^{28}$ each represents, independently of each other, an arylene group. No particular limitation is imposed on the number of carbon atoms of $Ar^{25}$ and $Ar^{26}$, insofar as the advantage of the present invention is not significantly impaired. However, it is desirable that it is in the same range as that described for $Ar^{18}$ in the explanation about formula (9).

No particular limitation is imposed on the number of rings of $Ar^{25}$ and $Ar^{28}$ either, insofar as the advantage of the present invention is not significantly impaired. However, it is desirable that it is in the same range as that described for $Ar^{18}$ in the explanation about formula (9).

Concrete examples of $Ar^{25}$ and $Ar^{28}$ include the same group described as example of $Ar^{18}$ in the formula (9)

Furthermore, $Ar^{23}$ to $Ar^{28}$ each may have, independently of each other, a substituent containing no unsaturated bond other than aromatic ring. Examples of such substituent having no unsaturated bond include alkyl group, aryl group, halogen group and alkoxy group. These substituents may be connected with each other to form a ring. The substituent may be present either as a single substituent or as 2 or more substituents in any combination and in any ratio.

In the formula (10), $X^3$ represents a bivalent group containing no unsaturated bond other than aromatic ring. Concrete examples of $X^3$ include: oxygen atom, cycloalkylidene group, —O—$CH_2$—O— and —$CR^eR^f$—. $R^e$ and $R^f$ each represents, independently of each other, a hydrogen atom, alkyl group, aryl group, halogen group or alkoxy group. $R^e$ and $R^f$ may be connected with each other to form a ring.

With respect to $R^e$ and $R^f$, preferable as aryl group are phenyl group and naphthyl group. Preferable as halogen group are a fluorine atom, chlorine atom, bromine atom and iodine atom, and preferable as alkoxy group are methoxy group, ethoxy group and butoxy group. When $R^e$ or $R^f$ is an alkyl group, the carbon number of the alkyl group is usually 1 or more, and usually 10 or less, preferably 8 or less, more preferably 3 or less.

Furthermore, it is preferable that $X^3$ has a chiral center. Therefore, when $X^3$ is —$CR^eR^f$—, it is preferable that the carbon atom of —$CR^eR^f$— (namely, carbon atom to which $R^e$ and $R^f$ are attached) is a chiral carbon (asymmetric carbon). In this way, a charge transport compound expressed by formula (10) is optically active, and therefore, compatibility in binder resins and solubility in solvents become high, which is an advantage. As an example of such $X^3$, d —$C(CH_3)(CH_2CH_3)$— can be cited.

[Chemical Formula 25]

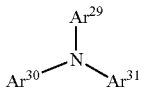

(11)

(In the above formula (11), $Ar^{29}$ to $Ar^{31}$ each represents, independently of each other, an aryl group. $Ar^{29}$ to $Ar^{31}$ may have a substituent containing no unsaturated bond other than aromatic ring.)

In the formula (11), $Ar^{29}$ to $Ar^{31}$ each represents, independently of each other, an aryl group. No particular limitation is imposed on the number of carbon atoms of $Ar^{29}$ to $Ar^{31}$, insofar as the advantage of the present invention is not significantly impaired. However, it is desirable that it is in the same range as that described for $Ar^{19}$ to $Ar^{22}$ in the explanation about formula (9).

The number of rings constituting $Ar^{29}$ to $Ar^{31}$ is also arbitrary insofar as the advantage of the present invention is not significantly impaired. However, it is desirable that it is in the same range as that described for $Ar^{19}$ to $Ar^{22}$ in the explanation about formula (9). However, for the formula (11) in particular, it is desirable that one of the $Ar^{29}$ to $Ar^{31}$ is biphenyl.

As a concrete example of $Ar^{29}$ to $Ar^{31}$, the same group described as example of $Ar^{19}$ to $Ar^{22}$ in the formula (9) can be cited.

Furthermore, $Ar^{29}$ to $Ar^{31}$ each may have, independently of each other, a substituent containing no unsaturated bond other than aromatic ring. Examples of such substituent containing no unsaturated bond include alkyl group, aryl group, halogen group and alkoxy group. These substituents may be connected with each other to form a ring. The substituent may be present either as a single substituent or as 2 or more substituents in any combination and in any ratio.

There is no special limitation on the molecular weight of the charge transport material according to the present subject matter, represented in any one of the formulae (9) to (11), insofar as the advantage of the present invention is not significantly impaired. It is usually 2000 or lower, preferably 1000 or lower.

Concrete examples of the charge transport material of the present subject matter will be cited below. It should be noted that the charge transport material of the present subject matter is not limited to these examples.

The following compounds can be cited as examples of the charge transport material according to the present subject matter, which is expressed by the above formula (9).

[Chemical Formula 26]

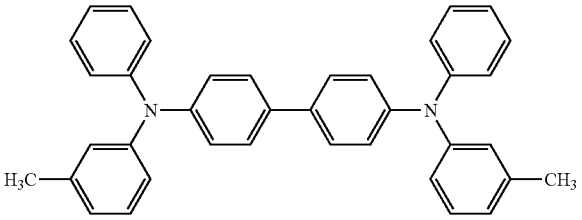

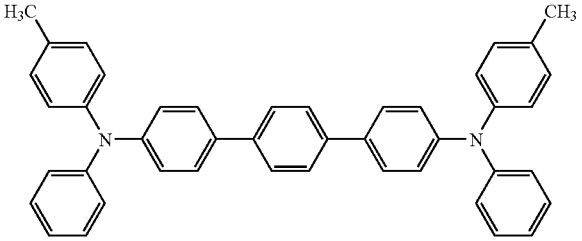

-continued

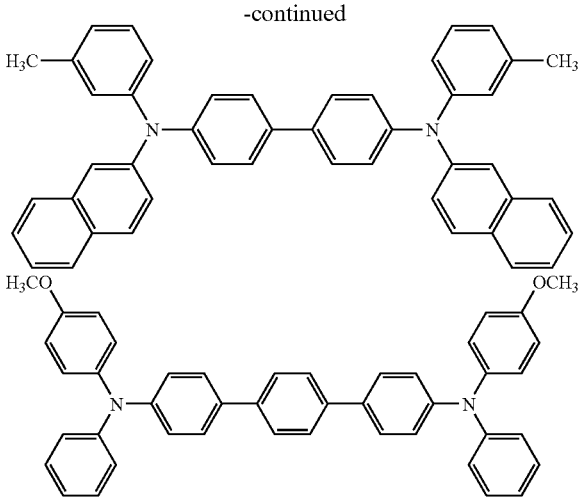

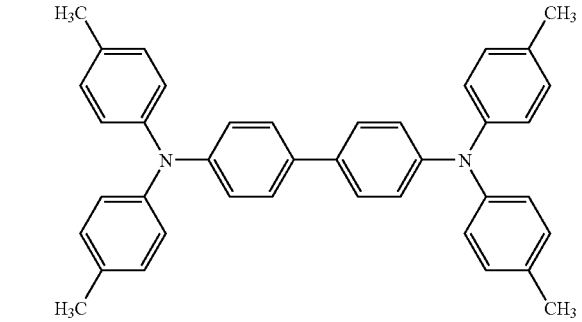

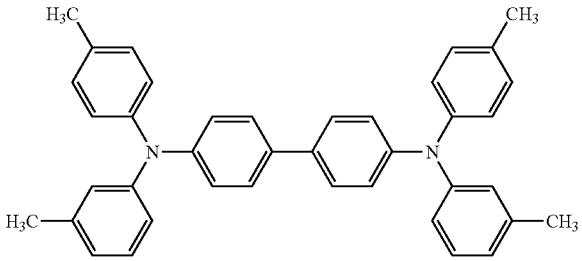

The following compounds can be cited as examples of the charge transport material according to the present subject matter, which is expressed by the above formula (10). Of these compounds, those listed in the bottom are preferable.

[Chemical Formula 27]

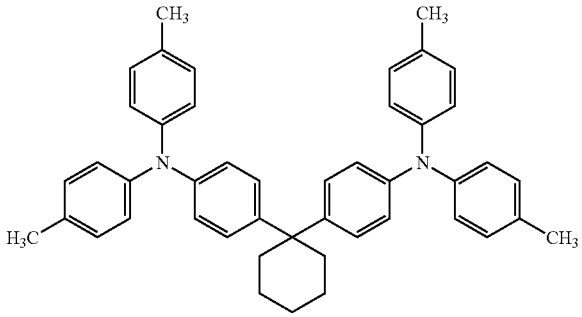

-continued

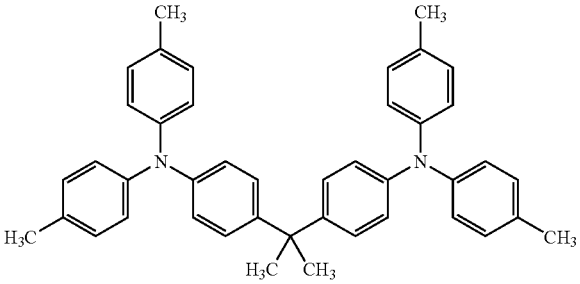

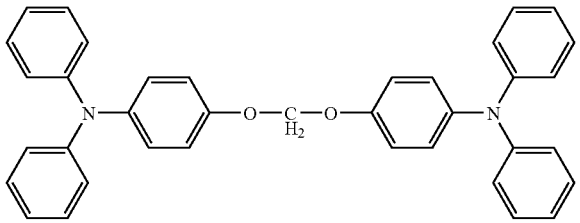

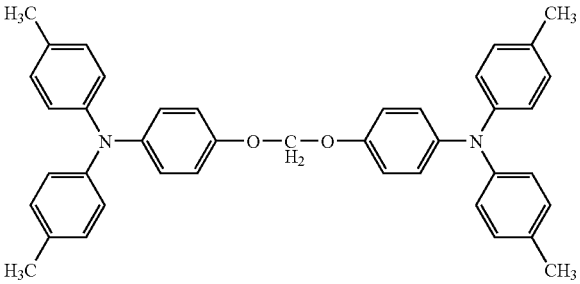

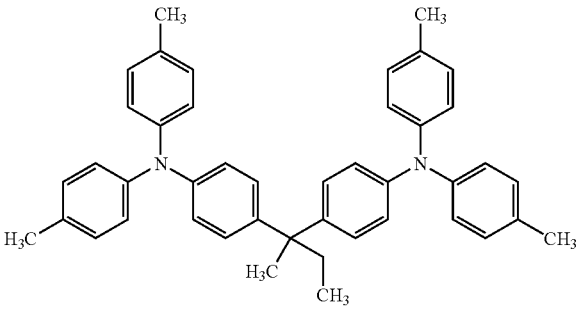

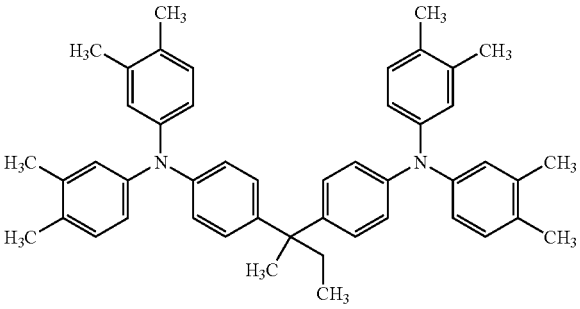

The following compounds can be cited as examples of the charge transport material according to the present subject matter, which is expressed by the above formula (11). Of these compounds, one listed in the right end is preferable.

[Chemical Formula 28]

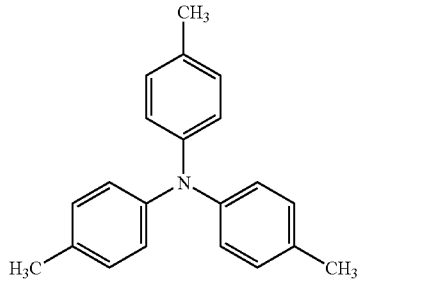

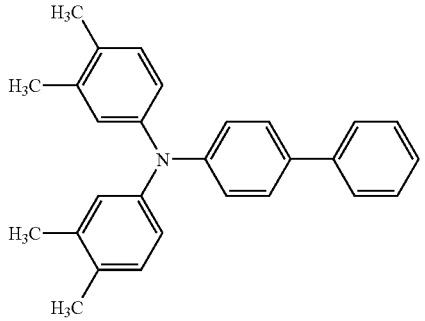

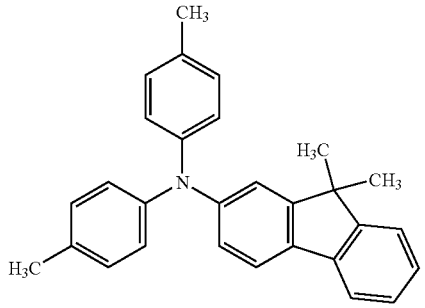

These charge transport materials according to the present subject matter can be used either as a single kind, or as a mixture of two or more kinds in any combination and in any ratio.

The amount of the charge transport material used in the present subject matter can be decided arbitrarily insofar as the advantage of the present invention is not significantly impaired. However, when it is used for the photosensitive layer of the monolayer type photoreceptor as well as when it is used for the charge transport layer of the lamination type photoreceptor, the amount of the charge transport material according to the present subject matter, relative to 100 weight parts of the binder resin (namely, sum of the polyester resin of the present invention and other resin added), is usually 30 weight parts or larger, preferably 40 weight parts or larger, more preferably 50 weight parts or larger, and usually 200 weight parts or smaller, preferably 150 weight parts or smaller, more preferably 100 weight parts or smaller. When the amount of the charge transport material is too small, electrical characteristics may deteriorate. When it is too large, a film formed by application of the coating liquid for forming photosensitive layer or charge transport layer may become fragile and the abrasion resistance may deteriorate.

[III-3. Electrophotographic Photoreceptor]

The photoreceptor according to the second subject matter of the present invention comprises at least a photosensitive layer on an electroconductive support. The photosensitive layer, in the second subject matter of the present invention, has a layer including the polyester resin of the present invention and a charge transport material. However, in this layer, which includes the polyester resin of the present invention and a charge transport material, only a charge transport material according to the present invention, containing substantially no unsaturated bond other than aromatic ring, is used as charge transport material. The polyester resin of the present invention functions as binder resin in the photosensitive layer.

The type of the photosensitive layer includes a monolayer type and lamination type, as described above. A lamination type photosensitive layer has a charge generation layer and a charge transport layer. At this point, when the photosensitive layer comprises two or more layers (for example, charge generation layer and charge transport layer), the polyester resin represented by the above formula (1) (namely, the polyester resin of the present invention) and the charge transport material containing no unsaturated bond other than aromatic ring may be contained in at least one of the layers forming the photosensitive layer. However, they are usually used for the same layer of the photosensitive layer, and preferably for the charge transport layer of a lamination type photosensitive layer.

[III-3-1. Electroconductive Support]

The electroconductive support is the same as explained for [II-3-1. Electroconductive support] of the first subject matter.

[III-3-2. Undercoat layer]

The undercoat layer is the same as explained for [II-3-2. Undercoat layer] of the first subject matter.

[III-3-3. Photosensitive Layer]

The photosensitive layer is provided on the electroconductive support (when using an undercoat layer, via the undercoat layer on the electroconductive support). The type of the photosensitive layer includes a lamination type, in which a charge generation layer and a charge transport layer are provided, and a monolayer type, in which both the charge transport material and charge generation material are contained in the same layer. The photosensitive layer has a layer including, in addition to the polyester resin of the present invention, only the above-mentioned charge transport material containing no unsaturated bond other than aromatic ring as charge transport material. Namely, when the photosensitive layer comprises only one layer, the very photosensitive layer contains, in addition to the polyester resin of the present invention, only the above-mentioned charge transport material containing no unsaturated bond other than aromatic ring as charge transport material. When the photosensitive layer comprises two or more layers, at least one layer of them contains, in addition to the polyester resin of the present invention, only the above-mentioned charge transport material containing no unsaturated bond other than aromatic ring as charge transport material. Furthermore, the photosensitive layer according to the present subject matter is the same as the photosensitive layer according to the first subject matter, except that, in the layer containing the polyester resin of the present invention and charge transport material, a hydrazone compound is not necessarily used as charge transport material, but instead, only a charge transport material containing substantially no unsaturated bond other than aromatic ring is used.

[III-3-3-1. Charge Generation Layer]

The charge generation layer is the same as explained for [II-3-3-1. Charge generation layer] of the first subject matter.

[III-3-3-2. Charge Transport Layer]

The charge transport layer of the second subject matter of the present invention is the same as explained for [II-3-3-2. Charge transport layer], except that a hydrazone compound is not necessarily used as charge transport material, but instead, only the above-mentioned charge transport material containing no unsaturated bond other than aromatic ring is used as charge transport material.

Accordingly, the polyester resin of the present invention, which is contained within the photosensitive layer in the second subject matter of the present invention, is preferably contained in this charge transport layer. In addition, only charge transport material according to the present invention, containing substantially no unsaturated bond other than aromatic ring, should be used as charge transport material. The charge transport material forms the charge transport layer by being bound in the binder resin. At this point, as binder resin, the polyester resin of the present invention can be preferably used. With such a construction, in which the charge transport layer contains both the polyester resin of the present invention and the charge transport material according to the present subject matter, containing no unsaturated bond other than aromatic ring, and does not use a charge transport material other than the charge transport material according to the present subject matter, not only the electrical properties but the mechanical strength of the charge transport layer can be enhanced. This results in that the electrical properties and mechanical strength of the photosensitive layer can be improved.

At this point, the charge transport layer may be formed either by a single layer or by plural and laminated layers having different components or different compositions, similarly to the first subject matter. When the charge transport layer includes two or more layers, at least one layer should include substantially only charge transport material according to the present invention as charge generation material, in addition to the polyester resin of the present invention.

When the charge transport layer includes more than two or more layers and a part of the layers contains substantially only charge transport material according to the present subject matter as charge transport material, in addition to the polyester resin of the present invention, the other layers may contain binder resin other than the polyester resin of the present invention. However, for the sake of the distinguished advantageous effect of the present invention, it is preferable that each of all layers of the charge transport layer contains substantially only charge transport material according to the present subject matter as charge transport material, in addition to the polyester resin of the present invention.

[III-3-3-3. Monolayer Type (Dispersion Type) Photosensitive Layer]

A monolayer type photosensitive layer is, also in the second subject matter of the present invention, constructed in such a way that the above-mentioned charge generation material is dispersed in the charge transport layer of the above composition. Namely, the monolayer type photosensitive layer according to the second subject matter of the present invention is the same as explained for [II-3-3-3. Monolayer type (dispersion type) photosensitive layer] in the first subject matter, except that a hydrazone compound is not necessarily used as charge transport material, but instead, only the above-mentioned charge transport material containing no unsaturated bond other than aromatic ring is used as charge transport material.

[III-3-4. Other Layers]

The photoreceptor may have additional layers besides the above-mentioned undercoat layer, charge generation layer, charge transport layer and monolayer type photosensitive layer.

The other layer is the same as explained for [II-3-4. Other layers] of the first subject matter.

[III-3-5. Formation Method of Each Layer]

The formation method of each layer such as undercoat layer, photosensitive layer (charge generation layer, charge transport layer, monolayer type photosensitive layer) and protective layer is the same as explained for [II-3-5. Formation method of each layer] of the first subject matter. In particular, the excellent stability of the coating liquid, when using the polyester resin of the present invention, is also the same.

[III-3-6. Advantage of the Photoreceptor]

As described above, by containing the polyester resin of the present invention in the photosensitive layer in combination with, as charge transport material, only charge transport material according to the present invention containing substantially no unsaturated bond other than aromatic ring, a photosensitive layer excellent in abrasion resistance, electrical properties and mechanical strength can be obtained.

Incidentally, the photoreceptor of the present invention is exposed to form an electrostatic latent image by a write-in light from the exposure part while image forming. Any type of the write-in light can be used in that process insofar as an electrostatic latent image can be formed. However, among them, a monochromatic light having exposure wavelength of usually 380 nm or longer, particularly 400 nm or longer, and usually 500 nm or shorter, particularly 480 nm or shorter can be preferably used. In this way, a photoreceptor excellent in abrasion resistance can be exposed with a light having smaller spot-size, leading to high quality image formation with high resolution and excellent tone reproduction.

[III-4. Image Forming Device]

The image forming device according to the second subject matter of the present invention is the same as explained for [II-4. Image forming device] in the first subject matter, except that it uses the above-mentioned photoreceptor according to the second subject matter of the present invention as electrophotographic photoreceptor. However, it is preferable that, as described above, a monochromatic light having exposure wavelength of 380 nm to 500 nm is used as exposure light of exposure apparatus 3.

In addition, also in the second subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7.

[IV. Third Subject Matter]

The electrophotographic photoreceptor according to the third subject matter of the present invention comprises at least a photosensitive layer on an electroconductive support. The photosensitive layer includes a polyester resin containing a repeating structural unit represented by the above formula (1) (namely, polyester resin of the present invention) and, in addition, a compound represented by the following formula (2) to be described later. The polyester resin contained in the photosensitive layer is used as binder resin and the compound of formula (2) is used as charge transport material.

[IV-1. Polyester Resin of the Present Invention]

The polyester resin of the present invention is the same as described in [I. Polyester resin of the present invention].

The polyester resin of the present invention, in the third subject matter of the present invention, can be used for an electrophotographic photoreceptor in combination with other resin. Other resins that can be used with in this subject matter are the same as described in the first subject matter. Therefore, the concrete examples, mixing ratio or the like of other resin in the third subject matter of the present invention is the same as those in the first subject matter of the present invention.

[IV-2. Diamine Compound]

Diamine compound represented by the formula (2) will be explained here. In the third subject matter of the present invention, diamine compound contained in the photosensitive layer, represented by the formula (2) below, is contained as charge transport material. The formula (2) includes a compound of n=2 in the formula (9), explained in [III-2. Charge transport material containing no unsaturated bond other than aromatic ring].

[Chemical Formula 29]

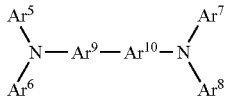

(2)

(In the formula (2), $Ar^5$ to $Ar^8$ each represents, independently of each other, an aryl group that may have a substituent of 8 or less carbon atoms. $Ar^9$ and $Ar^{10}$ each represents, independently of each other, an arylene group that may have a substituent.)

In the formula (2), $Ar^5$ to $Ar^8$ each represents, independently of each other, an aryl group that may have a substituent of 8 or less carbon atoms. Phenyl group and naphthyl group can be cited as examples of the aryl group, and phenyl group is preferable. As substituent, alkyl group can be cited such as methyl group, ethyl group, propyl group, isopropyl group, pentyl group, isopentyl group, neopentyl group, 1-methylbutyl group, 1-methylheptyl group, dodecyl group, hexadecyl group and octadecyl group; aralkyl group such as phenyl group, benzyl group and phenethyl group; alkoxy group; hydroxyl group; nitro group; and halogen atoms. These substituents may have another substituents. Preferable as substituent is an alkyl group. Methyl group is particularly preferable. Further, aryl groups of $Ar^5$ to $Ar^8$ may have a plural number of independent substituents.

$Ar^9$ and $Ar^{10}$ each represents, independently of each other, an arylene group that may possess a substituent. Arylene group includes phenylene group, naphthylene group and anthranylene group. Phenylene group is preferable. As substituent, an alkyl group can be cited such as methyl group, ethyl group, propyl group, isopropyl group, pentyl group, isopentyl group, neopentyl group, 1-methylbutyl group, 1-methylheptyl group, dodecyl group, hexadecyl group and octadecyl group; aryl group such as phenyl group, naphthyl group and anthryl group; and aralkyl group such as benzyl group and phenethyl group. These substituents may have another substituents. Of these, preferable as $Ar^9$ and $Ar^{10}$ are unsubstituted or methyl substituted phenylene group.

Concrete structural examples of the diamine compounds represented by the formula (2) are shown below. It is to be noted that these examples are presented for the purpose of detailed explanation of the present invention and should not be taken as restrictive insofar as the scope of the invention is not departed from.

[Chemical Formula 30]

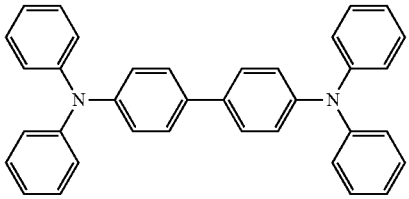

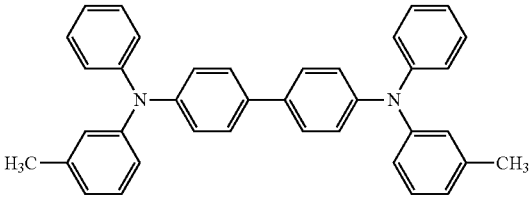

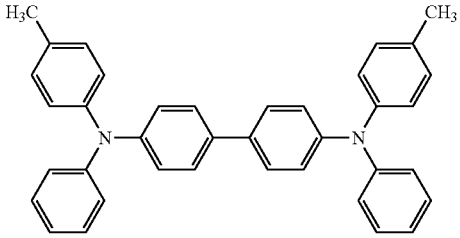

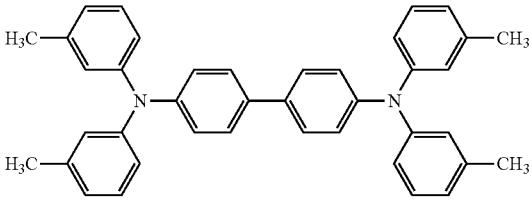

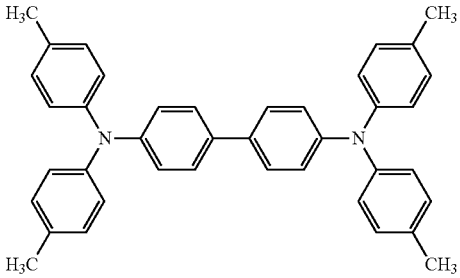

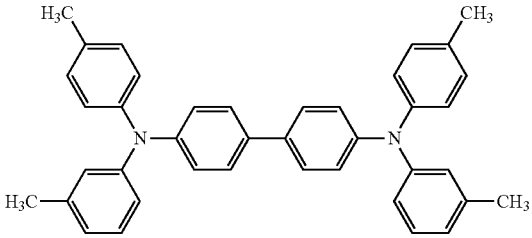

-continued
[Chemical Formula 31]
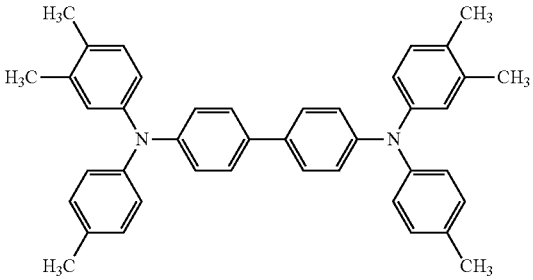
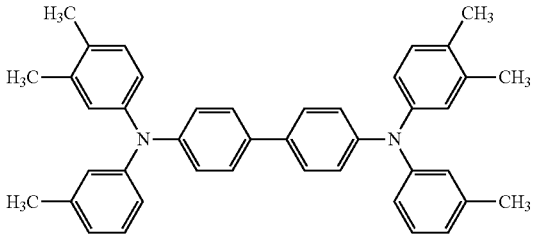
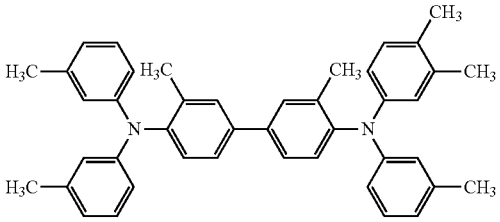
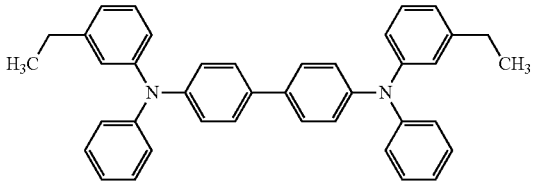
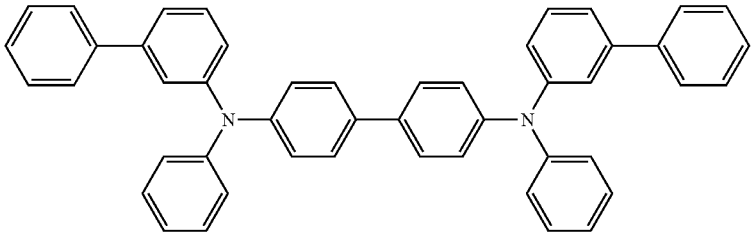
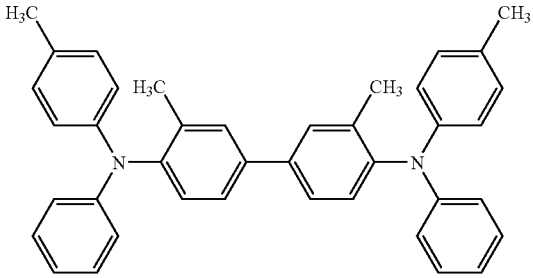
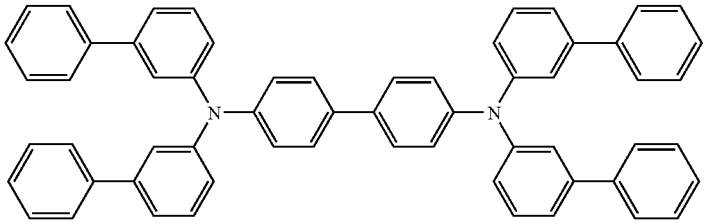
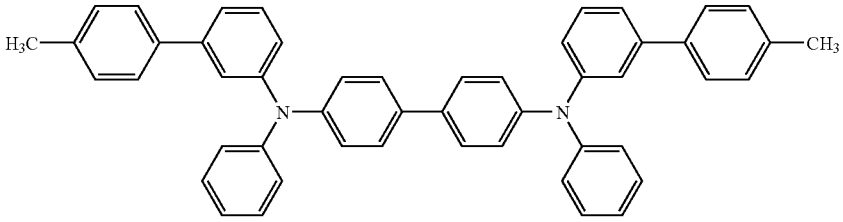

-continued

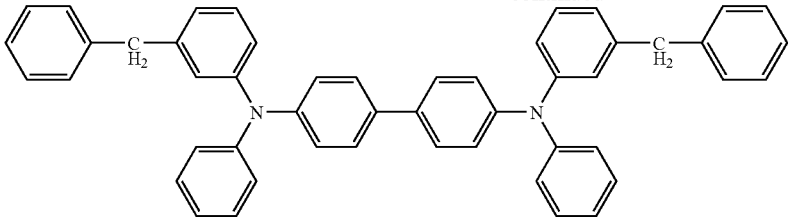

Diamine compound, which is used as charge transport material in the third subject matter of the present invention as described above, can be used either as a single kind or as a mixture of two or more kinds in any combination and in any ratio. Further, diamine compound can be used as a single kind or in combination with other charge transport material. Any known type of charge transport material can be used together. The examples are: electron-withdrawing substances including aromatic nitro compounds such as 2,4,7-trinitrofluorenone, cyano compounds such as tetracyanoquinodimethane, and quinone compounds such as diphenoquinone; and electron donating substances including heterocyclic compounds such as carbazole and its derivatives, indole and its derivatives, imidazole and its derivatives, oxazole and its derivatives, pyrazole and its derivatives, thiadiazole and its derivatives and benzofuran and its derivatives, and aniline and its derivatives, hydrazone and its derivatives, aromatic amine and its derivatives, stilbene and its derivatives, butadiene and its derivatives, and enamine and its derivatives, and the ones obtained by combining a plurality of these compounds, and polymers having a group comprising these compounds at its main chain or side chain. Further, it is possible to include two or more compounds represented by the formula (2). Even better characteristics can then be realized.

When the above-mentioned diamine compound is used with other charge transport material, the proportion between the diamine compound and other charge transport material can be decided arbitrarily. However, the proportion of the above-mentioned diamine compound is usually 50 weight % or more, and preferably 90 weight % or more. It is particularly preferable that only the above-mentioned diamine compound is used as charge transport material.

[IV-3. Electrophotographic photoreceptor]

The photoreceptor according to the third subject matter of the present invention comprises at least a photosensitive layer on an electroconductive support. In the third subject matter of the present invention, at least the polyester resin of the present invention and a diamine compound represented by the formula (2) are contained. The polyester resin of the present invention contained in the photosensitive layer functions as binder resin. The diamine compound serves as charge transport material.

The type of the photosensitive layer includes a monolayer type and lamination type, as described above. A lamination type photosensitive layer has a charge generation layer and a charge transport layer. At this point, when the photosensitive layer comprises two or more layers (for example, charge generation layer and charge transport layer), the polyester resin represented by the above formula (1) and the diamine compound represented by the formula (2) may be contained in at least one of the layers forming the photosensitive layer. However, they are usually used for the same layer of the photosensitive layer, and preferably for the charge transport layer of a lamination type photosensitive layer.

[IV-3-1. Electroconductive Support]

The electroconductive support is the same as explained for [II-3-1. Electroconductive support] of the first subject matter.

[IV-3-2. Undercoat layer]

The undercoat layer is the same as explained for [II-3-2. Undercoat layer] of the first subject matter.

[IV-3-3. Photosensitive Layer]

The photosensitive layer is provided on the electroconductive support (when using an undercoat layer, via the undercoat layer on the electroconductive support). The type of the photosensitive layer includes a lamination type, in which a charge generation layer and a charge transport layer are provided, and a monolayer type, in which both the charge transport material and charge generation material are contained in the same layer. The photosensitive layer includes the polyester resin of the present invention and the diamine compound represented by the formula (2). Furthermore, the photosensitive layer according to the present subject matter is the same as the photosensitive layer according to the first subject matter, except that a hydrazone compound is not necessarily used as charge transport material, but instead, the diamine compound represented by the formula (2) is contained as charge transport material.

[IV-3-3-1. Charge Generation Layer]

The charge generation layer is the same as explained for [II-3-3-1. Charge generation layer] of the first subject matter.

[IV-3-3-2. Charge Transport Layer]

The charge transport layer according to the third subject matter of the present invention is the same as explained for [II-3-3-2. Charge transport layer] in the first subject matter, except that a hydrazone compound is not necessarily used as charge transport material, but instead, at least the diamine compound represented by the formula (2) is contained as charge transport material.

[IV-3-3-3. Monolayer Type (Dispersion Type) Photosensitive Layer]

A monolayer type photosensitive layer is, also in the third subject matter of the present invention, constructed in such a way that the above-mentioned charge generation material is dispersed in the charge transport layer of the above composition. Namely, the monolayer type photosensitive layer according to the third subject matter of the present invention is the same as explained for [II-3-3-3. Monolayer type (dispersion type) photosensitive layer] in the first subject matter, except that a hydrazone compound is not necessarily used as charge transport material, but instead, at least the diamine compound represented by the formula (2) is contained as charge transport material.

[IV-3-4. Other Layers]

The photoreceptor may have additional layers besides the above-mentioned undercoat layer, charge generation layer, charge transport layer and monolayer type photosensitive layer.

The other layer is the same as explained for [II-3-4. Other layers] of the first subject matter.

[IV-3-5. Formation Method of Each Layer]

The formation method of each layer such as undercoat layer, photosensitive layer (charge generation layer, charge transport layer, monolayer type photosensitive layer) and protective layer is the same as explained for [II-3-5. Formation method of each layer] of the first subject matter. In particular, the excellent stability of the coating liquid, when using the polyester resin of the present invention, is also the same.

[IV-3-6. Advantage of the Photoreceptor]

As described above, by containing the polyester resin of the present invention in the photosensitive layer as well as containing at least the diamine compound represented by the formula (2), as charge transport material, a photosensitive layer excellent in abrasion resistance, electrical properties and mechanical strength can be obtained.

Incidentally, the photoreceptor of the present invention is exposed to form an electrostatic latent image by a write-in light from the exposure part while image forming. Any type of the write-in light can be used in that process insofar as an electrostatic latent image can be formed. However, among them, similarly to the second subject matter, a monochromatic light having exposure wavelength of 380 nm to 500 nm can be preferably used.

[IV-4. Image Forming Device]

The image forming device according to the third subject matter of the present invention is the same as explained for [II-4. Image forming device] in the first subject matter, except that it uses the above-mentioned photoreceptor according to the third subject matter of the present invention as electrophotographic photoreceptor. However, it is preferable that, as described above, a monochromatic light having exposure wavelength of 380 nm to 500 nm is used as exposure light of exposure apparatus 3.

In addition, also in the third subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7.

[V. Fourth Subject Matter]

The electrophotographic photoreceptor according to the fourth subject matter of the present invention comprises at least a photosensitive layer on an electroconductive support. The photosensitive layer includes a polyester resin containing a repeating structural unit represented by the above formula (1) (namely, polyester resin of the present invention) and, in addition, an antioxidant. The polyester resin contained in the photosensitive layer is used as binder resin.

[V-1. Polyester Resin]

The polyester resin of the present invention is the same as described in [I. Polyester resin of the present invention].

The polyester resin of the present invention, in the fourth subject matter of the present invention, can be used for an electrophotographic photoreceptor in combination with other resin. Other resins that can be used with in this subject matter are the same as described in the first subject matter. Therefore, the concrete examples, mixing ratio or the like of other resin in the fourth subject matter of the present invention is the same as those in the first subject matter of the present invention.

[V-2. Antioxidant]

As antioxidant, any known ones can be used. The examples include: inhibitors of radical chain reaction such as phenolic antioxidant and amine antioxidant; inhibitors of initiation of chain reaction such as UV absorbing agent, photostabilizing agent, metal inactivating agent and ozone deterioration preventer; and peroxide decomposer such as sulfur-containing antioxidant and phosphorus-containing antioxidant.

Inhibitors of radical chain reaction capture a radical which is generated by the effect of heat, light and gas hitting the photoreceptor, and stop the chain reaction triggered by the radical. Inhibitors of initiation of chain reaction work to inhibit the chain initiation reaction caused by such factors as light or heat. Peroxide decomposers decompose peroxides, derived from ozone generated at the time of charging, into inactive compounds and prevent their contribution to the chain reaction.

Of radical chain reaction inhibitors, phenolic antioxidant includes: 3,5-di-t-butyl-4-hydroxytoluene, 2,6-di-t-butylphenol, 2,6-di-t-butyl-4-ethylphenol, 2,6-di-t-butyl-4-methylphenol, 2,2'-methylenebis (6-t-butyl-4-methylphenol), 4,4'-butylidenebis (6-t-butyl-3-methylphenol), 4,4'-thiobis (6-t-butyl-3-methylphenol), 2,2'-butylidenebis (6-t-butyl-4-methylphenol), a-tocopherol, β-tocopherol, 2,2,4-trimethyl-6-hydroxy-7-t-butylchromane, pentaerythrityl tetrakis [3-(3,5-di-t-butyl-4-hydroxyphenyl)propionate], 2,2'-thioethylenebis [3-(3,5-di-t-butyl-4-hydroxyphenyl) propionate], 1,6-hexanediol bis[3-(3,5-di-t-butyl-4-hydroxyphenyl) propionate], butyl hydroxyanisole, dibutylhydroxyanisole, 1-[2-{(3,5-di-butyl-4-hydroxyphenyl) propionyloxy}ethyl]-4-[3-(3,5-di-butyl-4-hydroxyphenyl) propionyloxy]-2,2,6,6-tetramethylpiperazyl, 2,4-bis-(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl)benzene, 2-(5-methyl-2-hydroxyphenyl) benzotriazole, 2-(3-t-butyl-5-methyl-2-hydroxyphenyl)-5-chlorobenzotriazole, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetramethylpiperidine and n-octadecyl-3-(3,5-di-t-butyl-4-hydroxyphenyl) propionate.

Of these phenolic antioxidants, preferable are those having one or more t-butyl group on the phenol ring. Particularly preferable are those having a t-butyl group on the carbon atom adjacent to the phenolic hydroxy group. The preferable examples are: monophenol antioxidants such as 3,5-di-t-butyl-4-hydroxytoluene, 2,6-di-t-butylphenol, 2,6-di-t-butyl-4-ethylphenol, 2,6-di-t-butyl-4-methylphenol and n-octadecyl-3-(4'-hydroxy-3',5'-di-t-butylphenyl)propionate; and polyphenol antioxidant such as 2,2'-methylenebis (6-t-butyl-4-methylphenol), 1,3,5-trimethyl-2,4,6-tris (3,5-di-t-butyl-4-hydroxybenzyl)benzene and pentaerythrityltetrakis[3-(3,5-di-t-butyl-4-hydroxyphenyl) propionate].

Furthermore, hydroquinones can also be used as radical chain reaction inhibitors. Concrete examples include: 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone. Amine antioxidant includes: phenyl-β-naphthylamine, α-naphthylamine, phenothiazine, N,N'-diphenyl-p-phenylenediamine and tribenzylamine.

Of these, preferable from the standoint of electrical characteristics are 3,5-di-t-butyl-4-hydroxytoluene, n-octadecyl-3-(4'-hydroxy-3',5'-di-t-butylphenyl) propionate and 1,3,5-trimethyl-2,4,6-tris (3,5-di-t-butyl-4-hydroxybenzyl) benzene.

Of inhibitors of initiation of chain reaction, as UV absorbing agent and photostabilizing agent, the following can be cited: phenyl salicylate, monoglycol salicylate, 2-hydroxy-4-methoxybenzophenone, 2-(2'-hydroxy-5'-methylphenyl) benzotriazole and resorcinol monobenzoate. As metal inactivating agent, the following can be cited: N-salicyloyl-N'-aldehyde hydrazine and N,N'-diphenyloxamide. As ozone deterioration preventer, the following can be cited: 6-ethoxy-2,2,4-trimethyl-1,2-dihydroquinoline and N-phenyl-N'-isopropyl-p-phenylenediamine.

Of peroxide decomposers, as sulfur-containing antioxidant, the following can be cited: dilauryl-3,3'-thiodipropionate, distearyl-3,3'-thiodipropionate, ditetradecyl-3,3'-thiodipropionate, laurylstearylthiodipropionate, dimyristylthiodipropionate and 2-mercaptobenzimidazole. Further, as phosphorus-containing antioxidants, the following can be cited triphenylphosphine, tri (nonylphenyl) phosphine, tri(dinonylphenyl) phosphine, tricresylphosphine, tri (2,4-dibutylphenoxy)phosphine, tridecylphosphine and trioctadecylphosphine.

Of these antioxidants, phenolic antioxidants are particularly preferable. This is because they can improve the stability of the coating liquid. Among them, particularly preferable are 3,5-di-t-butyl-4-hydroxytoluene, octadecyl-3-(3,5-di-t-butyl-4-hydroxyphenyl) propionate and 1,3,5-trimethyl-2,4,6-tris (3,5-di-t-butyl-4-hydroxybenzyl)benzene.

Antioxidants can be used either as a single kind or as a mixture of two or more kinds in any combination and in any ratio.

There is no special limitation on the amount of the antioxidants used, insofar as the advantage of the present invention is not significantly impaired. The amount is, relative to 100 weight parts of the binder resin of the layer containing said antioxidant, usually 0.01 weight parts or more, preferably 0.05 weight parts or more, more preferably 0.1 weight parts or more, and usually 100 weight parts or less, preferably 30 weight parts or less, more preferably 16 weight parts or less. When the amount exceeds the upper limit, the electrical characteristics may deteriorate. When the amount is below the above-mentioned lower limit, the advantage of the present invention may not be fully exhibited.

[V-3. Electrophotographic Photoreceptor]

The photoreceptor according to the fourth subject matter of the present invention comprises at least a photosensitive layer on an electroconductive support. In the fourth subject matter of the present invention, at least the polyester resin of the present invention and the antioxidant are contained in the photosensitive layer. The polyester resin of the present invention functions as binder resin in the photosensitive layer. The antioxidant serves as additive in the photosensitive layer.

The type of the photosensitive layer includes a monolayer type and lamination type, as described above. A lamination type photosensitive layer has a charge generation layer and a charge transport layer. At this point, when the photosensitive layer comprises two or more layers (for example, charge generation layer and charge transport layer), the polyester resin of the present invention and the antioxidant may be contained in at least one of the layers forming the above-mentioned photosensitive layer. However, they are usually used for the same layer of the photosensitive layer, and preferably included in the charge transport layer of a lamination type photoreceptor.

[V-3-1. Electroconductive Support]

The electroconductive support is the same as explained for [II-3-1. Electroconductive support] of the first subject matter.

[V-3-2. Undercoat layer]

The undercoat layer is the same as explained for [II-3-2. Undercoat layer] of the first subject matter.

[V-3-3. Photosensitive Layer]

The photosensitive layer is provided on the electroconductive support (when using an undercoat layer, via the undercoat layer on the electroconductive support). The type of the photosensitive layer includes a lamination type, in which a charge generation layer and a charge transport layer are provided, and a monolayer type, in which both the charge transport material and charge generation material are contained in the same layer. The photosensitive layer includes at least the polyester resin of the present invention and an antioxidant. Furthermore, the photosensitive layer according to the present subject matter is the same as the photosensitive layer according to the first subject matter, except that a hydrazone compound is not necessarily used as charge transport material, but instead, the antioxidant is contained as additive.

[V-3-3-1. Charge Generation Layer]

The charge generation layer is the same as explained for [II-3-3-1. Charge generation layer] of the first subject matter.

However, when the polyester resin of the present invention is contained in the charge generation layer, in the fourth subject matter of the present invention, it is preferable that the charge generation layer contains the antioxidant. With such a construction, in which the charge generation layer contains both the polyester resin of the present invention and the antioxidant, the electrical properties of the charge generation layer can be enhanced.

At this point, there is no special limitation on the amount of the antioxidant used, insofar as the advantage of the present invention is not significantly impaired. However, it is preferable that it falls within the range of amount ratio between the antioxidant and binder resin, cited in the explanation for [V-2. Antioxidant].

[V-3-3-2. Charge Transport Layer]

The charge transport layer is a layer in which charge transport material is contained. The polyester resin of the present invention, which is contained within the photosensitive layer in the present invention, is preferably contained in this charge transport layer. In addition, the antioxidant, which is contained in the photosensitive layer in the fourth subject matter of the present invention, is preferably contained in this charge transport layer.

Particularly when the polyester resin of the present invention is contained in the charge transport layer, it is preferable that the antioxidant is contained in the charge transport layer. With such a construction, in which the charge transport layer contains both the polyester resin of the present invention and the antioxidant, the electrical properties of the charge transport layer can be enhanced. This also leads to the improvement in the abrasion resistance of the charge transport layer. This results in that the electrical properties and abrasion resistance of the photosensitive layer can be improved.

At this point, there is no special limitation on the amount of the antioxidant used, insofar as the advantage of the present invention is not significantly impaired. However, it is preferable that it falls within the range of amount ratio between the antioxidant and binder resin, cited in the explanation for [V-2. Antioxidant].

The charge transport layer may be formed either by a single layer or by plural and laminated layers having different components or different compositions. When the charge transport layer includes two or more layers, it is preferable that at least one of layer contain the antioxidant, in addition to the polyester resin of the present invention.

In the fourth subject matter of the present invention, there is no special limitation on the kind of charge transport material, and any type of charge transport material can be used. Therefore, any charge transport material cited in the above explanations for the first to third subject matters of the present invention can be used. Of those compounds, preferable are carbazole and its derivatives, aromatic amine and its derivatives, stilbene and its derivatives, butadiene and its derivatives, enamine and its derivatives and compound composed of two or more of these compounds connected. Of these, stilbene and its derivatives are particularly effectively used.

The charge transport layer according to the fourth subject matter of the present invention is the same as explained for [II-3-3-2. Charge transport layer] of the first subject matter, except the above-mentioned points.

[V-3-3-3. Monolayer Type (Dispersion Type) Photosensitive Layer]

A monolayer type photosensitive layer is, also in the fourth subject matter of the present invention, constructed in such a way that the above-mentioned charge generation material is dispersed in the charge transport layer of the above composition. Namely, the monolayer type photosensitive layer according to the fourth subject matter of the present invention is the same as explained for [II-3-3-3. Monolayer type (dispersion type) photosensitive layer] in the first subject matter, except that a hydrazone compound is not necessarily used as charge transport material, but instead, at least the antioxidant is contained as additive.

[V-3-4. Other Layers]

The photoreceptor may have additional layers besides the above-mentioned undercoat layer, charge generation layer, charge transport layer and monolayer type photosensitive layer.

The other layer is the same as explained for [II-3-4. Other layers] of the first subject matter.

[V-3-5. Formation Method of Each Layer]

The formation method of each layer such as undercoat layer, photosensitive layer (charge generation layer, charge transport layer, monolayer type photosensitive layer) and protective layer is the same as explained for [II-3-5. Formation method of each layer] of the first subject matter. In particular, the excellent stability of the coating liquid, when using the polyester resin of the present invention, is also the same.

[V-3-6. Advantage of the Photoreceptor]

As described above, by containing the polyester resin of the present invention in the photosensitive layer as well as the antioxidant, a photosensitive layer excellent in abrasion resistance, electrical properties and mechanical strength can be obtained.

The reason why the above advantage can be obtained by containing the polyester resin of the present invention in combination with the antioxidant in the photosensitive layer is not apparent, but it is inferred as follows. The use of the polyester resin of the present invention can enhance the abrasion resistance, but the polyester resin of the present invention in particular specifically-degrades occasionally. However, it is inferred that the antioxidant can prevent the above degradation, and therefore, the above-mentioned advantage can be obtained.

Further, as described above, when the photosensitive layer is formed as lamination type, it is preferable that the polyester resin of the present invention and the antioxidant are contained in the charge transport layer. This is because the film thickness of the charge transport layer is usually larger than that of the charge generation layer, and therefore, the advantage that can be obtained by containing the above-mentioned polyester resin and the antioxidant can be more fully exhibited in that case.

Incidentally, the photoreceptor of the present invention is exposed to form an electrostatic latent image by a write-in light from the exposure part while image forming. Any type of the write-in light can be used in that process insofar as an electrostatic latent image can be formed. However, among them, similarly to the second subject matter, a monochromatic light having exposure wavelength of 380 nm to 500 nm can be preferably used.

[V-4. Image Forming Device]

The image forming device according to the fourth subject matter of the present invention is the same as explained for [II-4. Image forming device] in the first subject matter, except that it uses the above-mentioned photoreceptor according to the fourth subject matter of the present invention as electrophotographic photoreceptor. However, it is preferable that, as described above, a monochromatic light having exposure wavelength of 380 nm to 500 nm is used as exposure light of exposure apparatus 3.

In addition, also in the fourth subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7.

[VI. Fifth Subject Matter]

The electrophotographic photoreceptor according to the fifth subject matter of the present invention comprises at least a photosensitive layer on an electroconductive support. The photosensitive layer has a polyester resin containing a repeating structural unit represented by the formula (1) (namely, the polyester resin of the present invention, which will be hereinafter referred to as "first resin" in the explanation of the fifth subject matter of the present invention, as appropriate) and at least one another resin selected from the group consisting of polyester resins, having different structures from the former polyester resin (namely, the first resin), and polycarbonate resins (hereinafter referred to as "second resin", as appropriate). These first resin and second resin usually serve as binder resins in the above-mentioned photosensitive layer.

[VI-1. Binder Resin]

The photoreceptor according to the fifth subject matter of the present invention contains the first resin and the second resin in its photosensitive layer. In more detail, when the photosensitive layer comprises a single layer, the photosensitive layer contains the first resin and the second resin. When the photosensitive layer comprises two or more layers, one or more layer of them contains the first resin and the second resin. In addition, the layer containing the first resin and the second resin may contain an additional resin other than the first resin and the second resin.

[VI-1-1. First Resin]

The first resin indicates the polyester resin of the present invention and its details are the same as explained in [I. Polyester resin of the present invention].

[VI-1-2. Second Resin]

There is no limitation on the kind of the second resin, insofar as the resin is one selected from the group consisting of polyester resins and polycarbonate resins, having different structures from the first resin. If this requirement is met, there is no other limitation, insofar as the advantage of the present invention is not significantly impaired. Therefore, a known polyester resin and a polycarbonate resin can be used as the second resin. Among others, a polycarbonate resin is preferably used as the second resin. Namely, it is preferable to use a polycarbonate resin at least as a part of the second resin, and it is more preferable to use a polycarbonate resin as the entire second resin. In the present invention, the use of at least either one of the polyester resin and the polycarbonate resin is essential as the second resin, but both of the polyester resin and the polycarbonate resin can also be used.

As polycarbonate resin that can be used as the second resin, the following can be cited: those having a structural unit derived from the following bifunctional phenols. Such bifunctional phenols include: bis-(4-hydroxyphenyl)methane, 1,1-bis-(4-hydroxyphenyl)ethane, 1,1-bis-(4-hydroxyphenyl) propane, 2,2-bis-(4-hydroxyphenyl) propane, 2,2-bis-(4-hydroxyphenyl) butane, 2,2-bis-(4-hydroxyphenyl) pentane, 2,2-bis-(4-hydroxyphenyl)-3-methylbutane, 2,2-bis-(4-hydroxyphenyl) hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(4-hydroxy-3-methylphenyl)methane, bis-(4-hydroxy-3,5-dimethylphenyl)methane, 1,1-bis-(4-hydroxy-3-methylphenyl)ethane, 2,2-bis-(4-hydroxy-3-methylphenyl) propane, 2,2-bis-(4-hydroxy-3,5-dimethylphenyl) propane, 2,2-bis-(4-hydroxy-3-ethylphenyl) propane, 2,2-bis-(4-hydroxy-3-isopropylphenyl) propane, 2,2-bis-(4-hydroxy-3-sec-butylphenyl) propane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl) diphenylmethane, bis-(4-hydroxyphenyl) dibenzylmethane, 4,4'-dihydroxydiphenylether, 4,4'-dihydroxydiphenylsulfone, 4,4'-dihydroxydiphenylsulfide, phenolphthalein, 5,5'-(1-methylethylidene) bis[1,1'-(biphenyl)-2-ol], [1,1'-biphenyl]-4,4'-diol, [1,1'-biphenyl]-3,3'-diol, 4,4'-oxybisphenol, bis(4-hydroxyphenyl)methanone, 2,6-dihydroxynaphthalene, 2,7-dihydroxynaphthalene, 1,1'-bis-(4-hydroxy-3-methylphenyl) propane, bis-(4-hydroxy-3-ethylphenyl) methane, 1,1-bis-(4-hydroxy-3-ethylphenyl)ethane, 1,1-bis-(4-hydroxy-3-ethylphenyl) propane, bis-(4-hydroxy-3-isopropylphenyl)methane, 1,1-bis-(4-hydroxy-3-isopropylphenyl)ethane, 1,1-bis-(4-hydroxy-3-isopropylphenyl) propane, bis-(4-hydroxy-3-sec-butylphenyl)methane, 1,1-bis-(4-hydroxy-3-sec-butylphenyl)ethane, 1,1-bis-(4-hydroxy-3-sec-butylphenyl) propane, 1,1-bis-(4-hydroxy-3,5-dimethylphenyl) propane, bis-(4-hydroxy-3,5-dimethylphenyl)methane, 1,1-bis-(4-hydroxy-3,5-dimethylphenyl)ethane and 2,2-bis-(4-hydroxy-3,5-dimethylphenyl) propane.

Of these compounds, from the standpoint of ease of preparation, 2,2-bis-(4-hydroxyphenyl) propane is preferable. From the standpoint of mechanical characteristics, preferable are 1,1-bis-(4-hydroxyphenyl)cyclopentane, 1,1-bis-(4-hydroxyphenyl)cyclohexane, 2,2-bis-(4-hydroxy-3-methylphenyl) propane and 1,1-bis-(4-hydroxyphenyl)-1-phenylethane. Of these, particularly preferable is 2,2-bis-(4-hydroxy-3-methylphenyl) propane.

These structural units can be used either as a single unit or, depending on the desired physicochemical property, as a combination of two or more units in any combination ratio.

The use of a copolymer based on 2,2-bis-(4-hydroxyphenyl) propane and 2,2-bis-(4-hydroxy-3-methylphenyl) propane is particularly effective from the standpoint of assuring high mechanical durability.

On the other hand, as a polyester resin that can be used as the second resin, the following can be cited: one having structural units derived from a polybasic acid component and a polyalcohol component. Examples of the polybasic acid component of the polyester resin include those derived from, unsaturated acids such as maleic anhydride, aromatic saturated acids such as phthalic anhydride, terephthalic acid and isophthalic acid, aliphatic saturated acid such as hexahydrophthalic acid anhydride, succinic acid and azelaic acid.

As a polyalcohol component, the following can be cited: polyalcohols and polyphenols. The examples of these polyalcohols and polyphenols include aromatic diols and aliphatic dihydroxy compounds.

As aromatic diols, the following compounds can be cited: hydroquinone, resorcinol, 1,3-dihydroxynaphthalene, 1,4-dihydroxynaphthalene, 2,3-dihydroxynaphthalene, 2,6-dihydroxynaphthalene, 2,7-dihydroxynaphthalene, 1,8-dihydroxynaphthalene, 1,5-dihydroxynaphthalene, bis-(4-hydroxyphenyl)methane, bis-(2-hydroxyphenyl)methane, (2-hydroxyphenyl)(4-hydroxyphenyl)methane, 1,1-bis-(4-hydroxyphenyl)ethane (BPE), 1,1-bis(4-hydroxyphenyl) propane, 2,2-bis(4-hydroxyphenyl) propane, bis-(4-hydroxy-3,5-dimethylphenyl)methane, 2,2-bis-(4-hydroxyphenyl) butane, 2,2-bis-(4-hydroxyphenyl) pentane, 2,2-bis-(4-hydroxyphenyl)-3-methylbutane, 2,2-bis-(4-hydroxyphenyl) hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(3-phenyl-4-hydroxyphenyl) methane, 1,1-bis-(3-phenyl-4-hydroxyphenyl)ethane, 1,1-bis-(3-phenyl-4-hydroxyphenyl) propane, 2,2-bis-(3-phenyl-4-hydroxyphenyl) propane, bis-(4-hydroxy-3-methylphenyl) methane, 1,1-bis-(4-hydroxy-3-methylphenyl)ethane, 2,2-bis-(4-hydroxy-3-methylphenyl) propane, 2,2-bis-(4-hydroxy-3-ethylphenyl)propane, 2,2-bis-(4-hydroxy-3-isopropylphenyl) propane, 2,2-bis-(4-hydroxy-3-sec-butylphenyl) propane, 1,1-bis-(4-hydroxy-3,5-dimethylphenyl)ethane, 2,2-bis-(4-hydroxy-3,5-dimethylphenyl) propane, bis-(4-hydroxy-3,6-dimethylphenyl)methane, 1,1-bis-(4-hydroxy-3,6-dimethylphenyl)ethane, bis-(4-hydroxyphenyl) phenylmethane, 1,1-bis-(4-hydroxyphenyl)-1-phenylethane, 1,1-bis-(4-hydroxyphenyl)-1-phenylpropane, bis-(4-hydroxyphenyl) diphenylmethane, bis-(4-hydroxyphenyl) dibenzylmethane, 4,4'-dihydroxydiphenylether, 4,4-dihydroxydiphenylsulfone, 4,4'-dihydroxydiphenylsulfide, phenolphthalein, 4,4'-[1,4-phenylenebis(1-methylvinylidene)] bisphenol and 4,4'-[1,4-phenylenebis (1-methylvinylidene)]bis[2-methylphenol].

Of these aromatic diols, preferable examples include bis-(4-hydroxyphenyl)methane, 1,1-bis-(4-hydroxyphenyl) ethane, 2,2-bis-(4-hydroxyphenyl) propane, bis-(4-hydroxy-3,5-dimethylphenyl)methane, 2,2-bis-(3-phenyl-4-hydroxyphenyl) propane, bis-(4-hydroxy-3-methylphenyl) methane, 1,1-bis-(4-hydroxyphenyl)cyclohexane, 1,1-bis-(4-hydroxy-3-methylphenyl)ethane, 2,2-bis-(4-hydroxy-3-methylphenyl) propane, bis-(4-hydroxy-3,5-dimethylphenyl)methane, 1,1-bis-(4-hydroxy-3,5-dimethylphenyl)ethane, 2,2-bis-(4-hydroxy-3,5-dimethylphenyl) propane, bis-(4-hydroxy-3,6-dimethylphenyl)methane and 1,1-bis-(4-hydroxyphenyl)-1-phenylethane.

Particularly preferable are 2,2-bis-(4-hydroxyphenyl) propane, bis-(4-hydroxy-3,5-dimethylphenyl)methane, 1,1-bis-(4-hydroxyphenyl)cyclohexane and 2,2-bis-(4-hydroxy-3-methylphenyl) propane. Most preferable is 2,2-bis-(4-hydroxy-3-methylphenyl) propane.

As aliphatic dihydroxy compounds, the following can be cited, for example: ethylene glycol, propylene glycol, 1,4-butanediol, 1,4-pentanediol, pentamethylenediol, 2,4-pentanediol, 1,5-hexanediol, hexamethylene glycol, 1,5-heptanediol, heptamethylenediol, octamethylenediol, 1,9-nonanediol, 1,10-decamethylene glycol and 1,6-cyclohexanediol. Preferable are ethylene glycol, propylene glycol and 1,4-butanediol.

These structural units can be used either as a single unit or, depending on the desired physicochemical property, as a combination of two or more units in any combination ratio.

The single use of 2,2-bis-(4-hydroxy-3-methylphenyl) propane is particularly effective from the standpoint of assuring high mechanical durability.

No particular limitation is imposed on the viscosity-average molecular weight of the second resin, insofar as the advantage of the present invention is not significantly impaired. However, when it is too low, the mechanical strength may be insufficient. Therefore, it is usually 10,000 or higher, preferably 20,000 or higher, and particularly preferably 30,000 or higher. When the viscosity-average molecular weight is too high, the viscosity of the coating liquid for forming photosensitive layer may become high, resulting in lower productivity. Therefore, it is usually 150,000 or lower, preferably 100,000 or lower, and particularly preferably 50,000 or lower.

[VI-1-3. Specific Repeating Structure]

In the fifth subject matter of the present invention, either the first resin or the second resin contains a repeating structural unit shown in the formula (3) below. Namely, at least one of the first resin or the second resin contains a repeating structural unit shown in the formula (3). It is preferable that at least one of the second resins contains the unit, and it is more preferable that all the second resins contain the unit. This is because the abrasion resistance is then improved.

[Chemical Formula 32]

(3)

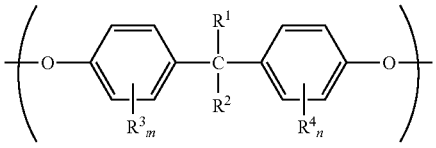

(In the formula (3), $R^1$ and $R^2$ each represents, independently of each other, a hydrogen atom or an alkyl group, $R^3$ and $R^4$ each represents, independently of each other, an alkyl group, and m and n each represents, independently of each other, an integer of 1 to 4.)

In the formula (3), $R^1$ and $R^2$ each represents, independently of each other, a hydrogen atom or an alkyl group, preferably a hydrogen atom or an alkyl group with 1 to 5 carbon atoms, more preferably a hydrogen atom or an alkyl group with 3 or less carbon atoms. Among them, particularly preferable is a hydrogen atom or a methyl group.

In the formula (3), $R^3$ and $R^4$ each represents, independently of each other, an alkyl group, preferably an alkyl group with 1 to 5 carbon atoms, more preferably an alkyl group with 3 or less carbon atoms. Among them, particularly preferable is a methyl group.

In the formula (3), m and n each represents, independently of each other, an integer of 1 to 4, preferably an integer of 2 or less. Particularly preferable is 1.

When the second resin has a repeating structural unit represented by the formula (3) above, as an example of the resin, one containing a structural unit derived from the following bifunctional phenol compounds can be cited. The examples of such preferable bifunctional phenols include: bis-(4-hydroxy-3-methylphenyl)methane, 1,1-bis-(4-hydroxy-3-methylphenyl)ethane, 1,1-bis-(4-hydroxy-3-methylphenyl) propane, 2,2-bis-(4-hydroxy-3-methylphenyl) propane, bis-(4-hydroxy-3-ethylphenyl)methane, 1,1-bis-(4-hydroxy-3-ethylphenyl)ethane, 1,1-bis-(4-hydroxy-3-ethylphenyl) propane, 2,2-bis-(4-hydroxy-3-ethylphenyl) propane, bis-(4-hydroxy-3-isopropylphenyl)methane, 1,1-bis-(4-hydroxy-3-isopropylphenyl)ethane, 1,1-bis-(4-hydroxy-3-isopropylphenyl) propane, 2,2-bis-(4-hydroxy-3-isopropylphenyl) propane, bis-(4-hydroxy-3-sec-butylphenyl)methane, 1,1-bis-(4-hydroxy-3-sec-butylphenyl)ethane, 1,1-bis-(4-hydroxy-3-sec-butylophenyl) propane, 2,2-bis-(4-hydroxy-3-sec-butylphenyl) propane, bis-(4-hydroxy-3,5-dimethylphenyl)methane, 1,1-bis-(4-hydroxy-3,5-dimethylphenyl)ethane, 1,1-bis-(4-hydroxy-3,5-dimethylphenyl) propane and 2,2-bis-(4-hydroxy-3,5-dimethylphenyl) propane.

Of these bifunctional phenol compounds, preferable from the standpont of mechanical characteristics are bis-(4-hydroxy-3-methylphenyl)methane, 1,1-bis-(4-hydroxy-3-methylphenyl)ethane and 2,2-bis-(4-hydroxy-3-methylphenyl) propane. Among them, 1,1-bis-(4-hydroxy-3-methylphenyl) ethane is preferable in view of its abrasion resistance and 2,2-bis-(4-hydroxy-3-methylphenyl) propane is particularly preferable in view of its surface characteristics.

Furthermore, it is preferable that the repeating structural unit represented by the above formula (3) is a repeating structural unit represented by the formula (3') below. This is because superior sliding property, high contact angle, superior toner transcription rate and the like can thus be obtained stably.

[Chemical Formula 33]

(3')

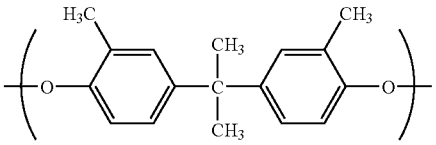

In the fifth subject matter of the present invention, the photosensitive layer contains a resin comprising a repeating structural unit represented by the formula (3). However, the resin containing a repeating structural unit represented by the formula (3) may also comprise a repeating structural unit other than that represented by the formula (3) within the scope of the present invention.

There is no special limitation on the proportion of the repeating structural unit represented by the above formula (3), insofar as the advantage of the present invention is exhibited.

However, when the repeating structural unit represented by the formula (3) is the one represented by the formula (3'), the weight ratio (component ratio) of the repeating structural unit represented by the formula (3') contained in the first and second resin in the total weight of the first and second resin, is usually 1 weight % or more, preferably 5 weight % or more, more preferably 10 weight % or more, and usually 45 weight % or less, preferably 30 weight % or less, more preferably 15 weight % or less. This is because, in this manner, an advantage of superior abrasion resistance and improvement in electrical characteristics can be realized stably.

Especially when a repeating structural unit represented by the formula (3) is the one represented by the formula (3') and a polycarbonate resin is used as the second resin, the proportion (component ratio) of a repeating structural unit represented by the formula (3") below contained in the polycarbonate resin is usually 70 weight % or more, preferably 80 weight % or more, more preferably 90 weight % or more. The upper limit is ideally 100 weight %, and it is preferable that the use of polycarbonate resin of which repeating structural unit only comprises the one represented by the formula (3') is preferable. This is because superior sliding property, high contact angle, superior toner transcription rate and the like can thus be obtained stably.

[Chemical Formula 34]

(3″)

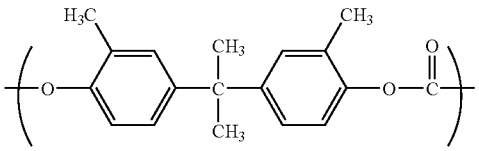

The weight of the repeating structural unit represented by the formula (3) can be measured by hydrolyzing the binder resin and analyzing the amount of the repeating structural unit by high performance liquid chromatography. The component ratio of the repeating structural unit represented by the formula (3) above indicates the component ratio in a layer comprising both the first resin and the second resin. Therefore, when the photosensitive layer comprises 2 or more layers and when one or more of the layer contains either the first resin or the second resin, that weights of the first or the second resin contained in the layer including either the first or the second resin and the repeating structural unit represented by the formula (3) are not to be included in the calculation of the above-mentioned component ratio.

[VI-1-4. Proportion of Amount Used]

No particular limitation is imposed on the amount ratio of the first resin and the second resin used, insofar as the advantage of the present invention is exhibited. However, from the standpoint of durability of the photoreceptor, the weight of the second resin contained in the photosensitive layer, relative to the total weight of the first and the second resin, is usually 80 weight % or less, preferably 70 weight % or less, more preferably 50 weight % or less. There is no lower limit specially but it is usually 1 weight % or more, preferably 5 weight % or more. When the ratio is below this lower limit, the abrasion resistance may be poor. Abrasion resistance may be also poor when the upper limit is exceeded.

The proportion of the amount of the first resin and the second resin defined above indicates the range of the weight proportion in layers containing both the first resin and the second resin. Therefore, when the photosensitive layer comprises two or more layers and when one or more of the layer contains either the first resin or the second resin, that weight of the first or the second resin contained in the layer including either the first or the second resin is not to be included in the calculation of the above-defined proportion.

[VI-1-5. Others]

Further, in the photosensitive layer of the photoreceptor according to the fifth subject matter of the present invention, a resin other than the above-mentioned first resin and the second resin may be combined (combined resin) as binder resin. Examples of other resin combined include: thermoplastic resins and various thermosetting resins including polymethylmethacrylate, polystyrene, vinyl polymer such as polyvinyl chloride, their copolymers, polycarbonate, polyester, polyester polycarbonate, polysulfone, phenoxy, epoxy and silicone resins. Of these resins, preferable are polycarbonate resin and polyester resin. These other resin to be combined with can be added either as a single kind or as a mixture of two or more kinds in any combination and in any ratio.

When a combined resin is used, the first resin and the second resin can be mixed with a combined resin, or they can be used separately for each layer constituting the photosensitive layer. For example, the first resin and the second resin can be used as one binder resin of the charge generation layer and charge transport layer to be described later, and a combined resin can be used as another binder resin of the charge generation layer and charge transport layer.

When a combined resin is used, the ratio of the combined resin is not particularly limited. For example, when the combined resin is used for a layer other than the layer for which the first resin and the second resin are used, there is no limitation to the amount of the combined resin used. However, when the combined resin is used in the same layer as the layer for which the first resin and the second resin are used (photosensitive layer, charge generation layer, charge transport layer), it is preferable to use it to the extent not exceeding the ratio of the first resin, in order to fully exhibit the advantage of the present invention. It is particularly preferable that the combined resin is not used.

[VI-3. Electrophotographic Photoreceptor]

The photoreceptor according to the fifth subject matter of the present invention comprises at least a photosensitive layer on an electroconductive support. In the fifth subject matter of the present invention, the photosensitive layer contains the above-mentioned first resin and second resin. These first resin and second resin usually serve as binder resins in the above-mentioned photosensitive layer.

The type of the photosensitive layer includes a monolayer type and lamination type, as described above. A lamination type photosensitive layer has a charge generation layer and a charge transport layer. At this point, when the photosensitive layer comprises one layer, the layer itself is made to contain the first resin and the second resin. When the photosensitive layer comprises two or more layers (for example, charge generation layer and charge transport layer), as in a lamination type, the first resin and the second resin may be contained in at least one of the layers forming the photosensitive layer. Namely, it is enough for the photosensitive layer to have at least one layer containing both the first resin and the second resin. However, the first resin and the second resin are usually used for the same layer of the photosensitive layer, and preferably for the charge transport layer of a lamination type photosensitive layer.

[VI-3-1. Electroconductive Support]

The electroconductive support is the same as explained for [II-3-1. Electroconductive support] of the first subject matter.

[VI-3-2. Undercoat layer]

The undercoat layer is the same as explained for [II-3-2. Undercoat layer] of the first subject matter.

[VI-3-3. Photosensitive Layer]

The photosensitive layer is provided on the electroconductive support (when using an undercoat layer, via the undercoat layer on the electroconductive support). The type of the photosensitive layer includes a lamination type, in which a charge generation layer and a charge transport layer are provided, and a monolayer type, in which both the charge transport material and charge generation material are contained in the same layer. The photosensitive layer includes at least the first resin (namely, the polyester resin of the present invention) and the second resin. Furthermore, the photosensitive layer according to the present subject matter is the same as the photosensitive layer according to the first subject matter, except that a hydrazone compound is not necessarily used as charge transport material, but instead, at least the first resin and the second resin are contained as binder resin and a preferable amount of the charge transport material is used.

[VI-3-3-1. Charge Generation Layer]

The charge generation layer is the same as described in [II-3-3-1. Charge generation layer] of the first subject matter, except that the upper limit of the preferable range of the charge generating material amount in the charge generation layer is, relative to 100 weight parts of the binder resin, usually 500 weight parts or less, preferably 400 weight parts or less, more preferably 300 weight parts or less. Further, in the charge generation layer of the fifth subject matter of the present invention, the above-mentioned first and second resin can be used as preferable binder resin in addition to the ones cited in the first subject matter.

[VI-3-3-2. Charge Transport Layer]

A charge transport layer of a lamination type photosensitive layer contains a charge transport material, binder resin and other component that is used as appropriate.

In the fifth subject matter of the present invention, the above-mentioned first resin and second resin are used as binder resin of the charge transport layer. When a photosensitive layer is a lamination type, it is usually preferable that both of the first resin and the second resin are contained in the charge transport layer. As mentioned above, the first resin and the second resin may be used in combination with other resin (combined resin).

The charge transport layer may be formed either by a single layer or by plural and laminated layers having different components or different compositions. When the photosensitive layer comprises a plural number of layers, at least one of the layers is, preferably all the layers are made to contain the first resin and the second resin.

Further, when the charge generation layer contains the first and the second resins, a resin other than the first and the second resins may be used as binder resin of the charge transport layer.

In the fifth subject matter of the present invention, there is no special limitation on the kind of charge transport material, and any type of charge transport material can be used. Therefore, any charge transport material cited in the above explanations for the first to fourth subject matters of the present invention can be used.

The charge transport layer according to the fifth subject matter of the present invention is the same as explained for [II-3-3-2. Charge transport layer] of the first subject matter, except the above-mentioned points.

[VI-3-3-3. Monolayer Type (Dispersion Type) Photosensitive Layer]

A monolayer type photosensitive layer is, also in the fifth subject matter of the present invention, constructed in such a way that the above-mentioned charge generation material is dispersed in the charge transport layer of the above composition. Namely, the monolayer type photosensitive layer according to the fifth subject matter of the present invention is the same as explained for [II-3-3-3. Monolayer type (dispersion type) photosensitive layer] in the first subject matter, except that a hydrazone compound is not necessarily used as charge transport material, but instead, at least the first resin and the second resin are contained as binder resin.

[VI-3-4. Other Layers]

The photoreceptor may have additional layers besides the above-mentioned undercoat layer, charge generation layer, charge transport layer and monolayer type photosensitive layer.

The charge generation layer is the same as explained for [II-3-4. Other layers] of the first subject matter.

[VI-3-5. Formation Method of Each Layer]

The formation method of each layer such as undercoat layer, photosensitive layer (charge generation layer, charge transport layer, monolayer type photosensitive layer) and protective layer is the same as explained for [II-3-5. Formation method of each layer] of the first subject matter. In particular, the excellent stability of the coating liquid, when using the polyester resin of the present invention (namely, the first resin), is also the same.

[VI-3-6. Advantage of the Photoreceptor]

As described above, by containing the above-mentioned first resin and second resin in the photosensitive layer, the abrasion resistance against the load to the photoreceptor can be improved. In that case, mechanical strength (for example, flaw resistance) other than abrasion resistance of the photosensitive layer can also be enhanced.

The reason why the above advantage can be obtained by containing both of the first resin and the second resin in the photosensitive layer as described above is not apparent, but it is inferred as follows. Namely, the first and second resins mixed together are not mixed completely uniformly, but they each exist unevenly, though just to a slight extent, within the photosensitive layer. This unevenness then leads to the slight irregularitiy of the photosensitive layer surface. And it is inferred that this irregularity decreases the contact area between the photosensitive layer and a substance outside of the photosensitive layer, thereby improving abrasion resistance of the photosensitive layer.

Accordingly, in order to obtain the above-mentioned advantage more effectively, when using a photosensitive layer with two or more layers, it is preferable that the first and the second resins are contained in a layer as outer as possible. Therefore, in a lamination type photosensitive layer, when it is a forward lamination type, the first and second resins are preferably used as binder resins of charge transport layer, and when it is a reverse lamination type, the first and second resins are preferably used as binder resins of charge generation layer.

Incidentally, the photoreceptor of the present invention is exposed to form an electrostatic latent image by a write-in light from the exposure part while image forming. Any type of the write-in light can be used in that process insofar as an electrostatic latent image can be formed. However, among them, similarly to the second subject matter, a monochromatic light having exposure wavelength of 380 nm to 500 nm can be preferably used.

[VI-4. Image Forming Device]

The image forming device according to the fifth subject matter of the present invention is the same as explained for [II-4. Image forming device] in the first subject matter, except that it uses the above-mentioned photoreceptor according to the fifth subject matter of the present invention as electrophotographic photoreceptor. However, it is preferable that, as described above, a monochromatic light having exposure wavelength of 380 nm to 500 nm is used as exposure light of exposure apparatus 3.

In addition, also in the fifth subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7.

[VII. Sixth Subject Matter]

A photoreceptor according to the sixth subject matter of the present invention is an electrophotographic photoreceptor of positive charge type comprising a monolayer type photosensitive layer, which contains the polyester resin of the present invention, on an electroconductive support. The photosensitive layer is usually provided on the electroconductive support. The polyester resin of the present invention functions as binder resin in the photosensitive layer.

[VII-1. Polyester Resin]

The polyester resin of the present invention is the same as described in [I. Polyester resin of the present invention].

The polyester resin of the present invention, in the sixth subject matter of the present invention, can be used for an electrophotographic photoreceptor in combination with other resin. Other resins that can be used with in this subject matter are the same as described in the first subject matter. Therefore, the concrete examples, mixing ratio or the like of other resin in the sixth subject matter of the present invention are the same as those in the first subject matter of the present invention.

[VII-2. Photoreceptor]

A photoreceptor according to the sixth subject matter of the present invention is an electrophotographic photoreceptor of positive charge type comprising a monolayer type photosensitive layer on an electroconductive support. In the sixth subject matter of the present invention, the photosensitive layer contains at least the polyester resin of the present invention. The polyester resin of the present invention functions as binder resin in the photosensitive layer.

[VII-2-1. Electroconductive Support]

The electroconductive support is the same as explained for [II-3-1. Electroconductive support] of the first subject matter.

[VII-2-2. Undercoat layer]

The undercoat layer is the same as explained for [II-3-2. Undercoat layer] of the first subject matter.

In a monolayer type photoreceptor such as one according to the sixth subject matter of the present invention, a charge generation layer of a lamination type photoreceptor can be substituted for an undercoat layer. In this instance, suitable substances as undercoat layer are as follows: phthalocyanine pigment or azo pigment, dispersed in a binder resin. Superior electrical properties may then be realized, which is desirable.

[VII-2-3. Photosensitive Layer]

A photoreceptor according to the sixth subject matter of the present invention has a monolayer type photosensitive layer. This monolayer type photosensitive layer is constructed in such a way that a charge transport material is dissolved or dispersed, and further a charge generation material is dispersed, in a binder resin. Namely, the photosensitive layer is formed in such a way that the above-mentioned charge transport material and charge generation material are bound to a binder resin containing the polyester resin of the present invention.

In the sixth subject matter of the present invention, it is preferable that the photosensitive layer consists of a single layer. It may also consist of a plural number of layers having different components or different compositions. The latter type is also referred to as monolayer type photoreceptor in consideration of the functions of the materials in the layers. In this context, in the photoreceptor according to the sixth subject matter of the present invention, it is enough that one or more layers in the photosensitive layer contains the polyester resin of the present invention.

No particular limitation is imposed on the charge transport material and any such material can be used. Therefore, any charge transport material cited in the above explanations in the first to fifth subject matters of the present invention can be used.

Concrete examples of preferable chemical structures of the charge transport material that can be combined in the sixth subject matter of the present invention are shown below. They serve only as examples and any known charge transport material can be used within the scope of the present invention. Bu below represents a butyl group and t-Bu represents a tertiary butyl group.

[Chemical Formula 35]

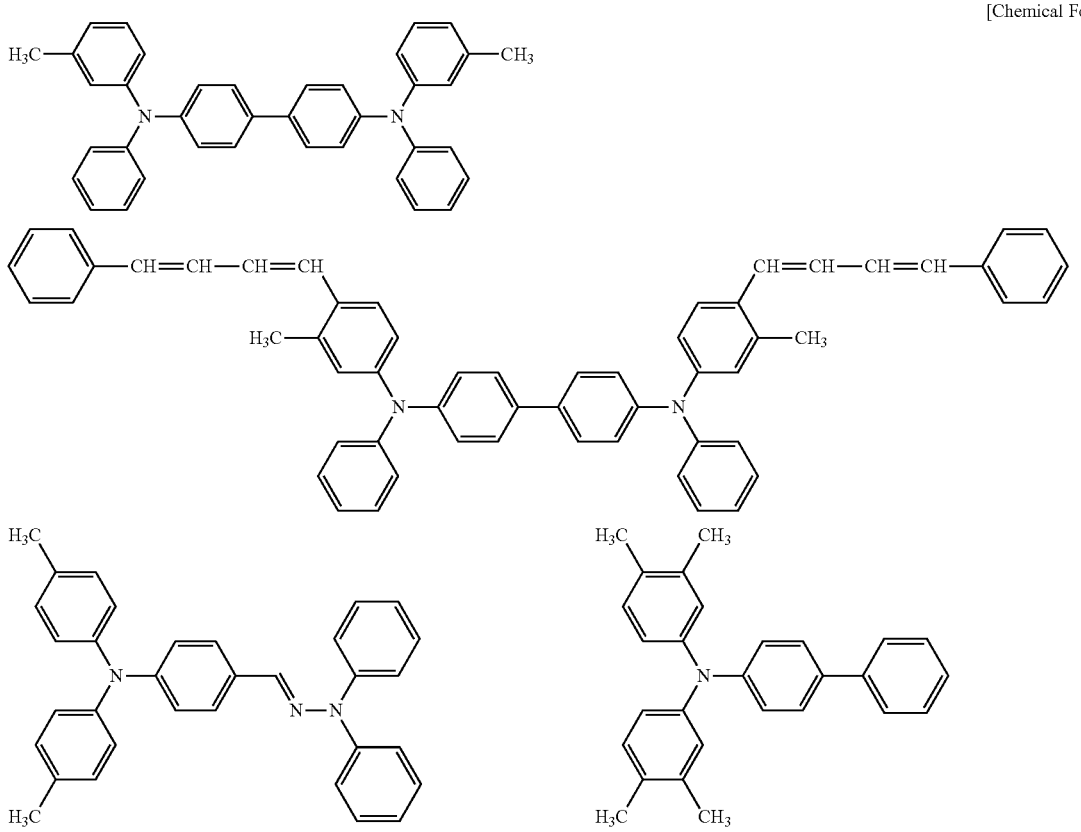

-continued
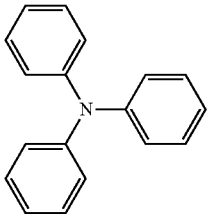
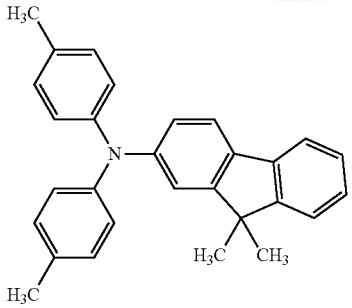
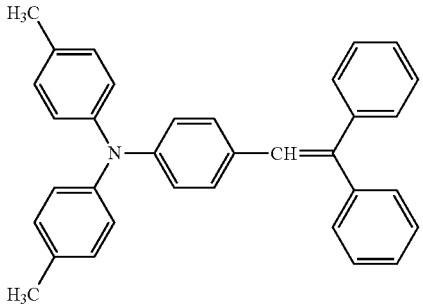
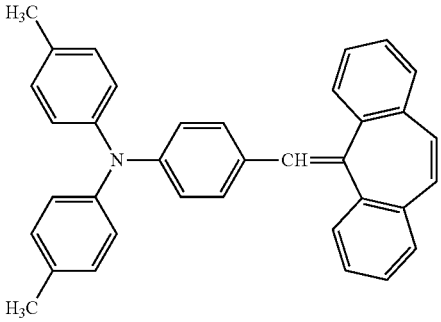
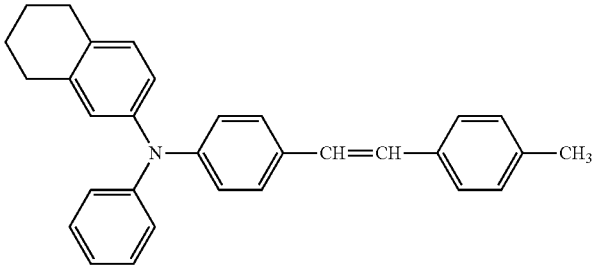
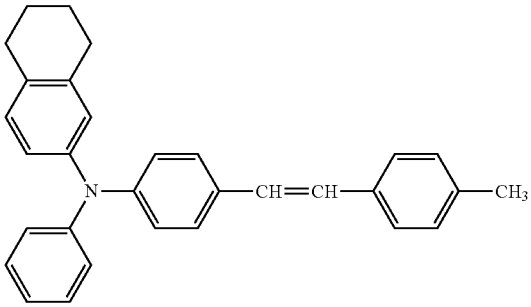
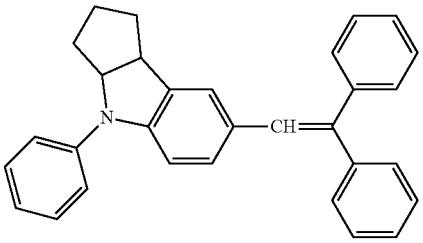
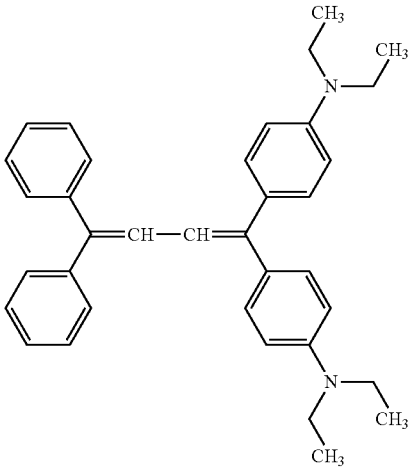
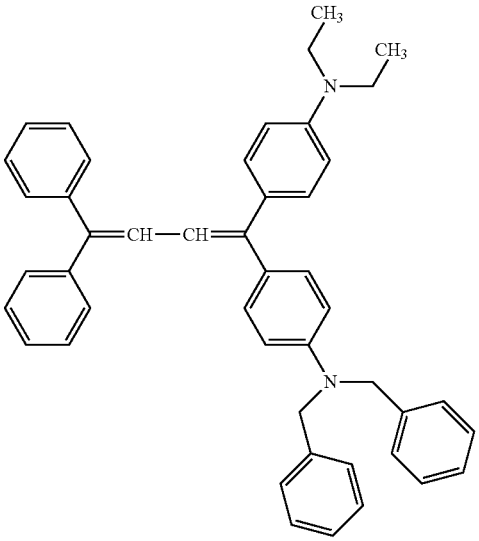

-continued
[Chemical Formula 36]
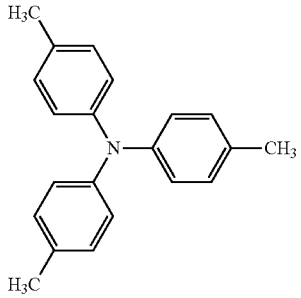
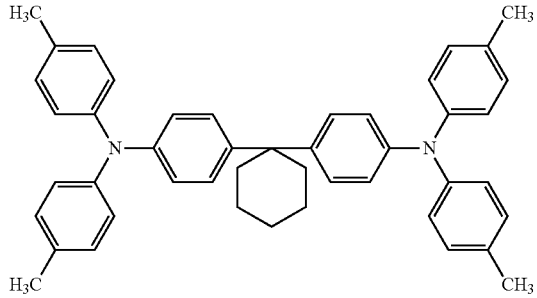
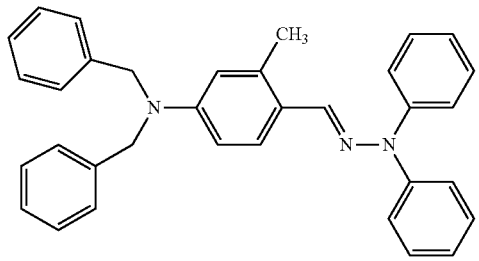
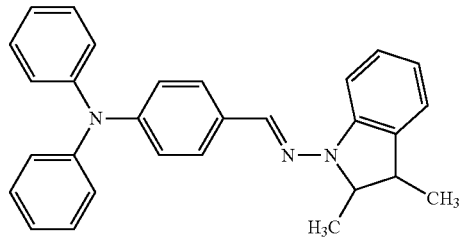
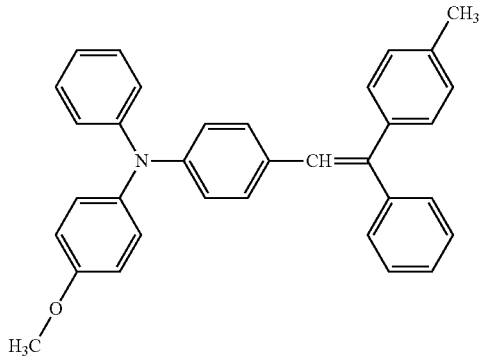
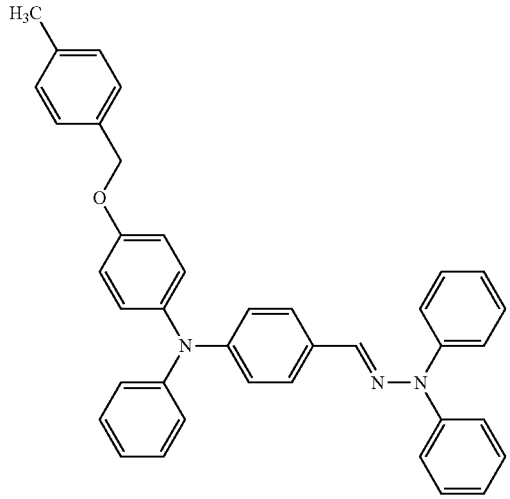
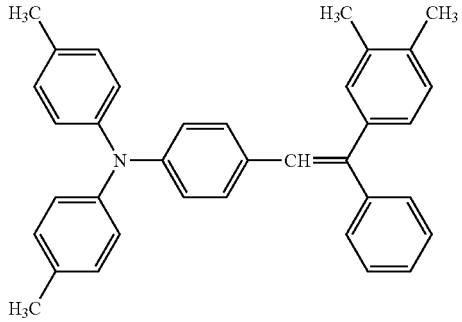
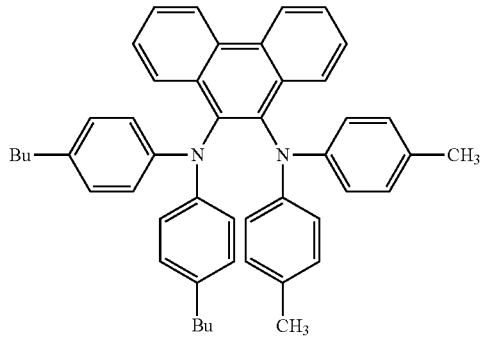

-continued
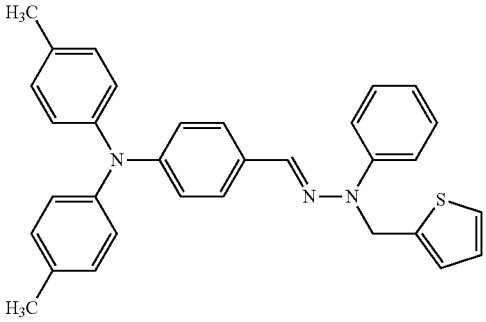
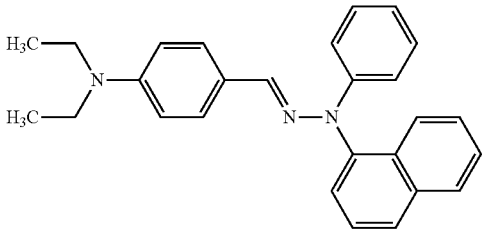
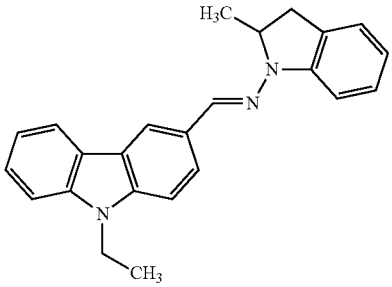
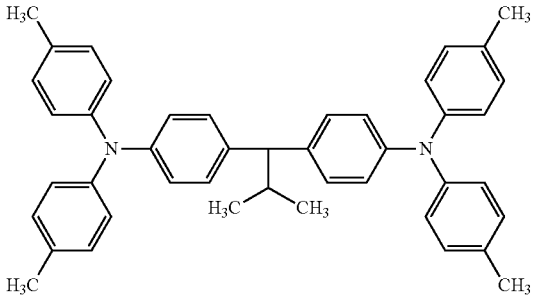
[Chemical Formula 37]
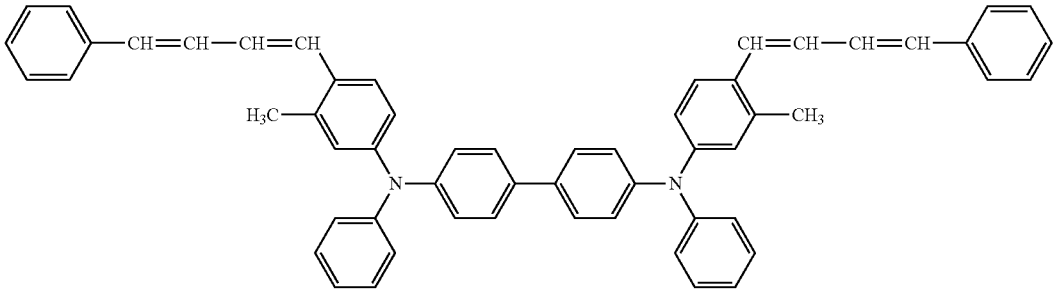
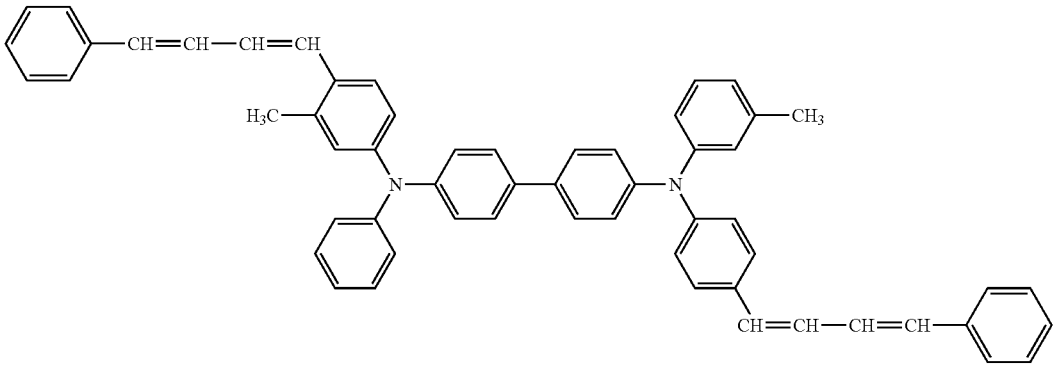
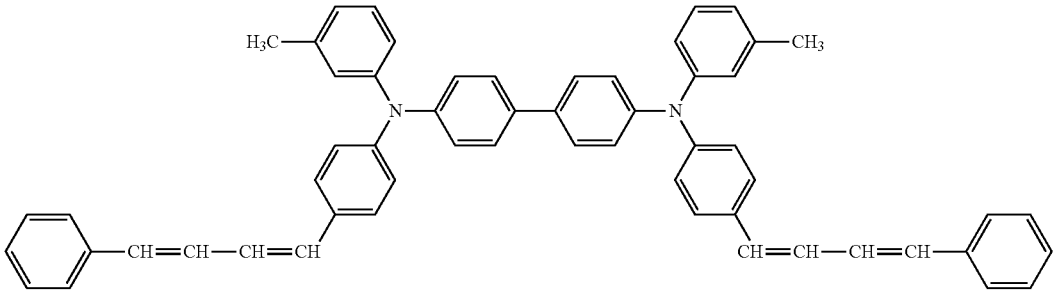

-continued
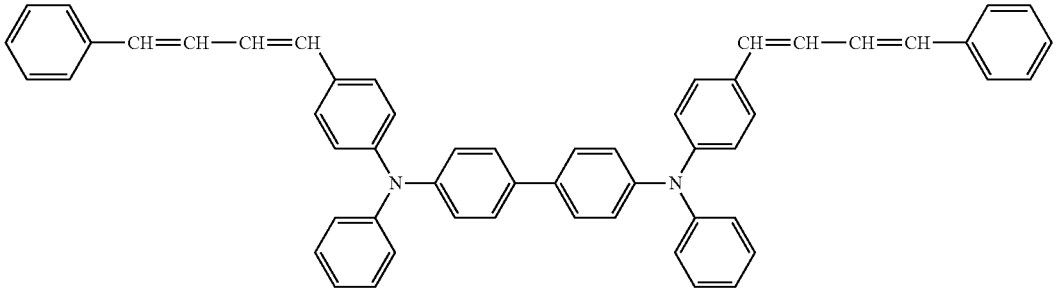
[Chemical Formula 38]
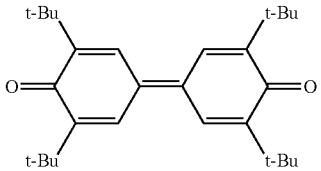
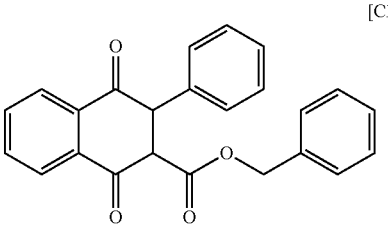
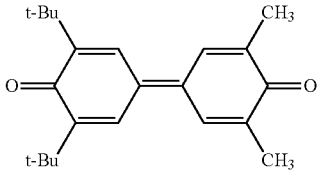
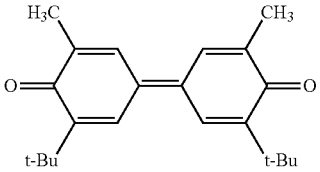
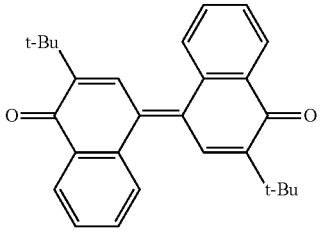
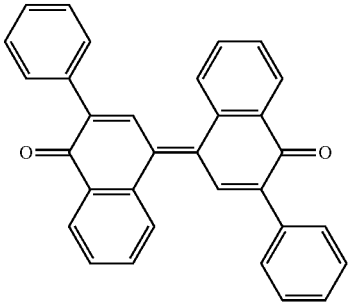
[Chemical Formula 39]
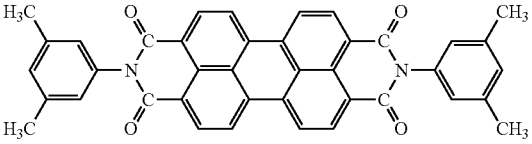
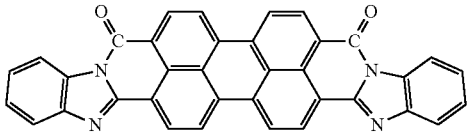
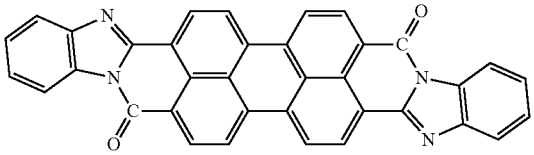
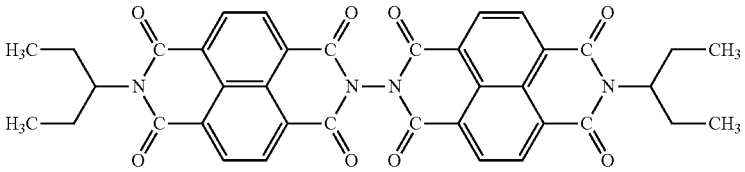

The charge transport material can be used either as a single kind, or as a mixture of two or more kinds in any combination and in any ratio.

The photosensitive layer according to the sixth subject matter of the present invention is the same as described in [II-3-3-3. Monolayer type (dispersion type) photosensitive layer] of the first subject matter except the above points.

[VII-2-4. Other Layer]

The photoreceptor may have additional layers besides the above-mentioned undercoat layer and photosensitive layer.

The other layer is the same as explained for [II-3-4. Other layers] of the first subject matter.

[VII-2-5. Formation Method of Each Layer]

The formation method of each layer such as undercoat layer, photosensitive layer and protective layer is the same as explained for [II-3-5. Formation method of each layer] of the first subject matter. In particular, the excellent stability of the coating liquid, when using the polyester resin of the present invention, is also the same.

[VII-2-6. Charge Type of the Photoreceptor]

The photoreceptor of the present invention is used as image forming device to be described later for the purpose of image formation. At this point, the photoreceptor according to the sixth subject matter of the present invention is a positive charge type photoreceptor, which is used at the charging step in an electrophotographic process by being charged positively. By using the photoreceptor according to the sixth subject matter of the present invention, as described above, abrasion resistance against the in-use load and electrical properties of the photoreceptor can be superior. In other words, though a previous positive charge type photoreceptor is inferior in abrasion resistance because it includes not only charge generation material but charge transport material in addition to binder resin, instead of such advantages as decreasing ozone generation and a promising high resolution, the use of the polyester resin of the present invention can improve both abrasion resistance and electrical properties. The reason for such advantages is not clear, but it is inferred that it is the chemical structure that is characteristic of the polyester resin of the present invention.

[VII-2-7. Advantage of the Photoreceptor]

As described above, by containing the polyester resin of the present invention in the monolayer type photosensitive layer, a photosensitive layer excellent in abrasion resistance and also in electrical properties can be obtained.

Incidentally, the photoreceptor of the present invention is exposed to form an electrostatic latent image by a write-in light from the exposure part while image forming. Any type of the write-in light can be used in that process insofar as an electrostatic latent image can be formed. However, among them, similarly to the second subject matter, a monochromatic light having exposure wavelength of 380 nm to 500 nm can be preferably used.

[VII-3. Image Forming Device]

The image forming device according to the sixth subject matter of the present invention is the same as explained for [II-4. Image forming device] in the first subject matter, except that it uses the above-mentioned photoreceptor according to the sixth subject matter of the present invention as electrophotographic photoreceptor and the photoreceptor is charged positively in the charging process. However, it is preferable that, as described above, a monochromatic light having exposure wavelength of 380 nm to 500 nm is used as exposure light of exposure apparatus 3.

In addition, also in the sixth subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7.

[VIII. Seventh Subject Matter]

The image forming device according to the seventh subject matter of the present invention comprises a photoreceptor, having a photosensitive layer containing the polyester resin of the present invention, and a toner, having a predetermined average degree of circularity (hereinafter referred to as "the toner of the present invention" as appropriate). The polyester resin of the present invention contained in the photosensitive layer is used as binder resin.

[VIII-1. Electrophotographic Photoreceptor]

There is no limitation on the photoreceptor according to the seventh subject matter of the present invention and thus any kind of photoreceptor can be used, insofar as it has a photosensitive layer containing the polyester resin of the present invention.

Therefore, the photoreceptor is the same as described in [II-3. Electrophotographic photoreceptor] of the first subject matter, except that, for example, it is not always necessary to use a hydrazone compound as charge transport material. Further, the photoreceptors described in the explanation for the first to sixth subject matters can also be used as the photoreceptor according to the seventh subject matter of the present invention, because every photoreceptor explained in the first to sixth subject matter has a photosensitive layer containing the polyester resin of the present invention.

[VIII-2. Toner of the Present Invention (Developer)]

The toner of the present invention is a toner (developer) having a predetermined average degree of circularity. The image forming device of the present invention can realize high-quality image formation by using such a toner having a predetermined average degree of circularity.

[VIII-2-1. Average Degree of Circularity of the Toner]

The shape of the toner of the present invention is preferably as spherical as possible. More specifically, the average degree of circularity of the toner, measured by a flow particle image analyzer, is usually 0.940 or larger, preferably 0.950 or larger, and more preferably 0.960 or larger. The more spherical the shape of the toner is, the less localization of electrostatic charge in the toner particles is likely to occur, and the more uniform the developing characteristics tend to be. The upper limit of the above-mentioned average degree of circularity has no particular limitation, insofar as it is 1.000 or less. However, when the toner shape is as close as a sphere, defective cleaning is likely to occur, and further, it is practically difficult to prepare a toner being absolutely spherical. Therefore, the upper limit is preferably 0.995 or less, and more preferably 0.990 or less.

In this context, the average degree of circularity mentioned above is used as an easy method for expressing the shape of a toner particle quantitatively. In the present invention, it is measured with a flow particle image analyzer FPIA-2000, manufactured by Sysmex Industrial Corporation, and the degree of circularity [a] of the measured particle is defined as the following formula (A).

$$\text{Degree of circularity } a = L_0/L \quad \text{(A)}$$

(In the Formula (A), $L_0$ indicates the peripheral length of a circle having the same projected area as that of the particle image, and L indicates the peripheral length of the particle image which is image-manipulated.

The above degree of circularity indicates the degree of unevenness of the toner particle's surface. When the toner is absolutely spherical, the value thereof is 1.00. The more complicated the surface shape is, the smaller the degree of circularity will be.

The average degree of circularity can be measured concretely in accordance with the following method. To the 20 mL of water, of which impurities are removed from the container, added a surfactant (preferably, alkylbenzene sulfonate) as dispersant, followed by adding the measurement sample (toner) of 0.05 g or around. This suspension liquid, in which the sample is dispersed, is irradiated with ultrasonic wave for 30 sec so as to adjust the concentration of the dispersion liquid at 3.0 to 8.0 thousand particles per 1 μL. Then the distribution of degree of circularity is measured with respect to the particles having equivalent circle diameter of 0.60 μm to 160 μm using the above-mentioned flow particle image analyzer.

[VIII-2-2. Kind of Toner]

There is no limitation on the toner of the present invention, insofar as it has an average degree of circularity of the above range. Various kinds of toners are generally produced depending on the various producing methods, but any kind of toner can be used as the toner of the present invention.

In the following, the kinds of toners will be explained, in combination with each corresponding producing method.

The toner of the present invention can be produced in any known method such as a polymerization method or melt-kneading pulverization method. Of these, a so-called polymerized toner is preferable, in which toner particles are formed in an aqueous medium. As polymerized toner, the following can be cited, for example: toners produced by suspension polymerization and emulsion polymerization flocculation. An emulsion polymerization flocculation method, in which toner is produced by the flocculation of polymer resin microparticles, colorant and so on in a liquid medium, is particularly preferable because the particle size and degree of circularity of the toner can be adjusted by controlling the flocculation condition.

In addition, a method has been proposed in which a low softening point material (so-called wax) is contained in toner, for the purpose of improving such characteristics of the toner as releasability, low-temperature fixing properties, offset property at high temperatures and filming resistance. In a melt-kneading pulverization method, the amount of wax contained in toner is difficult to be increased, and actually, the upper limit thereof is said to be about 5 weight % relative to that of the polymer (binder resin). On the other hand, in a polymerized toner, a large amount (5 to 30 weight %) of low softening point material can be contained, as described in Japanese Patent Laid-Open Publications No. Hei 5-88409 and No. Hei 11-143125. The above-mentioned "polymer" is a component material for a toner. For example, in the emulsion polymerization flocculation method to be described later, toner is produced by polymerizing polymerizable monomers.

A toner produced by the emulsion polymerization flocculation method will be described in more detail below.

When a toner is produced by the emulsion polymerization flocculation method, the manufacturing process thereof usually includes a polymerization step, mixing step, flocculation step, fusing step, and cleaning and drying step. Namely, polymer primary particles are obtained generally by emulsion polymerization (polymerization step). Then, to a dispersion liquid containing the polymer primary particles, a dispersion of a colorant (pigment), wax, charge control agent or the like, each of which is contained if necessary, is mixed (mixing step). Then, to the dispersion liquid, a flocculation agent is added to flocculate the primary particles to form agglomerates of particles (flocculation step). To this, microparticles or the like are deposited if necessary and then they are fused to form particles (fusing step). The obtained particles are washed and dried (cleaning and drying step), thereby to form base particles.

[1. Polymerization Step]

There is no special limitation on the kind of polymer microparticles (polymer primary particles). Therefore, as polymer primary particles, any kinds of microparticles can be used such as ones obtained by suspension polymerization, emulsion polymerization or the like, in which polymerizable monomers are polymerized in a liquid medium, or ones obtained by pulverizing agglomerates of polymers of resin or the like. However, among such methods, polymerization method is preferable. And among polymerization methods, particularly preferable is the emulsion polymerization method, especially in which wax is used as seeds of emulsion polymerization. The use of wax as seeds in emulsion polymerization can form microparticles as polymer primary particles, having a structure of polymers enveloping wax inside. By this method, wax does not leach out on the toner surface but remains enveloped inside the toner. Consequently, wax does not soil various members of the device or impair the charging characteristics of the toner, leading to the improvement in low-temperature fixing properties, offset property at high temperatures, filming resistance, releasability and the like of the toner.

In the following, a method to obtain polymer primary particles by emulsion polymerization using wax as seeds will be explained.

As emulsion polymerization method, any known one can be selected. The polymerization is usually carried out by mixing a polymerization initiator, polymerizable monomer to form polymer by polymerization, namely a compound having a polymerizable carbon-to-carbon double bond, and as needed, chain transfer agent, pH adjusting agent, polymerization degree-controlling agent, antifoaming agent, protective colloid, internal additive and the like, in wax microparticles which are obtained by dispersing wax in an liquid medium in the presence of an emulsifying agent, and then stirring them. By this procedure, an emulsion is obtained, in which microparticles (namely, polymer primary particles) having a structure of wax-enveloping polymers are dispersed in a liquid medium. Examples of the structure of wax-enveloping polymers include: core-shell structure, phase separation structure, occlusion structure and the like. Of these, preferable is core-shell structure.

(i. Wax)

As wax, any that is known to be usable for this purpose can be used. Examples include: olefin wax such as low-molecular-weight polyethylene, low-molecular-weight polypropylene or copolymerized polyethylene; paraffin wax; silicone wax with an alkyl group; fluorine resin wax such as low-molecular-weight polytetrafluoroethylene; higher fatty acid such as stearic acid; long chain aliphatic alcohol such as eicosanol; ester wax with a long chain aliphatic group such as behenyl behenate, montanic acid ester or stearyl stearate; ketones with a long chain alkyl group such as disstearyl ketone; vegetable wax such as hydrogenated ricinus oil or carnauba wax; esters or partial esters obtained from polyalcohol and long chain fatty acid, such as glycerin or pentaerythritol; higher fatty acid amide such as oleic amide or stearic acid amide; and low-molecular-weight polyester. Of these, a wax having at least one absorption peak within a range of 50° C. to 100° C. in the analysis using a differential scanning calorimeter (DSC).

Of these waxes, for example, ester wax, paraffin wax, olefin wax such as low-molecular-weight polypropylene and copolymerized polyethylene, and silicone wax are preferable because they exhibit releasability effect with a small amount. Particularly preferable is paraffin wax.

Waxes may be used either as a single kind thereof or as a mixture of two or more kinds in any combination and in any ratio.

When a wax is used, there is no limitation on the amount of the wax used. However, it is preferable that the content is usually 3 weight parts or more, preferably 5 weight parts or more, and usually 40 weight parts or less, preferably 30 weight parts or less, relative to 100 weight parts of the polymer. When the wax content is too small, the fixing temperature range may be insufficient. When it is too large, a device member may be soiled, leading to decreased image quality.

(ii. Emulsifying Agent)

There is no special limitation on the kind of the emulsifying agent, insofar as the advantage of the present invention is not significantly impaired. For example, any of the nonionic, anionic, cationic and amphoteric surfactants can be used.

Examples of nonionic surfactant include: polyoxyalkylene alkylether such as polyoxyethylene laurylether; polyoxyalkylene alkylphenylether such as polyoxyethylene octylphenylether; and sorbitan fatty acid ester such as sorbitan monolaurate.

Examples of anionic surfactant include: fatty acid salt such as sodium stearate and sodium oleate; alkylaryl sulfonate such as sodium dodecylbenzene sulfonate and alkyl sulfuric acid ester such as sodium lauryl sulfate.

Examples of cationic surfactant include: alkylamine salt such as laurylamine acetate and quaternary ammonium salt such as lauryltrimethylammonium chloride.

Further, as an example of amphoteric surfactant, alkyl betaine such as lauryl betaine can be cited.

Of these, nonionic surfactants and anionic surfactants are preferable.

Emulsifying agents can be used either as a single kind or as a mixture of two or more kinds in any combination and in any ratio.

Further, no particular limitation is imposed on the amount of emulsifying agent used, insofar as the advantage of the present invention is not significantly impaired. Usually, 1 to 10 weight parts of the emulsifying agent is used for 100 weight parts of the polymerizable monomer.

(iii, Liquid Medium)

As liquid medium, an aqueous medium is usually used, and water is used particularly preferably.

However, quality of the liquid medium relates to coarsening of the particles in the liquid medium, caused by re-flocculation. When the electrical conductivity of the liquid medium is high, the dispersion stability with time tends to be poor. Therefore, when an aqueous medium such as water is used as liquid medium, it is preferable to use an ion-exchange water or distilled water, which is desalted so that the electrical conductivity thereof is usually 10 μS/cm or lower, preferably 5 μS/cm or lower. The electrical conductivity is measured by a conductivity meter (Personal SC Meter SC72 and a detector SC72SN-11, manufactured by Yokogawa Electric Corporation) at 25° C.

There is no limitation on the amount of the liquid medium used, but usually about 1 to 20 times weight of the medium is used, relative to the polymerizable monomer.

The liquid medium can be also used either as a single kind or as a mixture of two or more kinds in any combination and in any ratio.

The wax microparticles can be formed by dispersing the above-mentioned wax in this liquid medium, in the presence of an emulsifying agent. The order by which the emulsifying agent and wax are put in the liquid medium is arbitrary. But usually, the emulsifying agent is put in the liquid medium first, and then the wax is. The emulsifying agent can also be put in the liquid medium continuously.

(iv. Polymerization Initiator)

After the preparation of the above-mentioned wax microparticles, a polymerization initiator is mixed in the liquid medium. Any kind of polymerization initiator can be used, insofar as the advantage of the present invention is not significantly impaired. The examples include: persulfates such as sodium persulfate and ammonium persulfate; organic peroxides such as t-butyl hydroperoxide, cumene hydroperoxide and p-menthan hydroperoxide; and inorganic peroxides such as hydrogen peroxide. Of these, inorganic peroxides are preferable. A polymerization initiator can be used either as a single kind or as a mixture of two or more kinds in any combination and in any ratio.

As another example of the polymerization initiator, a redox type initiator can be cited, in which persulfate, and/or organic/iorganic peroxide are mixed together with reducing organic compound such as ascorbic acid, tartaric acid and citric acid and/or reducing inorganic compound such as sodium thiosulfate, sodium bisulfite and sodium metabisulfite. In this case, the reducing inorganic compounds can be used either as a single kind or as a mixture of two or more kinds in any combination and in any ratio.

In addition, the amount of polymerization initiator used has no particular limitation. Usually, 0.05 to 2 weight parts of polymerization initiator is used for 100 weight parts of polymerizable monomer.

(v. Polymerizable Monomer)

After the preparation of the above-mentioned wax microparticles, polymerizable monomers are mixed, in addition to the above-mentioned polymerization initiator, in the liquid medium. No special limitation is imposed on the kind of polymerizable monomer. For example, styrenes, (metha) acrylic acid esters, acrylamides and monofunctional monomers such as monomer having a Bronsted acidic group (hereinafter abbreviate as "acidic monomer" as appropriate) and monomer having a Bronsted basic group (hereinafter abbreviate as "basic monomer" as appropriate) are mainly used. Furthermore, a polyfunctional monomer can be used in combination with a monofunctional monomer.

Examples of styrenes include styrene, methylstyrene, chlorostyrene, dichlorostyrene, p-tert-butylstyrene, p-n-butylstyrene and p-n-nonylstyrene.

Examples of (metha)acrylic acid esters include: methyl acrylate, ethyl acrylate, propyl acrylate, n-butyl acrylate, isobutyl acrylate, hydroxyethyl acrylate, 2-ethylhexyl acrylatre, methyl metacrylate, ethyl metacrylate, propyl metacrylate, n-butyl metacrylate, isobutyl metacrylate, hydroxyethyl metacrylate and 2-ethylhexyl metacrylate.

Examples of acrylamides include: acrylamide, N-propylacrylamide, N,N-dimethylacrylamide, N,N-dipropylacrylamide and N,N-dibutylacrylamide.

Further, examples of acidic monomers include: a monomer having a carboxyl group such as acrylic acid, methacrylic acid, maleic acid, fumaric acid and cinnamic acid; a monomer having a sulfonic acid group such as sulfonated styrene; and a monomer having a sulfonamide group such as vinylbenzene sulfonamide.

Further, examples of basic monomers include: aromatic vinyl compound having an amino group such as aminostyrene; a monomer containing a nitrogen-containing heterocyclic ring such as vinylpyridine and vinylpyrrolidone; and (metha)acrylic acid ester containing an amino group such as dimethylaminoethyl acrylate and diethylaminoethyl methacrylate.

Acidic monomers and basic monomers can exist as salt, accompanied by a counter ion.

Further, examples of polyfunctional monomers include: divinyl benzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol diacrylate or diallyl phthalate. Further, monomers having a reactive group, such as glycidyl methacrylate, N-methylol acrylamide or acrolein can also be used. Of these, a radical polymerizable bifunctional monomer is preferable, and divinylbenzene or hexanedioldiacrylate is particularly preferable.

Of these examples cited above, it is preferable that the polymerizable monomer comprises at least, one of styrenes, (metha)acrylic acid esters or an acidic monomers having a carboxyl group. As styrenes, preferable is styrene. As (metha) acrylic acid esters, butyl acrylate is preferable. As acidic monomers having a carboxyl group, acrylic acid is preferable.

The polymerizable monomer can be used either as a single kind or as a mixture of two or more kinds in any combination and in any ratio.

When the emulsion polymerization is performed with wax being seeds, an acidic monomer and a basic monomer are used in combination, as well as with a monomer other than those. This is because dispersion stability of the polymer primary particles can be enhanced by mixing an acidic monomer and a basic monomer.

In this procedure, the amount of the acidic monomer and basic monomer to be mixed can be decided arbitrarily. However, it is preferable that each amount of the acidic monomer and basic monomer is usually 0.05 weight parts or more, preferably 0.5 weight parts or more, more preferably 1 weight parts or more, and usually 10 weight parts or less, preferably 5 weight parts or less, relative to 100 weight parts of the total polymerizable monomers. When the amount of the acidic monomer or the basic monomer is below the above range, dispersion stability of the polymer primary particles may be decreased. When it exceeds the upper limit of the range, the charging characteristics of the toner may be affected adversely.

When a polyfunctional monomer is used together, the amount is arbitrary. However, it is preferable that the amount of the polyfunctional monomer is, relative to 100 weight parts of the polymerizable monomers, usually 0.005 weight parts or more, preferably 0.1 weight parts or more, more preferably 0.3 weight parts or more, and usually 5 weight parts or less, preferably 3 weight parts or less, more preferably 1 weight parts or less. The use of a polyfunctional monomer can improve the fixing properties of the toner. At this point, when the amount of the polyfunctional monomer falls below the above range, the offset resistance at high temperatures may be inferior. When it exceeds the upper limit of the range, the low-temperature fixing properties may be inferior.

There is no special limitation on the method for adding the polymerizable monomer to the liquid medium. For example, it may be added all at once, continuously or intermittently. Of these adding methods, from the viewpoint of reaction control, it is preferably added continuously. Further, when using two or more kinds of polymerizable monomers in combination, the respective polymerizable monomers may be added separately, or they may be mixed preliminarily before being added. Furthermore, during the addition of the monomers, the composition of the monomer mixture may be changed.

(vi. Chain Transfer Agent or the Like)

After the preparation of the above wax microparticles, if necessary, such additives as chain transfer agent, pH adjusting agent, polymerization degree-controlling agent, antifoaming agent, protective colloid and internal additive are added, in addition to the above-mentioned polymerization initiator and polymerizable monomer, to the liquid medium. There is no limitation on these additives, insofar as the advantage of the present invention is not significantly impaired. These additives may be used either as a single kind or as a mixture of two or more kinds in any combination and in any ratio.

As chain transfer agent, any known ones can be used. Concrete examples thereof include t-dodecyl mercaptan, 2-mercaptoethanol, diisopropylxanthogene, carbon tetrachloride and trichlorobromomethane. The chain transfer agent is usually used in the proportion of 5 weight parts to 100 weight parts of the polymerizable monomer.

As protective colloid, any that is known to be usable for this purpose can be used. Concrete examples include: polyvinyl alcohols such as partially or completely saponified polyvinyl alcohol, and cellulose and its derivatives such as hydroxy ethylcellulose.

Concrete examples of internal additives include: silicone oil, silicone varnish, fluorine-based oil. These internal additives are used for improving viscosity, flocculation property, flowability, charging characteristics, surface resistance or the like of the toner.

(vii. Polymer Primary Particles)

Polymer primary particles are obtained by mixing the polymerization initiator, polymerizable monomer, and as needed, various additives in the liquid medium containing wax microparticles, stirring them and polymerizing the monomers. The polymer primary particles can be obtained in a state of emulsion in the liquid medium.

There is no limitation on the order of adding the polymerization initiator, polymerizable monomer, additives or the like in the liquid medium. There is no limitation on the method of mixing or stirring them either.

Furthermore, there is no limitation on the reaction temperature of the polymerization (emulsion polymerization reaction), insofar as the reaction can proceed. However, the polymerization temperature is usually 50° C. or higher, preferably 60° C. or higher, more preferably 70° C. or higher, and usually 120° C. or lower, preferably 100° C. or lower, more preferably 90° C. or lower.

There is no special limitation on the volume average particle diameter of the polymer primary particles. It is usually 0.02 μm or larger, preferably 0.05 μm or larger, more preferably 0.1 μm or larger, and usually 3 μm or smaller, preferably 2 μm or smaller, more preferably 1 μm or smaller. When the volume average particle diameter is too small, it may be difficult to control the flocculation rate. When the volume average particle diameter is too large, the particle size of the toner obtained by the flocculation tends to be large, leading to the difficulty in forming a toner having intended particle size. The volume average particle diameter can be measured by a particle size analyzer utilizing the dynamic light scattering method to be described later.

In the present invention, the volume-based distribution of particle size is measured by the dynamic light scattering method. In this method, the particle size distribution is decided by detecting the scatterings of lights having different phases (Doppler Shift) depending on the speed of the Brownian motion of each particle which are dispersed finely, with a laser radiated on the particles. The actual measurement of the above-mentioned volume average particle diameter is carried out with an ultrafine particle size distribution analyzer (UPA-EX150, manufactured by NIKKISO Co., Ltd., hereinafter abbreviated as UPA) utilizing the dynamic light scattering method at the following settings.

upper limit of the measurement: 6.54 μm
lower limit of the measurement: 0.0008 μm
the number of channel: 52
measurement time: 100 sec
particle transmittance: absorption
particle refractive index: N/A (not applied)
particle shape: nonspherical
density: 1 g/cm$^3$
type of dispersion medium: WATER
dispersion medium refractive index: 1.333

The measurement is carried out using a sample in which a particle dispersion is diluted by a liquid medium so that the concentration index of the sample falls within the range of 0.01 to 0.1 and dispersed by an ultrasonic cleaner. The volume average particle diameter, relating to the present invention, is calculated as arithmetic mean value of the results of the above-mentioned volume-based distribution of particle size.

It is preferable that at least one of peak molecular weights of the polymer constituting the polymer primary particles, detected by the gel permeation chromatography (hereinafter abbreviated as "GPC" as appropriate), at usually 3000 or more, preferably 10000 or more, more preferably 30000 or more, and usually 100000 or less, preferably 70000 or less, more preferably 60000 or less. when the peak molecular weight is in the above range, durability, storage stability and fixing properties of the toner tend to be superior. Here, as the above-mentioned peak molecular weight, a value in terms of a polystyrene sample is used, and components insoluble in the solvent medium are eliminated at the measurement. Peak molecular weight here can be measured in the same way as for toner, which will be described later.

In particular, when a styrene resin is used as the above-mentioned polymer, the number-average molecular weight of the polymer detected by the gel permeation chromatography is usually 2000 or more, preferably 2500 or more, more preferably 3000 or more, and usually 50000 or less, preferably 40000 or less, more preferably 35000 or less. In addition, the weight-average molecular weight of the polymer is usually 20000 or more, preferably 30000 or more, more preferably 50000 or more, and usually 1000000 or less, preferably 500000 or less. This is because, by using a styrene resin having either one or preferably both of number-average molecular weight and weight-average molecular weight falling within each of the above ranges, durability, storage stability and fixing properties of the resultant toner will be excellent. Furthermore, the molecular weight distribution may have two main peaks. In this context, styrene resin means a polymer in which styrenes account for usually 50 weight % or more and preferably 65 weight % or more of the entire polymers.

It is preferable that the softening point (hereinafter abbreviated as "Sp" as appropriate) of the polymer is usually 150° C. or lower, and preferably 140° C. or lower, from the standpoint of low-energy fixing. Further, it is preferable that it is usually 80° C. or higher, and preferably 100° C. or higher, in view of offset resistance at high temperatures and durability. The softening point of the polymer can be decided as a temperature at the intermediate point of the strand from the beginning to the end of flow when 1.0 g of a sample is measured with a flow tester with a nozzle of 1 mm×10 mm under such conditions as 30 kg of load, 50° C. and 5 min of preheating and 3° C./min of temperature rising rate.

The glass transition point (Tg) of the polymer is usually 80° C. or lower, preferably 70° C. or lower. When the glass transition point (Tg) is too high, fixing may not be done with low energy. The lower limit of the glass transition point (Tg) of the polymer is usually 40° C. or higher, preferably 50° C. or higher. When the glass transition point (Tg) is too low, blocking resistance may be decreased. The glass transition point (Tg) of the polymer can be obtained as a temperature at the intersection of two tangent lines, drawn on the transition (inflection) points of a graph indicating a measurement by a differential scanning calorimeter under a condition of 10° C./min temperature rising rate.

The softening point and glass transition point (Tg) of the polymer can be within the above ranges by properly selecting the type, monomer composition, molecular weight or the like of the polymer.

[2. Mixing Step and Flocculation Step]

By adding pigment particles into the emulsion in which the above polymer primary particles were dispersed and flocculating them, an emulsion of flocculations (flocculated particles) containing polymers and pigments is prepared. At this point, the pigments are preferably added to the emulsion of the polymer primary particles as pigment particles dispersion, prepared by dispersing the pigment particles preliminarily in a liquid medium uniformly using a surfactant or the like. As liquid medium for the pigment particles dispersion is usually used an aqueous solvent such as water. Therefore, the pigment particles dispersion is prepared as an aqueous dispersion. At that preparation, a wax, charge control agent, release agent, internal additive or the like can be added to the emulsion as needed. Above-metioned emulsifying agent can also be added then for the purpose of maintaining the stability of the pigment particles dispersion.

As polymer primary particles, the above-mentioned polymer primary particles formed by the emulsion polymerization can be used. The polymer primary particles may be used either as a single kind thereof or as a mixture of two or more kinds in any combination and in any ratio. Furthermore, polymer primary particles (hereinafter, "combined polymer particles" as appropriate) prepared with materials or conditions other than those of the above-mentioned emulsion polymerization can be used in combination.

As such combined polymer particles, microparticles obtained by, for example, suspension polymerization or pulverization can be cited. As material of such combined polymer particles, resins can be used. Examples of that resin include, in addition to the (co)polymers of the monomers used for the above-described emulsion polymerization, single species polymer or copolymer of vinyl monomers such as vinyl acetate, vinyl chloride, vinyl alcohol, vinyl butyral and vinyl pyrolidone; thermoplastic resin such as saturated polyester resin, polycarbonate resin, polyamide resin, polyolefin resin, polyarylate resin, polysulfone resin and polyphenylene ether resin; and thermosetting resin such as unsaturated polyester resin, phenol resin, epoxy resin, urethane resin and rosin modified maleic acid. These combined polymer particles can be used either as a single kind or as a mixture of two or more kinds in any combination and in any ratio. However, the content of the combined polymer particles is, relative to the total weight of the polymer primary particles and combined polymer particles, usually 5 weight % or less, preferably 4 weight % or less, more preferably 3 weight % or less.

There is no limitation on the pigment, and any type of it can be used depending on the use. However, the pigment, which usually exists in the form of particles as colorant particles, preferably has little difference in density from polymer primary particles of the emulsion polymerization flocculation method. This is because, when flocculating the polymer primary particles and pigment, a uniform flocculation state can be formed and therefore the performance of the resultant toner will be improved. The density of the polymer primary particles is usually 1.1 to 1.3 g/cm$^3$.

From the above standpoint, the real density of the pigment particles measured by pycnometer method provided in JIS K 5101-11-1:2004 is usually 1.2 g/cm$^3$ or larger, preferably 1.3 g/cm$^3$ or larger, and usually 2.0 g/cm$^3$ or smaller, preferably 1.9 g/cm$^3$ or smaller, more preferably 1.8 g/cm$^3$. With a large real density of the pigment, particularly the sedimentation property in a liquid medium tends to deteriorate. In addition, considering such problems as storage stability and sublimation, carbon black or organic pigment is preferably used as the pigment.

The examples of the pigment that can meet the above requirements include such yellow pigments, magenta pigments and cyan pigments as cited in the following. As black pigment, the following can be used: carbon black or a pigment of which color tone is adjusted to black by mixing the following yellow pigment/magenta pigment/cyan pigment.

Among them, carbon black, which is used as black pigment, exists in a flocculated form of extremely fine primary particles and it is liable to suffer coarsening of the carbon black particles due to re-flocculation when dispersed as pigment particles dispersion. The re-flocculation degree of carbon black particles has a correlation with the amount of impurities (degree of undecomposed organic substances residue) contained in the carbon black. With large amount of impurities, the coarsening is dramatically liable to occur due to the re-flocculation after the dispersion.

With respect to the appropriate amount of impurities, the UV absorbance of toluene extract of the carbon black, measured quantitatively by the following method, is usually 0.05 or less, preferably 0.03 or less. A carbon black produced by channel method usually has a tendency to include a lot of impurities. Therefore, a carbon black produced by furnace method can be preferably used as carbon black for the toner of the present invention.

UV absorbance ($\lambda c$) of carbon black can be measured by the following method. Namely, 3 g of carbon black is dispersed and mixed well in 30 mL of toluene, and this mixture is filtered through No. 5C filter paper. The absorbance of this filtrate ($\lambda s$) is measured at 336 nm in a quartz cell of 1 cm path, using a commercially available UV spectrophotometer. The absorbance of toluene alone is measured as reference ($\lambda o$) in the same way and the UV absorbance of carbon black is calculated as $\lambda c=\lambda s-\lambda o$. As commercially available spectrophotometer, for example, UV visible spectrophotometer (UV-3100PC) manufactured by SHIMADZU CORPORATION can be used.

As yellow pigment, the following can be used, for example: compounds typified by condensed azo compounds and isoindolinone compounds. More concretely, C.I. pigment yellow 12, 13, 14, 15, 17, 62, 74, 83, 93, 94, 95, 109, 110, 111, 128, 129, 147, 168, 180, 185 and the like are preferably used.

As magenta pigment, the following can be used, for example: condensed azo compounds, diketo pyrrolo pyrrole compounds, anthraquinone, quinacridone compounds, basic dye lake compounds, naphthol compounds, benzimidazolone compounds, thioindigo compounds and perylene compounds. More concretely, C.I. pigment red 2, 3, 5, 6, 7, 23, 48:2, 48:3, 48:4, 57:1, 81:1, 122, 144, 146, 166, 169, 177, 184, 185, 202, 206, 207, 209, 220, 221, 238, 254, C.I. pigment violet 19 and the like are preferably used.

Of these, quinacridone pigments, represented as above C.I. pigment red 122, 202, 207, 209 and C.I. pigment violet 19 are particularly preferable. These quinacridone pigments are preferable as magenta pigment because they have brilliant hues and high light resistance. Of the quinacridone pigments, compound represented as C.I. pigment red 122 is particularly preferable.

As cyan pigment, the following can be used, for example, copper phthalocyanine compounds and their derivatives, anthraquinone compounds and basic dye lake compound. More concretely, C.I. pigment blue 1, 7, 15, 15:1, 15:2, 15:3, 15:4, 60, 62, 66 and the like are particularly preferable.

These pigments can be used either as a single kind or as a mixture of two or more kinds in any combination and in any ratio.

The above-mentioned pigment is mixed into the emulsion containing the polymer primary particles, as pigment particles dispersion, formed by dispersing the pigment particles in a liquid medium. At this point, the amount of the pigment particles used in the pigment particles dispersion is usually 3 weight parts or more, preferably 5 weight parts or more, and usually 50 weight parts or less, preferably 40 weight parts or less, relative to 100 weight parts of the liquid medium. When the content of the colorant exceeds the above range, such a high density of pigment enhances the possibility of re-flocculation of pigment particles in the dispersion, which is not favorable. When the content is below the above range, too much degree of dispersion makes it difficult to obtain an appropriate particle size distribution, which is not favorable either.

The content of the pigments, relative to that of the polymers contained in the polymer primary particles, is usually 1 weight % or more, preferably 3 weight % or more, and usually 20 weight % or less, preferably 15 weight % or less. Too small content of the pigments may thin the image density. Too much content thereof may make it difficult to control the flocculation degree.

A surfactant can be contained in the pigment particles dispersion. There is no special limitation on the surfactant. Examples thereof include the same surfactants exemplified for the emulsifying agent in the description for the emulsion polymerization method. Among them, nonionic surfactants, anionic surfactants such as alkylaryl sulfonates including sodium dodecylbenzenesulfonate and polymer surfactants are preferably used. The above surfactant can be used either as a single kind or as a mixture of two or more kinds in any combination and in any ratio.

Incidentally, the content of the pigments in the pigment particles dispersion is usually 10 to 50 weight %.

As liquid medium for the pigment particles dispersion, an aqueous medium is usually used and water is preferably used. At this point, the quality of water for the polymer primary particles and pigment particles dispersion relates to coarsening of each particle, caused by re-flocculation. When the electrical conductivity of the water is high, the dispersion stability with time tends to be poor. Therefore, it is preferable to use an ion-exchange water or distilled water, which is desalted so that the electrical conductivity thereof is usually 10 μS/cm or lower, preferably 5 μS/cm or lower. The electrical conductivity was measured by a conductivity meter (Personal SC Meter SC72 and a detector SC72SN-11, manufactured by Yokogawa Electric Corporation) at 25° C.

Also wax can be added to the emulsion, when the pigment is mixed in the emulsion containing the polymer primary particles. As wax, those cited in the explanation for the emulsion polymerization method can be used. The wax can be mixed either before, in the course of, or after the mixing of the pigment into the emulsion containing the polymer primary particles.

A charge control agent can also be added to the emulsion, when the pigment is mixed in the emulsion containing the polymer primary particles. As charge control agent, any that is known to be usable for this purpose can be used. As positively chargeable charge control agent, the following can be cited for example: nigrosine dyes, quaternary ammonium salts, triphenylmethane compounds, imidazole compounds and polyamine resin. As negatively chargeable charge control agent, the following can be cited for example: azo complex compound dye; metallic salt or metal complex of salicylic acid or alkyl salicylic acid; metallic salt or metal complex of calyxarene compound, benzylic acid; amide compound; phenol compound; naphthol compound; and phenolamide compound, which are containing atom such as Cr, Co, Al, Fe and B. Among them, it is preferable to choose a colorless or light-colored charge control agent in order to avoid a color tone abnormality. As positively chargeable charge control agent, quaternary ammonium salt or imidazole compound is particularly preferable. As negatively chargeable charge control agent, alkyl salicylic acid complex compound or calyxarene compound, containing atom such as Cr, Co, Al, Fe and B, is preferable. The charge control agent may be used either as a single kind or as a mixture of two or more kinds in any combination and in any ratio.

There is no limitation on the amount of the charge control agent used. However, it is usually 0.01 weight parts or more, preferably 0.1 weight parts or more, and usually 10 weight parts or less, preferably 5 weight parts or less, with respect to 100 weight parts of the polymer. When the amount of the charge control agent used is too much or too small, the desired charging amount may not be obtained.

The charge control agent can be mixed either before, in the course of, or after the mixture of the pigment into the emulsion containing the polymer primary particles.

It is preferable that the charge control agent is mixed at the time of flocculation as an emulsion in a liquid medium (usually, an aqueous medium), similarly to the above-mentioned pigment particles.

After the addition of the pigment to the emulsion containing the above-mentioned polymer primary particles, the polymer primary particles and the pigment are flocculated. As described above, at the mixing, the pigment is usually added in the form of pigment particles dispersion.

There is no limitation on the method of flocculatation. The examples thereof include heating, adding of an electrolyte and pH adjustment. Of these, method of adding an electrolyte is preferable.

Examples of the electrolyte added for flocculation include: chlorides such as NaCl, KCl, LiCl, $MgCl_2$ and $CaCl_2$; inorganic salts like sulfate such as $Na_2SO_4$, $K_2SO_4$, $Li_2SO_4$, $Mg_2SO_4$, $CaSO_4$, $ZnSO_4$, $Al_2$ $(SO_4)_3$ and $Fe_2(SO_4)_3$; and organic salts such as $CH_3COONa$ and $C_6H_5SO_3Na$. Of these, preferable is inorganic salts having a bivalent or higher, namely polyvalent, metal cation.

The electrolyte can be used either as a single kind or as a mixture of two or more kinds in any combination and in any ratio.

The amount of the electrolyte used depends on the type of the electrolyte. However, it is usually 0.05 weight parts or more, preferably 0.1 weight parts or more, and usually 25 weight parts or less, preferably 15 weight parts or less, more preferably 10 weight parts or less, with respect to 100 weight parts of the solid component in the emulsion. In the case of flocculation with an electrolyte mixed, when the amount of the electrolyte used is too small, the flocculation reaction proceeds more slowly, which may result in that residues of fine powder having diameter of 1 μm or less are remained or that the mean particle diameter of the resultant flocculation does not reach the intended particle size. When the amount of the electrolyte used is too large, the flocculation reaction proceeds too rapidly to control the particle diameter, which may lead to that the resultant flocculation comprises coarse particles or irregular-form substances.

It is preferable to heat the obtained flocculation in the same liquid medium to be spheroidized, in the same way as secondary flocculation (flocculation after the fusing step) to be described later. The heating may be done under the same condition as in the case of secondary flocculation (the same condition as explained for the fusing step).

On the other hand, when the flocculation is performed by heating, the temperature condition has no limitation, insofar as the flocculation reaction can proceed. A concrete example of the temperature condition for the flocculation reaction is usually 15° C. or higher, preferably 20° C. or higher, and usually the glass transition point (Tg) or lower, of the polymer of the polymer primary particles, and preferably 55° C. or lower. There is no limitation on the period for the flocculation reaction either. However, it is usually 10 min or longer, preferably 60 min or longer, and usually 300 min or shorter, preferably 180 min or shorter.

Further, it is preferable to perform the flocculation reaction under stirring. There is no special limitation on the apparatus used for the stirring, but the one having a double helical vane is preferable.

In this case, the obtained flocculation may be subsequently subjected to the next step, namely formation of a resin-coating layer (encapsulation step). Or otherwise, it may proceed to the encapsulation step after the fusing treatment by heating in the same liquid medium. However, it is more preferable to carry out the encapsulation step after the flocculation step, and then the fusing step in which heating is done at a temperature higher than the glass transition point (Tg) of the encapsulating resin microparticles. This is because the manufacturing processes can be simplified and the toner does not suffer a performance deterioration (such as thermal degradation).

[3. Encapsulation Step]

After the flocculation was obtained, it is preferable to form a resin-coating layer on the flocculation as approperiate. The encapsulation step for forming a resin-coating layer on the flocculation is a step in which the flocculation is covered with a resin by forming a resin-coating layer on the surface of the flocculation. By this step, the toner to be produced has a resin-coating layer. In the encapsulation step, the entire surface of the toner is not always covered, but a toner of which pigment does not leach out on the surface of the toner particle substantially can be obtained. The thickness of the resin-coating layer formed then has no limitation, but it usually falls within the range of 0.01 μm to 0.5 μm.

There is no special limitation on the method for forming the above resin-coating layer. Examples include: spray drying, mechanical fusion of particles, in-situ polymerization or method of coating particles in a liquid.

The method of forming resin-coating layer by the above spray drying is for example as follows. The flocculations, forming the inner layer, and the resin microparticles, forming the resin-coating layer, are dispersed in an aqueous medium to prepare a dispersion liquid. This dispersion liquid is sprayed out and dried, thereby a resin-coating layer can be formed on the flocculation surface.

The method of forming resin-coating layer by the above mechanical fusion of particles is for example as follows. The flocculations, forming the inner layer, and the resin microparticles, forming the resin-coating layer, are dispersed in a gas phase. Mechanical force is applied on them in a narrow gap, thereby a film of the resin microparticles is formed on the flocculation surface. As such apparatus, Hybridization System of Nara Machinery Co., Ltd. and Mechanofusion System of Hosokawa Micron Co can be used.

The method of the above in-situ polymerization is for example as follows. Monomers and polymerization initiator are added in the water in which the flocculations are dispersed, and then are absorbed to the flocculation surface. Subsequently the monomers are polymerized by heating, thereby a resin-coating layer is formed on the surface of the flocculation forming the inner layer.

The above method of coating particles in a liquid is for example as follows. The flocculations, forming the inner layer, and the resin microparticles, forming the outer layer, are reacted or combined to each other in an aqueous medium to form a resin-coating layer on the flocculation surface forming the inner layer.

The resin microparticles used for forming the outer layer is particles which has particle diameters smaller than that of the flocculations and consists mainly of resin component. There is no special limitation on the resin microparticles, insofar as they are composed of polymers. However, from the standpoint of the possiblity to control the thickness of the outer layer, it is preferable to use resin microparticles the same as above-mentioned polymer primary particles, flocculations or the fused particles formed by fusing the above flocculations. These resin microparticles, the same as particles such as the polymer primary particles, can be prepared by the same method as for the particles such as the polymer primary particles in the flocculations used for the inner layer.

There is no limitation on the amount of the resin microparticles used. However, it is preferable that the amount is usually 1 weight % or more, preferably 5 weight % or more, and usually 50 weight % or less, preferably 25 weight % or less, compared to the amount of the toner particles.

The particle diameter of the resin microparticles is preferably about 0.04 μm to 1 μm, in view of efficient adhesion or fusing of the resin microparticles to the flocculations.

It is preferable that the glass transition point (Tg) of the polymer component (resin component) used in the resin-coating layer is usually 60° C. or higher, preferably 70° C. or higher, and usually 110° C. or lower. In addition, the glass transition point (Tg) of the polymer component used in the resin-coating layer is preferably higher than that of the polymer primary particles by 5° C. or higher, more preferably by 10° C. or higher. When the glass transition point (Tg) is too low, the storage stability in a normal environment will deteriorate. When it is too high, the fusion properties will be insufficient, which is not preferable.

Moreover, it is preferable that polysiloxane wax is contained in the resin-coating layer. Thereby, an advantageous effect of offset resistance at high temperatures can be obtained. As an example of polysiloxane wax, silicone wax having an alkyl group can be cited.

There is no limitation on the content of the polysiloxane wax. However, it is, in each toner particle, usually 0.01 weight % or more, preferably 0.05 weight % or more, more preferably 0.08 weight % or more, and usually 2 weight % or less, preferably 1 weight % or less, more preferably 0.5 weight % or less. When the polysiloxane wax amount in the resin-coating layer is too small, the offset resistance at high temperatures may be insufficient. When it is too large, the blocking resistance may be decreased.

There is no limitation on the method of containing the polysiloxane wax in the resin-coating layer. The following is an example of the method. Emulsion polymerization is performed with the polysiloxane wax being seeds. The obtained resin microparticles are reacted or combined with the flocculations, which forms the inner layer, in an aqueous medium, thereby a resin-coating layer containing the polysiloxane wax is formed on the surface of the flocculations forming the inner layer.

[4. Fusing Step]

In the fusing step, the polymers constituting the flocculations are fused to be unified, by heating the flocculations.

In the case of encapsulated resin microparticles in which resin-coating layers are formed on the flocculations, the polymers constituting the flocculations and the resin-coating layer formed on its surface are fused to be unified together, by heating. Thereby, the pigment particles are made to be in such forms as not to leach out substantially on the surface.

The temperature of heat treatment in the fusing step is set at a temperature higher than the glass transition point (Tg) of the polymer primary particles constituting the flocculations. When the resin-coating layer is provided, it is set at a temperature higher than the glass transition point (Tg) of the polymer component constituting the resin-coating layer. There is no limitation on the more concrete temperature condition. However, it is preferably higher than the glass transition point (Tg) of the polymer component constituting the resin-coating layer by 5° C. or higher. In addition, there is no limitation on the upper limit. However, it is preferably equal to or lower than the "temperature higher than the glass transition point (Tg) of the polymer component constituting the resin-coating layer by 50° C.".

The period for the heat treatment depends on the processing capacity, production amount or the like. But it is usually 0.5 to 6 hr.

[5. Cleaning and Drying Step]

When the above-mentioned steps are carried out in a liquid medium, after the fusing step, the obtained encapsulated resin particles are washed and dried to remove the liquid medium. Thereby the toner can be obtained. There is no limitations on the methods of washing and drying.

[VIII-2-3. Physicochemical Properties of Toner]

[Data Regarding Particle Diameter of Toner]

There is no limitation on the volume average particle diameter (Dv) of the toner of the present invention, insofar as the advantage of the present invention is not significantly impaired. However, it is usually 4 μm or larger, preferably 5 μm or larger, and usually 10 μm or smaller, preferably 8 μm or smaller. When the volume average particle diameter (Dv) is too small, the stability in image quality may be decreased. When it is too large, the resolution may be lowered.

Further, it is preferable that the value (Dv/Dn), obtained by dividing the volume average particle diameter (Dv) by the number average particle diameter (Dn), of the toner of the present invention is usually 1.0 or larger, and usually 1.25 or smaller, preferably 1.20 or smaller, more preferably 1.15 or smaller. The value (Dv/Dn) indicates the degree of particle diameter distribution. The closer to 1.0 the value, the sharper the particle diameter distribution is. A sharper particle diameter distribution is preferable because the charging characteristics of the toner will be more uniform then.

In the toner of the present invention, the volume fraction of the particles having particle diameter of 25 μm or larger is usually 1% or smaller, preferably 0.5% or smaller, more preferably 0.1% or smaller, further more preferably 0.05% or smaller. The smaller the value, the more preferable. This is because, it indicates smaller ratio of coarse particles contained in the toner, which leads to less toner usage at continuous development and more stable image quality. No proportion of coarse particles with particle diameter of 25 μm or larger is most preferable, but it is practically impossible to manufacture. Therefore, usually it is not necessary to make the volume fraction 0.005% or smaller.

In addition, the volume fraction of the particles having particle diameter of 15 μm or larger, of the toner of the present invention, is usually 2% or smaller, preferably 1% or smaller, more preferably 0.1% or smaller. No proportion of coarse particles with particle diameter of 15 μm or larger is most preferable, but it is practically impossible to manufacture. Therefore, usually it is not necessary to make the volume fraction 0.01% or smaller.

Furthermore, it is preferable that, in the toner of the present invention, the number percentage of the particles with particle diameter of 5 μm or smaller is usually 15% or less, preferably 10% or less, from the standpoint of improving fog in image formation.

The volume average particle diameter (Dv), number average particle diameter (Dn), volume fraction, number percentage and the like of the toner can be measured by the following method. A Coulter counter, Multisizer type II or type III (manufactured by Beckman Coulter) is used as measurement device for measuring particle diameter of the toner. An interface for outputting the number distribution and volume distribution and a common personal computer are connected to the measurement device. As electrolytic solution, Isoton II is used. When measuring, to the above electrolytic solution, 100 to 150 mL, 0.1 to 5 mL of surfactant (preferably alkylbenzene sulfonate) as dispersant and 2 to 20 mg of the measurement sample (toner) are added. After dispersion treatment to the electrolytic solution in which the sample is suspended for about 1 to 3 min, the measurement is performed by the above Coulter counter, Multisizer type II or type III, using 100 μm aperture diameter. Thereby the numbers and volumes of the toner are measured. Then, based on them, the number and volume distribution are calculated, and then the volume average particle diameter (Dv) and number average particle diameter (Dn) are decided.

[Data Regarding Molecular Weight of Toner]

At least one peak molecular weight of THF-soluble fraction of the toner of the present invention, as measured by gel permeation chromatography, is usually 10,000 or higher, preferably 20,000 or higher, more preferably 30,000 or higher, and usually 150,000 or lower, preferably 100,000 or lower, more preferably 70,000 or lower. THF here indicates tetrahydrofuran. When all the peak molecular weights are below the above range, mechanical durability in nonmagnetic single component development method may deteriorate. When all the peak molecular weights are higher than the above range, low-temperature fixing properties or fix level may deteriorate.

The THF-insoluble fraction of the toner, determined by weight method using celite filtration to be described later, is usually 10% or more, preferably 20% or more, and usually 60% or less, preferably 50% or less. When the THF-insoluble fraction is not in the above range, it may be difficult to guarantee both of the mechanical durability and low-temperature fixing properties simultaneously.

The peak molecular weight of the toner of the present invention can be measured using an apparatus HLC-8120GPC (manufactured by TOSOH CORPORATION) under the following conditions.

Namely, the column is stabilized in a heat chamber at 40° C. and tetrahydrofuran (THF) is allowed to flow through the column as solvent at a rate of 1 mL per min at this temperature. Then, the toner is dissolved in THF, filtered through a 0.2 μm filter, and the filtrate is used as a sample.

The measurement can be done by injecting 50 to 200 μL of THF solution of the resin, prepared at a sample concentration (resin concentration) of 0.05 to 0.6 weight %, into a measurement apparatus. Molecular weight distribution of the sample (resin component in the toner) was calculated from the relationship between the logarithmic value of the calibration curve constructed from several monodisperse polystyrene standard samples and the number counted. As standard polystyrene samples for the construction of the calibration curve can be used, for example, a set of molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, $4.48\times10^6$, manufactured by Pressure Chemical Co. or Toyo Soda Co. It is appropriate that at least 10 points of such standard polystyrene samples are used. RI (Refractive index) detector is used as a detector.

For the satisfactory measurement of molecular weight range of $10^3$ to $2\times10^6$ in the above measurement method, it is advisable to use a plural number of commercially available polystyrene gel columns in combination. For example, a combination of μ-styragel 500, 103, 104 and 105, manufactured by Waters Co., or a combination of shodex KA801, 802, 803, 804, 805, 806 and 807 of SHOWA DENKO K. K. is preferable.

The amount of tetrahydrofuran (THF)-insoluble fraction of toner can be measured as follows. Namely, 1 g of toner sample is added to 100 g of THF and the mixture is left to stand at 25° C. for 24 hr for solubilization. The mixture is then filtered through 10 g of celite and the solvent is distilled off from the filtrate to determine THF-soluble fraction. The THF-insoluble fraction can be calculated by subtracting the amount of soluble fraction from 1 g.

[Softening Point and Glass Transition Point of Toner]

There is no limitation on the softening point (Sp) of the toner of the present invention, insofar as the advantage of the present invention is not significantly impaired. It is usually 150° C. or lower, and preferably 140° C. or lower, from the standpoint of low-energy fixing. Further, the softening point is usually 80° C. or higher, and preferably 100° C. or higher, in view of offset resistance at high temperatures and durability.

The softening point (Sp) of the toner can be decided as a temperature at the intermediate point of the strand from the beginning to the end of flow when 1.0 g of a sample is measured with a flow tester with a nozzle of 1 mm×10 mm under such conditions as 30 kg of load, 50° C. of preheating for 5 mins and 3° C./min of temperature rising rate.

There is no limitation on the glass transition point (Tg) of the toner of the present invention, insofar as the advantage of the present invention is not significantly impaired. It is usually 80° C. or lower, and preferably 70° C. or lower, from the standpoint of low-energy fixing. Further, the glass transition point (Tg) is usually 40° C. or higher, and preferably 50° C. or higher, in view of blocking resistance.

The glass transition point (Tg) of the toner can be obtained as a temperature at the intersection of two tangent lines, drawn on the transition (inflection) points of a graph indicating a measurement by a differential scanning calorimeter under a condition of 10° C./min temperature rising rate.

The softening point (Sp) and glass transition point (Tg) of toner are largely affected by the kind and composition ratio of the polymer contained in the toner. Therefore, the softening point (Sp) and glass transition point (Tg) of toner can be adjusted by optimizing the kind and composition ratio of the above polymer. They also can be adjusted with the molecular weight and gel component of the polymer, as well as the kind and content of low melting point component such as wax.

[VIII-2-4. Wax in Toner]

When the toner of the present invention contains wax, the mean dispersed particle diameter of the wax contained in the toner particle is usually 0.1 μm or larger, preferably 0.3 μm or larger. The upper limit thereof is usually 3 μm or smaller, preferably 1 μm or smaller. When the dispersed particle diameter is too small, an advantage of improved filming resistance may not be achieved. When the dispersed particle diameter is too large, wax tends to leach out on the toner surface, which may result in decreased charging characteristics or heat resistance.

The dispersed particle diameter of the wax can be decided, for example, by electron microscopic observation using toner formed into a thin film. As another example, it can be measured by microscopic observation of wax particles remained on a filter, after eluting the toner polymer in a solvent such as an organic resolvent that does not dissolve the wax and filtration of the eluate with the filter. Here, the dispersed particle size of the wax may be determined not only by a method wherein the toner is formed into a thin film and observed by an electron microscope but also by a method wherein the binder resin of the toner is eluted by e.g. an organic solvent which does not dissolve the wax, followed by-filtration through a filter, and the wax particles remaining on the filter are measured by a microscope.

The wax content in the toner has no limitation, insofar as the advantage of the present invention is not significantly impaired. However, it is usually 0.05 weight % or more, preferably 0.1 weight % or more, and usually 20 weight % or less, preferably 15 weight % or less. When the wax content is too small, the fixing temperature range may be insufficient. When it is too large, a device member may be soiled, leading to decreased image quality.

[VIII-2-5. Externally Added Microparticles]

An externally added microparticle can be attached on the surface of the toner particle, for the purpose of improving fluidity, charging stability, blocking resistance under high temperatures or the like of the toner.

Examples of the method for attaching the externally added microparticles on the particle surface of the toner include: a method in which, after mixing the externally added microparticles and the secondary flocculation, of the toner production method described above, in a liquid medium, the mixture is heated and thereby the externally added microparticles are adhered to the toner particles; and a method in which the externally added microparticles are mixed with or adhered to the toner particles dryly, the toner particles being obtained by washing and drying the secondary flocculations of which liquid medium was removed.

As a mixing machine used for dryly-mixing toner particles and externally added microparticles, the following can be cited: Henschel mixer, Super mixer, Nauta mixer, V-type mixer, Loedige mixer, double corn mixer and drum type mixer. It is particularly preferable to mix homogeneously, using a high speed blending type mixer such as Henschel mixer and Super mixer, and adjusting the blade shape, rotation speed, length of time, number of operation/termination, and the like appropriately.

As apparatus used to adhere externally added microparticles to toner particles by a dry method, the following can be used: a compression shearing stress apparatus which can apply compression shearing stress, and particle surface fusion treatment apparatus which can subject a particle surface to fusion treatment.

A compression shearing stress apparatus is equipped with a narrow gap portion composed of 2 head surfaces, head surface and wall surface, and two wall surfaces, these surfaces moving while maintaining the gap interval. Particles to be treated are made to pass forcibly through the gap, and compression stress and shearing stress are applied on the surface of the particles without particles being crushed substantially. As this kind of compression shearing stress apparatus, Mechanofusion Apparatus of Hosokawa Micron Co can be cited.

On the other hand, a particle surface fusion treatment apparatus is constructed in such a way that, by making use of a hot air stream for example, a mixture of base microparticles and externally added microparticles is heated instantaneously over a temperature of fusion initiation temperature of the base microparticles and, thereby, the externally added microparticles are adhered. As this kind of particle surface fusion treatment apparatus, a Surfusing System of Nippon Pneumatic Co., LTD can be cited.

As externally added microparticles, particles can be used which are known to be usable for the above purpose. The examples include: inorganic microparticles and organic microparticles.

As inorganic microparticles, the following can be cited: carbides such as silicon carbide, boron carbide, titanium carbide, zirconium carbide, hafnium carbide, vanadium carbide, tantalum carbide, niobium carbide, tungsten carbide, chromium carbide, molybdenum carbide and calcium carbide; nitrides such as boron nitride, titanium nitride, zirconium nitride and silicon nitride; borides such as zirconium boride, oxides or hydroxides such as silica, colloidal silica, titanium oxide, aluminum oxide, calcium oxide, magnesium oxide, zinc oxide, copper oxide, zirconium oxide, cerium oxide, talc and hydrotalcite; titanate compounds such as calcium titanate, magnesium titanate, strontium titanate, and barium titanate; phosphate compounds such as tricalcium phosphate, calcium dihydrogen phosphate, calcium monohydrogen phosphate and substituted calcium phosphate in which part of phosphate ion is replaced by negative ion; sulfides such as molybdenum disulfide; fluorides such as magnesium fluoride and carbon fluoride; metallic soap such as aluminum stearate, calcium stearate, zinc stearate and magnesium stearate; talc; bentonite and various carbon blacks such as electroconductive carbon black. Further, magnetic material such as magnetite, maghematite, and intermediate compound of magnetite and maghematite may be used.

On the other hand, as organic microparticles, the following can be used, for example: microparticles of such as styrene resin, acrylic resin such as methyl polyacrylate and methyl polymetacrylate, epoxy resin, melamine resin, tetrafluoroethylene resin, trifluoroethylene resin, polyvinyl chloride, polyethylene and polyacrylonitrile.

Of these externally added microparticles, preferably used are silica, titanium oxide, alumina, zinc oxide and carbon black.

The externally added microparticle can be used either as a single kind or as a mixture of two or more kinds in any combination and in any ratio.

Furthermore, the surface of these inorganic or organic microparticles may be treated by such means as hydrophobization by using, for example, silane coupling agent, titanate coupling agent, silicone oil, denatured silicone oil, silicone varnish, fluorine-containing silane coupling agent, fluorine-containing silicone oil, or coupling agent possessing amino group or quaternary ammonium salt group. These agents can be used either as a single kind or as a mixture of two or more kinds in any combination and in any ratio.

The number-average particle diameter of the externally added microparticles has no limitation, insofar as the advantage of the present invention is not significantly impaired. It is usually 0.001 μm or larger, preferably 0.005 μm or larger, and usually 3 μm or smaller, preferably 1 μm or smaller. It is possible to mix those having different mean particle diameters. The mean particle diameter of the externally added microparticle can be decided by electron microscopic observation or by calculation from the value of BET specific surface area.

The content ratio of the externally added microparticles, relative to the toner, has no limitation, insofar as the advantage of the present invention is not significantly impaired. However, it is preferable that the content ratio of the externally added microparticles, relative to the total weight of the toner and externally added microparticles, is usually 0.1 weight % or more, preferably 0.3 weight % or more, more preferably 0.5 weight % or more, and usually 10 weight % or less, preferably 6 weight % or less, more preferably 4 weight % or less. When the content of the externally added microparticles is too small, the fluidity and charging stability may be insufficient. When it is too large, the fixing properties may deteriorate.

[VIII-2-6. Others]

The charging characteristics of the toner of the present invention may be either negative or positive. It can be decided depending on the system of the image forming device in which the toner is used. Further, the charging characteristics of the toner can be adjusted by the composition and the proportion of the base particles of the toner such as charge control agent, as well as the composition and the proportion of the auxiliary microparticles, or the like.

The toner of the present invention may be used either as one component developer or as two component developer which includes a carrier mixed therein.

When it is used as two component developer, examples of the carrier, which is mixed with the toner to form a developer, include known magnetic materials such as iron-powder type carrier, ferrite-type carrier and magnetite-type carrier, or substances in which a resin coating is applied to those magnetic materials on their surfaces and magnetic resin carriers.

As coating resin for the carrier, the following can be used, for example: a commonly known resins such as styrene resin, acrylic resin, styrene-acrylic copolymer resin, silicone resin, modified silicone resin or fluorine-based resin, but it is not limited thereto.

There is no special limitation on the mean particle diameter of the carrier, but preferable carrier is the one having mean particle diameter of 10 μm to 200 μm. It is preferable to use the carrier in the proportion of 5 to 100 weight parts relative to 1 weight part of the toner.

Full-color image formation by the electrophotographic method can be performed by an ordinary method using color toners such as magenta, cyan and yellow, and if necessary, a black toner.

[VIII-3. Image Forming Device]

The image forming device according to the seventh subject matter of the present invention is the same as explained for [II-4. Image forming device] in the first subject matter, except that it uses the above-mentioned photoreceptor according to the seventh subject matter of the present invention as electrophotographic photoreceptor and the toner of the present invention as toner.

In this case, because the photoreceptor according to the seventh subject matter of the present invention and the toner of the present invention are used in combination, not only improvement in durability of the photoreceptor but also high quality of the image formation can be realized. A technology has been already present in which either improvement in durability of the photoreceptor or high quality of the image formation is achieved, but both of them can be realized at the same time in the present invention for the first time.

The advantages of the seventh subject matter of the present invention will be described below in comparison with previously known techniques.

Previously, for a copying machine or a printer, a higher image quality, in addition to the durability, was demanded. To satisfy such a requirement, a toner having mean particle diameter of about 3 μm to 8 μm and narrow particle size distribution has been used.

Toner has been produced by the melt-kneading pulverization method, in which a binder resin and a colorant, as main components, are melt-kneaded until they are homogenized, and then pulverized. However, it is difficult to efficiently produce toner that can meet the requirement of higher image quality by the melt-kneading pulverization method.

Therefore, a so-called polymerized toner has been proposed, in which toner particles are formed in an aqueous medium. For example, a toner produced by suspension polymerization is disclosed in Japanese Patent Laid-Open Publication No. Hei 5-88409. In addition, a toner produced by emulsion polymerization flocculation is disclosed in Japanese Patent Laid-Open Publication No. Hei 11-143125. The emulsion polymerization flocculation method, in which toner is produced by the flocculation of polymer resin microparticles and colorant in a liquid medium, is particularly advantageous in that various characteristics required for toner can be easily optimized, because the particle size and degree of circularity of the toner can be adjusted by controlling the flocculation condition.

In addition, a method has been proposed in which a low softening point material (so-called wax) is contained in toner, for the purpose of improving such characteristics of the toner as releasability, low-temperature fixing properties, offset property at high temperatures and filming resistance. In a melt-kneading pulverization method, the amount of wax contained in toner is difficult to be increased, and actually, the upper limit thereof is said to be about 5 weight % relative to that of the polymer (binder resin). On the other hand, in a polymerized toner, a large amount (5 to 30 weight %) of low softening point material can be contained, as described in Japanese Patent Laid-Open Publications No. Hei 5-88409 and No. Hei 11-143125.

However, a previous photoreceptor has such problems as abrasions and flaws on the surface due to the in-use loads such as development by toner, frictions from the transfer member, paper or cleaning member (blade). To solve these problems, by using a polyester resin having a predetermined structure as photosensitive layer of the photoreceptor, an image forming device has been obtained which has durability at some level and image quality at practical level.

However, it is desirable that an image forming device excels both in durability and image quality, as described above. But, with respect to high image quality as well as the high durability demanded nowadays, they have not yet been achieved at the same time both at considerable levels.

In contrast, because the image forming device according to the seventh subject matter of the present invention uses a photoreceptor having a photosensitive layer containing the polyester resin of the present invention and the toner of the present invention in combination, not only improvement in durability of the photoreceptor but also high quality of the image formation can be realized.

Further, it is preferable in the present subject matter that, as described in the second to sixth subject matter, a monochromatic light having exposure wavelength of 380 nm to 500 nm is used as exposure light of exposure apparatus 3.

In addition, also in the seventh subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7. However, in such a case, it is preferable that the cartridge contains at least the photoreceptor according to the seventh subject matter of the present invention and the toner of the present invention.

[IX. Eighth Subject Matter]

The image forming device according to the eighth subject matter of the present invention comprises a photoreceptor having a photosensitive layer containing the polyester resin of the present invention and an exposure part for forming an electrostatic latent image with a monochromatic light having an exposure wavelength of 380 nm to 500 nm. The polyester resin of the present invention contained in the photosensitive layer is used as binder resin.

[IX-1. Electrophotographic Photoreceptor]

There is no limitation on the photoreceptor according to the eighth subject matter of the present invention and thus any kind of photoreceptor can be used, insofar as it has a photosensitive layer containing the polyester resin of the present invention.

Therefore, the photoreceptor that can be used is the same as described in [II-3. Electrophotographic photoreceptor] of the first subject matter, except that, for example, it is not always necessary to use a hydrazone compound as charge transport material. Further, the photoreceptors described in the explanations for the first to seventh subject matters can also be used as the photoreceptor according to the eighth subject matter of the present invention, because every photoreceptor explained in the first to seventh subject matter has a photosensitive layer containing the polyester resin of the present invention.

However, in the photoreceptor according to the eighth subject matter of the present invention, the charge transport material, transmittance of the charge transport layer and charge generation material are preferable as follows.

[IX-1-1. Charge Transport Material]

Usually, it is preferable for a lamination type photoreceptor, often used for a photoreceptor, to have a charge transport layer with sufficient transmittance with respect to the write-in light wavelength. Accordingly, in the photoreceptor according to the eighth subject matter of the present invention, it is preferable also for the charge transport material to have sufficient transmittance with respect to the exposure wavelength of 380 nm to 500 nm. No particular limitation is imposed on the structure of the charge transport material. However, further extension of the conjugated system of aromatic compounds results in a shift of absorption wavelength to a longer wavelength region in many cases, which is not desirable.

In view of the above points, charge transport materials containing no unsaturated bond other than aromatic ring, cited in the explanation for [III-2. Charge transport material containing no unsaturated bond other than aromatic ring], can be used as charge transport material having a preferable structure in the photoreceptor according to the eighth subject matter of the present invention. Among others, compounds cited as examples of the charge transport material, which are represented by the formula (10) and (11), can be preferably used.

[IX-1-2. Transmittance of Charge Transport Layer]

As described earlier, in the photoreceptor according to the eighth subject matter of the present invention, it is preferable for the charge transport layer to have sufficient transmittance with respect to the exposure wavelength of 380 nm to 500 nm. Therefore, it is preferable that the transmittance of the charge transport layer is usually 70% or larger, preferably 80% or larger, more preferably 90% or larger, and particularly preferably 95% or larger for the wavelength region of 400 nm to 500 nm. When the transmittance of the charge transport layer is too low, sufficient sensitivity may not be obtained or the photoreceptor may deteriorate due to the write-in light.

To meet such a requirement, it is preferable to use the polyester resin of the present invention, already explained, in combination with the charge transport material described in [IX-1-1. Charge transport material]. A charge-transfer absorption occurs when a charge transport material with high electron-releasing ability is used in combination with a compound in which, for example, one aromatic ring such as terephthalic acid residue with two or more substituents of ester bindings is substituted, which is often used as conventional polyester resin. Consequently, the transmittance is lowered when that binder resin and charge transport material are used together, though each of them has sufficient transmittance with respect to the wavelength of 380 nm to 500 nm. However, the polyester resin of the present invention can be used for an image forming device with exposure wavelength of 380 nm to 500 nm, because it is not so high in electron-accepting properties and thus a charge-transfer absorption does not occur.

[IX-1-3. Charge Generation Layer]

As charge generation material in the photoreceptor according to the eighth subject matter of the present invention, for example, the one explained in the above [II-3-3-1. Charge generation layer] can be used. Among them, preferable are organic pigments, in particular, phthalocyanine pigments and azo pigments. Of these, azo pigments are more preferable in view of sensitivity. As phthalocyanine pigment, titanyl phthalocyanine of which diffraction angle $2\theta \pm 0.2°$ has a distinct peak at 27.3° in powder X ray diffraction using CuKα line is preferable.

[IX-2. Exposure Wavelength]

In the image forming device according to the eighth subject matter of the present invention, a monochromatic light having wavelength (exposure wavelength) of usually 380 nm or longer and 500 nm or shorter, preferably 480 nm or shorter and more preferably 430 nm or shorter is used for the exposure.

[IX-3. Image Forming Device]

The image forming device according to the eighth subject matter of the present invention is the same as explained for [II-4. Image forming device] in the first subject matter, except that it uses the above-mentioned photoreceptor according to the eighth subject matter of the present invention as electrophotographic photoreceptor and an exposure part that can form an electrostatic latent image with a monochromatic light having the above-mentioned predetermined wavelength range (namely, 380 nm to 500 nm).

In the following, the exposure part of the image forming device according to the eighth subject matter of the present invention will be explained in more detail, by referring to the image forming device cited in [II-4. Image forming device] as an example. The exposure part, namely, exposure apparatus 3, in the present image forming device is an apparatus that can form an electrostatic latent image on the photosensitive surface of electrophotographic photoreceptor 1 by exposing electrophotographic photoreceptor 1. There is no limitation on the number, kind, wavelength to be used or the like thereof, insofar as the exposure wavelength of at least one exposure apparatus 3 is 380 nm to 500 nm of a monochromatic light. This results in that two or more exposure apparatuses can be used and that a light having wavelength of other than 380 nm to 500 nm can be used together. Concrete examples of exposure apparatus 3 include a halogen lamp, a fluorescent lamp, lasers such as LD or He—Ne laser, and an LED. Of these, LD or LED having oscillation wavelength in the above-mentioned wavelength region is preferable.

Consequently, using the image forming device according to the eighth subject matter of the present invention, the rub resistance, as well as the sensitivity, of the photoreceptor can be enhanced. This usually leads to higher image quality, as well as long lifetime, of the image forming device.

In addition, also in the eighth subject matter of the present invention, similarly to the first subject matter, the photoreceptor may be constructed as an integrated cartridge (electrophotographic photoreceptor cartridge) that incorporates one or more of charging apparatus 2, exposure apparatus 3, developing apparatus 4, transfer apparatus 5, cleaning apparatus 6 and fixing apparatus 7. However, in such a case, it is preferable that the cartridge contains at least the photoreceptor according to the eighth subject matter of the present invention and an exposure part for exposing the photoreceptor with a monochromatic light having an wavelength of the above-mentioned wavelength range.

[X. Others]

The electrophotographic photoreceptor, image forming device and electrophotographic photoreceptor cartridge of the present invention have been explained in detail above. However, the present invention is by no means limited to the above-mentioned embodiments and examples, but any modifications can be added thereto without departing from the scope of the present invention.

For example, components according to each subject matter described above, such as charge generation material, charge transport material, binder resin, solvent, antioxidant, additive, photoreceptor comprising them, charging apparatus, exposure apparatus, developing apparatus, transfer apparatus, cleaning apparatus, fixing apparatus and charge removal apparatus, can be used in any combination, without departing from the scope of each subject matter of the present invention.

In the above-mentioned photoreceptor according to the eighth subject matter of the present invention, the charge transport layer may contain, as binder resin, polyester resin other than the polyester resin of the present invention, insofar as the transmittance of the charge transport layer meets the above-mentioned requirement.

EXAMPLE

In the following, the present embodiment will be explained more specifically with reference to Examples. It should be understood that the following Examples are just for the purpose of detailed explanation of the present invention, and the present invention is by no means restricted to the following Examples, insofar as it does not depart from the scope thereof. Further, the word "part(s)" in the following descriptions of Examples, Comparative Examples and Reference examples indicates "weight part(s)", unless specified otherwise. In addition, CTM indicates charge transport material.

[Production of the Resin]

The measurement of viscosity-average molecular weight will be explained first. A resin to be measured is dissolved in dichloromethane to prepare a solution with concentration C of 6.00 g/L. Time to flow t of the sample solution is measured in a thermostat bath set at 20.0° C., using an Ubbelohde capillary viscometer of which time to flow t0 of the solvent (dichloromethane) is 136.16 sec. The viscosity-average molecular weight Mv is calculated in accordance with the following equations.

$$a=0.438\times\eta_{sp}+1 \quad \eta_{sp}=t/t_0-1$$

$$b=100\times\eta_{sp}/C \quad C=6.00(\text{g/L})$$

$$\eta=b/a$$

$$Mv=3207\times\eta^{1.205}$$

The production method of the polyester resin will be explained in the following.

Production Example 1

Polyester Resin X

Sodium hydroxide, 23.01 g, and $H_2O$, 940 mL, were weighed out in a 1000 mL beaker, and the mixture was dissolved with stirring. 49.36 g of bis(4-hydroxy-3-methylphenyl)methane (hereinafter abbreviated as "BP-a") was added to this solution and dissolved therein with stirring. This alkaline aqueous solution was transferred to a 2-L reaction vessel. Benzyltriethylammonium chloride, 0.5766 g, and 2,3,5-trimethylphenol, 1.2955 g, were then added to the reaction vessel in this order. Separately, a mixed solution of diphenylether-4-4'-dicarboxylic acid chloride, 65.27 g, and dichloromethane, 470 mL, were transferred to a dropping funnel. While maintaining the external temperature of the polymerization vessel at 20° C., the dichloromethane solution was dropped from the dropping funnel to the alkaline aqueous solution in the reaction vessel over a period of one hr under stirring. After stirring for further 5 hrs, dichloromethane, 783 mL, was added, and stirring was continued for 7 hrs. Acetic acid, 8.34 mL, was then added, followed by stirring for 30 mins. Stirring was then stopped and the organic layer was separated. The organic layer was washed twice with 0.1 N sodium hydroxide water solution, 942 mL, twice with 0.1 N hydrochloric acid, 942 mL, and further twice with $H_2O$ 942, mL. The organic layer after washing was poured into 6266 mL of methanol, and the precipitate was separated by filtration, followed by drying, to obtain the target polyester resin X. The viscosity-average molecular weight of the resultant polyester resin X was 51,400. The repeating structural unit of the polyester resin X is shown below.

[Chemical Formula 40]

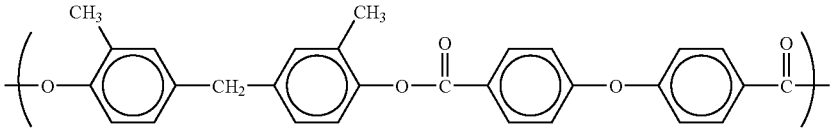

The Repeating Structural Unit of the Polyester Resin X

Production Example 2

Polyester Resin Y

Sodium hydroxide 22.34 g and $H_2O$ 940 mL were weighed out in a 1000 mL beaker, and the mixture was dissolved with stirring. To this solution was added 1,1-bis(4-hydroxy-3-methylphenyl)ethane (hereinafter abbreviated as "BP-b") 51.04 g, and the mixture was stirred and dissolved. This alkaline aqueous solution was transferred to a 2-L reaction vessel. Benzyltriethylammonium chloride 0.5579 g and 2,3,5-trimethylphenol 1.0613 g were then added to the reaction vessel one by one. Separately, a mixed solution of diphenylether-4-4'-dicarboxylic acid chloride 63.37 g and dichloromethane 470 mL were transferred to a dropping funnel. While maintaining the external temperature of the polymerization vessel at 20° C., the dichloromethane solution was dropped from the dropping funnel to the alkaline aqueous solution in the reaction vessel over a period of one hr under stirring. After stirring for further 5 hrs, dichloromethane 783 mL was added, and stirring was continued for 7 hrs. Acetic acid 8.10 mL was then added, followed by stirring for 30 mins. Stirring was then stopped and the organic layer was separated. The organic layer was washed twice with 0.1 N sodium hydroxide water solution 942 mL, twice with 0.1 N hydrochloric acid 942 mL, and further twice with $H_2O$ 942 mL. The organic layer after washing was poured into methanol 6266 mL, and the precipitate was separated by filtration, followed by drying, to obtain the target polyester resin Y. The viscosity-average molecular weight of the resultant polyester resin Y was 51,700. The repeating structural unit of the polyester resin Y is shown below.

[Chemical Formula 41]

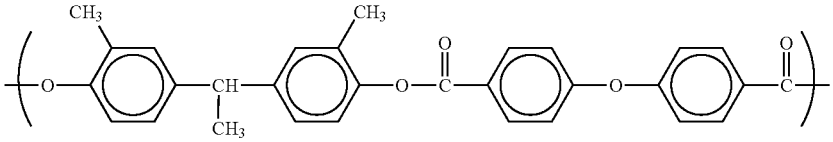

The Repeating Structural Unit of the Polyester Resin Y

Production Example 3

Polyester Resin Z

Sodium hydroxide 7.20 g and $H_2O$ 282 mL were weighed out in a 500 mL beaker, and the mixture was dissolved with stirring. To this solution 2,2-bis(4-hydroxy-3-methylphenyl) propane (hereinafter abbreviated as "BP-c") 17.40 g was added, and the mixture was stirred and dissolved. This alkaline aqueous solution was transferred to a 1-L reaction vessel. Benzyltriethylammonium chloride 0.1798 g and 2,3,5-trimethylphenol 0.3421 g were then added to the reaction vessel one by one. Separately, a mixed solution of diphenylether-4,4'-dicarboxylic acid chloride 10.21 g, terephthalic acid chloride 4.22 g, isophthalic acid chloride 2.81 g and dichloromethane 141 mL were transferred to a dropping funnel. While maintaining the external temperature of the polymerization vessel at 20° C., the dichloromethane solution was dropped from the dropping funnel to the alkaline aqueous solution in the reaction vessel over a period of one hr under stirring. After stirring for further 4 hrs, dichloromethane 235 mL was added, and stirring was continued for 8 hrs. Acetic acid 2.61 mL was then added, followed by stirring for 30 mins. Stirring was then stopped and the organic layer was separated. The organic layer was washed twice with 0.1 N sodium hydroxide water solution 283 mL, twice with 0.1 N hydrochloric acid 283 mL, and further twice with $H_2O$ 283 mL. The organic layer after washing was poured into methanol 1880 mL, and the precipitate was separated by filtration, followed by drying, to obtain the target polyester resin Z. The viscosity-average molecular weight of the resultant polyester resin X was 47,100. The repeating structural unit of the polyester resin Z is shown below.

[Chemical Formula 42]

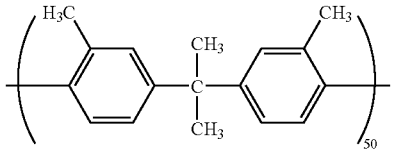

-continued

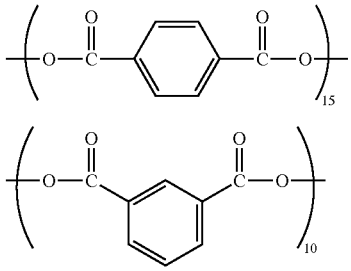

-continued

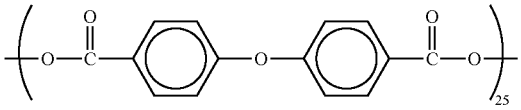

[Production of Photoreceptor Sheet]

Example 1

A dispersion liquid for forming undercoat layer was prepared as follows. Rutile type titanium oxide of 40 nm average primary particle diameter ("TTO55N", manufactured by Ishihara Sangyo Kaisha, Ltd.) and 3 weight % of methyldimethoxysilane ("TSL8117", manufactured by Toshiba Silicones Co., Ltd.), relative to the weight of said titanium oxide, were transferred to a high speed fluidized mixing kneader ("SMG300", manufactured by Kawata Co.) and mixed at a high rotation speed of 34.5 m/sec. The surface-treated titanium oxide obtained was dispersed in a mixed solvent of methanol/1-propanol by means of a ball mill to obtain a dispersion slurry of hydrophobized titanium oxide. This dispersion slurry, mixed solvent of methanol/1-propanol/toluene and pellets of copolymerized polyamide comprising ϵ-caprolactam (compound represented by formula (A) below), bis(4-amino-3-methylcyclohexyl)methane (formula (B) below), hexamethylene diamine (formula (C) below), decamethylene dicarboxylic acid (formula (D) below), and octadecamethylene dicarboxylic acid (formula (E) below) in a molar composition ratio of 60%, 15%, 5%, 15% and 5%, were mixed and stirred, while heated, and the polyamide pellets were dissolved. After ultrasonic dispersion treatment, dispersion liquid for undercoat layer with solid component concentration of 18.0% and whose weight ratio of hydrophobized titanium oxide/copolymerized polyamide is 3/1 and whose weight ratio of methanol/1-propanol/toluene is 7/1/2.

[Chemical Formula 43]

A

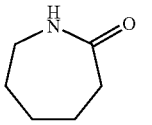

B

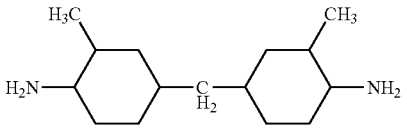

C

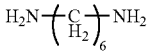

D

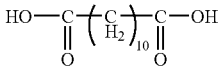

E

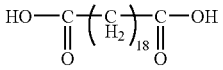

The coating liquid for forming undercoat layer obtained as above was coated on a polyethylene terephthalate sheet, whose surface was vapor deposited with aluminum, so that the thickness of the layer after drying was 1.2 μm, using a wire bar. After drying, an undercoat layer was thus prepared.

Figure 2:
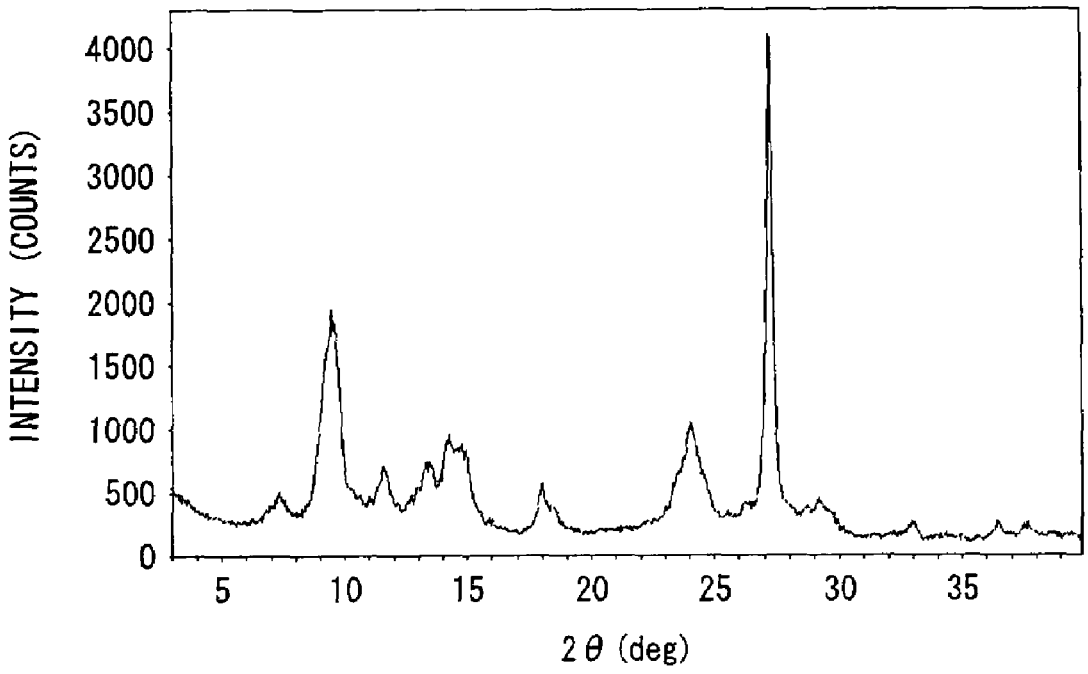
FIG. 2 is an X-ray diffraction pattern illustrating an X-ray diffraction spectrum of oxytitanium phthalocyanine powder used in Examples and Comparative Examples of the present invention.

Next, 10 weight parts of oxytitanium phthalocyanine, which shows an intense diffraction peak at Bragg angles (2θ±0.2) of 27.3° in X-ray diffraction caused by CuKα line and which has a powder X-ray diffraction spectrum shown in FIG. 2, was added to 150 weight parts of 1,2-dimethoxyethane. Then the mixture was pulverized and dispersed using a sand grinding mil to prepare a pigment dispersion liquid. The pigment dispersion liquid prepared, 160 weight parts, and 5% 1,2-dimethoxyethane solution of polyvinyl butyral (trade name of "#6000", manufactured by Denki Kagaku Kogyo Kabushiki Kaisha), 100 weight parts, and an appropriate amount of 1,2-dimethoxyethane were mixed to prepare a dispersion liquid finally with 4.0% of solid component concentration.

This dispersion liquid was coated on the above undercoat layer so that the thickness of the layer was 0.4 μm after drying, using a wire bar. After drying, a charge generation layer was thus prepared.

Next, a coating liquid for forming charge transport layer was prepared by adding, to 640 weight parts of a mixed solvent of tetrahydrofuran and toluene (80 weight % tetrahydrofuran and 20 weight % toluene), 50 weight parts of a charge transport material CTM1 of a hydrazone compound shown below, 100 weight parts of polyester resin X prepared in Production Example 1 and 0.05 weight parts of silicone oil, a leveling agent. This liquid was coated on the above-mentioned charge generation layer using an applicator so that the thickness of the layer was 25 μm after drying. A charge transport layer was formed after drying for 20 min at 125° C., and thus a photoreceptor sheet was prepared. The solubility of the polyester resin X in the solvent was good.

[Chemical Formula 44]

(CTM1)

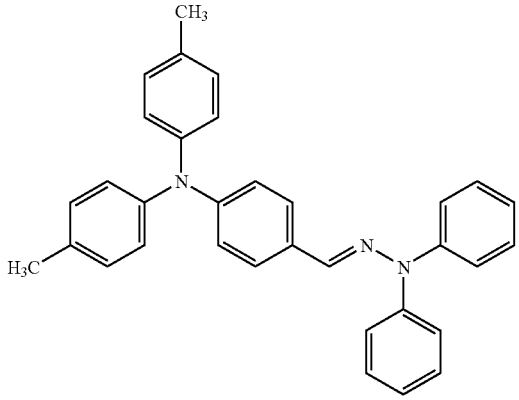

Example 2

Polyester resin Y, prepared in Production Example 2, was used in place of polyester resin X, which was used for the coating liquid for forming charge transport layer of Example 1. The photoreceptor sheet was prepared in otherwise the same procedure as described in Example 1.

Example 3

Polyester resin X, prepared in Production Example 3, was used in place of polyester resin X, which was used for the coating liquid for forming charge transport layer of Example 1. The photoreceptor sheet was prepared in otherwise the same procedure as described in Example 1.

Comparative Example 1

Polyester resin A of the following structure was used in place of polyester resin X, which was used for the coating liquid for forming charge transport layer of Example 1. The photoreceptor sheet was prepared in otherwise the same procedure as described in Example 1. Polyester resin A can be prepared by the known method. The viscosity-average molecular weight of polyester resin A was 52,000.

[Chemical Formula 45]

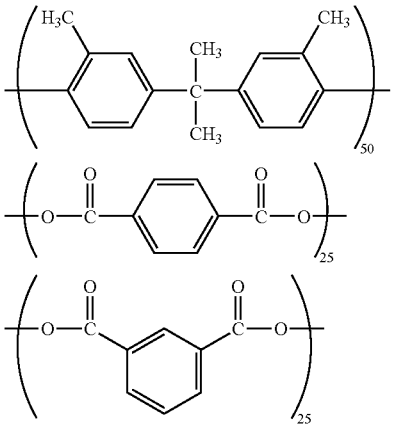

Polyester Resin A

Comparative Example 2

In place of 50 parts of the charge transport material (CTM1) used for the preparation of the coating liquid for forming charge transport layer in Example 3, 45 parts of a charge transport material of the following structure (CTM2) and 5 parts of a charge transport material (CTM3) were used to obtain 50 parts of the charge transport material in total. The photoreceptor sheet was prepared in otherwise the same procedure as described in Example 3.

[Chemical Formula 46]

(CTM2)

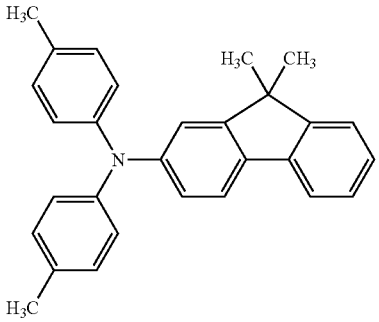

(CTM3)

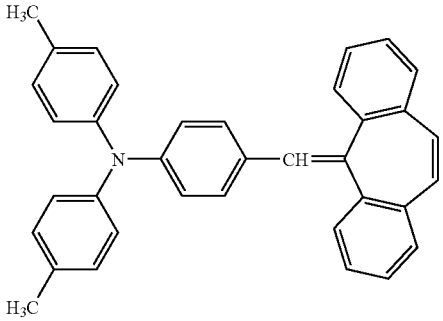

Comparative Example 3

In place of 50 parts of the charge transport material (CTM1) used for the preparation of the coating liquid for forming charge transport layer in Example 2, 50 parts of a charge transport material of the following structure (CTM4) was used. The photoreceptor sheet was prepared in otherwise the same procedure as described in Example 2.

[Chemical Formula 47]

(CTM4)

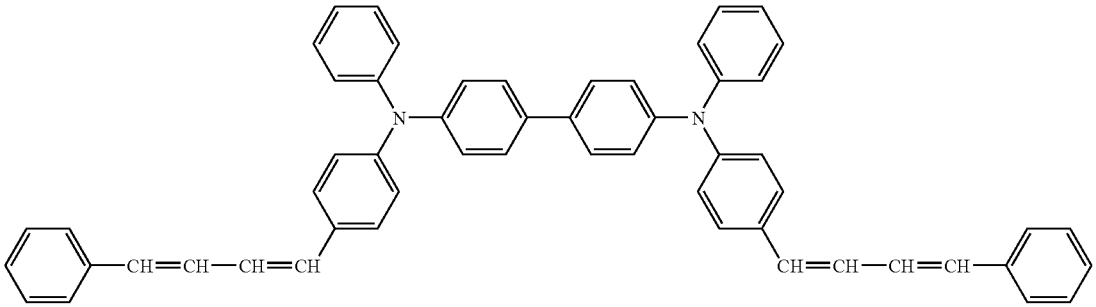

Reference Example 1

In place of polyester resin Y used for the coating liquid for forming charge transport layer in Example 2, polycarbonate resin B comprising the following repeating structural unit was used. The photoreceptor sheet was prepared in otherwise the same procedure as described in Example 2. The viscosity-average molecular weight of polycarbonate resin B was 50,500.

[Chemical Formula 48]

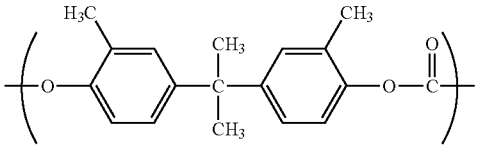

The Repeating Structural Unit of Polycarbonate Resin B

Reference Example 2

In place of polyester resin Y used for the coating liquid for forming charge transport layer in Comparative Example 2, polycarbonate resin B comprising the repeating structural unit described above was used. The photoreceptor sheet was prepared in otherwise the same procedure as described in Comparative Example 2.

Reference Example 3

In place of polyester resin Y used for the coating liquid for forming charge transport layer in Comparative Example 3, polycarbonate resin B comprising the repeating structural unit described above was used. The photoreceptor sheet was prepared in otherwise the same procedure as described in Comparative Example 3.

[Evaluation of Characteristics]

The following electrical properties test and abrasion resistance test were performed for the photoreceptor sheets prepared. The results are summarized in Table 1.

[Electrical Properties Test 1]

The test was performed in the following manner, using an evaluation apparatus of electrophotographic properties (refer to pages 404 and 405 of "Zoku Densisyasingijutsuno Kisoto Oyo", edited by the Society of Electrophotography and published by CORONA PUBLISHING CO., LTD.), manufactured in accordance with the measurement standard established by the Society of Electrophotography. The above-mentioned photoreceptor sheets were fixed onto an aluminum drum of 80 mm external diameter in a cylindrical form, and conduction between the aluminum drum and the aluminum support of the photoreceptor sheet was secured. In this state, the drum was rotated at constant rotational frequency of 60 rpm to perform electrical properties evaluation test by means of a cycle of charging, exposure, potential measurement and charge removal. The initial surface potential of the photoreceptors was charged at − (minus, the same hereinafter) 700 V, and the post-exposure surface potential (hereinafter referred to as VL, as appropriate) at 100 msec after irradiation with 1.0 $\mu J/cm^2$ of monochromatic light of 780 nm, obtained from a halogen lamp through an interference filter, was measured. At the time of VL measurement, the time required from the exposure to the potential measurement was set at 100 msec as a condition of high-speed response. With respect to the environment for measurement, temperature and relative humidity were set at 25° C. and 50% (hereinafter referred to as NN environment, as appropriate), and 5° C. and 10% (hereinafter referred to as LL environment, as appropriate), respectively.

[Abrasion Test 1]

The above photoreceptor sheets were cut in circle having a diameter of 10 cm and evaluation of abrasion was performed using a Taber Abraser (manufactured by Taber Co.). Under conditions of 23° C. and 50% relative humidity, a truck wheel of CS-10F was used with no load (own weight of truck wheel only) and abrasion amount was measured from the comparison of weight before and after 1000 revolution.

[Table 1]

TABLE 1

| | | Resin Composition | | Charge | Electrical Properties VL | | Abrasion |
|---|---|---|---|---|---|---|---|
| | | Phenol | Dicarboxylic Acid | Transport Material | NN (−V) | LL (−V) | Amount mg |
| Example | 1 | Bp-a | ODBA | CTM1 | 65 | 114 | 0.3 |
| | 2 | Bp-b | ODBA | CTM1 | 60 | 108 | 0.2 |
| | 3 | Bp-c | TPA/IPA/ODBA | CTM1 | 70 | 115 | 0.8 |
| Comparative Example | 1 | Bp-c | TPA/IPA | CTM1 | 71 | 205 | 2.1 |
| | 2 | Bp-c | ODBA | CTM2/CTM3 | 87 | — | 0.8 |
| | 3 | Bp-b | ODBA | CTM4 | 83 | 123 | 0.3 |
| Reference Example | 1 | Bp-c | — | CTM1 | 51 | 126 | 3.5 |
| | 2 | Bp-c | — | CTM2/CTM3 | 48 | — | 3.4 |
| | 3 | Bp-c | — | CTM4 | 46 | 109 | 3.6 |

In Table 1, BP-a indicates bis(4-hydroxy-3-methylphenyl) methane (refer to Production Example 1), BP-b indicates 1,1-bis(4-hydroxy-3-methylphenyl)ethane (refer to Production Example 2) and BP-c indicates 2,2-bis(4-hydroxy-3-methylphenyl)propane (refer to Production Example 3). ODBA indicates diphenylether-4-4'-dicarboxylic acid, TPA indicates terephthalic acid and IPA indicates isophthalic acid.

The photoreceptor of Comparative Example 2 and Reference Example 2, based on charge transport materials (CTM2)/(CTM3), was not sufficiently charged under LL environment and the characteristics could not be evaluated.

It is evident that the photoreceptor according to the present invention, which comprises a polyester resin containing diphenylether dicarboxylic acid residue, such as shown in Example 1, 2, 3 and Comparative Example 2, 3, is excellent in abrasion resistance as shown in the results of Taber test. Among them, photoreceptors of Example 1, 2 and Comparative Example 3 containing a polyester resin represented by the formula (9) show particularly excellent values.

It is to be noted that, as shown in the data of electrical properties of the photoreceptor of Reference Example 1, 2, 3, a hydrazone compound (CTM1) of the present invention is not particularly advantageous in a photoreceptor containing frequently used polycarbonate resin as binder resin, in comparison with charge transport materials (CTM2)/(CTM3) or (CTM4), which are outside the scope of the present invention.

On the other hand, in a photoreceptor which uses polyester resin Y of the present invention as binder resin, VL of a photoreceptor of Example 2 which uses a hydrazone compound of the present invention (CTM1) is −60 V under an NN environment, whereas VL of a photoreceptor of Example 3 which uses a charge transport material (CTM4) outside the scope of the present invention is −83 V under an NN environment. The data show that desirable electrical properties are exhibited only when hydrazone compound of the present invention is used.

Similarly, when polyester resin Z of the present invention was used as binder resin, VL of a photoreceptor of Example 3 which uses a hydrazone compound of the present invention (CTM1) is −70 V under an NN environment, whereas VL of a photoreceptor of Comparative Example 2 which uses a charge transport material (CTM2)/(CTM3) outside the scope of the present invention is −87 V under an NN environment. The data also show that desirable electrical properties are exhibited only when hydrazone compound is used.

Further, even when hydrazone compounds are used as charge transport material, the use of polyester resin A, a known polyarylate resin, as in a photoreceptor of Comparative Example 1, does not assure desirable characteristics in electrical properties (LL environment) or abrasion resistance.

[Stability of Coating Liquid]

In order to examine the stability of the coating liquid, the coating liquid for forming charge transport layer used in Example 2 and the coating liquid for forming charge transport layer used in Comparative Example 3 were stored for 1 month at room temperature.

Example 4

A photoreceptor sheet was prepared in exactly the same way as in Example 2, except that the coating liquid for forming charge transport layer of Example 2 was used after storage for 1 month at ordinary temperature.

Comparative Example 4

A photoreceptor sheet was prepared in exactly the same way as in Comparative Example 3, except that the coating liquid for forming charge transport layer of Comparative Example 3 was used after storage for 1 month at ordinary temperature.

Reference Example 4

A photoreceptor sheet was prepared in exactly the same way as in Reference example 3, except that the coating liquid for forming charge transport layer of Reference example 3 was used after storage for 1 month at ordinary temperature.

Electrical properties test were performed for these photoreceptor sheets. The results are summarized in Table 2.

[Table 2]

TABLE 2

| | Resin Composition | | | Electrical Properties | | |
|---|---|---|---|---|---|---|
| | | | | VL | | Abrasion |
| | Phenol | Di-carboxylic Acid | Charge Transport Material | NN (−V) | LL (−V) | Amount mg |
| Example 4 | Bp-b | ODBA | CTM1 | 62 | 110 | — |
| Comparative Example 4 | Bp-b | ODBA | CTM4 | 131 | 174 | — |
| Reference Example | Bp-c | — | CTM4 | 50 | 119 | — |

From the results presented, it is clear that, in the coating liquid consisting of the polyester resin of the present invention and a charge transport material CTM4, which is outside the scope of the present invention, deterioration with time occurred and electrical properties thereof deteriorates considerably, after a storage period of 1 month. On the other hand, electrical properties of the coating liquid consisting of the polyester resin of the present invention and a hydrazone compound (CTM1) of the present invention remained almost unchanged even after a storage period of 1 month, which is a remarkably advantageous effect. Reference Example 4 shows the change with time of a coating liquid consisting of a polycarbonate resin and a charge transport material CTM4, which shows that no major change occurred. Namely, stability of the coating liquid containing the polyester resin of the present invention depends specifically on the charge transport material contained, and the above results indicate that hydrazone compounds are very suitable as charge transport material.

From the above results, it has been demonstrated that the photoreceptor containing the polyester resin and hydrazone compound of the present invention is very stable in the state of coating liquid for forming charge transport layer. It is also excellent in abrasion resistance and electrical properties.

[Production of the Resin]

Production Example 4

Production of Resin Y'

Resin Y', having the same repeating structural unit as in Production Example 2, was prepared in the same manner as described in Production Example 2, except that dichloromethane 468 kg was added to the reaction vessel 1 and stirring time after that was shortened to 6 hr from 8 hr. The viscosity-average molecular weight of resin Y' obtained, measured by the above-mentioned method, was 40,000.

[Production of Photoreceptor Sheet]

Example 5

An undercoat layer and charge generation layer were established on a polyethylene terephthalate sheet whose surface was vapor deposited with aluminum, in the same manner as described in Example 1.

Resin X prepared in Production Example 1, 100 weight parts, charge transport material (CTM5) of the structure represented by the following formula (CTM5), 50 weight parts, and silicone oil as leveling agent, 0.05 weight parts, were added to 640 weight parts of a mixed solvent of tetrahydrofuran and toluene (tetrahydrofuran 80 weight %, toluene 20 weight %), to prepare a coating liquid for forming charge transport layer (coating liquid for forming photosensitive layer).

[Chemical Formula 49]

(CTM5)

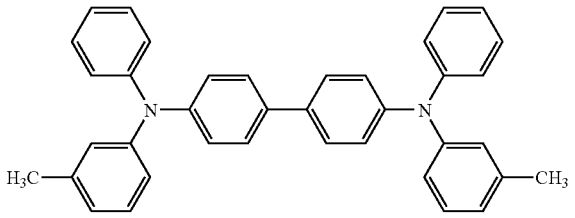

This coating liquid for forming charge transport layer was coated on the above-mentioned charge generation layer using an applicator so that the thickness of the layer was 25 μm after drying. A charge transport layer was formed after drying for 20 min at 125° C., and thus a photoreceptor sheet was prepared. The solubility of the resin in the solvent was good.

In order to examine the stability of the coating liquid, the coating liquid for forming charge transport layer was stored for 1 month at room temperature. A photoreceptor sheet was prepared in the same way, except that this coating liquid for forming charge transport layer was used after storage for 1 month at ordinary temperature. A change such as gelation was not observed for the coating liquid.

The coating liquid for forming charge transport layer was stored for further 2 months (3 months in total) at room temperature, and a photoreceptor sheet was prepared similarly. At this time also, a change such as gelation was not observed for the coating liquid.

Example 6

The procedure of Example 5 was followed, except that a resin Y, prepared in Production Example 2, was used in place of resin X used to prepare the coating liquid for forming charge transport layer of Example 5. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

Example 7

The procedure of Example 5 was followed, except that a resin Y', prepared in Production Example 4, was used in place of resin X used to prepare the coating liquid for forming charge transport layer of Example 5. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

Example 8

The procedure of Example 6 was followed, except that a compound (CTM6), having the structure represented by the formula below (CTM6), was used in place of the charge transport material used to prepare the coating liquid for forming charge transport layer of Example 6. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

[Chemical Formula 50]

(CTM6)

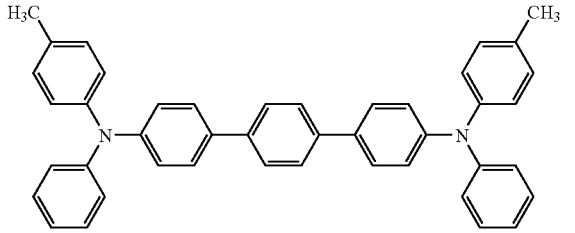

Example 9

The procedure of Example 6 was followed, except that 50 weight parts of a mixture, consisting of 25 weight parts of a diamine compound (CTM7) having a structure represented by the formula below (CTM7) and 25 weight parts of a diamine compound (CTM8) having a structure represented by the formula below (CTM8), was used in place of the charge transport material used to prepare the coating liquid for forming charge transport layer of Example 6. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

[Chemical Formula 51]

(CTM7)

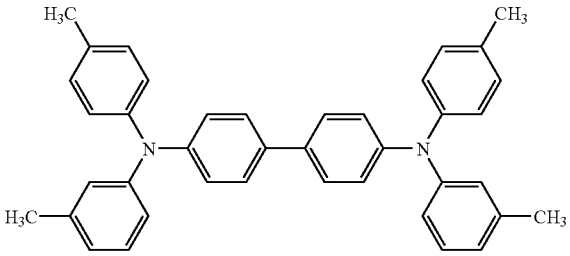

-continued (CTM8)

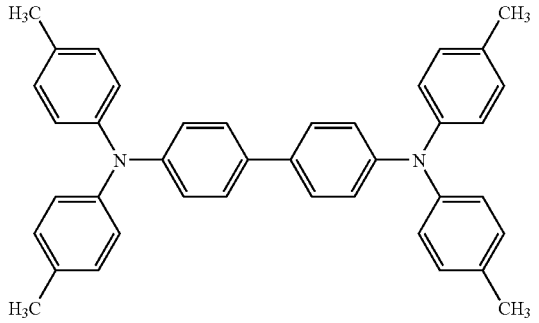

Example 10

The procedure of Example 9 was followed, except that a resin Y', prepared in Production Example 4, was used in place of resin Y used to prepare the coating liquid for forming charge transport layer of Example 9. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

Example 11

The procedure of Example 6 was followed, except that 70 weight parts of a mixture, consisting of 40 weight parts of a triphenylamine compound (CTM9) having a structure represented by the formula below (CTM9) and 30 weight parts of a triphenylamine compound (CTM10) having a structure represented by the formula below (CTM10), was used in place of the charge transport material used to prepare the coating liquid for forming charge transport layer of Example 6. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. At this time also, the solubility of the resin in the solvent was good and any change with time such as gelation was not observed.

[Chemical Formula 52]

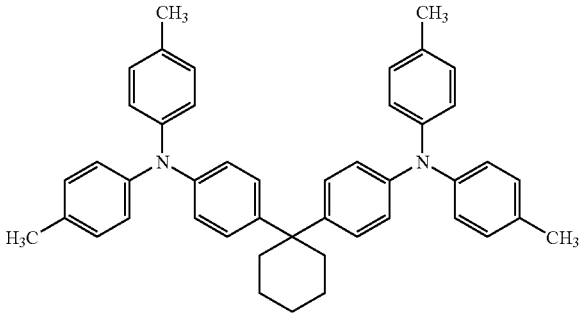

(CTM9)

-continued

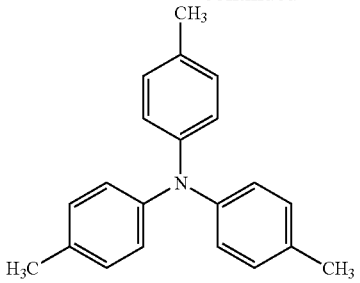

(CTM10)

Comparative Example 5

The procedure of Example 6 was followed, except that a mixture consisting of compounds of geometric isomers typified by the above formula (CTM4), disclosed in Japanese Patent Laid-Open Publication (Kokai) No. 2002-80432, was used in place of the charge transport material used to prepare the coating liquid for forming charge transport layer of Example 6. A coating liquid for forming charge transport layer H, a photoreceptor sheet using a coating liquid immediately after preparation, a photoreceptor sheet using a coating liquid stored for 1 month, and a photoreceptor sheet using a coating liquid stored for 3 months were prepared.

Comparative Example 6

The procedure of Comparative Example 5 was followed, except that a resin Y', prepared in Production Example 4, was used in place of resin Y used to prepare the coating liquid for forming charge transport layer of Comparative Example 5. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Comparative Example 7

The procedure of Comparative Example 5 was followed, except that a polycarbonate resin B-2 (viscosity-average molecular weight 40,000) formed by the following repeating structural unit, was used in place of resin Y used to prepare the coating liquid for forming charge transport layer of Comparative Example 5. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

[Chemical Formula 53]

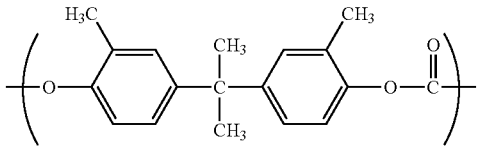

Repeating Structural Unit of Polycarbonate Resin B-2

[Evaluation]

The following electrical properties test and abrasion resistance test were performed for the photoreceptor sheets prepared. The results are summarized in Table 3.

[Electrical Properties Test 2]

The test was performed in the following manner, using an evaluation apparatus of electrophotographic properties (refer to pages 404 and 405 of "Zoku Densisyasingijutsuno Kisoto Oyo", edited by the Society of Electrophotography and published by CORONA PUBLISHING CO., LTD.), manufactured in accordance with the measurement standard established by the Society of Electrophotography. The above-mentioned photoreceptor sheets were fixed onto an aluminum drum of 80 mm external diameter in a cylindrical form, and conduction between the aluminum drum and the aluminum support of the photoreceptor sheet was secured. In this state, the drum was rotated at constant rotational frequency of 60 rpm to perform electrical properties evaluation test by means of a cycle of charging, exposure, potential measurement and charge removal. The initial surface potential of the photoreceptors was charged at −700 V, and the post-exposure surface potential (hereinafter referred to as VL, as appropriate) when irradiated with 0.8 μJ/cm$^2$ of monochromatic light of 780 nm, obtained from a halogen lamp through an interference filter, was measured. At the time of VL measurement, the time required from the exposure to the potential measurement was set at 100 msec as a condition of high-speed response. With respect to the environment for measurement, temperature and relative humidity were set at 25° C. and 50%, respectively.

[Abrasion Test 2]

The above photoreceptor sheets were cut in circle having a diameter of 10 cm and evaluation of abrasion was performed using a Taber Abraser (manufactured by Taber Co.).Under conditions of 23° C. and 50% relative humidity, a truck wheel of CS-10F (type-III) was used with no load (own weight of truck wheel only) and abrasion amount was measured from the comparison of weight before and after 1000 revolutions.

From the results presented, it is evident that the photoreceptors of Examples 5 to 11 are stable in electrical properties 3 months after preparation of coating liquids and show superior abrasion resistance. This is because the coating liquids contain the polyester resin of the present invention and contain only charge transport materials containing substantially no unsaturated bond other than aromatic ring, and this is effective in bringing about the above results. In particular, the use of the compounds (CTM5), (CTM7)/(CTMB) represented by the formula (2) is highly effective in bringing about excellent electrical properties.

On the other hand, a photoreceptor prepared using the coating liquid of Comparative Examples 5 and 6, containing the polyester resin of the present invention and a charge transport material having an unsaturated bond in addition to aromatic ring, is superior in abrasion resistance but deteriorates in electrical properties with time. This is considered to be due to the effect of residual monomer or terminal generated at the formation of resin, which caused the decomposition of the charge transport material both in the early stage and during storage. The degree of deterioration is particularly large when resin Y' of Production Example 4 was used, for which polymerization time of the polyester resin was considered to be not long enough.

A photoreceptor of Comparative Example 7 using a previously known polycarbonate resin as binder resin is stable in electrical properties with respect to time, although the charge transport material has an unsaturated bond. This is considered to be because the polycarbonate resin is free from residual components which decompose unsaturated bond. However, the photoreceptor of Comparative Example 7 is inferior in abrasion resistance and, therefore, the advantageous effect of the present invention can not be exhibited.

From the results obtained, a coating liquid containing the polyester resin of the present invention and charge transport material containing no unsaturated bond other than aromatic ring is very stable in coating property, and a photoreceptor

TABLE 3

| | | | | Immediately After Preparation of Coating Liquid | | 1 Month Later | 3 Month Later |
|---|---|---|---|---|---|---|---|
| | | Resin | Charge Transport Material | Abrasion Amount (mg) | Electrical Properties VL (−V) | | |
| Example | 5 | X | CTM5 | 0.3 | 62 | 62 | 64 |
| | 6 | Y | CTM5 | 0.3 | 58 | 58 | 60 |
| | 7 | Y' | CTM5 | 0.3 | 51 | 55 | 65 |
| | 8 | Y | CTM6 | 0.3 | 68 | 70 | 71 |
| | 9 | Y | CTM7/CTM8 | 0.2 | 50 | 50 | 51 |
| | 10 | Y' | CTM7/CTM8 | 0.2 | 44 | 53 | 58 |
| | 11 | Y | CTM9/CTM10 | 0.3 | 61 | 62 | 62 |
| Comparative Example | 5 | Y | mixture of geometrical isomers typified by CTM4 | 0.2 | 102 | 164 | 223 |
| | 6 | Y' | mixture of geometrical isomers typified by CTM4 | 0.3 | 103 | 194 | 265 |
| | 7 | B-2 | mixture of geometrical isomers typified by CTM4 | 3.6 | 45 | 47 | 51 |

based on that liquid is superior in mechanical strength such as abrasion resistance, and electrical properties.

Example 12

As charge generation material, 300 parts of 1,2-dimethoxyethane was added to 15 parts of a charge generation material (CGM1) of the following structure and the mixture was crushed for 8 hrs using a sand grinding mill, and micronization/dispersion treatment was done. Subsequently, the mixture was added to a binder solution in which 7.5 parts of polyvinyl butyral (trade name: "Denkabutyral" #6000C, manufactured by Denki Kagaku Kogyo Kabushiki Kaisha) and 7.5 parts of phenoxy resin (trade name: PKHH, manufactured by Union Carbide) were dissolved in 285 parts of 1,2-dimethoxyethane. Further, a mixture of 63 weight parts of 1,2-dimethoxyethane and 72 weight parts of 4-methoxy-4-methyl-2-pentanone was added to prepare a coating liquid containing 4.0 weight % of solid components (pigment+resin).

[Chemical Formula 54]

(CGM1)

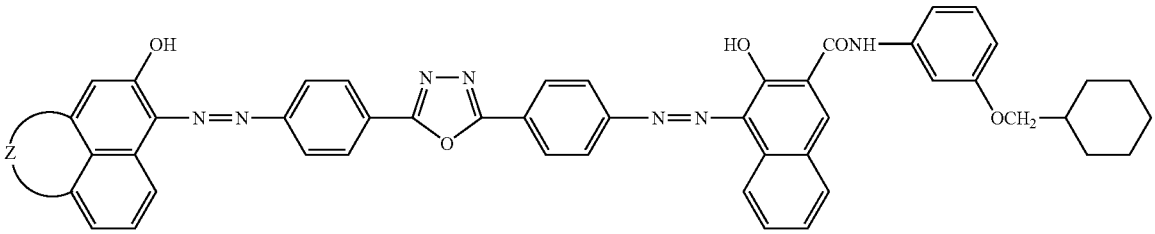

(Please note that Z is

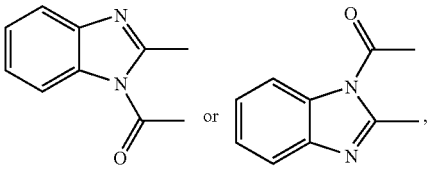

and these two compounds are used here.)

The coating liquid for forming charge generation layer obtained as above was coated on a polyethylene terephthalate sheet, whose surface was vapor deposited with aluminum, so that the thickness of the layer after drying was 0.4 μm, using a wire bar. The charge generation layer was thus completed after drying.

Next, 35 parts each of compounds (CTM11) and (CTM9) of the following structure (70 parts in total) as charge transport materials, 100 parts of polyester resin Y prepared in Production Example 2 as binder resin, and 0.05 parts of silicone oil (trade name: KF96, Shin-Etsu Chemical Co., Ltd.) as leveling agent were added to 640 parts of a mixed solvent of tetrahydrofuran/toluene (8/2), thereby to prepare a coating liquid for forming charge transport layer.

[Chemical Formula 55]

(CTM11)

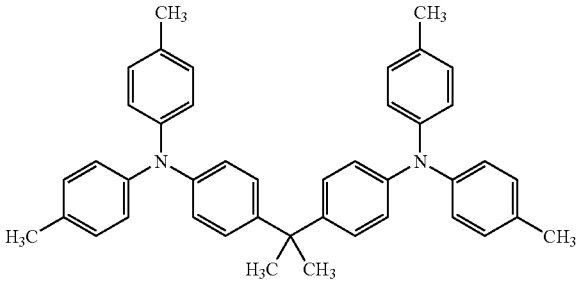

-continued (CTM9)

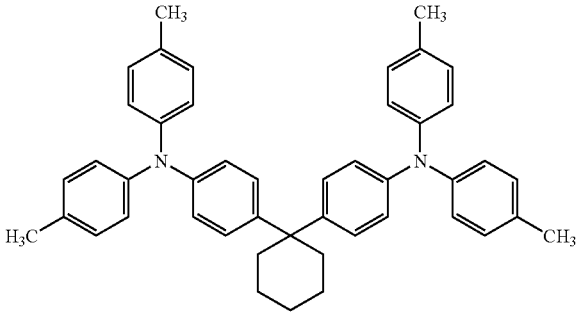

This coating liquid for forming charge transport layer was coated on the above-mentioned charge generation layer using an applicator so that the thickness of the layer was 25 μm after drying. A charge transport layer was formed after drying for 20 min at 125° C., and thus a photoreceptor sheet was prepared.

Example 13

A photoreceptor sheet was prepared in the same manner as described in Example 12, except that 70 parts of a compound represented by the formula below (CTM12) was used in place of charge transport materials (CTM11) and (CTM9), which were used for the coating liquid for forming charge transport layer of Example 12.

[Chemical Formula 56]

(CTM12)

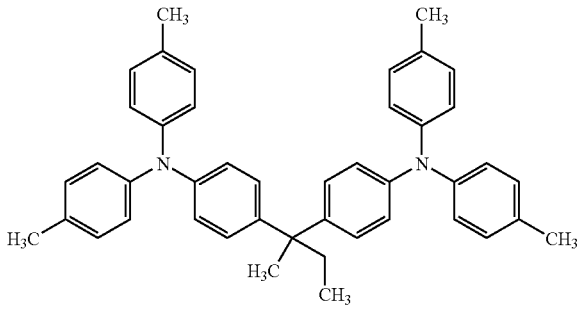

Example 14

A photoreceptor sheet was prepared in the same manner as described in Example 12, except that 70 parts of a compound represented by the formula below (CTM13) was used in place of charge transport materials (CTM11) and (CTM9), which were used for the coating liquid for forming charge transport layer of Example 12.

[Chemical Formula 57]

(CTM13)

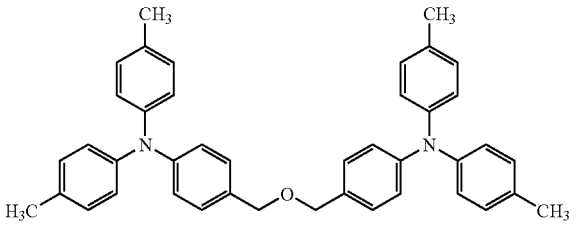

Example 15

A photoreceptor sheet was prepared in the same manner as described in Example 12, except that 70 parts of a compound represented by the formula below (CTM14) was used in place of charge transport materials (CTM11) and (CTM9), which were used for the coating liquid for forming charge transport layer of Example 12.

[Chemical Formula 58]

(CTM14)

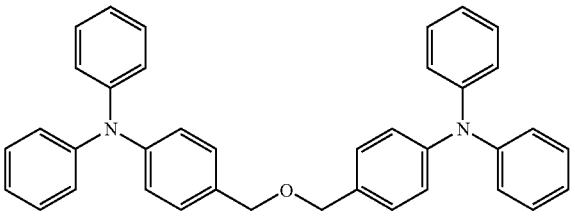

Example 16

A photoreceptor sheet was prepared in the same manner as described in Example 12, except that polyester resin W having a structure represented by the formula below was used in place of polyester resin Y, which was used for the coating liquid for forming charge transport layer of Example 12. Polyester resin W can be prepared by the known method. The viscosity-average molecular weight of polyester resin W was 40,000.

[Chemical Formula 59]

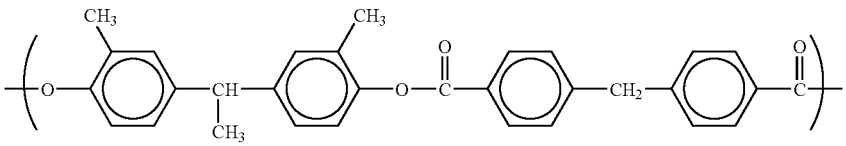

The Repeating Unit of Polyester Resin W

Comparative Example 8

A photoreceptor sheet was prepared in the same manner as described in Example 12, except that polyester resin C having a structure represented by the formula below was used in place of polyester resin Y, which was used for the coating liquid for forming charge transport layer of Example 12. Polyester resin C can be prepared by the known method. The viscosity-average molecular weight of polyester resin C was 32,000.

[Chemical Formula 60]

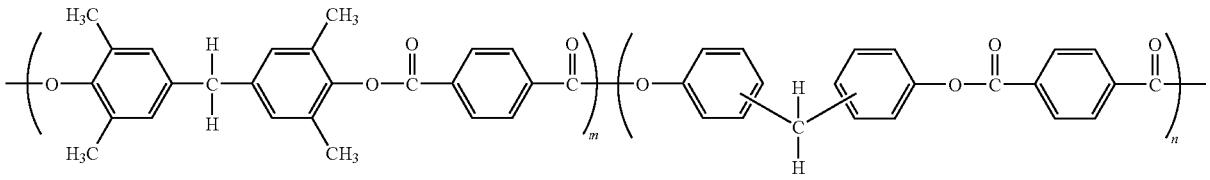

Polyester Resin C m:n = 7:3

Comparative Example 9

A photoreceptor sheet was prepared in the same manner as described in Example 12, except that polyester resin A described before (viscosity-average molecular weight 52,000) was used in place of polyester resin Y, which was used for the coating liquid for forming charge transport layer of Example 12.

[Evaluation]

The following [electrical properties test 3] and above-mentioned [abrasion resistance test 1] were performed for the photoreceptor sheets prepared. The results are summarized in Table 4.

[Electrical Properties Test 3]

The test was performed in the following manner, with the photoreceptor sheets fitted onto an evaluation apparatus of electrophotographic properties (refer to pages 404 and 405 of "Zoku Densisyasingijutsuno Kisoto Oyo", edited by the Society of Electrophotography and published by CORONA PUBLISHING CO., LTD.), manufactured in accordance with the measurement standard established by the Society of Electrophotography. Electrical properties were evaluated by means of a cycle of charging, exposure, potential measurement and charge removal.

The initial surface potential of the photoreceptors was charged at −700 V, and after irradiation with monochromatic light of 405 nm, obtained from a halogen lamp through an interference filter, irradiation energy (μJ/cm$^2$) where surface potential was −350 V was adopted as sensitivity E. The post-exposure surface potential (−V) after irradiation with 2.0 μJ/cm$^2$ was adopted as VL. At the time of VL measurement, the time required from the exposure to the potential measurement was set at 200 msec. With respect to the environment for measurement, temperature and relative humidity were set at 25° C. and 50%, respectively.

TABLE 4

| | Resin | Charge Transport Material | E 1 | VL 1 | Abrasion Amount (mg) |
|---|---|---|---|---|---|
| Example 12 | Y | CTM11/CTM9 | 0.212 | 21 | 0.3 |
| Example 13 | Y | CTM12 | 0.210 | 22 | 0.3 |
| Example 14 | Y | CTM13 | 0.270 | 36 | 0.3 |
| Example 15 | Y | CTM14 | 0.299 | 80 | 0.3 |
| Example 16 | W | CTM11/CTM9 | 0.215 | 25 | 0.5 |
| Comparative Example 8 | C | CTM11/CTM9 | 0.369 | 23 | 1.2 |

TABLE 4-continued

| | Resin | Charge Transport Material | E 1 | VL 1 | Abrasion Amount (mg) |
|---|---|---|---|---|---|
| Comparative Example 9 | A | CTM11/CTM9 | 0.326 | 31 | 0.8 |

[Transmittance of Charge Transport Layer]

Figure 3:
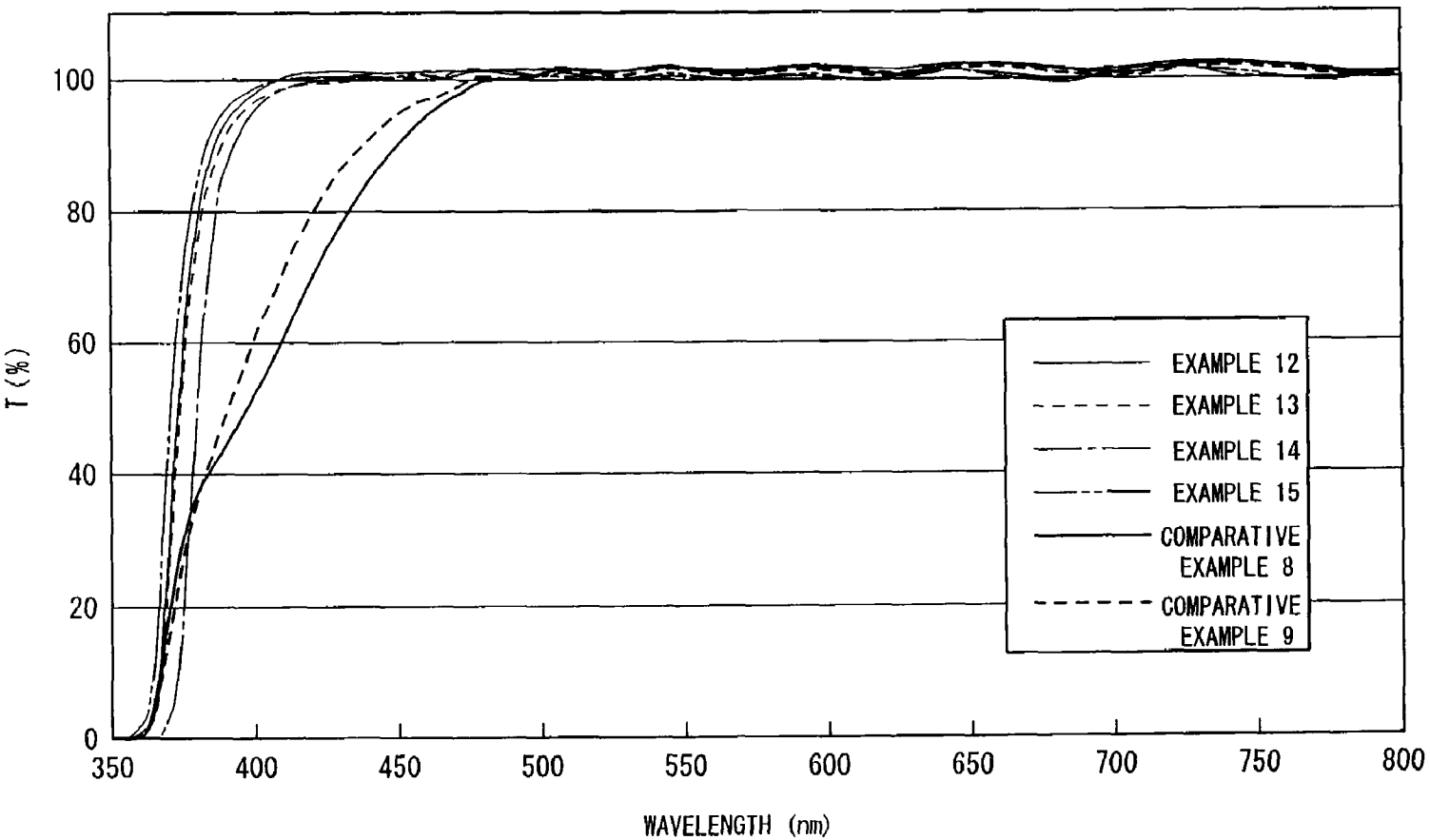
FIG. 3 is a graph illustrating transmittances measured in Examples 12 to 15 and Comparative Examples 8 and 9 of the present invention.

The coating liquid for forming charge transport layer used in Examples 12 to 15 and Comparative Examples 8 and 9 was coated on a polyethylene terephthalate film using an applicator so that the thickness of the layer was 25 μm after drying. The layer was dried at 125° C. for 20 min. This layer was taken off the polyethylene terephthalate film and the transmittance was measured with a UV-visible spectrophotometer UV-1650PC (manufactured by SHIMADZU CORPORATION). The result is shown in FIG. 3 and Table 5.

TABLE 5

| Transmittance (%) | | | | | | |
|---|---|---|---|---|---|---|
| | Resin | Charge Transport Material | Wavelength 400 nm | 405 nm | 420 nm | 450 nm |
| Example 12 | Y | CTM11/CTM9 | 97.9 | 99.0 | 100.0 | 100.0 |
| Example 13 | Y | CTM12 | 96.0 | 97.3 | 99.1 | 100.0 |
| Example 14 | Y | CTM13 | 95.5 | 97.7 | 100.0 | 100.0 |
| Example 15 | Y | CTM14 | 98.6 | 99.4 | 100.0 | 100.0 |
| Comparative Example 8 | C | CTM11/CTM9 | 52.3 | 56.4 | 69.7 | 90.3 |
| Comparative Example 9 | A | CTM11/CTM9 | 60.2 | 65.4 | 79.2 | 94.4 |

As mentioned above, the results of Examples 12 to 15 showed excellent sensitivity with respect to the exposure wavelength of 405 nm. Furthermore, the coating liquids for forming charge transport layer used for Examples 12 to 15 had transmittances of nearly 100% even with respect to 400 nm. In contrast, the coating liquids for forming charge transport layer of Comparative Examples 8 and 9 showed lower transmittances.

Resins (C, A) of Comparative Examples 8 and 9, as well as resins (Y) of Examples 12 to 15 also showed transmittances of nearly 100%, when they are only-resin layers containing no charge transport material. However, they show lower transmittances when containing charge transport material, as shown in Comparative Examples 8 and 9. This is considered to be due to charge-transfer absorption occurred between the charge transport material and the polyester resin. It is considered that, in contrast to Comparative Examples 8 and 9, the polyester resins of Examples 12 to 15, which are represented by the formula (1), is low in electron-withdrawing characteristics and therefore, the charge-transfer absorption, which decreases sensitivity with respect to the wavelength of around 400 nm, was not formed.

From the above-mentioned points, it can be known that the polyester resin of the present invention has high transmittance even with respect to short wavelengths, and therefore it can be used preferably for an exposure writing with a short wavelength. Further, the charge transport layer should not deteriorate by absorbing the write-in light. In addition, it exhibited remarkably excellent abrasion resistance.

Example 17

Anodic oxidation treatment was done to the mirror-finished surface of an aluminum alloy cylinder (30 mm of external diameter, 375.8 mm of length, 1.0 mm of thickness), followed by sealing treatment with a sealing agent composed mainly of nickel acetate. Anodic oxidation film (alumite film) of about 6 μm in thickness was thus formed.

300 parts of 1,2-dimethoxyethane was added to 15 parts of a charge generation material (CGM1) and the mixture was crushed for 8 hr using a sand grinding mill, and micronization/dispersion treatment was done. Subsequently, the mixture was added to a binder solution in which 7.5 parts of polyvinyl butyral (trade name: "Denkabutyral" #6000C, manufactured by Denki Kagaku Kogyo Kabushiki Kaisha) and 7.5 parts of phenoxy resin (trade name: PKHH, manufactured by Union Carbide) were dissolved in 285 parts of 1,2-dimethoxyethane. Further, a mixture of 63 weight parts of 1,2-dimethoxyethane and 72 weight parts of 4-methoxy-4-methyl-2-pentanone was added to prepare a coating liquid containing 4.0 weight % of solid components (pigment+resin).

This azo pigment dispersion liquid and a dispersion liquid for forming charge generation layer prepared in Example 1 were mixed in a weight ratio of 1:1. A coating liquid for forming charge generation layer containing both azo pigment and titanyl phthalocyanine was thus prepared.

An aluminum cylinder treated with anodic oxidation was dipped into this coating liquid so that the film thickness after drying was 0.6 μm, thereby to form a charge generation layer.

Next, 35 parts each of compounds (CTM11) and (CTM9) (70 parts in total) as charge transport materials, 100 parts of polyester resin Y prepared in Production Example 2 as binder resin, and 0.05 parts of silicone oil (trade name: KF96, Shin-Etsu Chemical Co., Ltd.) as leveling agent were added to 640 parts of a mixed solvent of tetrahydrofuran/toluene (8/2), thereby to prepare a coating liquid for forming charge transport layer.

This coating liquid was dip-coated onto the above charge generation layer so that the thickness of the layer after drying was 18 μm. The charge transport layer was thus formed and a photoreceptor drum having a lamination type photosensitive layer was obtained.

Comparative Example 10

A photoreceptor was prepared in the same manner as described in Example 17, except that polyester resin C (viscosity-average molecular weight 32,000) was used in place of polyester resin Y, which was used for the coating liquid for forming charge transport layer of Example 17.

Comparative Example 11

A photoreceptor was prepared in the same manner as described in Example 17, except that (CTM4) was used in place of (CTM11) and (CTM9) as charge transport material, which were used for the coating liquid for forming charge transport layer of Example 17.

[Evaluation]

The following [electrical properties test 4] and actual device evaluation were performed for the electrophotographic photoreceptors prepared as above. The results are summarized in Table 6.

[Electrical Properties Test 4]

The test was performed in the following manner, with the photoreceptor sheets fitted onto an evaluation apparatus of electrophotographic properties (refer to pages 404 and 405 of "Zoku Densisyasingijutsuno Kisoto Oyo", edited by the Society of Electrophotography and published by CORONA PUBLISHING CO., LTD.), manufactured in accordance with the measurement standard established by the Society of Electrophotography. Electrical properties were evaluated by means of a cycle of charging, exposure, potential measurement and charge removal.

The initial surface potential of the photoreceptors was charged at −700 V, and after irradiation with monochromatic light of 405 nm, obtained from a halogen lamp through an interference filter, irradiation energy ($\mu J/cm^2$) where surface potential was −350 V was adopted as sensitivity E1. The post-exposure surface potential (−V) after irradiation with 2.0 $\mu J/cm^2$ was adopted as VL1.

In exactly the same manner, sensitivity E2 and post-exposure surface potential VL2 were measured, using a monochromatic light of 760 nm obtained similarly through an interference filter. These E2 and VL2 can be measured in every photoreceptor of Example 17 and Comparative Examples 10 and 11.

At the time of VL1 and VL2 measurements, the time required from the exposure to the potential measurement was set at 200 msec. With respect to the environment for measurement, temperature and relative humidity were set at 25° C. and 50%, respectively.

[Table 6]

TABLE 6

| | Resin | Charge Transport Material | E 1 | VL 1 | E 2 | VL 2 |
|---|---|---|---|---|---|---|
| Example 17 | Y | CTM11/CTM9 | 0.236 | 21 | 0.112 | 21 |
| Comparative Example 10 | C | CTM11/CTM9 | 0.409 | 40 | 0.108 | 25 |
| Comparative Example 11 | Y | CTM4 | | | 0.108 | 39 |

[Actual Device Evaluation]

The prepared photoreceptor drum was mounted on the black drum cartridge of a commercially available, tandem type color printer (MICROLINE Pro 9800PS-E, manufactured by Oki Data Corporation) which is capable of printing A3 paper. The cartridge was attached to the above printer.

Specification of MICROLINE Pro 9800PS-E train-of-four tandem
color 36 ppm, monochrome 40 ppm
1200 dpi
DC contact-type roller charging
writing-in by LED
equipped with erase light
polymerized toner Then a personal computer was connected to the printer, and a gray scale (half tone) image was input. The density of every printout was excellent when using the photoreceptor of Example 17.

The exposure part of the color printer (MICROLINE Pro 9800PS-E, manufactured by Oki Data Corporation) was reconstructed so that the photoreceptor can be irradiated with light of the small-spot irradiation type blue LED (B3MP-8: 470 nm), manufactured by NISSIN ELECTRONIC CO., LTD.

The line drawn by this reconstructed printer, attached with the photoreceptor prepared in Example 17, had a high image quality. Then a dotted image was printed by this printer of which above-mentioned small-spot irradiation type blue LED was connected to a power source, LPS-203KS, for a stroboscopic light. A dotted image of 8 mm in radius can be printed.

From the results of the above actual device evaluation and electrical properties test, it is highly possible to be able to obtain substantially the same level of images even when exposed by blue LED having wavelength of nearly 400 nm, with just a little adjustment of exposure amount, because the photoreceptor of Example 17 shows sufficient electrical properties with respect to the light of between violet and blue wavelength (405 nm). The photoreceptors of Comparative Examples 10 and 11 need a lot more exposure amount when using a blue exposure, and therefore they can not be virtually used with a blue exposure.

[Production of Photoreceptor Sheet]

Example 18

An undercoat layer and charge generation layer were established on a polyethylene terephthalate sheet whose surface was vapor deposited with aluminum, in the same manner as described in Example 1.

A mixture consisting of 50 weight parts of compounds of geometric isomers typified by the above-mentioned formula (CTM4), disclosed in Japanese Patent Laid-Open Publication (Kokai) No. 2002-80432, 100 weight parts of resin X prepared in Production Example 1, 8 weight parts of octadecyl-3-(3,5-di-t-butyl-4-hydroxyphenyl) propionate (manufactured by Ciba Geigy Co., trade name: Irganox1076) as antioxidant, and 0.05 weight parts of silicone oil as leveling agent were added to 640 weight parts of a mixed solvent of tetrahydrofuran and toluene (80 weight % of tetrahydrofuran and 20 weight % of toluene). A coating liquid for forming charge transport layer was thus prepared. The solubility of the resin in the solvent was good.

This coating liquid for forming charge transport layer was coated on the above-mentioned charge generation layer using an applicator so that the thickness of the layer was 25 μm after drying. A charge transport layer was formed after drying for 20 min at 125° C., and thus a photoreceptor sheet was prepared.

In order to examine the stability of the coating liquid, the coating liquid for forming charge transport layer was stored for 1 month at room temperature. A photoreceptor sheet was prepared in the same way, except that this coating liquid for forming charge transport layer was used after storage for 1 month at ordinary temperature.

The coating liquid for forming charge transport layer was stored for further 2 months (3 months in total) at room temperature, and a photoreceptor sheet was prepared similarly.

Example 19

The procedure of Example 18 was followed, except that a resin Y, prepared in Production Example 2, was used in place of resin X used to prepare the coating liquid for forming charge transport layer of Example 18.A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. The solubility of the resin in the solvent was good also in this time.

Example 20

The procedure of Example 18 was followed, except that a resin Y', prepared in Production Example 4, was used in place of resin X used to prepare the coating liquid A for forming charge transport layer of Example 18. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared. The solubility of the resin in the solvent was good also in this time.

Example 21

The procedure of Example 19 was followed, except that BHT (3,5-di-t-butyl-4-hydroxytoluene) was used as antioxidant in place of Irganox1076, which was used for the coating liquid for forming charge transport layer of Example 19. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Example 22

The procedure of Example 19 was followed, except that 1,3,5-trimethyl-2,4,6-tris(3,5-di-t-butyl-4-hydroxybenzyl) benzene (SEENOX 326M, manufactured by SHIPRO KASEI KAISHA, LTD.) was used as antioxidant in place of Irganox1076, which was used for the coating liquid for forming charge transport layer of Example 19. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Example 23

The procedure of Example 19 was followed, except that (CTM1) described above was used in place of a charge transport material used in the coating liquid B for forming charge transport layer of Example 19. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Example 24

The procedure of Example 23 was followed, except that a resin Y', prepared in Production Example 4, was used in place of resin Y used to prepare the coating liquid for forming charge transport layer of Example 23. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Example 25

The procedure of Example 20 was followed, except that in total 50 weight parts of a mixture consisting of 25 weight parts of (CTM7) described before and 25 weight parts of (CTM8) described before was used in place of a charge transport material used for the coating liquid for forming charge transport layer of Example 20. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Comparative Example 12

The procedure of Example 19 was followed, except that the coating liquid for forming charge transport layer of Example 19 did not contain an antioxidant Irganox1076. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Comparative Example 13

The procedure of Example 20 was followed, except that the coating liquid for forming charge transport layer of Example 20 did not contain an antioxidant Irganox1076. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Comparative Example 14

The procedure of Example 19 was followed, except that polycarbonate resin B-2 (viscosity-average molecular weight 40,000) was used in place of resin Y, which was used for the coating liquid for forming charge transport layer of Example 19. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

Comparative Example 15

The procedure of Comparative Example 12 was followed, except that polycarbonate resin B-2 was used in place of resin Y, which was used for the coating liquid for forming charge transport layer of Comparative Example 12. A coating liquid for forming charge transport layer, a photoreceptor sheet using a coating liquid immediately after preparation, a photoreceptor sheet using a coating liquid stored for 1 month, and a photoreceptor sheet using a coating liquid stored for 3 months were prepared.

[Test]

The above-mentioned [electrical properties test 2] and [abrasion resistance test 1] were performed for the photoreceptor sheets prepared. The results are summarized in Table 7.

[Table 7]

TABLE 7

| | | | | Immediately After Preparation of Coating Liquid | | 1 Month Later | 3 Month Later |
|---|---|---|---|---|---|---|---|
| | Resin | Charge Transport Material | Antioxidant | Abrasion Amount (mg) | | Electrical Properties VL (−V) | |
| Example 18 | X | mixture of geometrical isomers typified by CTM4 | Irg. | 0.4 | 80 | 82 | 85 |
| 19 | Y | mixture of geometrical isomers typified by CTM4 | Irg. | 0.3 | 72 | 75 | 78 |
| 20 | Y' | mixture of geometrical isomers typified by CTM4 | Irg. | 0.4 | 61 | 65 | 69 |
| 21 | Y | mixture of geometrical | BHT | 0.4 | 84 | 90 | 96 |

TABLE 7-continued

| | | Resin | Charge Transport Material | Antioxidant | Immediately After Preparation of Coating Liquid: Abrasion Amount (mg) | Immediately After Preparation of Coating Liquid: Electrical Properties VL (−V) | 1 Month Later: Electrical Properties VL (−V) | 3 Month Later: Electrical Properties VL (−V) |
|---|---|---|---|---|---|---|---|---|
| | | | isomers typified by CTM4 | | | | | |
| | 22 | Y | mixture of geometrical isomers typified by CTM4 | 326M | 0.3 | 58 | 59 | 60 |
| | 23 | Y | CTM1 | Irg. | 0.3 | 59 | 61 | 61 |
| | 24 | Y' | CTM1 | Irg. | 0.4 | 50 | 51 | 55 |
| | 25 | Y' | CTM7/CTM8 | Irg. | 0.3 | 44 | 44 | 45 |
| Reference Example | 12 | Y | mixture of geometrical isomers typified by CTM4 | none | 0.3 | 102 | 164 | 223 |
| | 13 | Y' | mixture of geometrical isomers typified by CTM4 | none | 0.3 | 103 | 194 | 265 |
| | 14 | B-2 | mixture of geometrical isomers typified by CTM4 | none | 3.8 | 52 | 55 | 57 |
| | 15 | B-2 | mixture of geometrical isomers typified by CTM4 | none | 3.6 | 45 | 47 | 51 |

From the results presented, it is evident that the photoreceptors prepared from coating liquids for forming photoreceptor of Examples 18 to 25 are stable in electrical properties even 3 months after the preparation of the coating liquids, and moreover, show superior abrasion resistance. This effect is considered to be brought about by containing the binder resin of the present invention in combination with the antioxidant in the coating liquid.

Photoreceptors prepared from coating liquids for forming photosensitive layer of Comparative Examples 14 and 15, based on a previously known polycarbonate resin as binder resin, are stable in electrical properties with respect to time, regardless of the presence or absence of antioxidant, but inferior in abrasion resistance. Those containing antioxidant are slightly inferior in electrical properties to those containing no antioxidant.

On the other hand, photoreceptors prepared using coating liquids for forming photosensitive layer of Comparative Examples 12 and 13, containing the polyester resin of the present invention and no antioxidant, are superior in abrasion resistance, but show deterioration in electrical properties with time and what is worse, are inferior in electrical properties at the beginning to those containing antioxidant depending on the type of charge transport material. This is considered to be due to the effect of residual monomers or the like generated in the process of formation of resin, which caused the decomposition of the charge transport material both in the early stage and during storage. This corresponds to the fact that the degree of polymerization of resin Y is considered to be higher than that of resin Y', having different polymerization condition from resin Y, and that the coating liquid using resin Y was less deteriorated than the coating liquid using resin Y'.

From the above results, it is evident that a coating liquid for forming photosensitive layer containing the polyester resin of the present invention and antioxidant is quite stable in its coating property and a photoreceptor based on it is superior in abrasion resistance and electrical properties.

[Production of Photoreceptor Sheet]

Example 26

An undercoat layer and charge generation layer were established on a polyethylene terephthalate sheet whose surface was vapor deposited with aluminum, in the same manner as described in Example 1.

Subsequently, 50 weight parts of (CTM4) as charge transport material, 75 weight parts of resin Y prepared in Example 2, 25 weight parts of polycarbonate resin B-3 (second resin, having 50,000 of viscosity-average molecular weight) containing a repeating structural unit shown below, and 0.05 weight parts of silicone oil as leveling agent were added to 640 weight parts of a mixed solvent of tetrahydrofuran and toluene (tetrahydrofuran 80 weight %, toluene 20 weight %), to thereby prepare a coating liquid for forming charge transport layer.

[Chemical Formula 61]

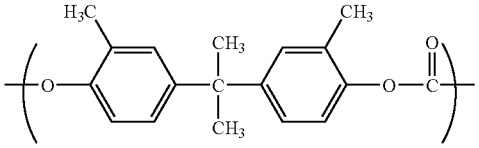

Repeating Structure of Polycarbonate Resin B-3

This coating liquid for forming charge transport layer was coated on the above-mentioned charge generation layer using an applicator so that the thickness of the layer was 20 μm after drying. A charge transport layer was formed after drying for 20 min at 125° C., and thus a photoreceptor sheet was prepared.

Example 27

A photoreceptor sheet was prepared in the same manner as described in Example 26, except that resin Y, used for the coating liquid for forming charge transport layer of Example 26, was used in the amount of 50 weight parts and resin B-3 was used in the amount of 50 weight parts.

Example 28

A photoreceptor sheet was prepared in the same manner as described in Example 26, except that resin Y, used for the coating liquid for forming charge transport layer of Example 26, was used in the amount of 25 weight parts and resin B-3 was used in the amount of 75 weight parts.

Example 29

A photoreceptor sheet was prepared in the same manner as described in Example 26, except that a polycarbonate resin D (second resin, having 50,000 of viscosity-average molecular weight) of the following structure was used in place of resin B-3, which was used for the coating liquid for forming charge transport layer of Example 26.

[Chemical Formula 62]

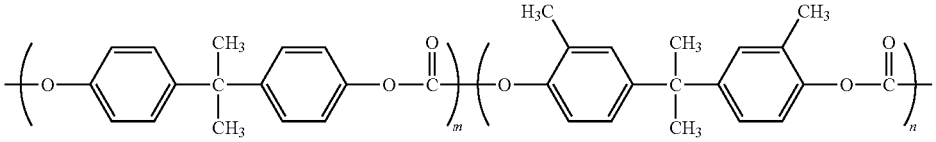

m:n = 40:60
Polycarbonate Resin D

Example 30

A photoreceptor sheet was prepared in the same manner as described in Example 26, except that resin Y, used for the coating liquid for forming charge transport layer of Example 26, was used in the amount of 50 weight parts and resin D, in place of resin B-3, was used in the amount of 50 weight parts.

Example 31

A photoreceptor sheet was prepared in the same manner as described in Example 26, except that resin Y, used for the coating liquid for forming charge transport layer of Example 26, was used in the amount of 25 weight parts and resin D, in place of resin B-3, was used in the amount of 75 weight parts.

Example 32

A photoreceptor sheet was prepared in the same manner as described in Example 26, except that a polycarbonate resin E (second resin, having 48,000 of viscosity-average molecular weight) containing the following repeating structural unit was used in place of resin B-3, which was used for the coating liquid for forming charge transport layer of Example 26.

[Chemical Formula 63]

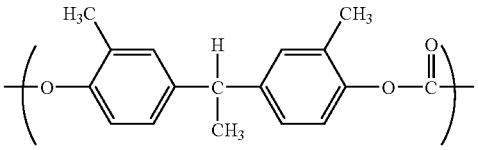

Repeating Structure of Polycarbonate Resin E

Example 33

A photoreceptor sheet was prepared in the same manner as described in Example 26, except that resin Y, used for the coating liquid for forming charge transport layer of Example 26, was used in the amount of 50 weight parts and resin E, in place of resin B-3, was used in the amount of 50 weight parts.

Example 34

A photoreceptor sheet was prepared in the same manner as described in Example 26, except that resin Y, used for the coating liquid for forming charge transport layer of Example 26, was used in the amount of 25 weight parts and resin E, in place of resin B-3, was used in the amount of 75 weight parts.

Comparative Example 16

A photoreceptor sheet was prepared in the same manner as described in Example 26, except that resin Y, used for the coating liquid for forming charge transport layer of Example 26, was used in the amount of 100 weight parts and resin B-3 was not used.

Comparative Example 17

A photoreceptor sheet was prepared in the same manner as described in Example 26, except that resin Y, used for the coating liquid for forming charge transport layer of Example 26, was not used and resin B-3 was used in the amount of 100 weight parts.

Comparative Example 18

A photoreceptor sheet was prepared in the same manner as described in Example 29, except that resin Y, used for the coating liquid for forming charge transport layer of Example 29, was not used and resin D was used in the amount of 100 weight parts.

Comparative Example 19

A photoreceptor sheet was prepared in the same manner as described in Example 32, except that resin Y, used for the coating liquid for forming charge transport layer of Example 32, was not used and resin E was used in the amount of 100 weight parts.

Comparative Example 20

A photoreceptor sheet was prepared in the same manner as described in Example 27, except that a polycarbonate resin F (second resin, having 40,100 of viscosity-average molecular weight) containing the following repeating structural unit was used in place of resin B-3, which was used for the coating liquid for forming charge transport layer of Example 27.

[Chemical Formula 64]

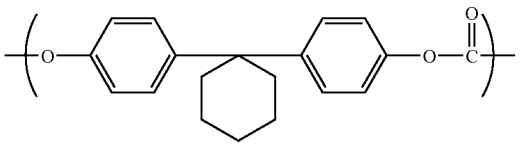

Repeating Structure of Polycarbonate Resin F

Comparative Example 21

A photoreceptor sheet was prepared in the same manner as described in Example 27, except that polyester resin C (viscosity-average molecular weight 32,000) was used in place of resin B-3, which was used for the coating liquid for forming charge transport layer of Example 27.

Comparative Example 22

A photoreceptor sheet was prepared in the same manner as described in Example 27, except that polyester resin C (viscosity-average molecular weight 32,000) was used in place of resin Y, which was used for the coating liquid for forming charge transport layer of Example 27.

[Evaluation]

The following [electrical properties test 5] and above-mentioned [abrasion resistance test 1] were performed for the photoreceptor sheets prepared. The results are summarized in Table 8. For Examples 26 to 28 and Comparative Examples 16 and 17, the contact angle to purified water was measured.

[Electrical Properties Test 5]

The test was performed in the following manner, with the photoreceptor sheets prepared in the above Examples and Comparative Examples fitted onto a photoreceptor characteristics tester (model EPA8100, manufactured by Kawaguchi Electric Works Co., Ltd.). After the photoreceptor was negatively charged (Vo) by 35 μA of corona current in the dark, it is irradiated with a light having 780 nm wavelength continuously. Then the half decay exposure ($E_{1/2}$), required for decrease in surface potential from −700 V to −350 V, and the residual potential (Vr), when 10 μJ/cm$^2$ of energy was irradiated, were measured.

[Table 8]

TABLE 8

| | Resin | Abrasion Amount (mg) | $V_0$ (−V) | $E_{1/2}$ (μJ/cm$^2$) | Vr (−V) |
|---|---|---|---|---|---|
| Example 26 | Y/(B-3) = 75/25 | 0.7 | 871 | 0.13 | 2 |
| Example 27 | Y/(B-3) = 50/50 | 0.8 | 881 | 0.12 | 2 |
| Example 28 | Y/(B-3) = 25/75 | 1.3 | 918 | 0.12 | 3 |
| Example 29 | Y/D = 75/25 | 0.5 | 872 | 0.13 | 4 |
| Example 30 | Y/D = 50/50 | 0.7 | 881 | 0.12 | 4 |
| Example 31 | Y/D = 25/75 | 0.7 | 913 | 0.12 | 3 |
| Example 32 | Y/E = 75/25 | 0.4 | 826 | 0.14 | 7 |
| Example 33 | Y/E = 50/50 | 0.5 | 825 | 0.14 | 7 |
| Example 34 | Y/E = 25/75 | 0.8 | 808 | 0.14 | 7 |
| Comparative Example 16 | Y = 100 | 0.9 | 831 | 0.14 | 5 |
| Comparative Example 17 | (B-3) = 100 | 1.4 | 890 | 0.12 | 3 |
| Comparative Example 18 | D = 100 | 1.0 | 898 | 0.12 | 4 |
| Comparative Example 19 | E = 100 | 1.8 | 833 | 0.14 | 6 |
| Comparative Example 20 | X/F = 50/50 | 1.3 | 916 | 0.13 | 7 |
| Comparative Example 21 | X/C = 50/50 | 1.4 | 907 | 0.13 | 7 |
| Comparative Example 22 | C/(B-3) = 50/50 | 1.7 | 878 | 0.12 | 4 |

[Measurement of Contact Angle]

The electrophotographic photoreceptor described above was cut into a piece of 60 mm in width and 130 mm in length and the piece was fixed with adhesive tape on a reciprocating table of an abraser, FR-2 type, manufactured by Suga Test Instruments Co., LTD. The piece of the electrophotographic photoreceptor was polished by allowing Wetordry Tri-M-ite Paper 2000, manufactured by 3M Company, to move to and from it (reciprocating motion) 300 times under a load of 7.8 N. Thereafter, the piece of the electrophotographic photoreceptor was further polished by allowing JK wiper (registered trademark) 150-S manufactured by Crecia Co. to move to and from it 300 times under a load of 7.8 N.

The contact angle to purified water of the electrophotographic photoreceptor was measured before and after the polishing of the surface, using a contact angle meter, FACE CA-D type, manufactured by Kyowa Interface Science Co., LTD. The results are shown in Table 9.

TABLE 9

| | Resin | Before Polishing | After Polishing |
|---|---|---|---|
| Example 26 | Y/(B-3) = 75/25 | 87.3 | 82.3 |
| Example 27 | Y/(B-3) = 50/50 | 87.3 | 82.4 |
| Example 28 | Y/(B-3) = 25/75 | 86.6 | 83.3 |
| Comparative Example 16 | Y = 100 | 84.1 | 73.6 |
| Comparative Example 17 | (B-3) = 100 | 86.8 | 78.3 |

From the above results, it is evident that a photoreceptor based on both the first resin and the second resin is superior in abrasion resistance to the one based on only either one of the resins, as shown in the result of Taber test in Table 9. This decrease is a specific effect of combination, and the abrasion resistance is excellent particularly when the content of the second resin in the total binder resin is 70 weight % or less.

Especially when resin Y and resin B-3 are combined, contact angle to purified water is higher than when either one is used as a single kind. This results in that transfer efficiency of the toner can be enhanced by installing this electrophotographic photoreceptor in a printer.

In summary, a polyester resin containing a repeating structural unit represented by the formula (1) is essential as the first resin. Further, combined use of the first resin and the second resin, and inclusion of a repeating structural unit represented by the formula (3) are essential. It has come to be evident that the combined use of the two resins is very effective.

[Production of Photoreceptor Sheet]

Example 35

An undercoat layer was established on a polyethylene terephthalate sheet whose surface was vapor deposited with aluminum, in the same manner as described in Example 1.

Next, 5 weight parts of oxytitanium phthalocyanine, which shows an intense diffraction peak at Bragg angles (2θ±0.2) of 27.3° in X-ray diffraction caused by CuKα line and which has a powder X-ray diffraction spectrum shown in FIGS. 2 and 70 weight parts of toluene were dispersed with a sand grinding mil. Similarly, 8 weight parts of an electron transport material represented by the following structural formula (ETM1) and 112 weight parts of toluene were dispersed with a sand grinding mil. Separately, 60 weight parts of (CTM1), as hole transport material, and 100 weight parts of binder resin X prepared in Production Example 1 were dissolved in 420 weight parts of toluene. To this solution, 0.05 parts of silicone oil was added as leveling agent and then the above-mentioned two dispersion liquids were mixed to be homogenized with a homogenizer. The coating liquid prepared as above was coated on the above-mentioned undercoat layer so that the thickness of the layer was 25 μm after drying, to thereby obtain an electrophotographic photoreceptor of positive charge and monolayer type. In this procedure, the solubility of the resin in the solvent was good and any change such as gelation was not observed even one month after the preparation of the coating liquid.

[Chemical Formula 65]

(ETM1)

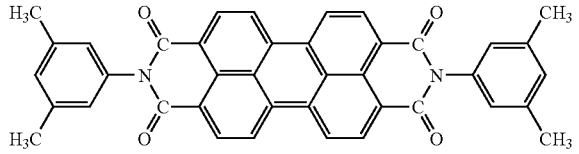

Example 36

A photoreceptor was obtained in the same manner as described in Example 35, except that 100 parts of resin Y, prepared in Production Example 2, was used as binder resin. In this procedure, the solubility of the binder resin in the solvent was good and any change such as gelation was not observed even one month after the preparation of the coating liquid.

Example 37

10 weight parts of oxytitanium phthalocyanine, which shows an intense diffraction peak at Bragg angles (2θ±0.2) of 27.3° in X-ray diffraction caused by CuKα line and which has a powder X-ray diffraction spectrum shown in FIG. 2, was added to 150 weight parts of 1,2-dimethoxyethane. Then the mixture was pulverized and dispersed using a sand grinding mil to prepare a pigment dispersion liquid. 160 weight parts of the pigment dispersion liquid prepared as above, 100 weight parts of 5% 1,2-dimethoxyethane solution of polyvinyl butyral (trade name of "#6000C", manufactured by Denki Kagaku Kogyo Kabushiki Kaisha), and an appropriate amount of 1,2-dimethoxyethane were mixed, to prepare a dispersion liquid finally with 4.0 weight % of solid component concentration.

This dispersion liquid was coated on the polyethylene terephthalate sheet whose surface was vapor deposited with aluminum so that the thickness of the layer was 0.4 μm after drying, using a wire bar. After drying, an undercoat layer was thus prepared.

A photosensitive layer, similarly to that of Example 36, was coated onto the above layer at a thickness of 25 μm to obtain a photoreceptor.

Comparative Example 23

A photoreceptor was prepared in the same manner as described in Example 36, except that polyarylate resin C-2 represented by the structural formula below (viscosity-average molecular weight 48,000) was used as binder resin.

[Chemical Formula 66]

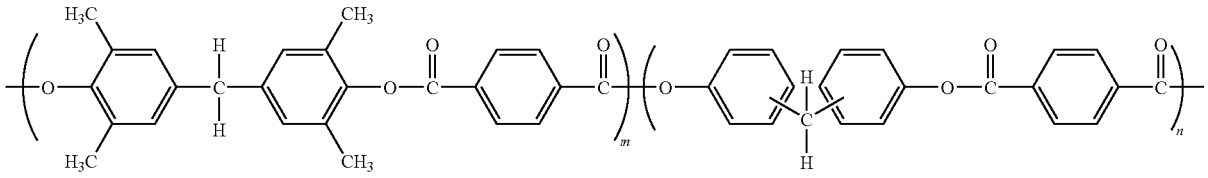

(m:n = 7:3)
Polyarylate Resin C-2

Comparative Example 24

A photoreceptor was prepared in the same manner as described in Example 36, except that a known polycarbonate resin G represented by the structural formula below (viscosity-average molecular weight 50,000) was used as binder resin.

[Chemical Formula 67]

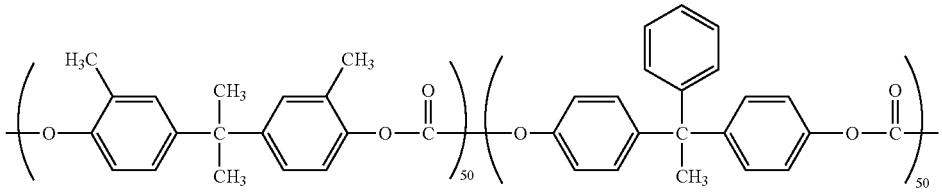

Polycarbonate Resin G

[Evaluation]

The following [electrical properties test 6] and above-mentioned [abrasion resistance test 1] were performed for the photoreceptor sheets prepared. The results are summarized in Table 10.

[Electrical Properties Test 6]

The test was performed in the following manner, using an evaluation apparatus of electrophotographic properties (refer to pages 404 and 405 of "Zoku Densisyasingijutsuno Kisoto Oyo", edited by the Society of Electrophotography and published by CORONA PUBLISHING CO., LTD.), manufactured in accordance with the measurement standard established by the Society of Electrophotography. The above-mentioned photoreceptor sheets were fixed onto an aluminum drum of 80 mm external diameter in a cylindrical form, and conduction between the aluminum drum and the aluminum support of the photoreceptor sheet was secured. In this state, the drum was rotated at constant rotational frequency of 60 rpm to perform electrical properties evaluation test by means of a cycle of charging, exposure, potential measurement and charge removal. The initial surface potential of the photoreceptors was charged at +700 V, and the post-exposure surface potential (hereinafter referred to as VL, as appropriate) when irradiated with 1.5 μJ/cm$^2$ of monochromatic light of 780 nm, obtained from a halogen lamp through an interference filter, was measured. At the time of VL measurement, the time required from the exposure to the potential measurement was set at 100 msec. With respect to the environment for measurement, temperature and relative humidity were set at 25° C. and 50%, respectively.

[Table 10]

TABLE 10

| | Resin | Undercoat Layer | VL (V) | Abrasion Amount (mg) |
|---|---|---|---|---|
| Example 35 | X | titania | 79 | 0.5 |
| Example 36 | Y | titania | 72 | 0.4 |
| Example 37 | Y | phthalocyanine | 64 | 0.4 |
| Comparative Example 23 | C-2 | titania | 95 | 2.7 |
| Comparative Example 24 | G | titania | 66 | 5.6 |

From the above results, it is evident that only in the monolayer type photoreceptor containing the polyester resin of the present invention, both abrasion resistance and electrical properties were secured high.

[Production of Photoreceptor Drum]

[Photoreceptor 1]

As charge generation material, 20 weight parts of oxytitanium phthalocyanine, which has a pattern of powder X-ray diffraction spectrum with respect to CuKα X-ray line shown in FIG. 2, was added to 280 weight parts of 1,2-dimethoxyethane. Then the mixture was dispersed using a sand grinding mil for two hours to prepare a dispersion liquid.

The dispersion liquid prepared, 10 weight parts of polyvinyl butyral (trade name: "Denkabutyral" #6000C, manufactured by Denki Kagaku Kogyo Kabushiki Kaisha), 487 weight parts of 1,2-dimethoxyethane, and 85 weight parts of 4-methoxy-4-methyl-2-pentanone were mixed to prepare a coating liquid for forming charge generation layer.

Anodic oxidation treatment was done to the mirror-finished surface of an aluminum cylinder (30 mm of external diameter, 376 mm of length, 0.75 mm of thickness), followed by sealing treatment with a sealing agent composed mainly of nickel acetate. Anodic oxidation film (alumite film) of about 6 μm in thickness was thus formed. This cylinder was dipped into the dispersion liquid for forming charge generation layer prepared above and a charge generation layer of about 0.4 μm in film thickness after drying was formed.

Next, 50 weight parts of (CTM1) as charge transport material, 100 weight parts of resin X prepared in Production Example 1, 8 weight parts of 3,5-di-t-butyl-4-hydroxytoluene as antioxidant, 0.1 weight parts of tribenzylamine, and 0.05 weight parts of silicone oil as leveling agent were added to 640 weight parts of a mixed solvent of tetrahydrofuran and toluene (tetrahydrofuran 80 weight %, toluene 20 weight %), to thereby prepare a coating liquid for forming charge transport layer.

A cylinder on which was formed a charge generation layer previously was dipped into this coating liquid for forming charge transport layer, so that the film thickness after drying was 18 μm, to thereby form a charge transport layer. A photoreceptor drum obtained as above was named Photoreceptor 1.

[Photoreceptor 2]

A photoreceptor drum was prepared in the same manner as described for Photoreceptor 1, except that 100 weight parts of resin Y, prepared in Production Example 2, was used in place of resin X, used for the coating liquid for forming charge transport layer of Photoreceptor 1. A photoreceptor drum obtained as above was named Photoreceptor 2.

[Photoreceptor 3]

A photoreceptor drum was prepared in the same manner as described for Photoreceptor 1, except that 100 weight parts of resin C-3 (viscosity-average molecular weight 31,000) represented by the structural formula below was used in place of resin X, used for the coating liquid for forming charge transport layer of Photoreceptor 1. A photoreceptor drum obtained as above was named Photoreceptor 3.

[Chemical Formula 68]

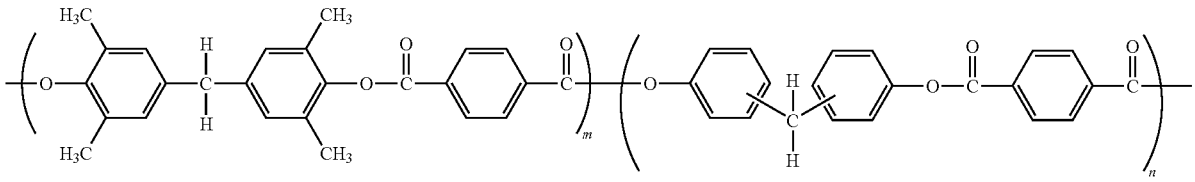

Resin C-3

(m:n = 7:3)

[Photoreceptor 4]

A photoreceptor drum was prepared in the same manner as described for Photoreceptor 1, except that 100 weight parts of resin G-2 (viscosity-average molecular weight 49,200) represented by the structural formula below was used in place of resin X, used for the coating liquid for forming charge transport layer of Photoreceptor 1. A photoreceptor drum obtained as above was named Photoreceptor 4.

[Chemical Formula 69]

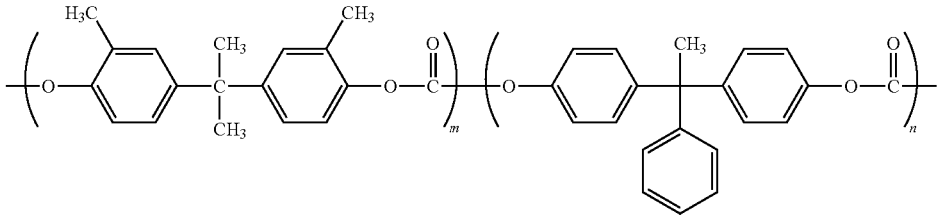

Resin G-2 m:n = 51:49

[Photoreceptor 5]

A photoreceptor drum was prepared in the same manner as described for Photoreceptor 3, except that an aluminum cylinder of 30 mm external diameter, 351 mm length and 1.0 mm thickness was used in place of an aluminum cylinder used for the preparation of Photoreceptor 3. A photoreceptor drum obtained as above was named Photoreceptor 5.

[Photoreceptor 6]

A photoreceptor drum was prepared in the same manner as described for Photoreceptor 4, except that an aluminum cylinder of 30 mm external diameter, 351 mm length and 1.0 mm thickness was used in place of an aluminum cylinder used for the preparation of Photoreceptor 4. A photoreceptor drum obtained as above was named Photoreceptor 6.

[Preparation of Toner for Development]

Preparation of Wax-long Chain Polymerizable Monomer Dispersion Liquid A1

27 parts (540 g) of paraffin wax (HNP-9, manufactured by Nippon Seiro Co., Ltd., 23.5 mN/m in surface tension, 82° C. in melting point, 220 J/g in melting heat, 8.2° C. in half-width of the melting peak, 13.0° C. in half width of the crystallization peak), 2.8 parts of stearyl acrylate (manufactured by Tokyo Chemical Industry Co., Ltd.), 1.9 parts of 20 weight % sodium dodecylbenzenesulfonate water solution (NEOGEN S20A, manufactured by Dai-ichi Kogyo Seiyaku Co., Ltd., hereinafter abbreviated as "20% DBS water solution" as appropriate) and 68.3 parts of desalted water were heated to 90° C. and stirred at rotational frequency of 8000 rpm for 10 min by a homomixer (mark II f model, manufactured by Tokushukika Co.).

Next, this dispersion liquid was heated to 90° C., and then subjected to recirculating emulsification under a pressurized condition of about 25 MPa using a homogenizer (15-M-8PA model, manufactured by Gaulin Co.). Then it was dispersed until the volume average particle diameter reached 250 nm, while measuring it with Microtrack UPA manufactured by NIKKISO Co., Ltd. (hereinafter abbreviated as "Microtrack UPA" as appropriate), to thereby prepare a wax-long chain polymerizable monomer dispersion liquid A1 (solid component concentration of the emulsion=30.2 weight %).

Preparation of Silicone Wax Dispersion Liquid A2

27 parts (540 g) of an alkyl-modified silicone wax (melting point 72° C.), 1.9 parts of 20% DBS water solution and 71.1 parts of desalted water were transferred into a 3 L stainless steel vessel. Then the mixture was heated to 90° C. and stirred at 8000 rpm rotational frequency for 10 min by a homomixer (mark II f model, manufactured by Tokushukika Co.).

Next, this dispersion liquid was heated to 99° C., and then subjected to recirculating emulsification under a pressurized condition of about 45 MPa using a homogenizer (15-M-8PA model, manufactured by Gaulin Co.). Then it was dispersed until the volume average particle diameter reached 240 nm, while measuring it with Microtrack UPA, to thereby prepare a silicone wax dispersion liquid A2 (solid component concentration of the emulsion=27.4 weight %).

Preparation of Polymer Primary Particles dispersion Liquid A1

To a reaction vessel (inner volume 21 L, inner diameter 250 mm, height 420 mm) fitted with a stirrer (three vanes), heating-cooling equipment, concentrating device and raw materials/additives feeder, were fed 35.6 weight parts (712.12 g) of wax-long chain polymerizable monomer dispersion liquid A1 and 259 parts of desalted water. Then the mixture was heated to 90° C. under a nitrogen stream with stirring at rotational frequency of 103 rpm.

To this, a mixture of the following monomers and emulsifier water solution over a period of 5 hr from the beginning of the polymerization was added. Then the initiator water solution shown below was added over a period of 4.5 hr from 30 min after the beginning of the polymerization, namely the beginning of the dropping of the above mixture comprising the monomers and emulsifier water solution. The additional initiator water solution shown below was further added over a period of 2 hr from 5 hr after the beginning of the polymerization. After that, the mixture was maintained for further 1 hr at rotational frequency of 103 rpm and internal temperature of 90° C.

| [Monomers] | |
|---|---|
| Styrene | 76.8 parts (1535.0 g) |
| Butyl acrylate | 23.2 parts |
| Acrylic acid | 1.5 parts |
| Trichlorobromomethane | 1.0 part |
| Hexanedioldiacrylate | 0.7 parts |
| [Emulsifier water solution] | |
| 20% DBS water solution | 1.0 part |
| Desalted water | 67.1 parts |
| [Initiator water solution] | |
| 8% hydrogen peroxide water solution | 15.5 parts |
| 8% L(+)-ascorbic acid water solution | 15.5 parts |
| [Additional initiator water solution] | |
| 8% L(+)-ascorbic acid water solution | 14.2 parts |

After completion of the polymerization reaction, the reaction system was cooled, to thereby obtain the milky white polymer primary particles dispersion liquid A1. The volume average particle diameter measured by Microtrack UPA was 280 nm, and the solid component concentration was 21.1 weight %.

Preparation of Polymer Primary Particles Dispersion Liquid A2

To a reaction vessel (inner volume 21 L, inner diameter 250 mm, height 420 mm) fitted with a stirrer (three vanes), heating-cooling equipment, concentrating device and raw materials/additives feeder were fed with 23.6 weight parts (472.3 g) of silicone wax dispersion liquid A2, 1.5 weight parts of 20% DBS water solution and 324 parts of desalted water. The mixture was heated to 90° C. under a nitrogen stream, and then 3.2 parts of 8% hydrogen peroxide water solution and 3.2 parts of 8% L(+)-ascorbic acid water solution were added at one time under stirring at rotational frequency of 103 rpm.

After 5 min, was added a mixture of the monomers and emulsifier water solution, described below, over a period of 5 hr from the beginning of the polymerization (namely, 5 min later from the simultaneous addition of 3.2 parts of 8% hydrogen peroxide water solution and 3.2 parts of 8% L(+)-ascorbic acid water solution). In addition, the initiator water solution shown below was added over a period of 6 hr from the beginning of the polymerization. After that, the mixture was maintained for further 1 hr at rotational frequency of 103 rpm and internal temperature of 90° C.

| [Monomers] | |
|---|---|
| Styrene | 92.5 parts (1850.0 g) |
| Butyl acrylate | 7.5 parts |
| Acrylic acid | 1.5 parts |
| Trichlorobromomethane | 0.6 parts |

-continued

| [Emulsifier water solution] | |
|---|---|
| 20% DBS water solution | 1.5 parts |
| Desalted water | 66.2 parts |
| [Initiator water solution] | |
| 8% hydrogen peroxide water solution | 18.9 parts |
| 8% L(+)-ascorbic acid water solution | 18.9 parts |

After completion of the polymerization reaction, the reaction system was cooled, to thereby obtain the milky white polymer primary particles dispersion liquid A2. The volume average particle diameter measured by Microtrack UPA was 290 nm, and the solid component concentration was 19.0 weight %.

Preparation of Colorant Dispersion Liquid A 20 parts (40 kg) of carbon black (Mitsubishi Carbon Black MA100S, manufactured by Mitsubishi Chemical Corporation), produced by furnace method and having real density of 1.8 g/cm$^3$ and UV absorbance for its toluene extract of 0.02, 1 part of 20% DBS water solution, 4 parts of nonionic surfactant (Emulgen 120, manufactured by Kao Corporation) and 75 parts of ion-exchange water having 2 μS/cm of electrical conductivity were fed into a container of 300-L inner volume, which is fitted with a stirrer (propeller vane), and then the mixture was dispersed preliminarily. Thereby a pigment premix liquid was obtained. The electrical conductivity was measured by a conductivity meter (Personal SC Meter SC72 and a detector SC72SN-11, manufactured by Yokogawa Electric Corporation).

50% volume median particle diameter Dv50 of the carbon black in the dispersion liquid after premixing was about 90 μm. The above premix liquid was fed into a wet-type beads mill as material slurry and one-pass dispersion was effected. The inner diameter of the stator was 75 mmϕ, the diameter of the separator was 60 mm ϕ, and the distance between the separator and the disc was 15 mm. As media for dispersion, zirconia beads of 50 μm in diameter (real density of 6.0 g/cm$^3$) was used. As the effective inner volume of the stator was about 0.5 L and the filling volume of the media was set at 0.35 L, filling rate of media was 70%. The rotation speed of the rotor was held constant (about 11 m/sec in circumferential velocity at the tip of the rotor) and the above premix slurry was supplied from the feeding inlet at a rate of about 50 L/hr by means of a nonpulsatile metering pump. Black-colored colorant dispersion A was thus obtained as it was poured out of the outlet route continuously. The volume-average particle diameter measured by Microtrack UPA was 150 nm, and the solid component concentration was 24.2 weight %.

Preparation of Base Particle for Development A

Polymer primary particles dispersion liquid A1
95 parts as solid content (998.2 g as solid content)
Polymer primary particles dispersion liquid A2
5 parts as solid content
Colorant microparticles dispersion liquid A
6 parts as solid content of colorant
20% DBS water solution
0.1 part as solid content Using the above components, a toner was prepared by the following procedure.

To a mixing vessel (inner volume 12 L, inner diameter 208 mm, height 335 mm) fitted with a stirrer (double helical vane), heating-cooling equipment, concentrating device and raw materials/additives feeder were fed with polymer primary particles dispersion liquid A1 and 20% DBS water solution. After the mixture was blended homogeneously at 12° C. of internal temperature and 40 rpm for 5 min, the stirring rotational frequency was raised to 250 rpm while internal temperature was maintained at 12° C. Then, after 0.52 parts of 5% water solution of ferrous sulfate was added as $FeSO_4.7H_2O$, colorant microparticles dispersion liquid A was added over a period of 5 min. The mixture was blended homogeneously while the reaction conditions (12° C. of internal temperature and 250 rpm) were maintained, and onto the mixture, further under the same condition, 0.5% water solution of aluminum sulfate (0.10 parts of solid content relative to that of resin) was dropped. After that, the internal temperature was raised to 53° C. over a period of 75 min, and then to 56° C. over a period of 170 min, while the rotational frequency was maintained at 250 rpm.

Then the particle size was measured by a high-performance particle size distribution analyzer (Multisizer III, manufactured by Beckman Coulter, hereinafter abbreviated as "Multisizer" as appropriate) with aperture diameter set at 100 μm, to obtain the value 6.7 μm as 50% volume-based diameter.

Subsequently, polymer primary particles dispersion liquid A2 was added over a period of 3 min while the revolution was maintained at 250 rpm, and then the mixture was maintained under the same condition for 60 min. Immediately after the rotational frequency was lowered to 168 rpm, 20% DBS water solution (6 parts, as solid component) was added over a period of 10 min. The temperature was raised to 90° C. over a period of 30 min while maintaining 168 rpm, and then the condition was maintained for 60 min.

The slurry was then cooled to 30° C. over a period of 20 min, drawn out and subjected to suction filtration through filter paper No. 5C (No. 5C, manufactured by Toyo Roshi Kaisha, LTD.) using an aspirator. The cake which remained on the filter paper was transferred to a stainless steel vessel of 10 L inner volume, fitted with a stirrer (propeller vane), and 8 kg of ion-exchange water of 1 μS/cm electrical conductivity was added. The mixture was dispersed homogeneously by stirring at 50 rpm and the stirring was continued for further 30 min.

Then the slurry was again subjected to suction filtration through filter paper No. 5C (No. 5C, manufactured by Toyo Roshi Kaisha, LTD.) using an aspirator. The cake which remained on the filter paper was again transferred to a stainless steel vessel of 10 L inner volume, which was fitted with a stirrer (propeller vane) and contained 8 kg of ion-exchange water of 1 μS/cm electrical conductivity. The mixture was dispersed homogeneously by stirring at 50 rpm and the stirring was continued for further 30 min. After this procedure was repeated 5 times, the electrical conductivity of the filtrate was 2 μS/cm. The electrical conductivity was measured by a conductivity meter (Personal SC Meter SC72 and a detector SC72SN-11, manufactured by Yokogawa Electric Corporation).

The obtained filter cake was spread over a stainless steel vat so that it is about 20 mm high. The cake was dried in an air-blowing dryer set at 40° C. for 48 hr, to thereby obtain base particles for development A.

Production of Toner for Development A 100 parts (1000 g) of base particle for development A was transferred into a 10-L inner-volume Henschel mixer (230 mm in diameter, 240 mm in height), equipped with a stirrer (Z/A0 vane) and a deflector extending from above and toward the wall surface at right angle. Subsequently, 0.5 parts of silica microparticles having 0.04 μm of volume-average primary particle size and 2.0 parts of silica microparticles having 0.012 μm of volume-average primary particle size, which were hydrophobized with silicone oil, were added. The mixture was blended under stirring for 10 min at 3000 rpm, and then sieved through an 150 mesh, to thereby obtain toner for development A. The volume average particle diameter and Dv/Dn of toner A, which were measured with Multisizer II, were 7.05 μm and 1.14 respectively. The average degree of circularity, measured with FPIA2000, was 0.963.

Example 38

Photoreceptor 1 prepared before and the above toner for development A were mounted on the black drum cartridge and black toner cartridge respectively, of a color printer MICROLINE Pro 9800PS-E manufactured by Oki Data Corporation. The cartridges were attached to the above printer.

30,000 sheets of text document images, each having about 5% of printing area, were formed under the condition of 25° C. temperature and 50% of humidity. The reduction amount in film thickness of the photoreceptor was calculated, the result of which is shown in Table 11. The reduction amount in film thickness here is represented by a relative amount to that of photoreceptor 4 in Comparative Example 26. Table 11 also shows the evaluations for halftone images printed at the beginning of and after 30,000-sheets image formation.

Example 39

Evaluation was made in the same manner except that photoreceptor 2 was substituted for the photoreceptor used in Example 38. The result is shown also in Table 11.

Comparative Example 25

Evaluation was made in the same manner except that photoreceptor 3 was substituted for the photoreceptor used in Example 38. The result is shown also in Table 11.

Comparative Example 26

Evaluation was made in the same manner except that photoreceptor 4 was substituted for the photoreceptor used in Example 38. The result is shown also in Table 11.

Comparative Example 27

Photoreceptor 5 prepared before was mounted on the black drum cartridge of a color printer MICROLINE Pro 3050c manufactured by Oki Data Corporation. The cartridge was attached to the above printer. As toner, a commercially available dedicated toner for the above printer, produced by the melt-kneading pulverization method, was used. The average degree of circularity of that toner was 0.935.

Specification of MICROLINE Pro 3050c train-of-four tandem
color 21 ppm, monochrome 26 ppm
1200 dpi
contact-type roller charging (applying direct voltage)
LED exposure
no charge-removing light 30,000 sheets of text document images, each having about 5% of printing area, were formed under the condition of 25° C. temperature and 50% of humidity. The result of reduction amounts in film thickness (abrasion amount) of the photoreceptors is shown in Table 11. The reduction amount in film thickness here is represented by a relative amount to that of photoreceptor 4 in Comparative Example 28. In addition, the evaluations were made on the halftone images printed at the beginning of and after 30,000-sheets image formation. The result showed a dot defect in a low print-density area.

Comparative Example 28

Evaluation was made in the same manner except that photoreceptor 6 was substituted for the photoreceptor used in Comparative Example 27. The result is shown also in Table 11.

[Table 11]

TABLE 11

| | Photo-receptor | Resin | Abrasion Amount | State of Image: Beginning | State of Image: After 3000 sheets image formation |
|---|---|---|---|---|---|
| Example 38 | 1 | X | 0.56 | High Quality | High Quality |
| Example 39 | 2 | Y | 0.60 | High Quality | High Quality |
| Comparative Example 25 | 3 | C-3 | 0.85 | High Quality | High Quality |
| Comparative Example 26 | 4 | G-2 | 1.00 | High Quality | High Quality |
| Comparative Example 27 | 5 | C-3 | 0.90 | High Quality | Dot Defect in Low Print-Density Area |
| Comparative Example 28 | 6 | G-2 | 1.00 | High Quality | High Quality |

[Actual Device Evaluation]

The exposure part of a tandem type color printer (MICROLINE Pro 9800PS-E, manufactured by Oki Data Corporation) was reconstructed so that the photoreceptor can be irradiated with light of the small-spot irradiation type blue LED (B3MP-8: 470 nm), manufactured by NISSIN ELECTRONIC CO., LTD.

The line drawn by this reconstructed printer, fitted with photoreceptor 1 or 2 used in Example 38 and 39, had a high image quality. Then a dot was printed by this printer of which above-mentioned small-spot irradiation type blue LED was connected to a power source LPS-203KS for a stroboscopic light. A dot having 8 mm of radius can be printed.

[Reference Experiment 1]

Onto an aluminum-deposited layer formed on the surface of a biaxially-stretched polyethylene terephthalate resin film (film thickness of 75 μm), which was used as electroconductive support, the coating liquid for forming charge generation layer prepared in Example 38 was coated so that the film thickness after drying was 0.4 μm using a bar coater. After drying, a charge generation layer was thus prepared. Moreover, a layer consisting only of resin X was formed on the charge generation layer by coating so that the film thickness after drying was 25 μm.

The above sheet formed with the resin layer thereon was cut into a piece of 60 mm in width and 130 mm in length and the piece was fixed with adhesive tape on a reciprocating table of an abraser, FR-2 type, manufactured by Suga Test Instruments Co., LTD. The piece of the electrophotographic photoreceptor was polished by allowing Wetordry Tri-M-ite Paper 2000, manufactured by 3M Company, to move to and from it (reciprocating motion) 300 times under a load of 7.8 N. Thereafter, the piece of the electrophotographic photoreceptor was further polished by allowing JK wiper (registered trademark) 150-S manufactured by Crecia Co. to move to and from it 300 times under a load of 7.8 N. The contact angle to purified water of the electrophotographic photoreceptor was measured before and after the polishing of the surface, using a contact angle meter, FACE CA-D type, manufactured by Kyowa Interface Science Co., LTD. The result is shown in Table 12.

[Reference Experiment 2]

Contact angle was measured in the same manner as described in Reference Experiment 1, except that resin Y was used in place of resin X. The result is shown in Table 12.

[Comparative Reference Experiment 1]

Contact angle was measured in the same manner as described in Reference Experiment 1, except that resin C-3 was used in place of resin X. The result is shown in Table 12.

[Comparative Reference Experiment 2]

Contact angle was measured in the same manner as described in Reference Experiment 1, except that resin G-2 was used in place of resin X. The result is shown in Table 12.

[Table 12]

TABLE 12

| | Resin | Before Polishing | After Polishing |
|---|---|---|---|
| Reference Experiment 1 | X | 83.4 | 72.2 |
| Reference Experiment 2 | Y | 83.3 | 72.4 |
| Comparative Reference Experiment 1 | C-3 | 83.8 | 73.0 |
| Comparative Reference Experiment 2 | G-2 | 87.4 | 75.8 |

From the results shown in Table 12, it is evident that the photoreceptor using resin X or Y, which had a structure of the polyester resin of the present invention, excels in print resistance. The photosensitive layer using a polymerized toner is liable to be scraped easily compared to that using a grinded toner, and therefore, the print resistance thereof is particularly important. Furthermore, because a high-quality image could be obtained even after 30,000 sheets of image formation, it is evident that this photoreceptor is suitable for the use of a polymerized toner.

A phenomenon that the transfer efficiency of the toner will be worse at highlights (thin half tone) is generally known. The reason is said to be as follows. When an image with high density is printed, the toner layer formed on the photoreceptor can be transferred easily by the force of electric field. On the other hand, when an image with low density is printed, the toner, directly adhered to the photoreceptor, have to be transferred, but the adhesive force is relatively large. Therefore, the transfer efficiency at highlights is remarkably poor.

The surface of the polyester resin used in the present invention has a low contact angle to water, compared to the surface of polycarbonate resin, as shown by the result of Reference Experiment in Table 12. This means it has relatively large surface energy, and therefore a low-quality image formation at highlights tends to occur.

However, the use of the toner of the present Example, which has 0.940 of average degree of circularity or larger one, can make the contact angle, as well as the Van der Waals' force, smaller. This is considered to be the reason for that the use of photoreceptor of the present Example could obtain an image of sufficient quality.

Industrial Applicability

The present invention can be used in any fields using an electrophotographic photoreceptoceptor. Particularly, it can be preferably applied to an image forming device such as a printer and a copying machine.

The present invention has been explained in detail above by referring to specific embodiments. However, it is obvious for those skilled in the art that various modifications can be added thereto without departing from the intention and the scope of the present invention.

The present application is based on Japanese Patent Application (No. 2006-1041) filed on Jan. 6, 2006, Japanese Patent Application (No. 2006-6647) filed on Jan. 13, 2006, Japanese Patent Application (No. 2006-6686) filed on Jan. 13, 2006, Japanese Patent Application (No. 2006-6687) filed on Jan. 13, 2006, Japanese Patent Application (No. 2006-6688) filed on Jan. 13, 2006, Japanese Patent Application (No. 2006-6689) filed on Jan. 13, 2006 and Japanese Patent Application (No. 2006-6690) filed on Jan. 13, 2006, and their entireties are incorporated herewith by reference.

The invention claimed is:

1. An electrophotographic photoreceptor comprising at least a photosensitive layer on an electroconductive support, wherein said photosensitive layer comprises a polyester resin comprising a hydrazone compound and having a repeating structural unit represented by the formula (1):

[Chemical Formula 1]

(1)

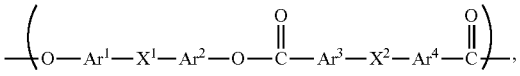

wherein $Ar^1$ to $Ar^4$ each represents, independently of each other, an arylene group which may be substituted, $X^1$ represents a bivalent group or a single bond, and $X^2$ represents a bivalent group with 3 or less atoms.

2. An electrophotographic photoreceptor comprising at least a photosensitive layer on an electroconductive support, wherein said photosensitive layer comprises a layer including a polyester resin comprising a repeating structural unit represented by the formula (1) and a charge transport material, and said charge transport material comprises only a charge transport material containing substantially no unsaturated bond other than in an aromatic ring:

[Chemical Formula 2]

(1)

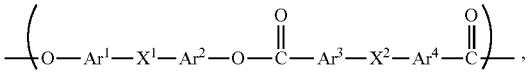

wherein $Ar^1$ to $Ar^4$ each represents, independently of each other, an arylene group which may be substituted, $X^1$ represents a bivalent group or a single bond, and $X^2$ represents a bivalent group with 3 or less atoms.

3. An electrophotographic photoreceptor comprising at least a photosensitive layer on an electroconductive support, wherein said photosensitive layer comprises a polyester resin comprising a repeating structural unit represented by the formula (1) and a diamine compound represented by the formula (2):

[Chemical Formula 3]

(1)

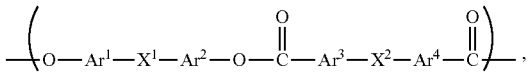

wherein $Ar^1$ to $Ar^4$ each represents, independently of each other, an arylene group which may be substituted , $X^1$ represents a bivalent group or a single bond, and $X^2$ represents a bivalent group with 3 or less atoms; and

[Chemical Formula 4]

(2)

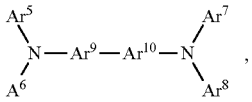

wherein $Ar^5$ to $Ar^8$ each represents, independently of each other, an aryl group which may have a substituent with 8 or less carbon atoms, and $Ar^9$ and $Ar^{10}$ each represents, independently of each other, an arylene group which may be substituted.

4. An electrophotographic photoreceptor comprising at least a photosensitive layer on an electroconductive support, wherein said photosensitive layer comprises a polyester resin containing an antioxidant and having a repeating structural unit represented by the formula (1):

[Chemical Formula 5]

(1)

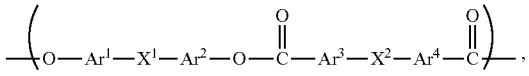

wherein $Ar^1$ to $Ar^4$ each represents, independently of each other, an arylene group which may be substituted, $X^1$ represents a bivalent group or a single bond, and $X^2$ represents a bivalent group with 3 or less atoms.

5. The electrophotographic photoreceptor according to claim 4, wherein said antioxidant is a phenolic antioxidant.

6. An electrophotographic photoreceptor comprising at least a photosensitive layer on an electroconductive support, wherein said photosensitive layer comprises a polyester resin as a first resin comprising a repeating structural unit represented by the formula (1) and at least another resin as a second resin selected from the group consisting of a polyester resin having a different structure from said first resin and a polycarbonate resin, wherein at least either said first resin or said second resin comprises a repeating structural unit represented by the formula (3):

[Chemical Formula 6]

(1)

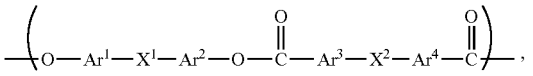

wherein $Ar^1$ to $Ar^4$ each represents, independently of each other, an arylene group which may be substitute , $X^1$ represents a bivalent group or a single bond, and $X^2$ represents a bivalent group with 3 or less atoms; and

[Chemical Formula 7]

(3)

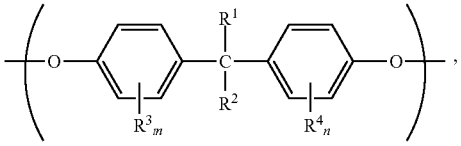

wherein $R^1$ and $R^2$ each represents, independently of each other, a hydrogen atom or an alkyl group, $R^3$ and $R^4$ each represents, independently of each other, an alkyl group, and m and n each represents, independently of each other, an integer selected from 1 to 4.

7. The electrophotographic photoreceptor according to claim 6, wherein said second resin is a polycarbonate resin.

8. The electrophotographic photoreceptor according to claim 6, wherein the repeating structural unit represented by the formula (3) is a repeating structural unit represented by the formula (3'):

[Chemical Formula 8]

(3')

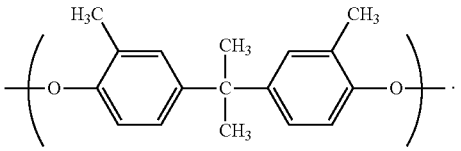

9. The electrophotographic photoreceptor according to claim 8, wherein the weight ratio of the repeating structural unit represented by the formula (3') in the total weight of said first resin and said second resin is from 1 weight % to 45 weight %.

10. The electrophotographic photoreceptor according to claim 8, wherein said second resin is a polycarbonate resin.

11. The electrophotographic photoreceptor according to claim 10, wherein the second resin comprises repeating structural unit of the formula (3"), and the weight ratio of the repeating structural unit represented by the formula (3") contained in said polycarbonate resin is 70 weight % or more of said polycarbonate resin:

[Chemical Formula 9]

(3")

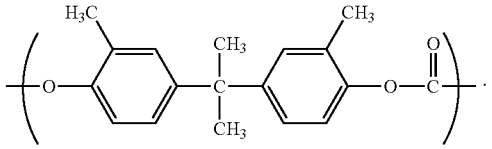

12. An electrophotographic photoreceptor of a positive charge type comprising a monolayer type photosensitive layer on an electroconductive support, wherein said monolayer type photosensitive layer comprises a polyester resin comprising a repeating structural unit represented by the formula (1):

[Chemical Formula 10]

(1)

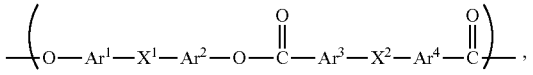

wherein $Ar^1$ to $Ar^4$ each represents, independently of each other, an arylene group which may be substituted, $X^1$ represents a bivalent group or a single bond, and $X^2$ represents a bivalent group with 3 or less atoms.

13. An electrophotographic photoreceptor cartridge comprising:

the electrophoto graphic photoreceptor according to claim 1 and at least one means selected from the group consisting of means for charging said electrophotographic photoreceptor, means for exposing said charged electrophotographic photoreceptor to form an electrostatic latent image thereon, and a means for developing the electrostatic latent image formed on said electrophotographic photoreceptor.

14. An electrophotographic photoreceptor cartridge comprising:

the electrophotographic photoreceptor according to claim 2 and at least one means selected from the group consisting of means for charging said electrophotographic photoreceptor, means for exposing said charged electrophotographic photoreceptor to form an electrostatic latent image thereon, and means for developing the electrostatic latent image formed on said electrophotographic photoreceptor.

15. An electrophotographic photoreceptor cartridge comprising:

the electrophotographic photoreceptor according to claim 3 and at least one means selected from the group consisting of means for charging said electrophotographic photoreceptor, means for exposing said charged electrophotographic photoreceptor to form an electrostatic latent image thereon, and means for developing the electrostatic latent image formed on said electrophotographic photoreceptor.

16. An electrophotographic photoreceptor cartridge comprising:

the electrophotographic photoreceptor according to claim 4 and at least one means selected from the group consisting of means for charging said electrophotographic photoreceptor, means for exposing said charged electrophotographic photoreceptor to form an electrostatic latent image thereon, and means for developing the electrostatic latent image formed on said electrophotographic photoreceptor.

17. An electrophotographic photoreceptor cartridge comprising:

the electrophotographic photoreceptor according to claim 6 and at least one means selected from the group consisting of means for charging said electrophotographic photoreceptor, means for exposing said charged electrophotographic photoreceptor to form an electrostatic latent image thereon, and means for developing the electrostatic latent image formed on said electrophotographic photoreceptor.

18. An electrophotographic photoreceptor cartridge comprising:

the electrophotographic photoreceptor according to claim 12 and at least one means selected from the group consisting of means for charging said electrophotographic photoreceptor, means for exposing said charged electrophotographic photoreceptor to form an electrostatic latent image thereon, and means for developing the electrostatic latent image formed on said electrophotographic photoreceptor.

19. An image forming device comprising:

the electrophotographic photoreceptor according to claim 1, means for charging said electrophotographic photoreceptor, means for exposing said charged electrophotographic photoreceptor to form an electrostatic latent image thereon, means for developing the electrostatic latent image with toner, and means for transferring the toner to a transfer target.

20. An image forming device comprising:

the electrophotographic photoreceptor according to claim 2, means for charging said electrophotographic photoreceptor, means for exposing said charged electrophotographic photoreceptor to form an electrostatic latent image thereon, means for developing the electrostatic latent image with toner, and means for transferring the toner to a transfer target.

21. An image forming device comprising:

the electrophotographic photoreceptor according to claim 3, means for charging said electrophotographic photoreceptor, means for exposing said charged electrophotographic photoreceptor to form an electrostatic latent image thereon, means for developing the electrostatic latent image with toner, and means for transferring the toner to a transfer target.

22. An image forming device comprising:

the electrophotographic photoreceptor according to claim 4, means for charging said electrophotographic photoreceptor, means for exposing said charged electrophotographic photoreceptor to form an electrostatic latent image thereon, means for developing the electrostatic latent image with toner, and means for transferring the toner to a transfer target.

23. An image forming device comprising:

the electrophotographic photoreceptor according to claim 6, means for charging said electrophotographic photoreceptor, means for exposing said charged electrophotographic photoreceptor to form an electrostatic latent image thereon, means for developing the electrostatic latent image with toner, and means for transferring the toner to a transfer target.

24. An image forming device comprising:

the electrophotographic photoreceptor according to claim 12, means for charging said electrophotographic photoreceptor, means for exposing said charged electrophotographic photoreceptor to form an electrostatic latent image thereon, means for developing the electrostatic latent image with toner, and means for transferring the toner to a transfer target.

25. An image forming device comprising at least an electrophotographic photoreceptor and a toner, wherein the photosensitive layer of said electrophotographic photoreceptor comprises a polyester resin containing a repeating structural unit represented by formula (1) below, and the average degree of circularity of said toner, measured by a flow particle image analyzer, is 0.940 or larger and 1.000 or smaller:

[Chemical Formula 11]

(1)

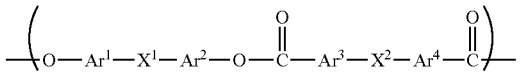

wherein $Ar^1$ to $Ar^4$ each represents, independently of each other, an arylene group which may have a substituent, $X^1$ represents a bivalent group or a single bond, and $X^2$ represents a bivalent group with 3 or less atoms.

26. An image forming device according to claim 25, wherein said toner is produced in an aqueous medium.

27. An image forming device according to claim 25, wherein said toner has a resin-coating layer.

28. An image forming device according to claim 27, wherein said toner contains polysiloxane wax in said resin-coating layer.

29. An image forming device according to claim 25, wherein said toner contains a paraffin wax.

30. An electrophotographic photoreceptor for an image forming device of which an exposure part for forming an electrostatic latent image emits a monochromatic light having an exposure wavelength of 380 nm to 500 nm, the photoreceptor comprising at least a photosensitive layer which comprises a polyester resin comprising a repeating structural unit represented by the formula (1):

[Chemical Formula 12]

(1)

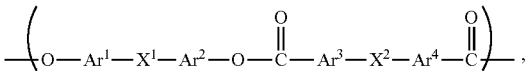

wherein $Ar^1$ to $Ar^4$ each represents, independently of each other, an arylene group which may be substituted, $X^1$ represents a bivalent group or a single bond, and $X^2$ represents a bivalent group with 3 or less atoms.

31. An electrophotographic photoreceptor comprising at least a photosensitive layer on an electroconductive support, said photosensitive layer comprises a charge transport layer, wherein said charge transport layer has a transmittance of 70% or larger in the wavelength region of 400 nm to 500 nm, and said charge transport layer comprises a polyester resin, said polyester resin comprises a repeating structural unit represented by the formula (1):

[Chemical Formula 13]

(1)

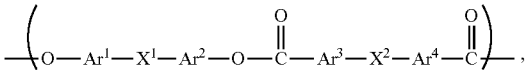

wherein $Ar^1$ to $Ar^4$ each represents, independently of each other, an arylene group which may be substitued, $X^1$ represents a bivalent group or a single bond, and $X^2$ represents a bivalent group with 3 or less atoms.

32. An image forming device comprising:

the electrophotographic photoreceptor according to claim 30, means for charging said electrophotographic photoreceptor, means for exposing said charged electrophotographic photoreceptor with a monochromatic light having an exposure wavelength of 380 nm to 500 nm to form an electrostatic latent image thereon, and means for developing the electrostatic latent image formed on said electrophotographic photoreceptor.

33. An image forming device comprising:

the electrophotographic photoreceptor according to claim 31, means for charging said electrophotographic photoreceptor, means for exposing said charged electrophotographic photoreceptor with a monochromatic light having an exposure wavelength of 380 nm to 500 nm to form an electrostatic latent image thereon, and means for developing the electrostatic latent image formed on said electrophotographic photoreceptor.

* * * * *